US006802753B1

(12) United States Patent
Ando et al.

(10) Patent No.: US 6,802,753 B1
(45) Date of Patent: Oct. 12, 2004

(54) METHOD FOR MANUFACTURING ELECTRON BEAM DEVICE, METHOD FOR MANUFACTURING IMAGE FORMING APPARATUS, ELECTRON BEAM DEVICE AND IMAGE FORMING APPARATUS MANUFACTURED THOSE MANUFACTURING METHODS, METHOD AND APPARATUS FOR MANUFACTURING ELECTRON SOURCE, AND APPARATUS FOR MANUFACTURING IMAGE FORMING APPARATUS

(75) Inventors: Yoichi Ando, Inagi (JP); Keisuke Yamamoto, Yamato (JP); Hideshi Kawasaki, Machida (JP); Tamaki Kobayashi, Isehara (JP); Satoshi Mogi, Yamato (JP); Akira Hayama, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 223 days.

(21) Appl. No.: 09/722,454

(22) Filed: Nov. 28, 2000

Related U.S. Application Data

(63) Continuation of application No. PCT/JP00/00228, filed on Jan. 19, 2000.

(30) Foreign Application Priority Data

| | | |
|---|---|---|
| Jan. 19, 1999 | (JP) | 11-011108 |
| Feb. 1, 1999 | (JP) | 11-024249 |
| Feb. 19, 1999 | (JP) | 11-041867 |
| Feb. 24, 1999 | (JP) | 11-047085 |
| Feb. 26, 1999 | (JP) | 11-050508 |
| Feb. 26, 1999 | (JP) | 11-050576 |

(51) Int. Cl.[7] ..... H01J 9/00; H01J 9/44
(52) U.S. Cl. ..... 445/6; 445/24; 445/50
(58) Field of Search ..... 445/3, 6, 24, 25, 445/49, 50, 51

(56) References Cited

U.S. PATENT DOCUMENTS

| | | | |
|---|---|---|---|
| 5,066,883 A | 11/1991 | Yoshioka et al. | 313/309 |
| 5,528,108 A | 6/1996 | Cisneros | 315/169.3 |

(List continued on next page.)

FOREIGN PATENT DOCUMENTS

| | | |
|---|---|---|
| EP | 0660357 | 6/1995 |
| JP | 1-31332 | 2/1989 |

(List continued on next page.)

OTHER PUBLICATIONS

Meyer, et al.; "Recent Development on 'Microtips' Display At Leti"; Tech. Dig. of IVMC 91, Nagahama 1991, pp. 6–9.

(List continued on next page.)

*Primary Examiner*—Nimeshkumar D. Patel
*Assistant Examiner*—Mariceli Santiago
(74) *Attorney, Agent, or Firm*—Fitzpatrick, Cella, Harper & Scinto

(57) ABSTRACT

In a manufacturing process of an image forming apparatus (electron beam device) using electron emission elements, particularly, surface conduction type electron emission elements, wirings on an electron source substrate on which the wirings and element electrodes are formed are opposite to electrodes for a face plate, and a given voltage is applied between the wirings and the electrodes to thereby generate a discharge phenomenon in advance, thus removing a protrusion or the like. In this way, when an electric field applying process is conducted on the electron source substrate, a factor such as a protrusion in an electron source which induces a discharge phenomenon in driving an electron beam device represented by an image forming apparatus is removed, thus realizing an image forming apparatus excellent in display characteristic with no defective pixel even in image display for a long period of time.

37 Claims, 86 Drawing Sheets

U.S. PATENT DOCUMENTS

| | | | | | |
|---|---|---|---|---|---|
| 5,569,974 | A | | 10/1996 | Morikawa et al. | 313/310 |
| 5,682,085 | A | | 10/1997 | Suzuki et al. | 315/169.1 |
| 5,847,495 | A | | 12/1998 | Yamanobe et al. | 313/310 |
| 5,853,310 | A | * | 12/1998 | Nishimura et al. | 445/51 |
| 6,306,001 | B1 | * | 10/2001 | Hiroki | 445/6 |
| 2002/0132041 | A1 | | 9/2002 | Yamanobe et al. | 427/77 |

FOREIGN PATENT DOCUMENTS

| | | |
|---|---|---|
| JP | 2-257551 | 10/1990 |
| JP | 3-55738 | 3/1991 |
| JP | 4-28137 | 1/1992 |
| JP | 7-105850 | 4/1995 |
| JP | 7-192611 | 7/1995 |
| JP | 7-235255 | 9/1995 |
| JP | 8-102250 | 4/1996 |
| JP | 8-162012 | 6/1996 |
| JP | 9-129124 | 5/1997 |
| JP | 8-106847 | 6/1997 |
| JP | 9-213224 | 8/1997 |
| JP | 9-306336 | 11/1997 |
| JP | 10-255650 | 9/1998 |
| JP | 11-54038 | 2/1999 |

OTHER PUBLICATIONS

Hartwell, et al.; "Strong Electron Emission From Patterned Tin–Indium Oxide Thin Films"; Tech. Dig. 1 EDM, Tech. Pig., Dec. 1–3, 1975, Wash. D.C., pp. 519–521 (1976).

Spindt, et al.; "Physical Properties Of Thin–Film Field Emission Cathodes With Molybdenum Cones"; J. Appl. Phys. vol. 47, No. 12, Dec. 1976, pp. 5248–5263.

C.A. Mead; "Operation Of Tunnel–Emission Devices"; J. Appl. Phys. vol. 32, No. 4, Apr. 1961, pp. 646–652.

Elinson, et al.; "The Emission Of Hot Electrons And The Field Emission Of Electrons From Tin Oxide"; Radio Engineering and Electronic Physics, vol. 10, pp. 1290–1296, (1965).

G. Dittmer, "Electrical Conduction And Electron Emission Of Discontinuous Thin Films"; Thin Solid Films, vol. 9, pp. 317–328 (1972).

Dyke, et al., "Field Emission", Advances in Electronics and Electron Physics, vol. III, Academic Press, 89–184 (1956).

Araki, et al., "Electroforming and Electron Emission of Carbon Thin Films"; J. Vac. Soc. Japan, vol. 26, No. 1, pp. 22–29 (1981).

High Voltage Technology, Electric Institute, Ohm Company, pp. 38, 39 (1981).

* cited by examiner

PRIOR ART

PRIOR ART

PRIOR ART

METHOD FOR MANUFACTURING ELECTRON BEAM DEVICE, METHOD FOR MANUFACTURING IMAGE FORMING APPARATUS, ELECTRON BEAM DEVICE AND IMAGE FORMING APPARATUS MANUFACTURED THOSE MANUFACTURING METHODS, METHOD AND APPARATUS FOR MANUFACTURING ELECTRON SOURCE, AND APPARATUS FOR MANUFACTURING IMAGE FORMING APPARATUS

This application is a continuation of International Application No. PCT/JP00/00228, filed Jan. 19, 2000, which claims the benefit of Japanese Patent Applications as follows:

1) 11-011108 filed on Jan. 19, 1999
2) 11-024249 filed on Feb. 1, 1999
3) 11-041867 filed on Feb. 19, 1999
4) 11-047085 filed on Feb. 24, 1999
5) 11-050508 filed on Feb. 26, 1999
6) 11-050576 filed on Feb. 26, 1999

TECHNICAL FIELD

The present invention relates to an electron beam device in which a plurality of electron emission portions are formed on a substrate, an image forming apparatus in which an image forming member is formed opposite to the electron emission portions and a method of manufacturing those devices.

BACKGROUND ART

Up to now, as the electron emitting elements, there have been known the two kinds of a hot cathode element and a cold cathode element. As the cold cathode element of those elements, there have been known, for example, a surface conduction type electron emission element, a field emission element (hereinafter referred to as "FlE type"), a metal/insulating layer/metal type emission element (hereinafter referred to as "MIM type"), etc.

As the surface conduction type electron emission elements, there have been known, for example, an example disclosed in Radio Eng. Electron Phys., 10, 1290 (1965) by M. I. Elinson, or other examples which will be described later.

The surface conduction type electron emission element utilizes a phenomenon in which electron emission occurs by allowing a current to flow into a small-area thin film formed on a substrate in parallel to a film surface. As the surface conduction type electron emission element, there have been reported a surface conduction type electron emission element using an $SiO_2$ thin film by the above-mentioned Elinson and others, a surface conduction type electron emission element using an Au thin film [G. Dittmer: "Thin Solid Films", 9,317 (1972)], a surface conduction type electron emission element using an $In_2O_3/SnO_2$ thin film [M. Hartwell an C. G. Fonstad: "IEEE Trans. ED Conf.", 519(1975)], a surface conduction type electron emission element using a carbon thin film ["Vapor Vacuum," Vol. 26, No. 1, p 22 (1983), by Hisashi Araki, et al.], etc.

As a typical example of those surface conduction type electron emission elements, a plan view of the above-mentioned element by M. Hartwell is shown in FIG. 93. In FIG. 93, reference numeral 8001 denotes a substrate, and reference numeral 8004 denotes an electrically conductive thin film that is made of a metal oxide formed through sputtering. The electrically conductive film 8004 is formed in an H-shaped plane as shown in FIG. 93. An electrifying process called "electrification forming" which will be described later is conducted on the electrically conductive thin film 8004 to form an electron emission portion 8005. In FIG. 93, an interval L is set to 0.5 to 1 (mm), and W is set to 0.1 (mm). For convenience of showing in the figure, the electron emission portion 8005 is shaped in a rectangle in the center of the electrically conductive thin film 8004. However, this shape is schematic and does not faithfully express the position and the configuration of the actual electron emission portion.

In the above-mentioned surface conduction type electron emission elements including the element proposed by M. Hartwell, et al., the electron emission portion 8005 is generally formed on the electrically conductive film 8004 through the electrifying process which is called "electrification forming" before the electron emission is conducted. In other words, the electrification forming is directed to a process in which a constant d.c. voltage or a d.c. voltage that steps up at a very slow rate such as about 1 V/min is applied to both ends of the electrically conductive film 8004 and electrified, to thereby locally destroy, deform or affect the electrically conductive film 8004, thus forming the electron emission portion 8005 which is in an electrically high-resistant state. A crack occurs in a part of the electrically conductive film 8004 which has been locally destroyed, deformed or affected. In the case where an appropriate voltage is applied to the electrically conductive thin film 8004 after the above electrification forming, electron emission is conducted from a portion close to the crack.

Examples of the FE type have been known from "Field Emission" of Advance in Electron Physics, 8, 89 (1956) by W. P. Dyke and W. W. Dolan, "Physical properties of thin-film field emission cathodes with molybdenum cones" of J. Appl. Phys., 47,5248 (1976), by C. A. Spindt, etc.

As a typical example of the element structure of the FE element, FIG. 94 shows a cross-sectional view of the elements made by the above-mentioned C. A. Spindt, et al. In this figure, reference numeral 8010 denotes a substrate, 8011 is an emitter wiring made of an electrically conductive material, 8012 is an emitter cone, 8013 is an insulating layer, and 8014 is a gate electrode. The element of this type is so designed as to apply an appropriate voltage between the emitter cone 8012 and the gate electrode 8014 to produce electric field emission from a leading portion of the emitter cone 8012.

Also, as another element structure of the FE type, there is an example in which an emitter and a gate electrode are disposed on a substrate substantially in parallel with the substrate plane, without using a laminate structure shown in FIG. 94.

Also, as an example of the MIM type, there has been known, for example, "Operation of tunnel-emission devices," J. Appl. Phys., 32,646 (1961) by C. A. Mead, etc. A typical example of the element structure of the MIM type is shown in FIG. 95. FIG. 95 is a cross-sectional view, and in the figure, reference numeral 8020 denotes a substrate, 8021 is a lower electrode made of metal, 8022 is a thin insulating layer about 10 nm in thickness, and 8023 is an upper electrode made of metal about 8 to 30 nm in thickness. In the MIM type, an appropriate voltage is applied between the upper electrode 8023 and the lower electrode 8021, to thereby produce electron emission from the surface of the upper electrode 8023.

The above-mentioned cold cathode element does not require a heater for heating because it can obtain electron emission at a low temperature as compared with the hot cathode element. Accordingly, the cold cathode element is simpler in structure than the hot cathode element and can prepare a fine element. Also, in the cold cathode element, even if a large number of elements are disposed on the substrate with a high density, a problem such as heat melting of the substrate is difficult to occur. Further, the cold cathode element is advantageous in that a response speed is high which is different from the hot cathode element which is low in the response speed because it operates due to heating by the heater. For the above-mentioned reasons, a study for applying the cold cathode elements has been extensively conducted.

For example, the surface conduction type electron emission element has the advantage that a large number of elements can be formed on a large area since it is particularly simple in structure and easy to manufacture among the cold cathode elements.

For that reason, a method in which a large number of elements are arranged and driven has been studied as disclosed in JP-A-64-31332 by the present applicant.

As the application of the surface conduction type electron emission element, for example, an image display device, an image forming apparatus such as an image recording device, a charge beam source, and so on have been studied.

In particular, as the application to the image display device, there has been studied an image display device using the combination of the surface conduction type electron emission element with a phosphor that emits light by irradiation of an electron beam as disclosed in for example U.S. Pat. No. 5,066,883 by the present applicant, JP-A-2-257551, and JP-A-4-28137. In the image display device using the combination of the surface conduction type electron emission element with the phosphor, the characteristic superior to the conventional other image display devices is expected. For example, even as compared with the liquid crystal display device which has been spreading in recent years, the above image display device is excellent in that no back light is required because it is of the self light emitting type and the angle of visibility is broad.

Also, a method in which a large number of FE type elements are disposed and driven is disclosed in, for example, U.S. Pat. No. 4,904,895 by the present applicant. Also, as an example of applying the FE type to the image display device, there has been known, for example, a plate type display device reported by R. Meyer [R. Meyer: "Recent Development on Micro-tips Display at LETI", Tech. Digest of 4th Int. Vacuum Micro-electronics Conf., Nagahama, pp. 6 to 9 (1991].

Also, an example in which a large number of MIM type elements are arranged and applied to an image display device is disclosed in, for example, JP-A-3-55738 by the present applicant.

Among the image forming apparatuses using the above-mentioned electron emission element, attention has been paid to the flat type image display device thin in depthwise as a replacement of the CRT type image display device since the space is saved and the weight is light.

FIG. 96 is a perspective view showing an example of a display panel portion which forms a plane-type image display device, in which a part of the panel is cut off in order to show the internal structure.

In FIG. 96, reference numeral 8115 denotes a rear plate, 8116 a side wall, 8117 a face plate, and the rear plate 8115, the side wall 8116 and the face plate 8117 form an envelope (airtight vessel) for maintaining the interior of the display panel in a vacuum state.

The rear plate 8115 is fixed with a substrate 8111, and N×M cold cathode elements 8112 are formed on the substrate 8111 (N and M are positive integers of equal to or larger than 2 or more and appropriately set in accordance with the target number of display pixels). Also, the N×M cold cathode elements 8112 are wired by M row wirings 8113 and N column wirings 8114 as shown in FIG. 96. A portion made up of the substrate 8111, the cold cathode elements 8112, the row wirings 8113 and the column wirings 8114 is called the multiple electron beam source. Also, at least in portions where the row wirings 8113 and the column wirings 8114 cross each other, an insulating layer (not shown) between both of the wirings is formed to keep electric insulation.

A lower surface of the face plate 8117 is formed with a fluorescent film 8118 formed of a phosphor on which phosphors (not shown) of three primary colors consisting of red (R), green (G) and blue (B) are separately painted. Also, black material (not shown) are disposed between the respective color phosphors which form the fluorescent film 8118, and a metal back 8119 made of Al or the like is formed on a surface of the fluorescent film 8118 on the rear plate 8115 side.

Dx1 to Dxm, Dy1 to Dyn and Hv are electric connection terminals with an airtight structure provided for electrically connecting the display panel to an electric circuit not shown. Dx1 to Dxm are electrically connected to the row wirings 8113 of the multiple electron beam source, Dy1 to Dyn are electrically connected to the column wirings 8114 of the multiple electron beam source, and Hv is electrically connected to the metal back 8119, respectively.

Also, the interior of the above airtight vessel is maintained in a vacuum state of about $1\times10^{-4}$ Pa, and there is required means for preventing the deformation or destruction of the rear plate 8115 and the face plate 8117 due to a pressure difference between the interior of the airtight vessel and the external, as a display area of the image display device increases. In a method of thickening the rear plate 8115 and the face plate 8117, not only does the weight of the image display device increase, but also a distortion of an image or a parallax occurs when viewing the display device from an oblique direction. On the contrary, in FIG. 96, there is provided a structure support (called spacer or rib) 8120 which is formed of a relatively thin glass substrate for supporting the atmospheric pressure. With this structure, a space of normally sub mm to several mm is kept between the substrate 8111 on which the multiple beam electron source is formed and the face plate 8117 on which the fluorescent film 8118 is formed, and the interior of the airtight vessel is maintained in a high vacuum state as described above.

In the image display device using the display panel as described above, when a voltage is applied to the respective cold cathode elements 8112 through the vessel external terminals Dx1 to Dxm and Dy1 to Dyn, electrons are emitted from the respective cold cathode elements 8112. At the same time, with the application of a high voltage of several hundreds (V) to several (kV) to the metal back 8119 through the vessel external terminal Hv, the above emitted electrons are accelerated and allowed to collide with an inner surface of the face plate 8117. As a result, the phosphors of the respective colors which form the fluorescent film 8118 are excited and emit light, thus displaying an image.

In general, electrons emitted from the electron source are accelerated by a voltage (accelerating voltage) applied between the electron source and the phosphor and collide with the phosphor to emit a light. Accordingly, a display image becomes higher in luminance as the accelerating voltage is larger. However, as described above, in a case of a thin-type image forming apparatus in which an opposite distance between the electron source and a substrate having the phosphor is shortened, an electric field intensity formed between the electron source and the phosphor becomes large due to the accelerating voltage.

The above case suffers from the following problems.

In the case where a high electric field is applied to the electron source, specifically, a high voltage of several hundreds V or higher (that is, a high electric field of 1 kV/mm or higher)) is applied between the multiple beam electron source and the face plate 8117 in order to accelerate the emitted electrons from the cold cathode element 8112, and for example, foreign material such as dust, a protrusion or the like (hereinafter generically named protrusion) exists on the electron source. There is a case where the electric field concentrates to the protrusion, and the electrons are emitted therefrom. The configuration of the protrusion further becomes sharp due to an influence of a heat caused by the emitted current or of the high electric field, the electric field intensity becomes further higher, and the amount of emitted electrons increases.

When a positive feedback is effected as described above, there finally occurs such a phenomenon that the projection is thermally destroyed.

When the above phenomenon occurs as described above, not only the protrusion is destroyed but also the vacuum atmosphere within the image forming apparatus is deteriorated. This acts as a trigger and a discharge phenomenon occurs between the electron source and the phosphor to which the high electric field is applied. The accelerated cations collide with the electron source to damage the electron source, resulting in such a problem that an image defect is induced.

As a method of suppressing the above discharge phenomenon, there has been known, for example, a method in which, in order to suppress spark discharge, the spark discharge is conducted in a high vacuum in advance (for example, "high voltage technology" (Electric Institute, Ohm Company 1981)). The above processing is usually called "conditioning".

In manufacturing a large-area image forming apparatus, there is a case in which the execution of the conditioning process adversely affects the electron emission characteristic. This is because the Joule heat consumed in the element by discharge during the conditioning process destroys the electrically conductive thin film.

FIG. 26 is a diagram showing an equivalent circuit in this process. It is presumed that the above phenomenon is induced by electric charges which are stored in a capacitor made up of an electron source substrate 2071 and an electrode 2010 for high voltage application which conduct the conditioning process.

When a voltage V is applied across a parallel plate capacitor formed of two electrodes each having an area S which are apart from each other at a distance d, the stored electric charge amount Q is represented by $Q=CV=\in SV/d$. When the same electric field is developed in the conditioning process, an energy E stored in the capacitor made up of the electron source substrate 2071 and the electrode 2010 for high voltage application is represented by $E=CV/2=\in SV/2d$ where $\in$ is the dielectric constant of a material between those two electrodes (or vacuum).

For that reason, when the conditioning process is conducted by using the electron source substrate 2071 and the electrode 2010 for high voltage application which is opposite to the electron source substrate 2071 and identical in area, there arises such a problem that the energy consumed by the electron source substrate during the discharge operation increases in proportion to the area.

Also, as another method of suppressing the above discharge phenomenon, there is disclosed in JP-A-8-106847 a technique in which an inductor is disposed between an anode and an external voltage source for the purpose of limiting a large current that flows in an emitter (cathode) as an electric arc through the anode from the external voltage source during arc discharge operation when the arc discharge occurs. In the present specification, the abnormal discharge includes the above-described arc discharge.

The outline of the technique disclosed in the above-described JP-A-8-106847 is schematically shown in FIG. 97. In FIG. 97, reference numeral 9121 denotes a substrate; 9122 is a cathode electrode; 9123 is an emitter; 9124 is a cathode conductor; 9125 is an insulator; 9126 is a gate; 9127 is an anode; 9128 is an inductor; 9129 is a resistor; and 9130 is a voltage source. The technique is that an electric field emission element is used as the electron emission element, and a current which is concerned in the arc discharge between the anode 9127 and the emitter 9123 and supplied from a voltage source 9130 is substantially limited by the provision of the inductor 9128 while the arc discharge occurs between the anode 9127 and the emitter 9123 (cathode). In other words, in the case where the arc discharge occurs and the potential of the anode is lowered, the implantation of electric charges from the external power supply is temporally limited.

However, the large-screen image forming apparatus large in a capacitance between the anode and the cathode electrode suffers from such a problem that the amount of electric charges stored in the anode and the cathode electrode is large, and the electric charges move through a discharge path in response to the deterioration of the potential of the anode when the abnormal discharge starts. In the case where the movement of the electric charges is conducted in a moment, a current value becomes remarkably large. It is needless to say that the current cannot be observed as a current that flows into the anode from the external power supply, that is, the current cannot be suppressed in the above-described method of limiting the implantation of the electric charges from the external power supply.

This is because in the case where the abnormal discharge occurs, the lowered potential of the anode is restored, in other words, only a current that charges the capacitor made up of the anode and the cathode substrate, or a current that connects the arc as a result of the arc discharge is observed. The present inventors have recognized through the measurement of a change in the anode potential with a time during the abnormal discharge that the movement of the electric charges in response to the deterioration of the potential of the anode occurs by a time scale of about $\mu$ seconds or shorter. Also, the present inventors have recognized that the current corresponding to the drop of the potential of the anode may induce a damage because it flows through the discharge path. Accordingly, in implementation of the conditioning process, it becomes necessary to suppress the current corresponding to the drop of the potential of the anode from flowing through the discharge path.

Also, once the abnormal discharge occurs, there is the possibility that a secondary abnormal discharge occurs, and it is important to prevent the secondary abnormal discharge. It is necessary to surely prevent the secondary abnormal discharge when the secondary abnormal discharge occurs in a linking manner, because there may be a case where a large damage resultantly occurs even if no damage occurs in the first abnormal discharge.

An object of the present invention is to provide a manufacturing method that removes a factor such as a protrusion which induces a discharge phenomenon within an electron beam device represented by an image forming apparatus, to thereby manufacture an excellent electron beam device (electron source) which is high in reliability through the manufacturing method, and to provide an image forming apparatus with no defective pixel even in image display for a long period of time.

Also, another object of the present invention is to provide a manufacturing method and a manufacturing apparatus for an image forming apparatus which suppress a damage caused by abnormal discharge and prevent abnormal discharge which may secondarily occur as much as possible.

DISCLOSURE OF THE INVENTION

According to the present invention, there is provided a method of manufacturing an electron beam device in which electron emission portions that emit electrons and wirings that electrically connect the electron emission portions are disposed on a substrate, the method comprising: a wiring forming step of forming the wiring on the substrate; and an electron emission portion forming process of forming the electron emission portions on the substrate; wherein an electric field applying process of applying a given electric field to the substrate on which the wiring is formed is conducted after the wiring forming step is completed and before the electron emission portion forming process is completed.

In one mode of the method of manufacturing the electron beam device in accordance with the present invention, the electric field is 1 kV/mm or more in its electric field intensity.

In one mode of the method of manufacturing the electron beam device in accordance with the present invention, the electric field applying steps comprises a step of discharging, by application of the electric field, electricity from a portion of the substrate from which electricity is liable to be discharged in various processes after the electric field applying process including the electron emission portion forming process, or when the electron beam device is used, to thereby change the portion into a shape which is difficult to discharge electricity.

In one mode of the method of manufacturing the electron beam device in accordance with the present invention, the electron emission portion forming step includes an electrode forming step of forming a pair of electrodes to which different potentials are given from the wirings in correspondence with the respective electron emission portions, and the electric field applying step is conducted before the electrode forming step is conducted.

In one mode of the method of manufacturing the electron beam device in accordance with the present invention, the pair of electrode comprise a pair of electrodes that constitute surface conduction type electron emission elements.

In one mode of the method of manufacturing the electron beam device in accordance with the present invention, the electrode forming step comprises a step which includes a thin film forming step of forming an electrically conductive thin film on the substrate, and produces a gap in the formed electrically conductive thin film and constitutes the pair of electrodes by the electrically conductive thin films which exists on both sides of the gap.

In one mode of the method of manufacturing the electron beam device in accordance with the present invention, the electric field applying step is conducted before the thin film forming step is conducted.

In one mode of the method of manufacturing the electron beam device in accordance with the present invention, the electric field applying step is conducted after the thin film forming step is completed and before the gap is produced in the electrically conductive thin film.

In one mode of the method of manufacturing the electron beam device in accordance with the present invention, the pair of electrodes comprise an emitter and a gate of the electric field emission type electron emission element.

In one mode of the method of manufacturing the electron beam device in accordance with the present invention, the electric field emission type electron emission element comprises the emitter that emits electrons from an end portion and the gate that produces an electric field between the end portion and the gate.

In one mode of the method of manufacturing the electron beam device in accordance with the present invention, the electric field applying step is conducted before the emitter is formed.

In one mode of the method of manufacturing the electron beam device in accordance with the present invention, the electric field applying step is conducted before the gate is formed.

In one mode of the method of manufacturing the electron beam device in accordance with the present invention, the plurality of electron emission portions are connected onto one main surface of the substrate in the form of a ladder or a matrix by the wirings.

In one mode of the method of manufacturing the electron beam device in accordance with the present invention, in the electric field applying step, an electrode is disposed opposite to a surface of the substrate on which the wirings are disposed, and a voltage is applied between the electrode and the wirings on the substrate to apply the electric field.

In one mode of the method of manufacturing the electron beam device in accordance with the present invention, a voltage given between the electrode and the wirings is changed during the electric field applying step.

In one mode of the method of manufacturing the electron beam device in accordance with the present invention, a distance between the electrode and the substrate is changed during the electric field applying step.

In one mode of the method of manufacturing the electron beam device in accordance with the present invention, a current limit resistor is connected between the electrode and the power supply that applies a voltage to the electrode.

In one mode of the method of manufacturing the electron beam device in accordance with the present invention, the electric field applying step is conducted in a vacuum atmosphere.

According to the present invention, there is provided a method of manufacturing an image forming apparatus that includes an electron source in which a plurality of electron source elements each having a pair of element electrodes formed on a substrate, an electrically conductive thin film which are electrically connected to each of the element electrodes, and an electron emission portion formed on a part of the electrically conductive thin film are formed on the same substrate, and the element electrodes of the respective electron source elements are connected in the form of a ladder or a matrix by wirings; and an image forming member disposed opposite to the electron source on the substrate, the method comprising: an electric field applying step of applying a given electric field to the substrate on which the wirings are formed after a step of forming the wirings is completed and before a step of forming the electron emission portions is completed.

In one mode of the method of manufacturing an image forming apparatus in accordance with the present invention, a control electrode which controls the electron beam emitted from the respective electron source elements in response to an information signal is combined.

In one mode of the method of manufacturing an electron beam device in accordance with the present invention, the electric field applying step is conducted in such a manner that the electrode for applying the electric field and the substrate are disposed opposite to each other to apply a voltage between the electrode and the wirings, and an energy stored in the capacitor formed of the electrode and the substrate is equal to or less than an energy that destroys the electrically conductive thin film.

According to the present invention, there is provided a method of manufacturing an electron beam device that includes a plurality of surface conduction type electron emission elements, the method comprising a step of forming plural pairs of element electrodes on a substrate, a step of connecting a plurality of row-directional wirings and a plurality of column-directional wirings which are stacked one on another through an insulating layer to the respective electrodes of the plural pairs of element electrodes to form common wirings in a matrix, a step of forming electrically conductive thin films between each pair of element electrodes, a forming step of forming electron emission portions by conducting an electrifying process on the electrically conductive thin films between each pair of element electrodes, and a conditioning step of applying the electric field by applying a voltage between the electrode and the common wiring in which an electrode for applying an electric field to a surface having the common wirings and the substrate are disposed opposite to each other, wherein the conditioning step is conducted under the condition where an energy stored in a capacitor formed of the electrode and the substrate is equal to or less than an energy that destroys the electrically conductive thin film.

In one mode of the method of manufacturing an electron beam device in accordance with the present invention, assuming that an area where the electrode and the substrate face each other is S, a distance between the electrode and the substrate is Hc, a voltage applied between the electrode and the common wiring is Vc, a dielectric constant of vacuum is $\in$, and an energy by which the electrically conductive thin film is destroyed is Eth, the conditioning step is conducted under the following condition:

$$\in \times S \times Vc^2/2Hc < Eth \quad (1)$$

In one mode of the method of manufacturing an electron beam device in accordance with the present invention, a plurality of electrodes for applying the electric field are used in the conditioning step.

In one mode of the method of manufacturing an electron beam device in accordance with the present invention, a relative position between the electrode and the substrate is changed in the conditioning step.

According to the present invention, there is provided a method of manufacturing an image forming apparatus that includes a substrate on which a plurality of surface conduction type electron emission elements are formed, and an image forming member which is disposed opposite to the surface conduction type electron emission elements on the substrate, the method comprising a step of forming plural pairs of element electrodes on a substrate, a step of connecting a plurality of row-directional wirings and a plurality of column-directional wirings which are stacked one on another through an insulating layer to the respective electrodes of the plural pairs of element electrodes to form common wirings in a matrix, a step of forming electrically conductive thin films between each pair of element electrodes, a forming step of forming electron emission portions by conducting an electrifying process on the electrically conductive thin films between each pair of element electrodes, and a conditioning step of applying the electric field by applying a voltage between the electrode and the common wiring in which an electrode for applying an electric field to a surface having the common wirings and the substrate are disposed opposite to each other, wherein the conditioning step is conducted under the condition where an energy stored in a capacitor formed of the electrode and the substrate is equal to or less than an energy that destroys the electrically conductive thin film.

According to the present invention, there is provided a method of manufacturing an electron beam device that includes a first plate with an electron beam source which generates an electron beam, the method comprising a step of applying a voltage between the first plate and an electrode which is opposite to the first plate, wherein in the step, a voltage that allows a leader current to flow is applied between the first plate and an electrode which is opposite to the first plate.

In one mode of the method of manufacturing an electron beam device in accordance with the present invention, the voltage is a voltage which can maintain a state in which the leader current flows.

According to the present invention, there is provided a method of manufacturing an electron beam device that includes a first plate with an electron beam source which is formed of an electrically conductive film and generates an electron beam, the method comprising a step of applying a voltage between the first plate and an electrode which is opposite to the first plate, wherein in the step, a voltage an influence of which on the electrically conductive film can be permitted is applied.

According to the present invention, there is provided a method of manufacturing an image forming apparatus that includes a rear plate on which an electron beam source is formed and a face plate on which a phosphor that emits a light by irradiation of an electron beam is formed, the method comprising a step of applying a high voltage to a substrate on which an electrode is formed before a vacuum vessel including the rear plate and the face plate therein is formed.

In one mode of the method of manufacturing an image forming apparatus in accordance with the present invention, the high voltage applying step is conducted on a rear plate substrate on which the electrode is formed before an electron beam source is completed.

In one mode of the method of manufacturing an image forming apparatus in accordance with the present invention, the high voltage applying step is conducted in vacuum.

In one mode of the method of manufacturing an image forming apparatus in accordance with the present invention, the high voltage applying step is conducted in gas.

In one mode of the method of manufacturing an image forming apparatus in accordance with the present invention, a high voltage is applied between the substrate on which the electrode is formed and a dummy face plate with a counter electrode.

In one mode of the method of manufacturing an image forming apparatus in accordance with the present invention, the substrate on which the electrode is formed has a feeder wiring to the electron emission element, and the high voltage is applied with the wiring as one electrode and the dummy face plate as the other electrode.

In one mode of the method of manufacturing an image forming apparatus in accordance with the present invention, the substrate on which the electrode is formed has a plurality of row-directional wirings and a plurality of column-directional elements for feeder so as to wire a plurality of electron emission elements in a matrix, all of the row-directional wirings and the column-directional wirings are made common wiring to the electron emission element, and the high voltage is applied with the row-directional and column-directional wirings as one electrode and the dummy face plate as the other electrode.

In one mode of the method of manufacturing an image forming apparatus in accordance with the present invention, the high voltage is a d.c. voltage that gradually steps up from a low voltage.

In one mode of the method of manufacturing an image forming apparatus in accordance with the present invention, the high voltage is an a.c. voltage that gradually steps up from a low voltage.

In one mode of the method of manufacturing an image forming apparatus in accordance with the present invention, the high voltage is a pulse voltage that gradually steps up from a low voltage.

In one mode of the method of manufacturing an image forming apparatus in accordance with the present invention, the electron beam source is a cold cathode element.

In one mode of the method of manufacturing an image forming apparatus in accordance with the present invention, the electron beam source is a surface conduction type emission element.

According to the present invention, there is provided a method of manufacturing an image forming apparatus that includes a rear plate with an electron beam source, a face plate on which a phosphor that emits a light by irradiation of an electron beam is formed, and a structure support disposed between the rear plate and the face plate, the method comprising a step of applying a high voltage between the face plate and the rear plated after the face plate, the rear plate and the structure support are assembled together into a panel, and a step of forming an electron source after the high voltage applying step.

In one mode of the method of manufacturing an image forming apparatus in accordance with the present invention, the high voltage applying step is conducted in vacuum.

In one mode of the method of manufacturing an image forming apparatus in accordance with the present invention, the high voltage applying step is conducted by introducing gas within the image forming apparatus.

In one mode of the method of manufacturing an image forming apparatus in accordance with the present invention, the electron beam source has a plurality of electron emission elements connected to each other by a plurality of wirings, and in the high voltage applying step, the plurality of wirings are commonly grounded, and the high voltage is applied to the face plate.

In one mode of the method of manufacturing an image forming apparatus in accordance with the present invention, the structure support has a rectangular shape and is disposed between the electron beam source and the face plate so that its longitudinal direction is in parallel with the plurality of wirings.

In one mode of the method of manufacturing an image forming apparatus in accordance with the present invention, the electron source has a plurality of electron emission elements which are wired in a matrix by a plurality of row-directional wiring and a plurality of column-directional wirings, and in the high voltage applying step, the plurality of row-directional wirings and the plurality of column-directional wirings are commonly grounded, and the high voltage is applied to the face plate.

In one mode of the method of manufacturing an image forming apparatus in accordance with the present invention, the structure support is disposed between the electron beam source and the face plate so that its longitudinal direction is in parallel with any one of the plurality of row-directional wirings and the plurality of column-directional wirings.

In one mode of the method of manufacturing an image forming apparatus in accordance with the present invention, the high voltage is an a.c. voltage a peak value of which gradually steps up from a low voltage.

In one mode of the method of manufacturing an image forming apparatus in accordance with the present invention, the high voltage is a pulse voltage a peak value of which gradually steps up from a low voltage.

In one mode of the method of manufacturing an image forming apparatus in accordance with the present invention, the high voltage is a monotonic increase voltage which gradually steps up from a low voltage.

In one mode of the method of manufacturing an image forming apparatus in accordance with the present invention, the electron beam source is a cold cathode element.

In one mode of the method of manufacturing an image forming apparatus in accordance with the present invention, the electron beam source is a surface conduction type emission element.

In one mode of the method of manufacturing an image forming apparatus in accordance with the present invention, the electron source forming step includes an electrification forming step.

In one mode of the method of manufacturing an image forming apparatus in accordance with the present invention, the electron source forming step includes an electrification activating step.

According to the present invention, there is provided a method of manufacturing an electron beam device that includes a first plate with an electron beam source which generates an electron beam and an electrode which is opposite to the first plate, the method comprising a first step of applying a voltage between the first plate and the electrode, and a step of forming the electron beam source after the first step.

In one mode of the method of manufacturing an electron beam device in accordance with the present invention, the electron beam source forming step conducted after the first step comprises a step of forming a high resistant portion on an electrically conductive film by electrifying the electrically conductive film.

In one mode of the method of manufacturing an electron beam device in accordance with the present invention, the electron beam source forming step after the first step comprises a step of depositing a deposit on an electron emission portion, a portion close to the electron emission portion or the electron emission portion, the portion close to the electron emission portion.

In one mode of the method of manufacturing an electron beam device in accordance with the present invention, the first step is conducted after wirings are formed on the first plate.

In one mode of the method of manufacturing an electron beam device in accordance with the present invention, the first step is conducted after an electrically conductive thin film in which the electron emission portion is formed is formed.

In one mode of the method of manufacturing an electron beam device in accordance with the present invention, a current flows between the first plate and the electrode by applying a voltage between the first plate and the electrode.

In one mode of the method of manufacturing an electron beam device in accordance with the present invention, a current flows by discharge generated between the first plate and the electrode.

According to the present invention, there is provided a method of manufacturing an image forming apparatus including a conditioning step of disposing an electrode at a position opposite to an electron source substrate that constitutes an electron source and applying a high voltage between the electrode and an electron source substrate in a step of manufacturing the electron source that constitutes an image forming apparatus, the method comprising plural kinds of conditioning steps where the sheet resistances of the electrodes are different, respectively.

In one mode of the method of manufacturing an image forming apparatus in accordance with the present invention, a high voltage is applied between the electron source substrate and the electrode with the electron source substrate side as a cathode.

According to the present invention, there is provided a method of manufacturing an image forming apparatus including a conditioning step of disposing an electrode at a position opposite to an anode substrate that constitutes an anode and applying a high voltage between the electrode and an anode substrate in a step of manufacturing the anode that constitutes an image forming apparatus, the method comprising plural kinds of conditioning steps where the sheet resistances of the electrodes are different, respectively.

In one mode of the method of manufacturing an image forming apparatus in accordance with the present invention, a high voltage is applied between the anode substrate and the electrode with the substrate side as an anode.

In one mode of the method of manufacturing an image forming apparatus in accordance with the present invention, there are provided a fluorescent film forming step of forming a fluorescent film that emits a light by allowing electrons to collide with the anode substrate; a first conditioning step which is conducted after the fluorescent film forming step; and a second conditioning step which is conducted by the electrode which is smaller in sheet resistance than that in the first conditioning step conducted after the first conditioning step.

In one mode of the method of manufacturing an image forming apparatus in accordance with the present invention, there are provided conditioning steps in which the electric field intensities formed between the substrate and the electrode are different, respectively.

In one mode of the method of manufacturing an image forming apparatus in accordance with the present invention, at least one of a voltage value which is applied to the electrode or a distance between the substrate and the electrode is changed to make the electric field intensities different, respectively.

According to the present invention, there is provided a method of manufacturing a plate type image forming apparatus that includes a cathode substrate on which an electron beam source is disposed, and an image formation anode substrate disposed opposite to the cathode substrate, wherein a high voltage is applied to an anode disposed opposite to the cathode substrate with the cathode substrate as a cathode, and abnormal discharge generated by application of the high voltage is detected to suppress the abnormal discharge during manufacturing of the cathode substrate.

According to the present invention, there is provided a method of manufacturing a plate type image forming apparatus that includes a cathode substrate on which an electron beam source is disposed, and an image formation anode substrate disposed opposite to the cathode substrate, wherein a high voltage is applied to an anode disposed opposite to the cathode substrate with the cathode substrate as a cathode, and abnormal discharge generated by application of the high voltage is detected, and the potential the anode is allowed to approach the potential of the cathode to suppress the abnormal discharge during manufacturing of the cathode substrate.

In one mode of the method of manufacturing an image forming apparatus in accordance with the present invention, the abnormal discharge is detected to electrically cut off the anode and the high voltage power supply connected to the anode.

In one mode of the method of manufacturing an image forming apparatus in accordance with the present invention, the cathode substrate is that a plurality of surface conduction type electron emission elements are disposed in a matrix as the electron source.

According to the present invention, there is provided a device for manufacturing a plate type image forming apparatus including a cathode substrate on which an electron beam source is disposed, and an image formation anode substrate disposed opposite to the cathode substrate, the device comprising an anode, a high voltage power supply connected to the anode, and detecting means for detecting abnormal discharge generated between the anode and a cathode disposed opposite to the anode by application of a high voltage from the high voltage power supply, wherein the high voltage is applied between the cathode substrate disposed as the cathode and the anode by the high voltage power supply, and the generated abnormal discharge is detected by the detecting means to suppress the abnormal discharge during manufacturing of the cathode substrate.

According to the present invention, there is provided a device for manufacturing a plate type image forming apparatus including a cathode substrate on which an electron beam source is disposed, and an image formation anode substrate disposed opposite to the cathode substrate, the device comprising an anode, a high voltage power supply connected to the anode, and detecting means for detecting abnormal discharge generated between the anode and a cathode disposed opposite to the anode by application of a high voltage from the high voltage power supply, wherein the high voltage is applied between the cathode substrate disposed as the cathode and the anode by the high voltage power supply, and the generated abnormal discharge is detected by the detecting means, and the potential of the anode is allowed to approach the potential of the cathode to suppress the abnormal discharge during manufacturing of the cathode substrate.

In one mode of the device for manufacturing an image forming apparatus in accordance with the present invention, there is provided means for electrically cutting off the anode and the high voltage power supply connected to the anode on the basis of the detection of the abnormal discharge by the detecting means in one mode of the device of manufacturing an image forming apparatus in accordance with the present invention, the cathode substrate is that a plurality of surface conduction type electron emission elements are disposed in a matrix as the electron source.

An electron beam device according to the present invention is manufactured through the above-mentioned manufacturing method.

An image forming apparatus according to the present invention is manufactured through the above-mentioned manufacturing method.

According to the present invention, there is provided a method of manufacturing an electron source having a plurality of electron emission elements and wirings connected to the electron emission elements on a substrate, in which each of the electron emission elements includes a pair of opposite electrodes disposed on the substrate, an electrically conductive film connected to the electrodes and having a first crack in a region between the electrodes, and a deposit mainly containing carbon, having a second crack narrower than the first crack within the first crack and disposed within the first crack and in the region of the electrically conductive film including the first crack, the method comprising the steps of forming the electrically conductive film, forming the first crack in the electrically conductive film (forming step), forming the deposit mainly containing carbon (activating step), the activating step being conducted after the forming step, and applying an electric field in a direction substantially perpendicular to a surface of the substrate on which at least the wirings and the electrodes are formed where the electron emission elements are formed (conditioning step), wherein the conditioning step is executed before the forming step.

In one mode of the method of manufacturing an electron source in accordance with the present invention, the conditioning step is conducted by disposing a conditioning electrode opposite to a surface of the substrate on which the electrodes and the wirings are formed at an interval and applying a voltage between the conditioning electrode and the substrate.

In one mode of the method of manufacturing an electron source in accordance with the present invention, the conditioning step is conducted after the step of forming the wirings and the electrodes on the substrate, and thereafter the step of forming the electrically conductive film is conducted.

In one mode of the method of manufacturing an electron source in accordance with the present invention, the conditioning step comprises a first conditioning step conducted after the step of forming the wirings and the electrodes on the substrate and before the electrically conductive film forming step, and a second conditioning step conducted after the electrically conductive film forming step and before the forming step, wherein assuming that the sheet resistances of the conditioning electrode when conducting the first and second conditioning steps are R1 and R2, respectively, the values R1 and R2 satisfy R1<R2.

In one mode of the method of manufacturing an electron source in accordance with the present invention, there is provided, after the forming step and before the activating step, a third conditioning step of disposing the conditioning electrode opposite to a surface of the substrate on which the electrodes and the wirings are formed at an interval and applying a voltage between the conditioning electrode and the substrate to apply an electric field in direction substantially perpendicular to the surface of the substrate on which the electron emission elements are formed, wherein the sheet resistance R3 of the conditioning electrode satisfies R2<R3.

In one mode of the method of manufacturing an electron source in accordance with the present invention, there is provided, after the activating step, a fourth conditioning step of disposing the conditioning electrode opposite to a surface of the substrate on which the electrodes and the wirings are formed at an interval and applying a voltage between the conditioning electrode and the substrate to apply an electric field in a direction substantially perpendicular to the surface of the substrate on which the electron emission elements are formed, wherein the sheet resistance R4 of the conditioning electrode satisfies R4<R1.

In one mode of the method of manufacturing an electron source in accordance with the present invention, the conditioning step is executed while a leader phenomenon of the discharge between the conditioning electrode and the substrate is monitored, and control under which the potential of the conditioning electrode is allowed to approach the potential of the substrate is conducted when the leader phenomenon is detected.

In one mode of the method of manufacturing an electron source in accordance with the present invention, the conditioning step is executed while voltage supply means is connected between the conditioning electrode and the substrate, a leader phenomenon of the discharge between the conditioning electrode and the substrate is monitored, and control for cutting off the connection between the conditioning electrode and the voltage applying means is conducted when the leader phenomenon is detected.

In one mode of the method of manufacturing an electron source in accordance with the present invention, the conditioning step is executed by moving the conditioning electrode on the substrate while an interval between the conditioning electrode and the substrate is held to a given value by using the conditioning electrode having an area opposite to the substrate which is smaller than an area of the surface of the substrate on which the electron emission elements are disposed.

In one mode of the method of manufacturing an electron source in accordance with the present invention, the conditioning step is executed while an interval between the conditioning electrode and the substrate is changed.

According to the present invention, there is provided a method of manufacturing an image forming apparatus including an electron source having a plurality of electron emission elements and wirings connected to the electron emission elements and an image forming member which forms an image by irradiation of an electron beam emitted from the electron source on a substrate, the electron source and the image forming member being disposed opposite to each other within an airtight vessel, in which the electron emission elements includes a pair of opposite electrodes disposed on the substrate, an electrically conductive film connected to the electrodes and having a first crack in a region between the electrodes, and a deposit mainly containing carbon, having a second crack narrower than the first crack within the first crack and disposed within the first crack and in the region of the electrically conductive film including the first crack, the method comprising the steps of: forming the wiring and the electrode on the substrate; forming the electrically conductive film; forming the first crack in the electrically conductive film (forming step); forming the deposit mainly containing the carbon (activating step), the relevant step being conducted after the forming step; and applying an electric field in a direction substantially perpendicular to a surface of the substrate on which at least the wirings and the electrodes are formed where the electron emission elements are formed (conditioning step); and assembling the airtight vessel so as to include the electron source and the image forming apparatus therein;

wherein the conditioning step is executed by applying a voltage between the image forming member and the substrate after the step of assembling the airtight vessel and before the forming step.

In one mode of the method of manufacturing an image forming apparatus in accordance with the present invention, the conditioning step is executed while a leader phenomenon of the discharge between the image forming member and the substrate is monitored, and control under which the potential of the image forming member is allowed to approach the potential of the substrate is conducted when the leader phenomenon is detected.

In one mode of the method of manufacturing an image forming apparatus in accordance with the present invention, the conditioning step is executed while voltage supply means is connected between the image forming member and the substrate, a leader phenomenon of the discharge between the image forming member and the substrate is monitored, and control for cutting off the connection between the image forming member and the voltage applying means is conducted when the leader phenomenon is detected.

According to the present invention, there is provided a manufacturing apparatus for executing the electron source manufacturing method, wherein an area of the conditioning electrode opposite to the substrate is smaller than an area of the surface of the substrate which includes the electron emission elements, and there is provided moving means for moving the conditioning electrode while an interval between the conditioning electrode and the substrate is held to a given value.

In one mode of the manufacturing method in accordance with the present invention, there is provided interval control means for controlling the interval between the conditioning electrode and the substrate in the conditioning step.

According to the present invention, there is provided a manufacturing apparatus for executing the electron source manufacturing method, in which there are provided monitoring means for monitoring a leader phenomenon of the discharge between the conditioning electrode and the substrate; and potential changing means for making the potential of the conditioning electrode approach the potential of the substrate on the basis of a signal indicating that the monitoring means detects the leader phenomenon.

In one mode of the manufacturing apparatus in accordance with the present invention, the potential changing means comprises a switch for turning on/off a circuit that short-circuits between the conditioning electrode and the substrate.

According to the present invention, there is provided a manufacturing apparatus for executing the image forming apparatus manufacturing method, in which there are provided monitoring means for monitoring a leader phenomenon of the discharge between the image forming member and the substrate, and potential changing means for making the potential of the image forming member approach the potential of the substrate on the basis of a signal indicating that the monitoring means detects the leader phenomenon.

In one mode of the manufacturing apparatus in accordance with the present invention, the potential changing means comprises a switch for turning on/off a circuit that short-circuits between the image forming member and the substrate.

According to the present invention, there is provided a manufacturing apparatus for executing the electron source manufacturing method, in which there are provided monitoring means for monitoring a leader phenomenon of the discharge between the conditioning electrode and the substrate, and connection cutoff means for cutting off the electric connection between the conditioning electrode and the voltage applying device on the basis of a signal indicating that the monitoring means detects the leader phenomenon.

According to the present invention, there is provided a manufacturing apparatus for executing the image forming apparatus manufacturing method, in which there are provided monitoring means for monitoring a leader phenomenon of the discharge between the image forming member and the substrate, and connection cutoff means for cutting off the electric connection between the image forming member and the voltage applying device on the basis of a signal indicating that the monitoring means detects the leader phenomenon.

BEST MODE OF CARRYING OUT THE INVENTION

Hereinafter, a description will be given of preferred first to sixth embodiment modes and the respective embodiments incidental to the respective embodiment modes in accordance with the present invention with reference to the accompanying drawings.

First Embodiment

As an electron emission element that constitutes an electron source of the present invention, a surface conduction type electron emission element is preferably used. The surface conduction type electron emission elements are of the plane type and the vertical type, and hereinafter the present invention will be described in detail with an example of an electron source and an image forming apparatus which are structured by using the plane type surface conduction type electron emission elements as a preferred embodiment mode of the present invention. The surface conduction type electron emission element used in the present invention is, for example, an element disclosed in JP-A-7-235255.

Figure 1A:
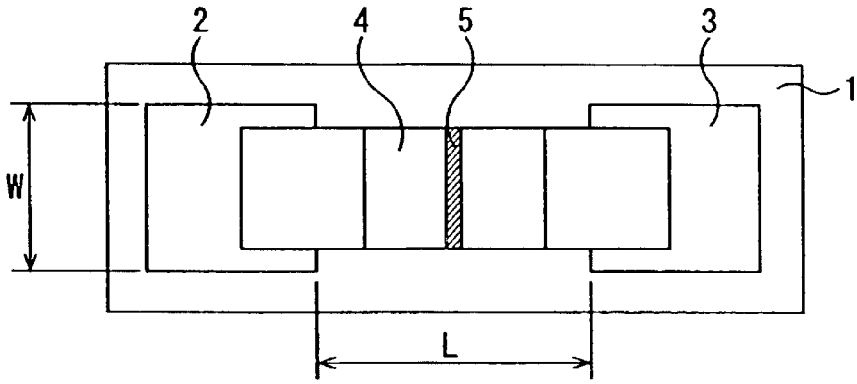
FIGS. 1A and 1B are schematic views showing the structure of an electron emission element that constitutes an electron source in accordance with an embodiment of the present invention.
Figure 1B:
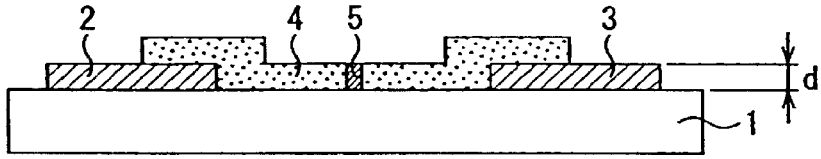

FIG. 1 is a diagram showing the structure of an example of the plane type surface conduction type electron emission element used in the present invention, in which FIGS. 1A and 1B are a plan view and a cross-sectional view thereof. Referring to FIG. 1, reference numeral 1 denotes a substrate, 2 and 3 are element electrodes, 4 is an electrically conductive film and 5 is an electron emission portion.

The substrate 1 may be made of quartz glass, glass having impurity content such as Na reduced, soda lime glass, a glass substrate resulting from laminating $SiO_2$ formed through a sputtering method or the like on a soda lime glass, ceramics such as alumina, an Si substrate, or the like.

The material of the opposite element electrodes 2 and 3 may be a general conductive material. For example, the material may be appropriately selected from, for example, metal such as Ni, Cr, Au, Mo, W, Pt, Ti, Al, Cu or Pd, or alloy of those metal, metal such as Pd, Ag, Au, $RuO_2$, Pd or Ag, or metal oxide of those material, a printing conductor made of glass or the like, transparent conductor such as $In_2O_3$—$SnO_2$, and semiconductor material such as polysilicon.

An interval L between the element electrodes, a length W of the element electrodes, the configuration of the electrically conductive film 4, etc., are designed taking the applied form, etc., into consideration. The interval L between the element electrodes is preferably set to a range of from several hundreds of nm to several hundreds of $\mu$m, and more preferably set to a range of from several $\mu$m to several tens of $\mu$m taking a voltage which is applied between the element electrodes, etc., into consideration. The length W of the element electrode is preferably set to a range of several $\mu$m to several hundreds of $\mu$m taking the resistance of the electrode and the electron emission characteristic into consideration, and the thickness d of the element electrodes 2 and 3 is preferably set to a range of several tens of nm to several $\mu$m.

The electron emission element according to the present invention is not limited to the structure shown in FIG. 1, but also applicable to a structure in which the electrically conductive film 4 and the opposite element electrodes 2 and 3 are stacked on the substrate 1 in the stated order.

The thickness of the electrically conductive film 4 is appropriately set taking a step coverage on the element electrodes 2 and 3, the resistance between the element electrodes 2 and 3, the forming conditions which will be described later, etc., into consideration, and normally preferably set to a range of several times of 0.1 nm to several hundreds of nm, and more preferably set to a range of 1 nm to 50 nm. The resistance Rs is a value of 10 to $10^7$ Ω/square. Further, R is the amount obtained when the resistor Rs of the thin film which is t in thickness, w in width and l in length satisfies R=Rs(1/w).

The material of the electrically conductive film 4 may be appropriately selected from metal such as Pd, Pt, Ru, Ag, Au, Ti, In, Cu, Cr, Fe, Zn, Sn, Ta, W or Pd, oxide such as PdO, $SnO_2$, $In_2O_3$, PbO or $Sb_2O_3$, oxide such as PdO, $SnO_2$, $In_2O_3$, PbO, $Sb_2O_3$, boride such as $HfB_2$, $ZrB_2$, $LaB_6$, $CeB_6$, $YB_4$ or $GdB_4$, carbide such as TiC, ZrC, HfC, TaC, SiC or WC, nitride such as TiN, ZrN or HfN, semiconductor such as Si or Ge, and carbon or the like.

The electron emission portion 5 is made up of a high-resistant crack formed in a part of the electrically conductive film 4, and depends on the thickness, the quality and the material of the electrically conductive film 4, and a method such as the electrification forming which will be described later. There is a case in which electrically conductive fine grains which are several times of 0.1 nm to several tens of nm in grain diameter exist in the interior of the electron emission portion 5. The electrically conductive fine grains contain a part of elements of the material that constitutes the electrically conductive film 4 or all elements thereof. The electron emission portions 5 and the electrically conductive film 4 in the vicinity of the electron emission portions 5 may also include carbon or carbon compound.

A basic example of the method of manufacturing the above-described electron emission element is shown in FIG. 2. In FIG. 2, the same parts as those shown in FIG. 1 are designated by the same references.

Figure 2A:
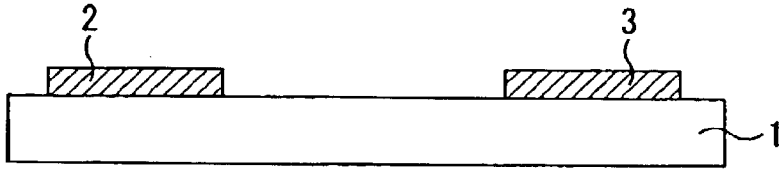
FIGS. 2A to 2C are process diagrams showing an example of a method of manufacturing an electron emission element.

1) After the substrate 1 has been sufficiently cleaned by using a detergent, pure water, organic solvent, etc., and the material of the element electrodes are deposited through the vacuum evaporation method, the sputtering method or the like, the element electrodes 2 and 3 are formed on the substrate 1 for example, by using the photolithography technique (FIG. 2A).

Figure 2B:
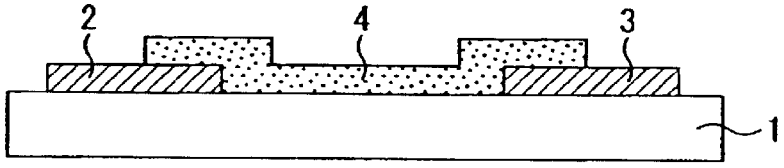

2) An organic metal solvent is coated on the substrate 1 on which the element electrodes 2 and 3 are disposed, to thereby form an organic metal thin film. As the organic metal solvent, there may be used a solution of the organic metal compound which mainly contains the metal of the material of the above-mentioned electrically conductive thin film 4. The organic metal thin film is baked by heating and then patterned by lift-off, etching or the like, to thereby form the electrically conductive film 4 (FIG. 2B). In this example, a description was given of the method of coating the organic metal solution. However, the method of forming the electrically conductive film 4 is not limited to the above method, but there may be employed a vacuum evaporation method, a sputtering method, a chemical gas phase depositing method, a dispersively coating method, a dipping method, a spinner method, an ink jet method or the like.

In a case of using the ink jet method, because fine liquid droplets of from about 10 ng to several tens of ng can be produced with high reproducibility and given to the substrate, and patterning due to the photolithography and the vacuum process are not required, the ink jet method is preferable from the viewpoint of productivity. As a device for achieving the ink jet method, a bubble jet type using an electro-thermal converting member as an energy generating element, a piezo-electric jet type using a piezoelectric element or the like is useable. As means for baking the above-mentioned liquid droplet, there is used electromagnetic wave irradiating means, heated-air irradiating means, or means for heating the entire substrate. As the electromagnetic wave irradiating means, for example, an infrared ray lamp, an argon ion laser, a semiconductor laser or the like may be used.

Figure 2C:
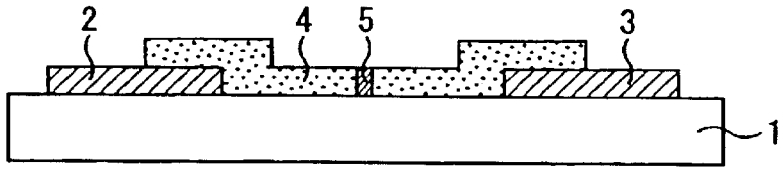

3) Subsequently, a forming process is conducted. An example of a method of conducting the forming process will be described with reference to a method using an electrifying process. When electricity is supplied between the element electrodes 2 and 3 by using a power supply not shown, an electron emission portion 5 with a changed structure is formed on a portion of the electrically conductive film 4 (FIG. 2C). The portion with the changed structure which is locally destroyed, deformed or affected is formed in the electrically conductive film 4 through the electrification forming(in general, there are many cases in which the portion is in a crack form). That portion constitutes the electron emission portion 5. An example of the voltage waveform of the electrification forming is shown in FIG. 3.

Figure 3A:
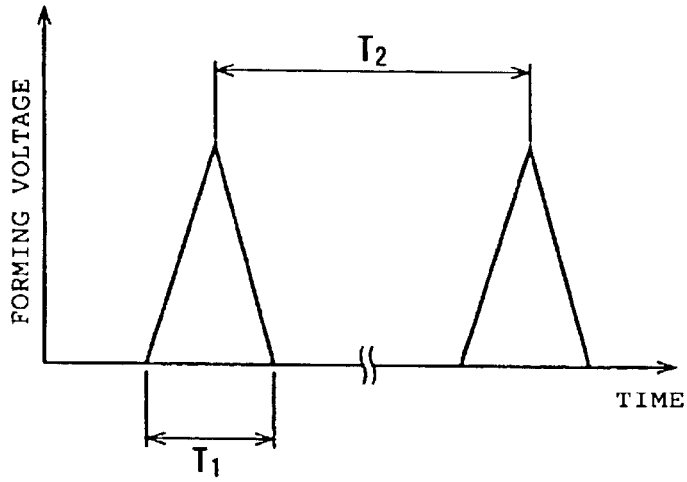
FIGS. 3A and 3B are diagrams showing an example of a voltage waveform of an electrification forming used in a method of manufacturing an electron source in accordance with the present invention.
Figure 3B:
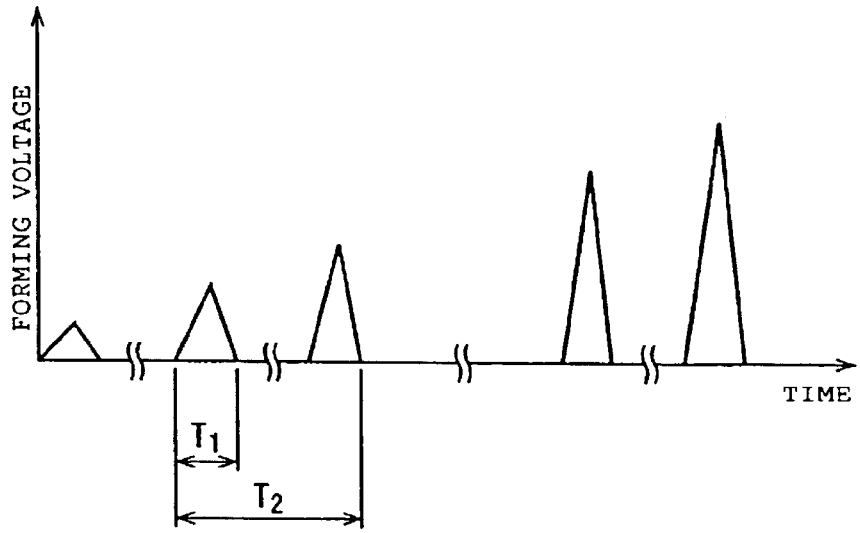

It is preferable that the voltage waveform is a pulse waveform. In case of the pulse waveform, there are a manner of continuously applying pulses with the pulse peak value as a constant voltage as shown in FIG. 3A and a manner of applying a voltage pulse while the pulse peak value is being increased as shown in FIG. 3B.

First, a case in which the pulse peak value is set as the constant voltage will be described with reference to FIG. 3A. In FIG. 3A, T1 and T2 are the pulse width and the pulse interval of the voltage waveform. The peak value (a peak voltage during the electrification forming) of a chopping wave is appropriately selected in accordance with the form of the surface conduction type electron emission element. Under the above condition, a voltage is applied, for example, for several seconds to several tens of seconds. The pulse waveform is not limited to the chopping wave but a desired waveform such as a rectangular wave can be applied.

Subsequently, a case in which the voltage pulse is applied while the pulse peak value is being increased will be described with reference to FIG. 3B. In FIG. 3B, T1 and T2 are identical with T1 and T2 shown in FIG. 3A. Also, the peak value of the chopping wave is increased, for example, about 0.1 V by 0.1 V.

The completion of the electrification forming process can be detected by applying a voltage to the degree that the electrically conductive film 4 is not locally destroyed or deformed during a pulse interval T2 and measuring a current. For example, a current that flows due to application of a voltage of about 0.1 V is measured, a resistance is found, and when the detected resistance is 1 MΩ or more, the electrification forming is completed.

4) The element on which the forming process has been conducted is subjected to a process called "activating process". The activating process is a process for remarkably changing the element current If and the emission current Ie.

The activating process can repeat the application of a pulse voltage under an atmosphere containing an organic material as in the electrification forming. In this situation, a preferable gas pressure of the organic material is appropriately set according to circumstances because it depends on the form of the above-mentioned application, the shape of the vacuum vessel, a sort of the organic material, etc.

Through the above process, carbon or carbon compound is deposited on the electron emission portions formed on the electrically conductive film from the organic material that exists in the atmosphere, to thereby remarkably change the element current If and the emission current Ie.

In this example, carbon or carbon compound is, for example, graphite (so-called HOPG, PG and GC where HOPG is directed to the substantially complete crystal structure of graphite, PG is directed to the slightly disordered crystal structure about 20 nm in crystal grain and GC is directed to the more largely disordered crystal structure about 2 nm in crystal grain), or amorphous carbon (directed to amorphous carbon, and the mixture of amorphous carbon and microcrystal of the graphite), and its thickness is preferably set to 50 nm or less, more preferably 30 nm or less.

An appropriate organic material useable in the present invention may be aliphatic hydrocarbons such as alkane, alkene or alkyne, aroma hydrocarbons, alcohols, aldehydes, ketones, amines, or organic acids such as phenol, carboxylic acid or sulfonic acid. Specifically, there can be applied saturated hydrocarbon represented by $C_nH_{2n+2}$ such as methane, ethane or propane, unsaturated hydrocarbon represented by a composition formula of $C_nH_{2n}$, $C_nH_{2n-2}$ or the like such as ethylene, propylene, or acetylene, benzene, methanol, ethanol, formaldehyde, acetaldehyde, acetone, methyl ethyl ketone, methylamine, ethylamine, phenol, formic acid, acetic acid, propionic acid, etc. In the present invention, those organic materials may be employed independently or mixed together as occasion demands.

Also, those organic materials may be diluted with another gas which is not an organic material. The kinds of gas which can be used as a diluent gas may be an inactive gas such as nitrogen, argon or xenon.

In the present invention, in the method of applying a voltage in the activating process, conditions such as a change in voltage value with a time, a direction of applying a voltage, or a waveform are considered.

The change in the voltage value with a time can be conducted by a method of raising the voltage value with a time or a method using a fixed voltage as in the forming process.

The judgement of the completion of the activating process can be appropriately conducted while the element current If and the emission current Ie are measured.

5) It is preferable that the electron emission element obtained through the above processes is subjected to a stabilizing process. This process is a process of exhausting th organic material from the vacuum vessel. It is preferable that a vacuum exhausting device that exhausts the organic material from the vacuum vessel is a device using no oil so that the characteristics of the respective electron emission elements are not adversely affected by the oil generated from the device. Specifically, there can be applied a vacuum exhausting device such as a sorption pump or an ion pump.

The divided pressure of the organic compounds within the vacuum vessel is preferably set to a divided pressure under which carbon or carbon compound is not substantially newly deposited, that is, $1.3\times10^{-6}$ Pa or less, and particularly preferably set to $1.3\times10^{-8}$ Pa or less. It is preferable that when the organic material is further exhausted from the vacuum vessel, the entire vacuum vessel is heated so that the molecules of the organic material adsorbed by the inner wall of the vacuum vessel or the respective electron emission elements are liable to be exhausted. In this situation, the heating condition is to set to 80 to 250° C., and preferably set to 150° C. or higher and it is desirable that a heat treatment is conducted for a period of time as long as possible. However, the present invention is not particularly limited to the above conditions, but the above process is conducted under the conditions appropriately selected according to various conditions such as the size and the shape of the vacuum vessel or the structure of the electron emission element. It is necessary to reduce the pressure within the vacuum vessel as much as possible, preferably to $1\times10^{-5}$ Pa or less, and more preferably to $3\times10^{-6}$ Pa or less.

It is preferable that the atmosphere at the driving time after the stabilizing process has been conducted is kept to the atmosphere after the above stabilizing process has been completed, but the atmosphere is not limited to this, that is, the sufficient stable characteristic can be maintained even if the pressure per se is raised somewhat if the organic material is sufficiently removed. With the application of such vacuum atmosphere, the additional deposition of carbon or carbon compound can be suppressed and also $H_2O$ and $O_2$ or the like adsorbed on the vacuum vessel, the substrate, etc., can be removed, as a result of which the element current If and the emission current Ie are stabilized.

The basic characteristic of the electron emission element used in the present invention which has been obtained through the above-described process will be described with reference to FIGS. 4 and 5.

Figure 4:
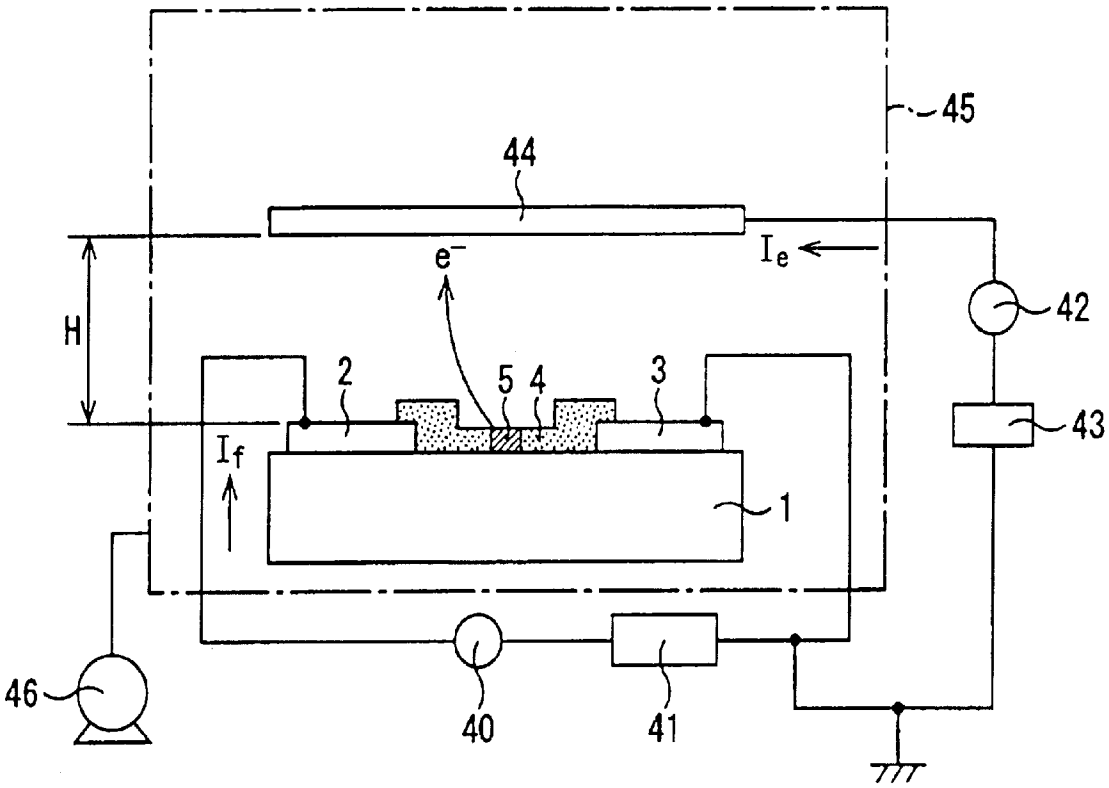
FIG. 4 is a schematic view showing an example of a vacuum processing device having a measurement evaluating function for evaluating the electron emission characteristic of an electron emission element that constitutes the electron source in accordance with the present invention.

FIG. 4 is a schematic diagram showing an example of a vacuum processing device, and the vacuum processing device functions also as a measurement evaluating device. In FIG. 4, the parts as those shown in FIG. 1 are designated by identical references as those in FIG. 1. Referring to FIG. 4, reference numeral 45 denotes a vacuum vessel, and 46 is an exhaust pump. The electron emission elements are disposed within the vacuum vessel 45. That is, reference numeral 1 denotes a substrate that constitutes the electron emission elements, 2 and 3 are element electrodes, 4 is an electrically conductive film and 5 is an electron emission portion. Reference numeral 41 denotes a power supply for applying an element voltage Vf to the electron emission elements, 40 is an ammeter for measuring an element current If that flows in the electrically conductive film 4 between the element electrodes 2 and 3, and 44 is an anode electrode for catching the emission current I emitted from the electron emission portion of the element. Reference numeral 43 is a high voltage source for applying a voltage to the anode electrode 44, and 42 is an ammeter for measuring the emission current I emitted from the electron emission portion 5 of the element. As an example, the measurement can be conducted under the conditions where a voltage across the anode electrode is in a range of from 1 kV to 10 kV, and a distance H between the anode electrode and the electron emission element is in a range of from 2 mm to 8 mm.

A device such as a vacuum gage not shown necessary for measurement under the vacuum atmosphere is located within the vacuum vessel 45, and the measurement evaluation is conducted under a desired vacuum atmosphere. The exhaust pump 46 is made up of a normal high vacuum device system made up of a turbo pump, a rotary pump and the like, and a super high vacuum device system made up of an ion pump and the like. The entire vacuum processing device where the electron source substrate is disposed in this example can be heated by a heater not shown. Therefore, the processes subsequent to the above-described electrification forming can be conducted by using the vacuum processing device.

Figure 5:
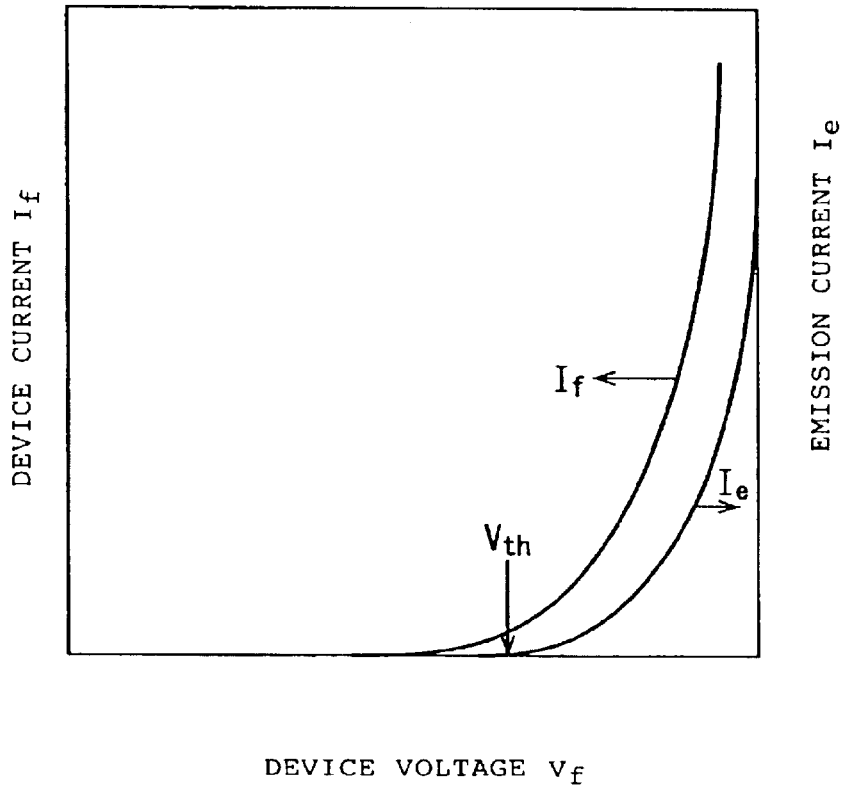
FIG. 5 is a graph showing an example of a relationship of an emission current Ie, an element current If and an element voltage Vf in the electron emission element that constitutes the electron source in accordance with the present invention.

FIG. 5 is a diagram schematically showing a relationship of the emission current Ie, the element current If and the element voltage Vf which are measured by using the vacuum processing device shown in FIG. 4. In FIG. 5, since the emission current Ie is remarkably small as compared with the element current If, it is represented by an arbitrary unit. The axes of ordinate and abscissa are linear scales.

As is apparent from FIG. 5, the surface conduction type electron emission element used in the present invention has the following three characteristic properties of the emission current Ie.

Namely, (i) When an element voltage which is equal to or more than a certain voltage (called "threshold voltage" Vth in FIG. 5) is applied to the electron emission element, the emission current Ie rapidly increases whereas when the element voltage as applied is less than the threshold voltage Vth, the emission current Ie is hardly detected. That is, the electron emission element is a non-linear element with a definite threshold voltage Vth with respect to the emission current Ie.

(ii) Because the emission current Ie depends on the element voltage Vt in a monotonic increase manner, the emission current Ie can be controlled by the element voltage Vf.

(iii) The emission charges caught by the anode electrode 44 depends on a period of time during which the element voltage Vf is applied to the electron emission element. That is, the emission charges caught by the anode electrode 44 can be controlled by the period of time during which the element voltage Vf is applied to the electron emission element.

As is understood from the above description, the electron emission element used in the present invention can readily control the electron emission characteristic in response to an input signal. By utilizing this property, the electron emission elements used in the present invention can be applied to multiple fields such as the electron source structured so as to arrange a plurality of electron emission elements, an image forming apparatus and so on. FIG. 5 shows an example in which the element current If monotonically increases with respect to the element voltage Vf (hereinafter referred to as "MI characteristic"). There is a case in which the element current If exhibits a voltage control type negative resistant characteristic with respect to the element voltage Vf (hereinafter referred to as "VCNR characteristic") (not shown). Those characteristics can be controlled by controlling the above-described process.

The electron source according to the present invention is designed in such a manner that a plurality of electron emission elements are arranged on the substrate, and the image forming apparatus according to the present invention is structured by the combination of the electron source with the image forming member which can form an image by irradiation of the electron beam from the electron source.

In the electron source according to the present invention, various arrangements of the electron emission elements can be applied. As one example, there is a ladder-like arrangement in which a large number of electron emission elements arranged in parallel are connected to each other at both ends thereof so that a large number of electron emission element rows are disposed (called "row direction"), and the electrons from the electron emission elements are driven under control by a control electrode (also called "grid") disposed above the electron emission elements along a direction orthogonal to the above wirings (called "column direction"). As another example, there is an arrangement in which a plurality of electron emission elements are arranged in a matrix in an X-direction and a Y-direction, and ones of electrodes of the plural electron emission elements disposed in the same row are commonly connected to the wirings in the X-direction, and others of the electrodes of the plural electron emission elements disposed in the same column are commonly connected to the wirings in the Y-direction, which is a so-called simple matrix arrangement. First, the simple matrix arrangement will be described in detail below.

Figure 6:
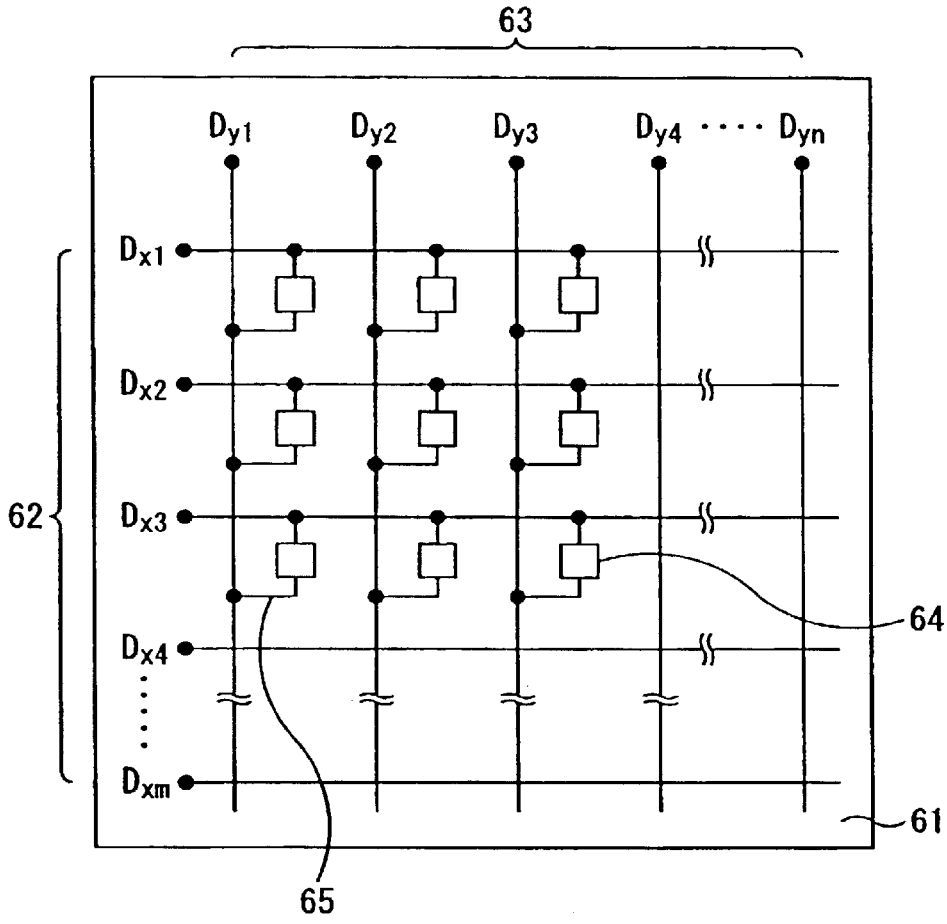
FIG. 6 is a schematic view showing an example of the electron source arranged in a simple matrix in an electron source of in accordance with an embodiment of the present invention.

FIG. 6 is a schematic view showing an electron source arranged in a simple matrix in accordance with an embodiment mode of the present invention. Referring to FIG. 6, reference numeral 61 denotes an electron source substrate, 62 is X-directional wirings, and 63 is Y-directional wirings. Reference numeral 64 denotes a surface conduction type electron emission element, and 65 is connections.

The m X-directional wirings 62 are comprised of m wirings of Dx1, Dx2, . . . , Dxm, and can be made of an electrically conductive metal, etc., formed through a vacuum evaporation method, a printing method, a sputtering method or the like. The material, the thickness and the width of the wirings are appropriately designed. The Y-directional wirings 63 are comprised of n wirings of Dy1, Dy2, . . . , Dyn, and are formed in the same manner as the X-directional wirings 62.

An interlayer insulating layer not shown is disposed between the m X-directional wirings 62 and the n Y-directional wirings 63 so that those wirings 62 and 63 are electrically isolated from each other (both of m and n are positive integers). The interlayer insulating layer not shown is made of $SiO_2$ formed through a vacuum evaporation method, a printing method, a sputtering method or the like. For example, the interlayer insulating layer is formed in a desired configuration on an entire surface or a partial surface of the substrate 61 on which the X-directional wirings 62 are formed, and in particular, the thickness, the material and the manufacturing method of the interlayer insulating layer are appropriately set so as to withstand the potential difference of the cross portions of the X-directional wirings 62 and the Y-directional wirings 63.

The X-directional wirings 62 and the Y-directional wirings 63 are drawn as external terminals, respectively. The respective pairs of electrodes (not shown) which constitute the surface conduction type electron emission elements 64 are electrically connected by the m X-directional wirings 62, the n Y-directional wirings 63 and the connections 65 made of the electrically conductive metal or the like. The material of the wirings 62 and the wirings 63, the material of the connections 65 and the material of the pairs of element electrodes may be partially or entirely identical with each other or different from each other. Those materials are appropriately selected from, for example, the above-described materials of the element electrode. In the case where the material of the element electrode is identical with the wiring material, the wirings connected to the element electrode can be regarded as the element electrode.

The electron emission element used in the present invention has the characteristics of (i) to (iii) as described above, that is, the emission elements from the electron emission elements can be controlled by the peak value and the width of a pulse voltage applied between the opposite element electrodes when the element voltage is equal to or more than the threshold voltage. On the other hand, when the element voltage is less than the threshold voltage, the emission elements are hardly emitted. According to that characteristic, even in the case where a large number of electron emission elements are arranged, if pulse voltages are appropriately applied to the respective elements, the electron emission elements are selected in response to an input signal so as to control the amount of emitted electrons.

For example, the Y-directional wirings 63 are connected with scanning signal supply means not shown which supplies a scanning signal for selecting the row of the surface conduction type electron emission elements 64 arranged in the Y-direction. On the other hand, the X-directional wirings 62 are connected with modulation signal generating means not shown for modulating the respective columns of the surface conduction type electron emission elements 64 arranged in the X-direction in response to the input signal. The drive voltage which is applied to the respective electron emission elements is applied as a differential voltage between the scanning signal and the modulation signal which are supplied to the element.

In the above structure, the individual element is selected so as to be driven independently, by using the simple matrix wiring.

The manufacturing method according to the present invention is characterized by applying a high electric field to the electron source substrate having a large number of electron sources thus prepared. In the case where a protrusion, etc., which induce the discharge phenomenon in the image forming apparatus are formed in the electron source, the protrusion is destroyed by allowing the discharge phenomenon to be generated in the electric field applying process according to the present invention. That is, the protrusion, etc., which induces the discharge phenomenon in the image forming apparatus is destroyed and removed by intentionally generating the discharge phenomenon by the provision of the same state as the drive state of the image forming apparatus in advance.

It is preferable that the process of applying an electric field to the electron source substrate according to the present invention is conducted before a forming process which will be described later. This is because there is the possibility that since the electrically conductive film having a crack which has been subjected to the forming process is connected onto the matrix wiring after the forming process, in the case where a current flows onto the electron source substrate when the electric field is applied to the electron source substrate, a voltage higher than the voltage applied in the forming process is applied to the electrically conductive film by a rise of the potential due to the wiring resistance of the matrix wiring to destroy the crack form, thereby being incapable of manufacturing the electron source. On the contrary, before the forming process, because the current is escaped through the electrically conductive film, a rise of the potential is suppressed, thereby being capable of reducing a damage.

In addition, it is preferable to conduct the electric field applying process in a state where only the matrix wiring and the element electrode are formed on the substrate because there is no influence on the electrically conductive film.

FIG. 7 is a conceptual diagram showing an example of the substrate arrangement and an example of a supply electric field given between the substrate and the electrode when the electron source substrate and the electrode are made opposite to each other.

Figure 7A:
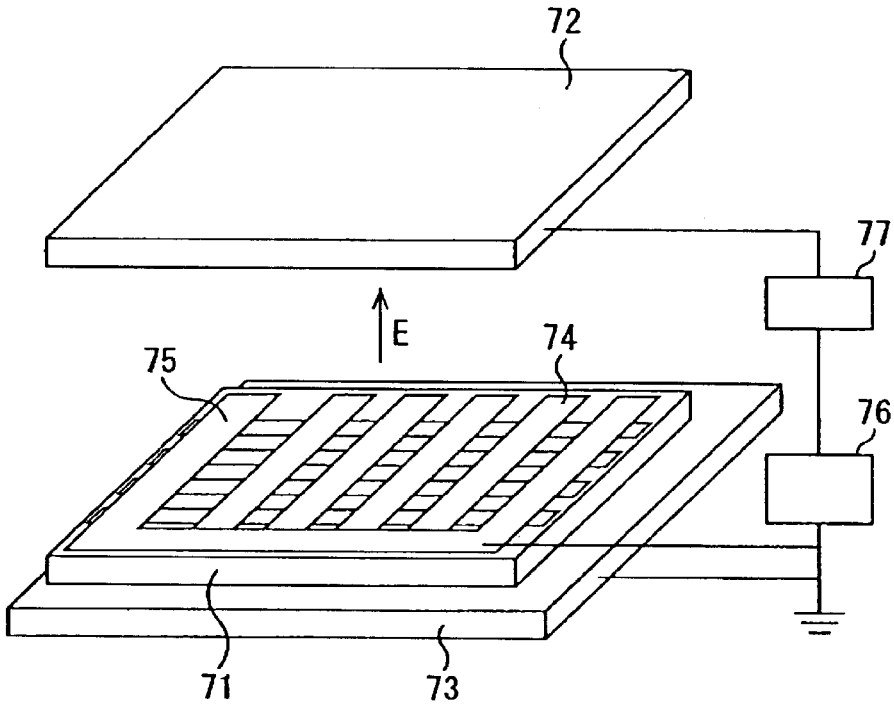
FIGS. 7A and 7B are diagrams showing an arrangement of an electron source substrate and an electrode in an electric field applying process in a method of manufacturing an electron source in accordance with the present invention.

As shown in FIG. 7A, an electrode 72 is disposed at a position opposite to an electron source substrate 71 disposed on a substrate stage 73 which is connected to GND. Also, a wiring 74 on the electron source substrate 71 is commonly connected to an electrically conductive takeoff member 75 on an end portion of the wiring, and connected to GND by a cable or the like, and the electrode 72 is connected to a high-voltage power supply 76. In this example, the electrically conductive takeoff member is formed of a sheet or a wire which is made of a relatively soft metal material (gold, indium, etc.,) which is pressfitted for use. Then, a voltage is applied between the electron source substrate 71 and the electrode 72 to apply an electric field E to the electron source substrate.

In general, because it is desirable that the wiring resistance of the matrix wiring is low since many electron emission elements are driven, it is preferable to make the thickness and the width of the wiring as large as possible. In order to ensure the precision of the image forming apparatus, it is difficult to make the width of the wiring as large as possible, and the thickness of the wiring may be made large instead.

In the case of preparing the thicker wiring, there is a case in which a period of time during which vacuum evaporation is conducted becomes long or repetitive printing is conducted. In this case, a risk that a foreign material is stuck onto the wiring, etc., may increase, resulting in the possibility that the protrusion to which the high electric field is applied occurs.

In the image forming apparatus which will be described later, a distance between the phosphor and the upper wirings of the matrix wirings is shortest, and among the upper wirings, a distance between the phosphor and regions in which the upper wirings cross the lower wirings through the interlayer insulating layer is shortest. Therefore, in the case of using the plate electrode as shown in FIG. 7A, it is necessary that the parallel degree with the electron source substrate is sufficiently taken, and an electric field is sufficiently applied onto the entire surface of the electron source substrate.

Also, it is preferable that a resistor (not shown) for current limit is inserted in a cable to which a high voltage is applied to regulate the upper limit of the current.

Further, the discharge phenomenon occurring between the electron source substrates can be evaluated by using a device 77 that measures the current that flows between the electron source substrates.

It is necessary that the intensity of the electric field applied in the electric field applying process is equal to or more than the intensity of the electric field applied between the electron source and the phosphor as the image forming apparatus. The electric field intensity applied in the electric field applying process is about 1 kV/mm or more.

A period of time during which the electric field is applied in the electric field applying process is preferably set to about a period of time during which the image display device is driven, but a longer period of time is taken in the electric field applying process. If the electric field applying intensity is made higher than the electric field applying intensity during actual driving operation, the above period of time in the electric field applying process can be shortened.

Figure 7B:
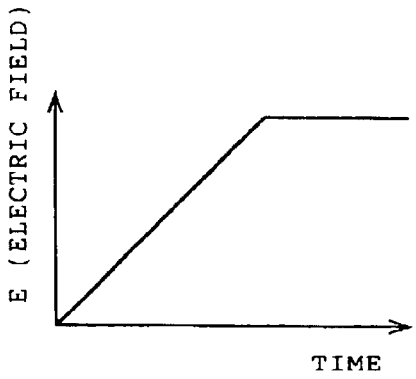

For example, as shown in FIG. 7B, there is proposed a method in which the electric field is made to gradually arise, and a desired electric field is maintained for a given period of time.

The image forming apparatus structured by using the electron source arranged in a simple matrix in accordance with the present invention will be described with reference to FIGS. 8 to 10.

Figure 8:
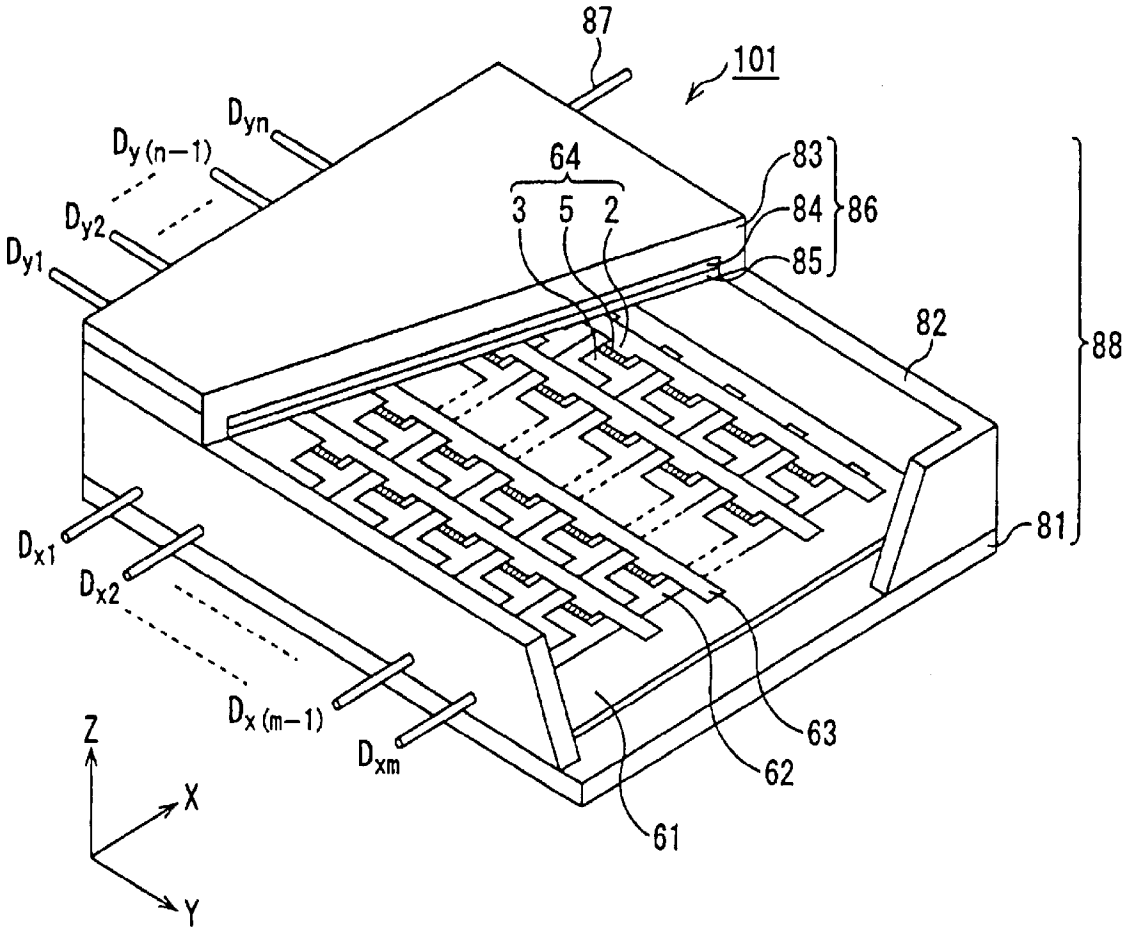
FIG. 8 is a schematic view showing an example of a display panel using an electron source arranged in a simple matrix in an image forming apparatus in accordance with an embodiment of the present invention.
Figure 9A:
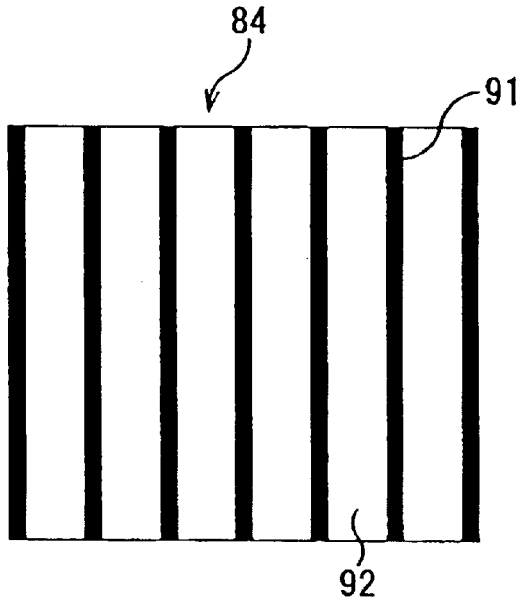
FIGS. 9A and 9B are schematic views showing an example of a fluorescent film used in the display panel.
Figure 9B:
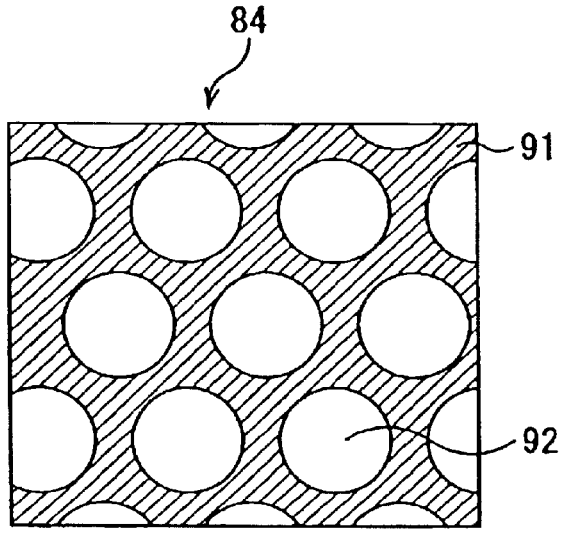
Figure 10:
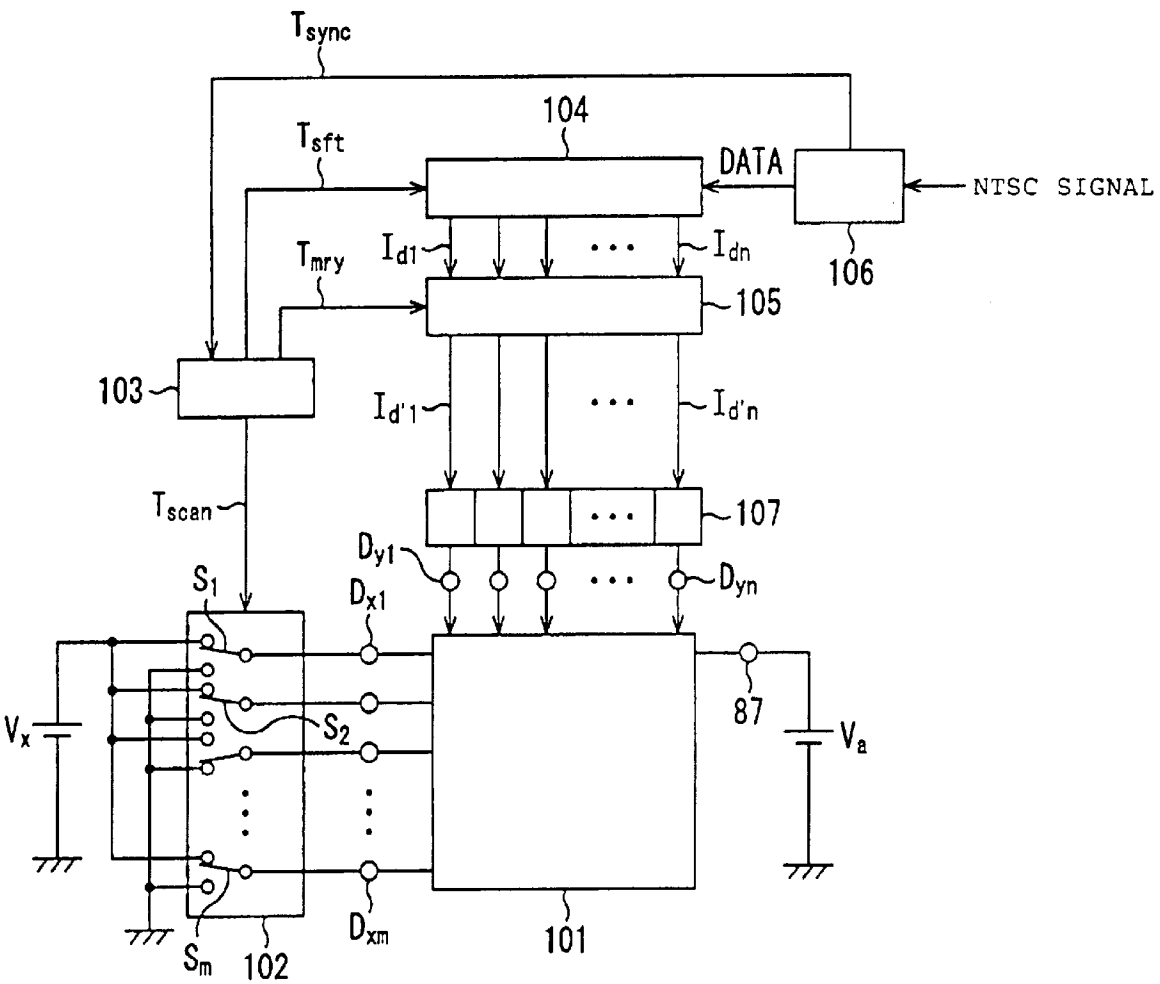
FIG. 10 is a block diagram showing an example of a drive circuit for conducting display in response to a television signal of the NTSC system in an image forming apparatus in accordance with the present invention.

FIG. 8 is a schematic view showing an example of a display panel in an image forming apparatus in accordance with an embodiment mode of the present invention, and FIG. 9 is a schematic view showing a fluorescent film used in the display panel shown in FIG. 8. FIG. 10 is a block diagram showing an example of a drive circuit for conducting display in response to a television signal of the NTSC system.

Referring to FIG. 8, reference numeral 61 denotes an electron source substrate in which a plurality of electron emission elements are arranged; 81, a rear plate fixed with the electron source substrate 61; 86, a face plate in which a fluorescent film 84, a metal back 85 and so on are formed on an inner surface of a glass substrate 83. Reference numeral 82 denotes a support frame, and the support frame 82 is joined with the rear plate 81 and the face plate 86 through a flit glass with a low melting point or the like. Reference numeral 64 corresponds to the electron emission element shown in FIG. 1. Reference numeral 62 and 63 are X-directional wirings and Y-directional wirings which are connected to a pair of element electrodes of the surface conduction type electron emission elements. The electrically conductive film of the respective elements is omitted for convenience.

The envelope 88 is made up of the face plate 86, the support frame 82 and the rear plate 81 as described above. Because the rear plate 81 is provided mainly for the purpose of reinforcing the strength of the substrate 61, if the substrate 61 per se has a sufficient strength, the separately provided rear plate 81 may be unnecessary. In other words, the support frame 82 may be directly sealingly attached to the substrate 61 so that the envelope 88 is made up of the face plate 86, the support frame 82 and the substrate 61. On the other hand, if a support member not shown which is called "spacer" is located between the face plate 86 and the rear plate 81, the envelope 88 having a sufficient strength against the atmospheric pressure can be structured.

FIG. 9 is a schematic view showing a fluorescent film. The fluorescent film 84 can be made up of only a phosphor in case of monochrome. In case of a color fluorescent film, the fluorescent film 84 can be made up of a black conductive member 91 and a phosphor 92 which are called "black stripes" or "black matrix" due to the arrangement of the phosphors. The purposes of providing the black stripes and the black matrix are to make a mixed color, etc., neutral by blacking the boundary portions of the respective phosphors 92 of three primary color phosphors required in case of color display, and to suppress the deterioration of contrast due to reflection of the external light on the fluorescent film 84. The material of the black stripes can be made of a material that mainly contains black lead which is generally used, or a material which is electrically conductive and small in the transmission and refection of a light.

A method of coating the phosphors on the glass substrate 83 can be applied with a sedimentation or printing method, etc., regardless of monochrome or color. The metal back 85 is normally disposed on the inner surface side of the fluorescent film 84. The purposes of providing the metal back are to improve the luminance by mirror-reflecting a light directed to the inner surface side among the light emission of the phosphors to the face plate 86 side, to operate the metal back as an electrode for applying an electron beam accelerating voltage, to protect the phosphors from any damage due to collision of negative ions produced within the envelope, etc. The metal back can be manufactured by smoothing the inner surface of the fluorescent film (normally called "filming")after the fluorescent film has been prepared, and thereafter depositing Al through the vacuum evaporation, etc.

The face plate 86 may be provided with a transparent electrode (not shown) at the outer surface side of the fluorescent film 84 in order to enhance the electric conductivity of the fluorescent film 84.

When the above sealing attachment of the envelope is conducted, in case of color, it is necessary that the respective color phosphors are made to correspond to the electron emission elements, and the sufficient positioning is essential.

An example of a method of manufacturing the display panel in the image forming apparatus shown in FIG. 8 will be described below.

Figure 11:
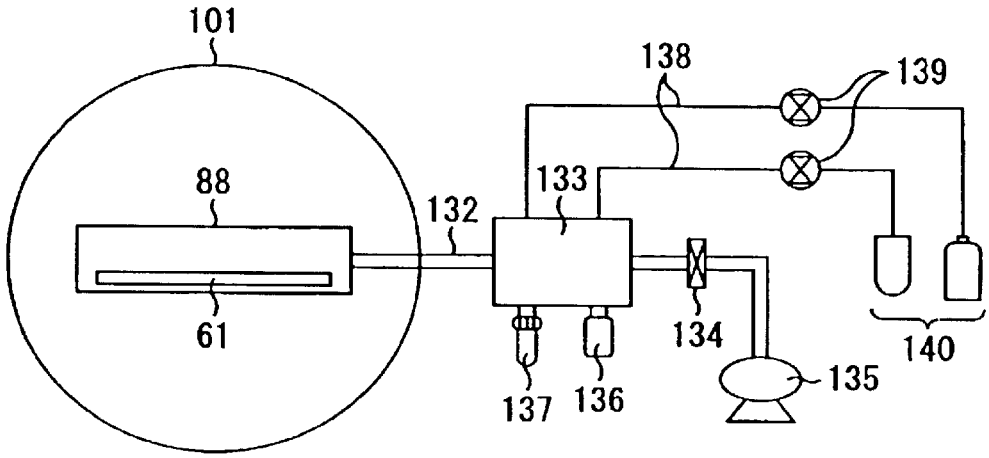
FIG. 11 is a schematic view showing a vacuum exhaust device for conducting forming and activating processes in a method of manufacturing an electron source in accordance with the present invention.

FIG. 11 is a schematic view showing the outline of a device used in the above process. A display panel 101 is coupled to a vacuum chamber 133 through an exhaust pipe 132 and also connected to an exhausting device 135 through a gate valve 134. A pressure gauge 136, a quadrupole mass spectrograph 137 and so on are attached to the vacuum chamber 133 in order to measure an internal pressure and the divided pressures of the respective components in the atmosphere. Because it is difficult to directly measure the internal pressure in the envelope 88 of the display panel 101, etc., a pressure or the like in the vacuum chamber 133 is measured, to thereby control the processing conditions. Also, a gas introduction line 138 is connected to the vacuum chamber 133 in order to introduce required gas into the vacuum chamber to control the atmosphere. The other end of the gas introduction line 138 is connected with an introduction material source 140, and the introduction material is inserted into an ample or a bomb and then stored therein. Introduction amount control means 139 for controlling a rate at which the introduction material is introduced is disposed on the gas introduction line. As the specific introduction amount control means, a valve such a slow leak valve which can control a flow rate to be escaped, a mass flow controller, etc., can be used in accordance with a kind of the introduction material.

Figure 12:
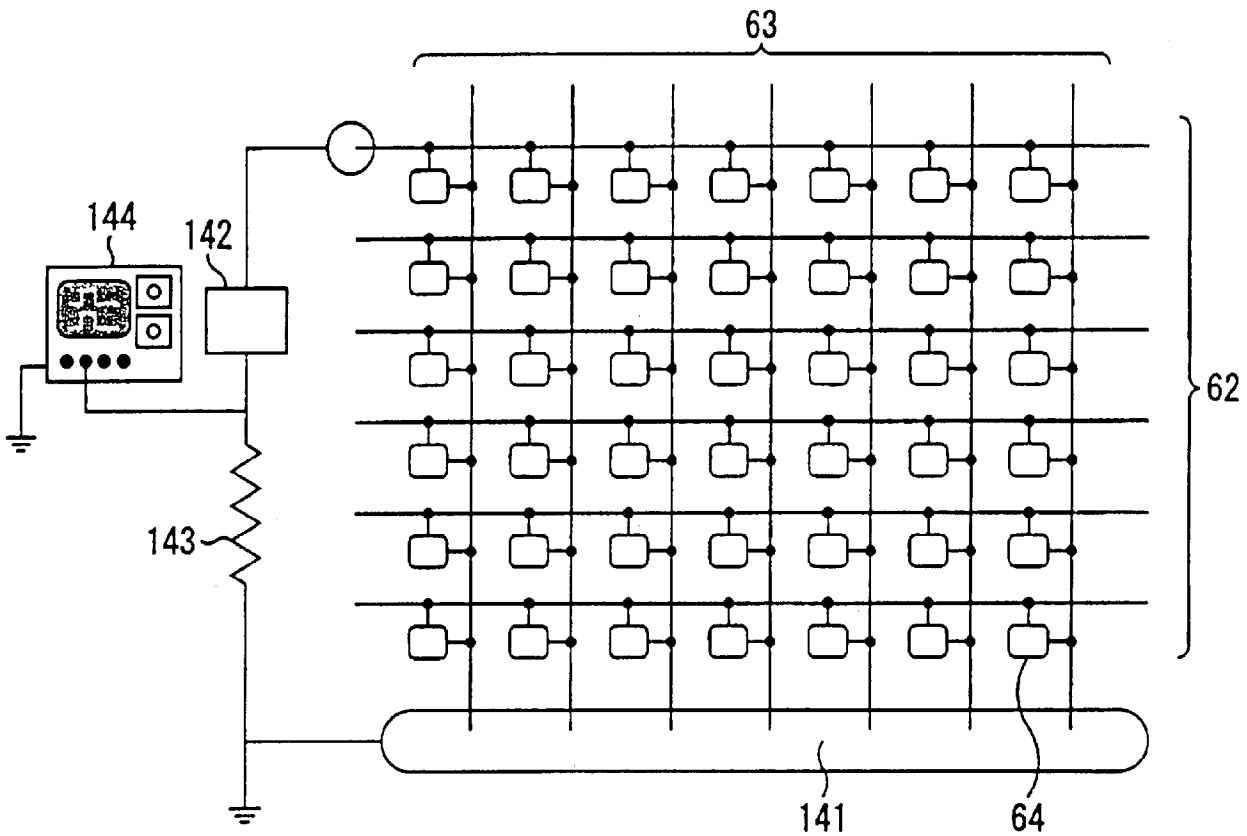
FIG. 12 is a schematic view showing a connecting method for conducting forming and activating processes in a method of manufacturing an electron source in accordance with the present invention.

A gas is exhausted from the interior of the envelope 88 by the device shown in FIG. 11 to conduct a forming process. In this situation, for example, as shown in FIG. 12, the Y-directional wirings 63 are connected to the common electrode 141, and a voltage pulse is applied to the elements connected to one of the X-directional wirings 62 by the power supply 142 at the same time, thereby being capable of conducting the forming process. The conditions such as the shape of the pulse and the judgement of the completion of the processing may be selected in accordance with the above-described method of forming the respective elements. Also, if pulses phases of which are shifted are sequentially applied to the plurality of X-directional wirings (scroll), it is possible to conduct the forming process on the elements connected to the plurality of X-directional wirings together. In the figure, reference numeral 143 denotes a current measurement resistor, and 144 is a current measurement oscilloscope.

After the forming process has been completed, an activating process is conducted. The organic material is introduced into the envelope 88 from the gas introduction line 138 after a gas has been sufficiently exhausted from the envelope 88.

In the atmosphere containing the organic material thus formed, a voltage is applied to the respective electron emission elements with the results that carbon, carbon compound or the mixture of those materials is deposited on the electron emission portions, and the amount of emitted electrons drastically arises as in case of the respective elements. Also, in this example, in the voltage applying method, it is possible that the Y-directional wirings 63 are connected to the common electrode 141, and pulses whose phases are shifted are sequentially applied to the plurality of X-directional wirings 62 (scroll), to thereby activate the elements connected to the plurality of X-directional wirings 62 together. The conditions such as the shape of the pulse and the judgement of the completion of the processing may be selected in accordance with the above-described method of activating the respective elements.

After the activating process has been completed, it is preferable to conduct the stabilizing process as in the individual elements. The gas within the envelope 88 is exhausted through an exhaust pipe 132 by the exhausting device 135 using no oil such as an ion pump or a sorption pump while being appropriately heated so as to be maintained at 80 to 250° C., to thereby provide the atmosphere sufficiently small in the amount of organic material, and thereafter the exhaust pipe is heated and melted by a burner to conduct sealing. In order to maintain the pressure after the envelope 88 is sealed, a gettering process may be conducted. This is a process in which a getter disposed at a given position (not shown) within the envelope 88 is heated due to heating using resistor heating or high frequency heating, etc., immediately before the envelope 88 is sealed or after the envelope 88 has been sealed, to thereby form a deposition film. The getter normally mainly contains Ba or the like and maintains the atmosphere within the envelop 88 by an absorption action of the deposition film.

Subsequently, a description will be given of an structural example of a drive circuit for conducting television display on the basis of a television signal of an NTSC system on the display panel structured by using the electron source of the simple matrix arrangement with reference to FIG. 10. Referring to FIG. 10, reference numeral 101 denotes a display panel; 102, a scanning circuit; 103, a control circuit; 104, a shift register; 105, a line memory; 106, a synchronous signal separating circuit; 107, a modulated signal generator; and Vx and Vxa are d.c. voltage sources. The display panel 101 is connected to an external electric circuit through terminals Dx1 to Dxm, terminals Dy1 to Dyn, and a high voltage terminal 87. The terminals Dy1 to Dyn are applied with a scanning signal for sequentially driving the electron source disposed within the display panel, that is, the surface conduction type electron emission element group which are arranged in matrix of m rows×n columns one line (m element) by one line.

The terminals Dx1 to Dxm are applied with a modulation signal for controlling the output electron beams of the respective elements of the surface conduction type electron emission elements on one row selected in accordance with the scanning signal. The high voltage terminal 87 is applied with a d.c. voltage of, for example, 10 kV by the d.c. voltage source Va. This is an accelerating voltage for giving an energy sufficient to excite the phosphors to an electron beam emitted from the surface conduction type electron emission elements. The scanning circuit 102 will be described. The scanning circuit 102 includes n switching elements (in the figure, schematically represented by S1 to Sm) therein. The respective switching elements select any one of the output voltage of the d.c. voltage source V and 0 V (ground level) and are electrically connected to the terminals Dy1 to Dyn of the display panel 101. The respective switching elements of S1 to Sm operate on the basis of a control signal Tscan outputted from the control circuit 103 and can be structured by the combination of switching elements such as FETs.

In this example, the d.c. voltage source Vx is so set as to output a constant voltage so that a drive voltage applied to an element which is not scanned becomes an electron emission threshold voltage or less, on the basis of the characteristic of the surface conduction type electron emission elements (electron emission threshold voltage).

The control circuit 103 has a function of matching the operation of the respective members with each other so that appropriate display is conducted on the basis of an image signal inputted from the external. The control circuit 103 generates the respective control signals of Tscan, Tsft and Tmry to the respective members on the basis of a synchronous signal Tsync transmitted from the synchronous signal separating circuit 106. The synchronous signal separating circuit 106 is a circuit for separating a synchronous signal component and a luminance signal component from the television signal of the NTSC system which is inputted from the external and can be made up of a general frequency dividing (filtering) circuit and so on. The synchronous signal separated by the synchronous signal separating circuit 106 consists of a vertical synchronous signal and a horizontal synchronous signal, but is shown as a signal Tsync in this example for convenience of description. The luminance signal component of an image which is separated from the television signal is represented as a DATA signal for convenience. The DATA signal is inputted to the shift register 104.

The shift register 104 is so designed as to serial-parallel convert the DATA signal inputted in serial temporarily for one line of the image and operates on the basis of the control signal Tsft transmitted from the control circuit 103 (that is, the control signal Tsft is also called "shift clock" of the shift register 104). The data for one line of the image which has been converted from serial to parallel (corresponding to the drive data of m elements of the electron emission elements) is outputted from the shift register 104 as m parallel signals of Id1 to Idm.

The line memory 105 is a memory device for storing the data for one line of the image for a required period of time, and appropriately stores the contents of Id1 to Idm in accordance with the control signal Tmry transmitted from the control circuit 103. The stored contents are outputted as Id'l to Id'm and then inputted to the modulated signal generator 107.

The modulation signal generator 107 is a signal source for appropriately driving and modulating the respective surface conduction type electron emission elements in accordance with the respective image data Id'l to Id'm, and its output signal is supplied to the surface conduction type electron emission elements within the display panel 101 through the terminals Dx1 to. Dxm.

As described above, the electron emission element used in the present invention has the basic characteristics of the emission current Ie. That is, the electron emission has the definite threshold voltage Vth, and the electron emission occurs only when the voltage of Vth or higher is applied. The emission current also changes in accordance with a change of the supply voltage to the elements with respect to the voltage which is equal to or higher than the electron emission threshold value. From the above fact, in the case where the pulse voltage is applied to the electron emission elements, for example, even if the voltage lower than the electron emission threshold value is applied to the elements, the electron emission does not occur. However, in the case where the voltage equal to or higher than the electron emission threshold value, the electron beams are outputted. In this situation, the intensity of the output electron beams can be controlled by changing the peak value V difference of the pulses. Also, it is possible to control the total amount of the electric charges of the electron beams outputted by changing the pulse width Pw. Accordingly, as a system of modulating the electron emission element in accordance with the input signal, there can be applied a voltage modulating system, a pulse width modulating system and so on. In implementing the voltage modulating system, as the modulation signal generator 107, there can be used a circuit of the voltage modulating system which generates a voltage pulse of a constant length and appropriately modulates a peak value of the pulse in accordance with inputted data.

In implementing the pulse width modulating system, as the modulation signal generator 107, there can be used a circuit of the pulse width modulating system which generates a voltage pulse of a constant peak value and appropriately modulates the width of the voltage pulse in accordance with inputted data.

The shift register 104 and the line memory 105 may be of the digital signal system or the analog signal system. This is because the serial to parallel conversion of the image signal and the storage thereof may be conducted at a given speed.

In the case of using the digital signal system, it is necessary to convert the output signal DATA of the synchronous signal separating circuit 106 into a digital signal, and in this case, an A/D convertor may be disposed on an output portion of the synchronous signal separating circuit 106. With being associated with the above structure, a circuit used in the modulation signal generator 107 is slightly different depending on whether the output signal of the line memory 105 is a digital signal or an analog signal. That is, in case of the voltage modulating system using the digital signal, the modulation signal generator 107 is equipped with, for example, a D/A converting circuit, and an amplifying circuit or the like is added to the generator 107 as occasion demands. In case of the pulse width modulating system, the modulation signal generator 107 is equipped with, for example, a circuit combining a high-speed oscillator, a counter (counter) that counts the number of waves outputted from the oscillator, and a comparator (comparator) which compares an output value of the counter with an output value of the memory together. As occasion demands, an amplifier which voltage-amplifies the modulated signal which is outputted from the comparator and modulated in pulse width up to the drive voltage of the surface conduction type electron emission elements may be added to the circuit.

In case of the voltage modulating system using the analog signal, the modulation signal generator 107 may be equipped with, for example, an amplifying circuit using an operational amplifier, etc., and as occasion demands, a level shifting circuit, etc., may be added to the system. In case of the pulse width modulating system, for example, a voltage control type oscillating circuit (VCO) can be applied, and as occasion demands, an amplifier for amplifying the voltage up to a drive voltage of the surface conduction type electron emission elements may be added to the circuit. In the image forming apparatus thus structured according to the present invention, a voltage is applied to the respective electron emission elements through the terminals Dx1 to Dxm and the terminals Dy1 to Dyn disposed in the exterior of the vessel, to thereby cause electron emission. A high voltage is applied to the metal back 85 or a transparent electrode (not shown) through the high voltage terminal 87, to thereby accelerate an electron beam. The accelerated electrons collide with the fluorescent film 84 to emit a light, thereby forming an image.

The above-described structure of the image forming apparatus is an example of the image forming apparatus to which the present invention is applicable, and various deformations can be made on the basis of the technical conception of the present invention. The input signal is of the NTSC system, but the input signal is not limited to this system and is applicable to the PAL and SECAM systems, etc., and also a TV signal (for example, a high-grade TV including the MUSE system) system with a larger number of scanning lines than the PAL and SECAM systems.

Figure 13:
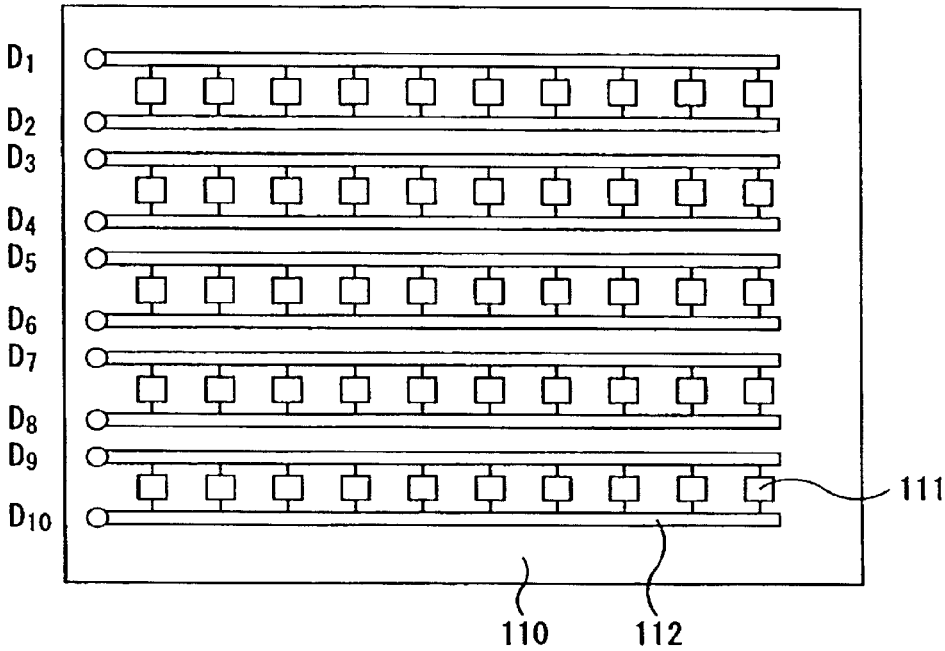
FIG. 13 is a schematic view showing an example of an electron source arranged in a ladder in an electron source in accordance with another embodiment of the present invention.

FIG. 13 is a schematic view showing an example of electron sources which are arranged in the form of a ladder as another embodiment mode of the electron source according to the present invention. Referring to FIG. 13, reference numeral 110 denotes an electron source substrate; and 111 is an electron emission element. Reference numeral 112 denotes common wirings D1 to D10 for connecting the electron emission element 111. A plurality of electron emission elements 111 are disposed on the substrate 110 in parallel in the X-direction (called "element row"). A plurality of element rows are disposed to constitute the electron source. When the drive voltage is applied between the common wirings of the respective element rows, the respective element rows can be driven independently. That is, the element rows from which the electron beams are intended to be emitted are applied with a voltage of an electron emission threshold value or higher whereas the element rows from which the electron beams are not intended to be emitted are applied with a voltage lower than the electron emission threshold value. The common wirings D2 to D9 positioned between the respective element rows can be made by integrating, for example, D2 and D3 into the same wiring.

Figure 14:
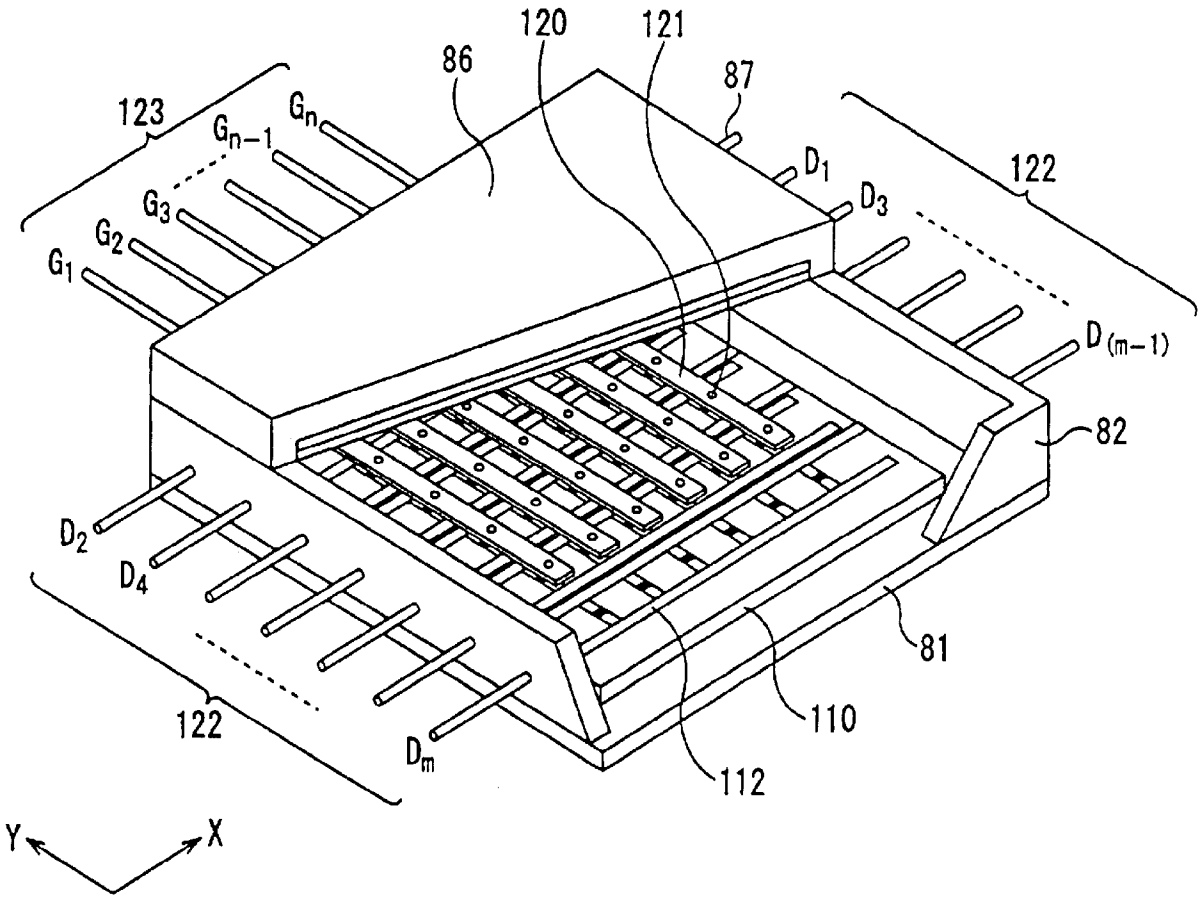
FIG. 14 is a schematic view showing an example of a display panel using an electron source arranged in a ladder in an image forming apparatus in accordance with still another embodiment of the present invention.

FIG. 14 is a schematic view showing an example of a display panel structure in the image forming apparatus having the electron sources which are arranged in the form of a ladder in accordance with an embodiment mode of the present invention. Reference numeral 120 denotes grid electrodes; 121 is openings through which electrons pass; and 122 is vessel external terminals of D1, D2, . . . , Dm. Reference numeral 123 is vessel external terminals of G1, G2, . . . , Gn connected with the grid electrodes 120.

In FIG. 14, the same parts as those shown in FIGS. 8 and 13 are designated by identical references as those in those figures. A great difference between the display panel shown in FIG. 14 and the display panel of the simple matrix arrangement shown in FIG. 8 resides in that whether the grid electrodes 120 are disposed between the electron source substrate 110 and the face plate 86, or not.

The grid electrodes 120 are so designed as to modulate the electron beam emitted from the surface conduction type electron emission elements and one circular opening 121 is provided for each of the respective elements in order that the electron beam is allowed to pass through the stripe electrodes disposed orthogonal to the element rows of the ladder-type arrangement. The shape of the grid electrodes and the position at which the grid electrodes are arranged are not limited to what are shown in FIG. 14. For example, a large number of passage ports can be disposed in a mesh as openings, or the grid can be disposed around or in the vicinity of the surface conduction type electron emission elements.

The vessel external terminals 122 and the grid vessel external terminals 123 are electrically connected to a control circuit not shown. In the image forming apparatus according to this example, the modulated signal for one line of the image is supplied to the grid electrode columns at the same time in synchronism with the sequential drive (scanning) operation of the element rows column by column. With this operation, the irradiation of the respective electron beams to the phosphors is controlled, thereby being capable of displaying the image one line by one line. The image forming apparatus according to the present invention can be employed as a display device for a television broadcast, a display device for a television conference system, a computer or the like, o an image forming apparatus structured by using a photosensitive drum and so on as an optical printer, etc.

Figure 22:
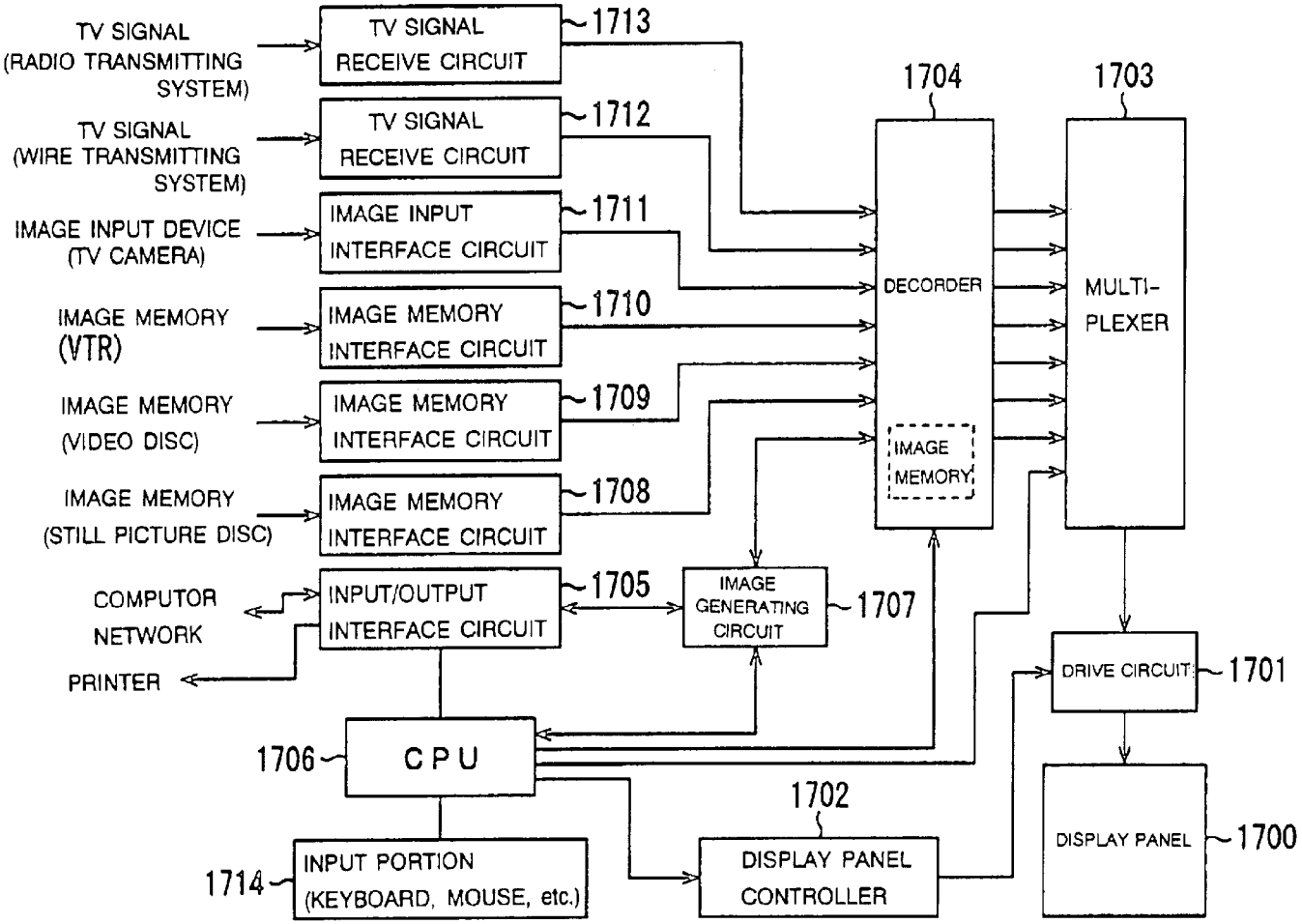
FIG. 22 is a block diagram showing an example of an image forming apparatus in accordance with the present invention.

FIG. 22 is a block diagram showing an example of an image forming apparatus which is structured so as to display image information supplied from various image information sources, for example, including a television broadcasting in accordance with the present invention.

In the figure, reference numeral 1700 denotes a display panel, 1701 is a drive circuit of the display panel, 1702 is a display controller, 1703 is a multiplexer, 1704 is a decoder, 1705 is an input/output interface circuit, 1706 is a CPU, 1707 is an image generating circuit, 1708 to 1710 are image memory interface circuits, 1711 is an image input interface circuit, 1712 and 1713 are TV signal receiving circuits, and 1714 is an input portion.

The present image forming apparatus displays video information and simultaneously reproduces audio information when the apparatus receives a signal including both of the video information and the audio information, for example, as with a television signal. However, circuits pertaining to the reception, separation, reproduction, processing, storage of the audio information, a speaker and so on which are not directly concerned with the features of the present invention will be omitted from description.

Hereinafter, the functions of the respective parts will be described along a flow of the image signal.

First, the TV signal receiving circuit 1713 is a circuit for receiving a TV signal transmitted on a radio transmission system such as electric waves or spatial optic communication. The system of the received TV signal is not particularly limited, but any system of, for example, the NTSC system, the PAL system, the SECAM system and so on may be applied. Also, the system of a so-called high-grade TV signal, for example, a MUSE system having a larger number of scanning lines than those systems is a proper signal source for exhibiting the advantage of the above-described display panel suitable for a large area or a large number of pixels.

The TV signal received by the TV signal receiving circuit 1713 is outputted to the decoder 1704.

The TV signal receiving circuit 1712 is a circuit for receiving a TV signal transmitted on the wire transmitting system such as a coaxial cable or an optical fiber. As in the above TV signal receiving circuit 1713, the system of the received TV signal is not particularly limited. Also, the TV signal received by this circuit is outputted to the decoder 1704.

The image input interface circuit 1711 is a circuit for taking in an image signal supplied from an image input device such as a TV camera or an image reading scanner, and the taken-in image signal is outputted to the decoder 1704.

The image memory interface circuit 1710 is a circuit for taking in an image signal stored in a video tape recorder (hereinafter referred to as "VTR"), and the taken-in image signal is outputted to the decoder 1704.

The image memory interface circuit 1709 is a circuit for taking in an image signal stored in a video disc, and the taken-in image signal is outputted to the decoder 1704.

The image memory interface circuit 1708 is a circuit for taking in an image signal from a device that stores still image data as in a still image disc, and the taken-in image signal is outputted to the decoder 1704.

The input/output interface circuit 1705 is a circuit for connecting the present image display device to an output device such as an external computer, a computer network or a printer. The input/output interface circuit 1705 conducts the input/output of image data, character/graphic information and also can conduct the input/output of a control signal or numerical data between the CPU 1706 provided in the present image forming apparatus and the external as occasion demands.

The image generating circuit 1707 is a circuit for generating image data for display on the basis of image data or character/graphic information inputted from the external through the input/output interface circuit 1705 or image data or character/graphic information outputted from the CPU 1706. The interior of the image generating circuit 1707 is equipped with circuits necessary for generating the image, such as a rewritable memory for storing, for example, the image data and the character/graphic information, a read only memory in which an image pattern corresponding to character codes are stored, a processor for conducting image processing, etc.

The image data for display generated by the image generating circuit 1707 is outputted to the decoder 1704, and can be outputted to the external computer network or the printer through the input/output interface circuit 1705 as occasion demands.

The CPU 1706 mainly conducts the operation control of the present image display device, and work pertaining to the generation, selection or edition of the display image.

For example, the control signal is outputted to the multiplexer 1703, and the image signal displayed on the display panel is appropriately selected or combined. In this case, the control signal is generated to the display panel controller 1702 in response to the image signal to be displayed, and the operation of the display device such as a screen display frequency, a scanning method (for example, interlace or non-interlace) or the number of scanning lines for one screen is appropriately controlled. Also, the image data or the character/graphic information is directly outputted to the image generating circuit 1707, or the external computer or the memory is accessed through the input/output interface circuit 1705 to input the image data or the character/graphic information.

The CPU 1706 may pertain to the works for other purposes. For example, the CPU 1706 may be directly concerned with a function of generating or processing the information as in a personal computer, a word processor, etc. Also, as described above, the CPU 1706 may be connected to the external computer network through the input/output interface circuit 1705, and cooperates works such as numerical calculation with the external device.

The input portion 1714 is so designed as to input a command, program or data to the CPU 1706 by a user. Various input devices such as a keyboard, a mouse, a joy stick, a bar code reader, or a voice recognizing device can be used.

The decoder 1704 is a circuit for reversely converting various image signals inputted from the above devices 1707 to 1713 into three primary color signals, or a luminance signal and an I signal, a Q signal. As indicated by a dotted line in the figure, it is desirable that the decoder 1704 includes an image memory therein. This is to deal with the television signal that requires the image memory in reserve conversion as in, for example, the MUSE system. Also, with the provision of the image memory, the display of the still picture is facilitated. Also, there are advantageous in that the image processing and edition such as an image thinning, interpolation, enlargement, reduction or composition are facilitated in cooperation with the image generating circuit 1707 and the CPU 1706.

The multiplexer 1703 is so designed as to appropriately select the display image on the basis of the control signal inputted from the CPU 1706. That is, the multiplexer 1703 selects a desired image signal from the reversely converted image signals inputted from the decoder 1704 to output the selected image signal to the drive circuit 1701. In this case, if the image signal is changed over and selected within a display period of one screen, one screen is divided into a plurality of areas so that different images can be displayed on each area as in a so-called multi-screen television.

The display panel controller 1702 is a circuit for controlling the operation of the drive circuit 1701 on the basis of the control signal inputted from the above CPU 1706.

As the basic operation of the display panel, for example, a signal for controlling the operating sequence of a power supply (not shown) for driving the display panel is outputted to the drive circuit 1701. As the method of driving the display panel, for example, a signal for controlling the screen display frequency or the scanning method (for example, interlace or non-interlace) is outputted to the drive circuit 1701. Also, as occasion demands, a control signal pertaining to the adjustment of an image quality such as the luminance, the contrast, the tone or the sharpness of a display image is outputted to the drive circuit 1701.

The drive circuit 1701 is a circuit for generating a drive signal applied to the display panel 1700 and operates on the basis of an image signal inputted from the multiplexer 1703 and a control signal inputted from the display panel controller 1702.

The above description was given of the functions of the respective parts. With the structure exemplified in FIG. 22, the present image forming apparatus can display the image information inputted from various image information sources on the display panel 1700. That is, after various image signals such as the television broadcast has been reversely converted by the decoder 1704, those image signals are appropriately selected in the multiplexer 1703 and then inputted to the drive circuit 1701. On the other hand, the display controller 1702 generates a controls signal for controlling the operation of the drive circuit 1701 in response to the image signal to be displayed. The drive circuit 1701 applies a drive signal to the display panel 1700 on the basis of the image signal and the control signal. With the above operations, the image is displayed on the display panel 1700. Those sequential operations are controlled by the CPU 1706 in a generalizing manner.

The present image forming apparatus not only displays the image selected from the image memory equipped in the decoder 1704 or selected from the image generating circuit 1707 or the image selected from the information, but also can conduct image processing such as enlargement, reduction, rotation, movement, edge emphasis, thinning, interpolation, color conversion, or the conversion of the longitudinal to lateral ratio of an image, or image edition such as composition, erasion, connection, replacement or insertion with respect o the image information to be displayed. An exclusive circuit for processing or editing the audio information may be provided as in the above image processing or the image edition.

Accordingly, the present image forming apparatus can provide the functions of the display device for the television broadcast, the terminal device for television conference, the image editing device for dealing with the still picture or the moving picture, the terminal device of the computer, a business terminal device such as a word processor, a playing machine or the like together by one device. Therefore, the present image forming apparatus is extremely broad in applied field as industrial or public use.

FIG. 22 merely shows an example of the structure of the image forming apparatus using the display panel with the electron emission elements as the electron beam source, and it is needless to say that the image forming apparatus according to the present invention is not limited to the above structure.

For example, the circuits pertaining to the function unnecessary for the purpose of use may be omitted from the structural elements shown in FIG. 22. Also, conversely, some structural elements may be added for the purpose of use. For example, in the case where the present image display device is applied as a television phone, it is preferable to add a television camera, an audio microphone, a lighting equipment, a transmit/receive circuit including a modem to the structural elements.

In the image forming apparatus according to this example, since it is easy to thin the display panel with the electron emission elements as an electron beam source, the width of the display device can be reduced. In addition, in the display panel with the electron emission elements with the electron beam source, because it is easy to make the screen large, the luminance is high and the visibility angle characteristic is also excellent, the image high in attendance feeling and powerful can be displayed with a high visibility in the image forming apparatus. Also, since the electron source realizing the stable and high-efficiency electron emission characteristic is used, a color flat television long in lifetime, bright and high in grade is realized.

EXAMPLES

Example 1

Figure 15:
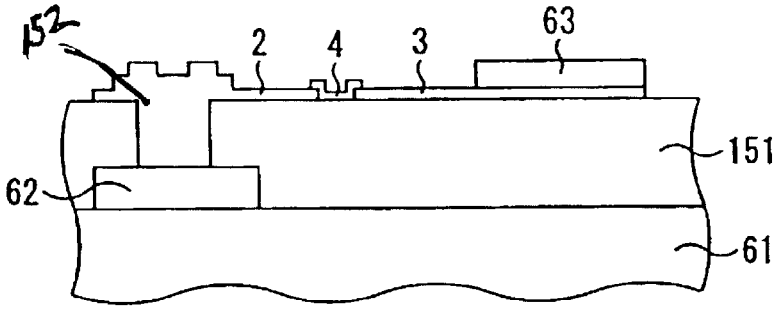
FIG. 15 is a partially cross-sectional view showing an electron source in accordance with an embodiment 1.

In this embodiment, an image forming apparatus having a display panel structured as shown in FIG. 8 is manufactured. FIG. 15 is a partially cross-sectional view showing the electron source. In the figure, reference numeral 61 denotes a substrate; 62 is an X-directional wiring (also called "lower wiring") corresponding to Dxm shown in FIG. 8; 63 is a Y-directional wiring (also called "upper wiring") corresponding to Dyn shown in FIG. 8; 4 is an electrically conductive film including electron emission portions (not shown); 2 and 3 are element electrodes; 151 is an interlayer insulating layer; and 152 is a contact hole.

In the electron source according to this example, 300 electron emission elements are formed on the X-directional wiring, and 100 electron emission elements are formed on the Y-directional wiring.

Subsequently, the manufacturing method will be described in detail in accordance with the process order with reference to FIGS. 16 and 17.

Step-a

Figure 16A:
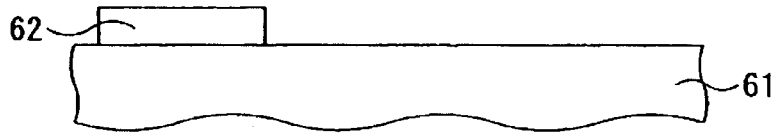
FIGS. 16A to 16D are diagrams showing a process of manufacturing an electron source in accordance with the embodiment 1.

A Cr film 5 nm in thickness and an Au film 600 nm in thickness are sequentially laminated through a vacuum evaporation method on a substrate 61 obtained by forming a silicon oxide film 5 $\mu$m in thickness on a soda lime glass which has been cleaned through a sputtering method. Then, after photoresist ("AZ1370" made by Hext Corp.) is rotationally coated on the upper surface of the layer by a spinner and baked, a photo mask image is exposed and developed to form a resist pattern of the lower wiring 62, and an Au/Cr deposit film is wet-etched to form the lower wiring 62 in a desired shape (FIG. 16A).

Step-b

Figure 16B:
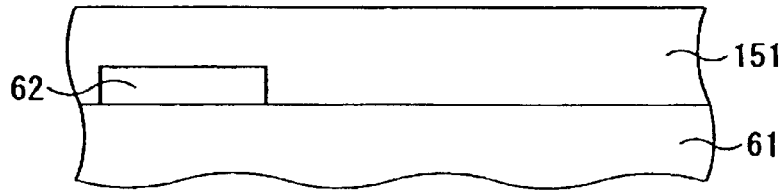

Subsequently, the interlayer insulating layer 151 formed of a silicon oxide film 1.0 $\mu$m in thickness is deposited on the upper surface of the layer through an RF sputtering method (FIG. 16B).

Step-c

Figure 16C:
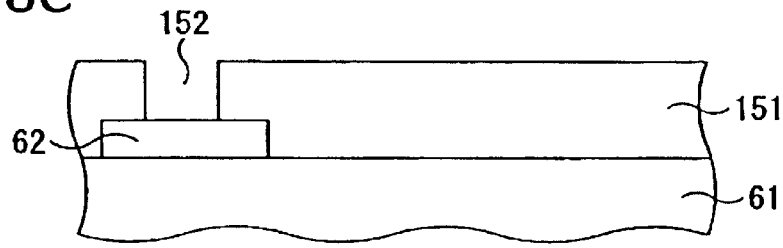

A photoresist pattern for forming a contact hole 152 in the silicon oxide film deposited in the step b is prepared, and the interlayer insulating layer 151 is etched with the photoresist pattern as a mask to form the contact hole 152 (FIG. 16C). The etching is conducted through an RIE (Reactive Ion Etching) method using $CF_4$ and $H_2$ gas.

Step-d

Figure 16D:
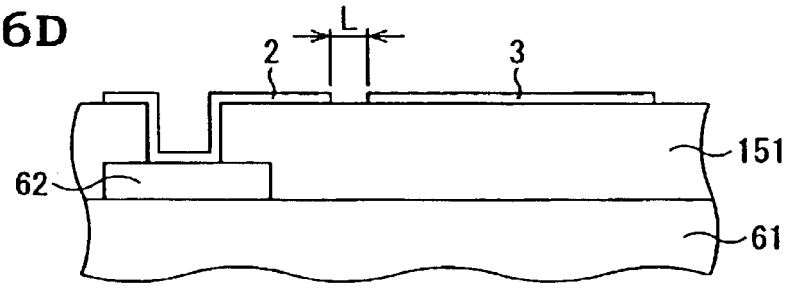

Thereafter, a pattern for producing a gap L between the element electrode 2 and the element electrode 3 is formed in a photoresist ("RD-2000N-41" made by Hitachi Kasei Corp.), and a Ti film 5 nm in thickness and an Ni film 100 nm in thickness are sequentially deposited on the upper surface of the layer through a vacuum evaporation method. The photoresist pattern is melted by an organic solvent, and the Ni/Ti deposit film is lifted off to form the element electrodes 2 and 3 which are 5 $\mu$m in the element electrode interval L and 300 $\mu$m in the width W of the element electrodes (FIG. 16D).

Step-e

Figure 17E:
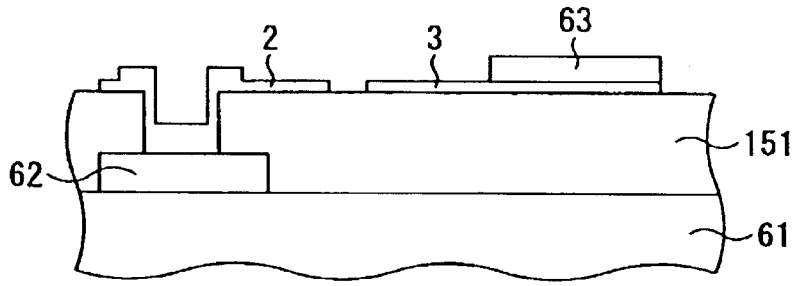
FIGS. 17E to 17G are diagrams showing a process of manufacturing an electron source in accordance with the embodiment 1.

After a photoresist pattern of the upper wiring 63 is formed on the element electrode 3, a Ti film 5 nm in thickness and an Au film 500 nm in thickness are sequentially deposited on the upper surface of the layer through the vacuum evaporation method, and an unnecessary portion is removed by lift-off to form the upper wiring 63 in a desired shape (FIG. 17E).

Step-f

A Cr film 100 nm in thickness is deposited and patterned through the vacuum evaporation, an organic Pd solvent ("ccp 4230" made by Okuno Chemicals Corp.) is rotationally coated on the Cr film by a spinner and then heated and baked at 300° C. for 10 minutes. The thickness of the electrically conductive film 4 made of PdO as the main element thus formed is 10 nm in thickness, and the sheet resistance is $5\times10^{-4}$ Ω/square.

Figure 17F:
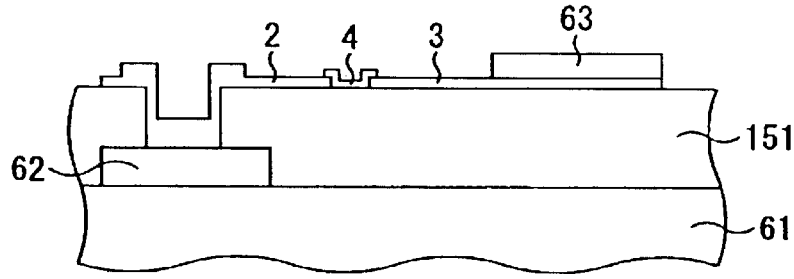

Thereafter, the Cr film and the electrically conductive film 4 which has been baked are etched by an acid etchant into a desired pattern (FIG. 17F).

Step-g

Figure 17G:
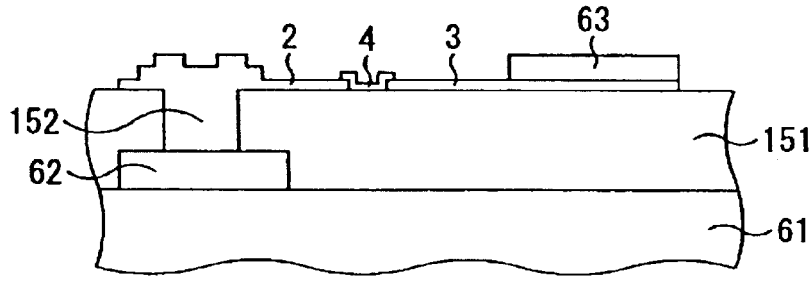

A pattern designed to coat a resist except for the contact hole 152 portion is formed, and then a Ti film 5 nm in thickness and an Au film 500 nm in thickness are sequentially deposited on the upper surface of the layer through the vacuum evaporation method, and an unnecessary portion is removed by lift-off to embed the contact hole 152 therein (FIG. 17G).

Through the above processes, the lower wiring 62, the interlayer insulating film 151, the upper wiring 63 and the element electrodes 2, 3, the electrically conductive film 4, and so on are formed on the substrate 61.

Figure 18:
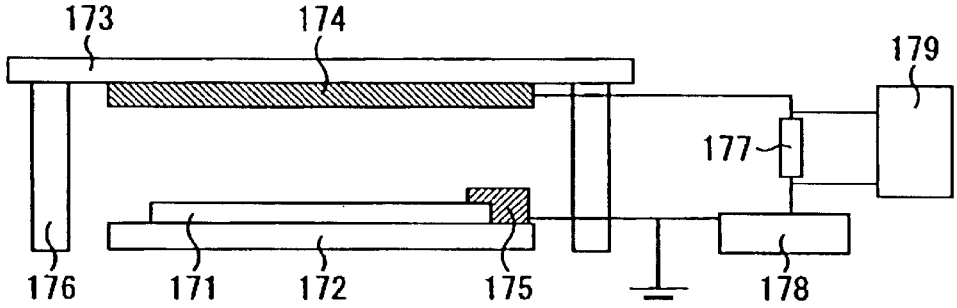
FIG. 18 is a schematic view showing a device used in an electric field applying process of an electron source substrate in accordance with the embodiment 1.

Subsequently, using the electron source manufactured in the above manner, an electric field is applied to the electron source substrate 171 by the electric field applying device structured as shown in FIG. 18.

First, an indium sheet 175 which is 500 $\mu$m in thickness and 5 mm in width are press-fitted on the end portions of the upper and lower wirings with respect to the electron source substrate 171 arranged on the stage substrate 172 made of Al, to thereby make the stage substrate 172 and all the wirings common. In addition, an Al electrode 174 fixed by an insulating support member (soda lime glass) 176 is disposed at a position opposite to the electron source substrate 171. In this example, an opposite distance between the electron source substrate 171 and the electrode 174 is set to 3 mm.

Figure 19:
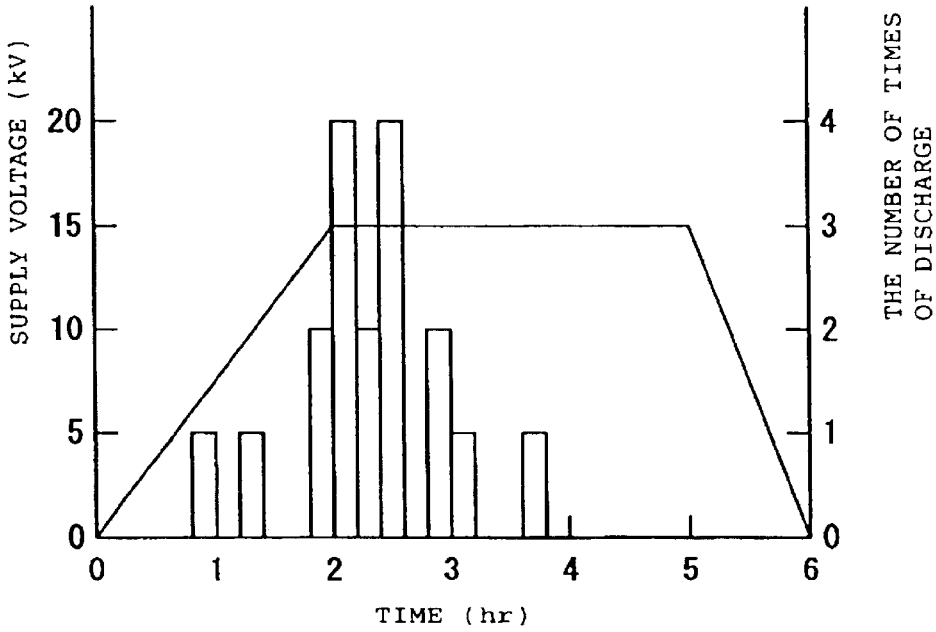
FIG. 19 is a characteristic diagram showing a supply voltage and the number of times of discharge in the electron source in accordance with the embodiment 1.

Subsequently, the indium sheet 175 which makes the wirings of the electron source substrate 171 and the stage substrate 172 common is connected to GND, and the electrode 174 is connected to a high voltage power supply 178 through a resistor 177 of 100 kΩ. Further, a voltage between both ends of the resistor 177 is measured by a voltmeter 179 to measure a current that flow in the resistor 177. Then, as shown in FIG. 19, a voltage is applied between the electron source substrate 171 and the electrode 174 (a polygonal line graph in FIG. 19) and maintained at 15 kV for 4 hours. The number of times of discharge where a current that flows in the resistor 177 at this time is 1 mA or more is shown in FIG. 19. As is apparent from FIG. 19, the discharge operation of 18 times in total is measured (a bar graph in FIG. 19) since the discharge operation starts from 6 kV until the discharge operation is maintained at 5 kV for 2 hours.

Thereafter, the high voltage power supply 178 is turned off, the electron substrate is detached from the device, and the indium sheet is removed from the electron source substrate.

Subsequently, using the electron source substrate to which the electric field is applied in the above manner, the image forming apparatus structured as shown in FIG. 8 is manufactured as follows:

After the substrate 61 on which a large number of plane type surface conduction electron emission elements are prepared is fixed onto the rear plate 81, the face plate 86 (which is structured in such a manner that the fluorescent film 84 and the metal back 85 are formed on an inner surface of the glass substrate 83) is disposed 5 mm above the substrate 61 through the support frame 82. Then, a flit glass is coated on the joint portions of the face plate 86, the support frame 82 and the rear plate 81 and baked in the atmosphere at 410° C. for 10 minutes or longer so that those members are sealingly attached to each other, to thus prepare the envelope 88. Also, the substrate 61 is also fixed onto the rear plate 81 by the flit glass.

As the fluorescent film 84, there is used a color fluorescent film where black stripes are arranged, which is made of the black electrically conductive material 91 and the phosphor 92. The black stripes are formed in advance, and the respective phosphors of the respective colors are coated on the respective gap portions, to thereby prepare the fluorescent film 84. The method of coating the phosphor on the glass substrate is a slurry method. The metal back 85 is disposed on the inner surface of the fluorescent film 84. The metal back 85 is produced by smoothing the inner surface of the fluorescent film 84 (normally called "filming") after the fluorescent film is produced and then vacuum-evaporating Al. In conducting the above-described sealing, because the phosphors of the respective colors should be made to correspond to the electron emission elements in case of color, sufficient positioning is conducted.

The envelope 88 thus completed is connected to the vacuum device from which gas is exhausted by the magnetic floating type turbo molecular pump through an exhaust pipe (not shown).

Thereafter, gas is exhausted from the envelope 88 to $1.3\times10^{-4}$ Pa.

A voltage is applied between the electrodes 2 and 3 of the electron emission element 64 through the vessel external terminals Dx1 to Dxm (m=300) and Dy1 to Dyn (n=100), and the electron emission portions 5 are produced by conducting the electrification processing (forming process) on the electrically conductive film 4.

The electron emission portions 5 thus produced becomes into a state where fine grains that mainly contain paradium elements are dispersed, and the fine grains are 3 nm in average grain diameter.

Subsequently, benzonitrile of $6.6\times10^{-4}$ Pa is introduced into the envelope 88.

The vessel external terminals Dx1 to Dxm (m=300) are made common, and a power supply (not shown) is sequentially connected to Dy1 to Dyn (n=100), and a voltage is applied between the electrodes 2 and 3 of the corresponding electron emission elements 64 to conduct the activating process.

Thereafter, benzonitrile is exhausted from the envelope 8B.

Finally, after baking is conducted at 150° C. for 10 hour under a pressure of about $1.33\times10^{-4}$ Pa as the stabilizing process, the exhaust pipe not shown is heated by a gas burner and welded to seal the envelope 88. In the image forming apparatus thus completed in accordance with the present invention, the respective electron emission elements are connected to GND through the vessel external terminals Dx1 to Dxm (m=300) and the terminals Dy1 to Dyn (n=100), and a high voltage of 8 kV is applied to the metal back 85 through the high voltage terminal 87.

As a result of applying a voltage of 8 kV to measure a static voltage withstand for 6 hours, a sudden discharge phenomenon has not been observed.

In the present specification, the sudden discharge phenomenon is defined as the number of times where a current that flows in a high voltage terminal exceeds 5 mA. As a result of measuring the individual characteristics (Ie) of the respective electron emission elements, the variation was maintained to 8%.

In the present specification, the variation is set to a value obtained by dividing the dispersion value by the average value of Ie values of the respective elements.

Comparative Example 1

An image forming apparatus is manufactured in the same manner as that of the example 1 except that the electric field applying process using the device of FIG. 18 is not conducted. As a result of measuring the static withstand voltage as in the same manner as that of the example 1 for 6 hours, the sudden discharge phenomenons of 8 times were observed. The electron source was damaged by the discharge phenomenon.

Also, as a result of measuring the individual characteristics (Ie) of the respective electron emission elements after and before the image display, the variation is changed from 8% to 17%.

Example 2

Figure 20:
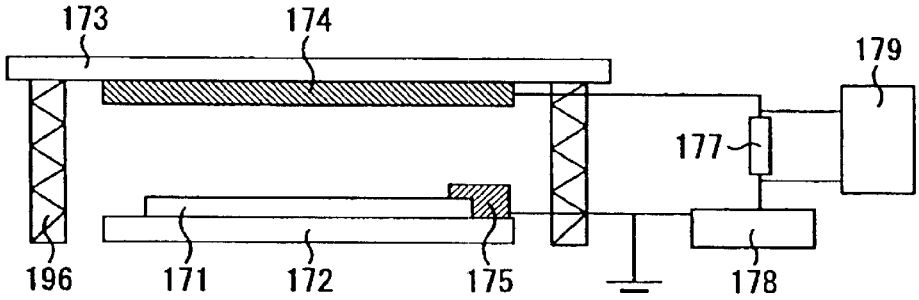
FIG. 20 is a schematic view showing a device used in an electric field applying process of an electron source substrate in accordance with an embodiment 2.

An image forming apparatus is manufactured in the same manner as that of the example 1 except that the electric field applying process is conducted by the device of FIG. 20. In the device of FIG. 20, the same parts as those in FIG. 18 are denoted by identical references. In the figure, reference numeral 196 denotes a support member that fixes a soda lime glass having an electrode which is equipped with a variable mechanism so as to change a distance between the electrode 174 and the electron source substrate 171.

Figure 21:
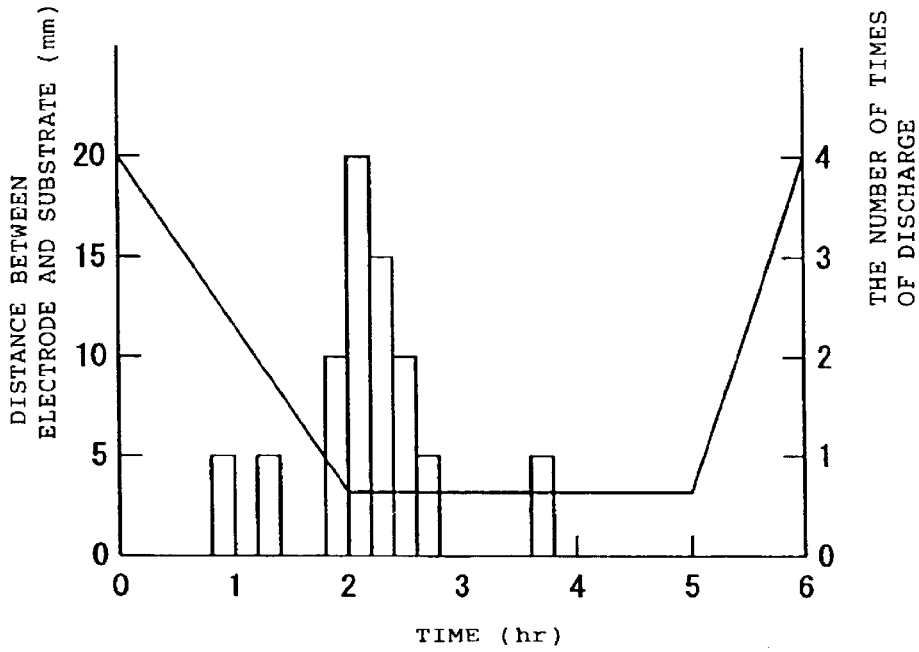
FIG. 21 is a characteristic view showing a supply voltage and the number of times of discharge in the electron source in accordance with the embodiment 2.

As shown in FIG. 21, a voltage applied from a high voltage is constantly maintained to 15 kV, a distance between the electrode and the electron source substrate (a polygonal line graph in FIG. 21) is changed from 20 mm to 3 mm and maintained for 3 hours.

In the electric field applying process using the device shown in FIG. 20, the discharge phenomenon (a bar graph in FIG. 21) where a current of 1 mA or more flows between the electron source substrates was observed 15 times.

As a result of measuring the static withstand voltage as in the same manner as that of the example 1 in the image forming apparatus thus obtained for 6 hours, the sudden discharge phenomenon was not observed. Accordingly the damage of the electron source by the discharge operation was not observed.

Also, as a result-of measuring the individual characteristics (Ie) of the respective electron emission elements after and before the image display, the variation was maintained to 8%.

Second Embodiment

The basic structure of the surface conduction type electron emission elements to which the present invention is applicable is roughly specified into a plane type and a vertical type.

First, the plane type surface conduction type electron emission element will be described.

Figure 23:
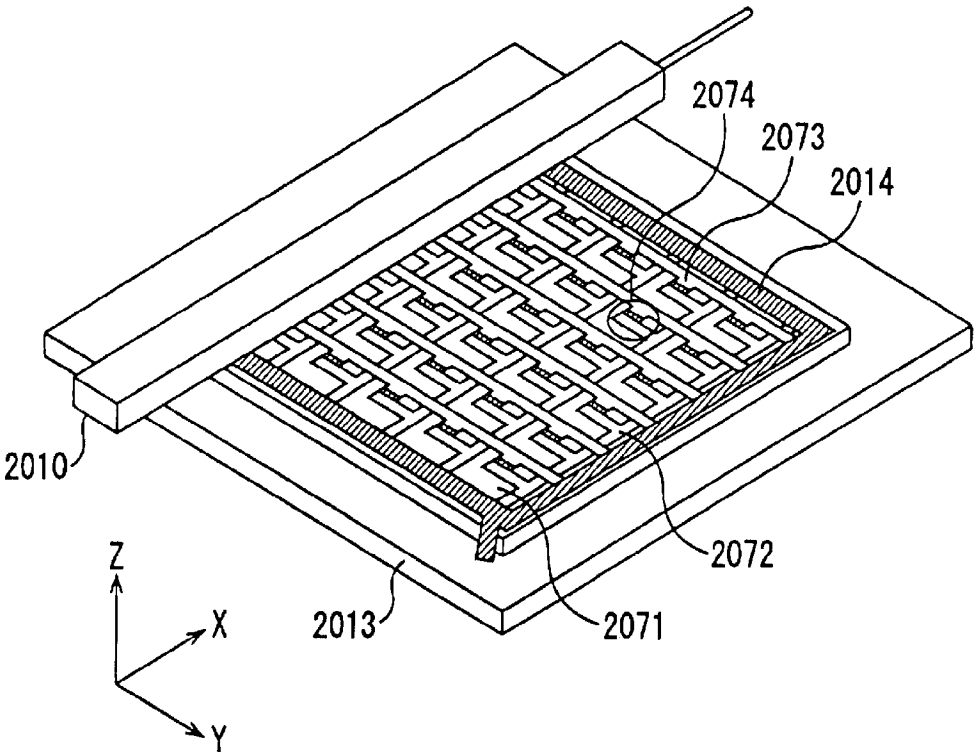
FIG. 23 is a schematic view showing a conditioning process of an electron source substrate to which the present invention is applicable.

FIG. 23 is a schematic view showing the structure of the plane type surface conduction type electron emission elements to which the present invention is applicable, in which FIG. 23A is a plan view and FIG. 23B is a cross-sectional view.

In FIG. 23, reference numeral 2001 denotes a substrate; 2002 and 2003 are element electrodes; 2004 is an electrically conductive thin film, and 2005 is an electron emission portion.

The substrate 2001 may be made of quartz glass, glass having impurity content such as Na reduced, soda lime glass, a glass substrate resulting from laminating $SiO_2$ formed on a soda lime glass through a sputtering method or the like, ceramics such as alumina, an Si substrate, or the like.

The material of the opposite element electrodes 2002 and 2003 may be a general conductive material. For example, the material of the element electrodes 2002 and 2003 may be appropriately selected from metal such as Ni, Cr, Au, Mo, W, Pt, Ti, Al, Cu or Pd, or alloy of those metal, metal such as Pd, Ag, Au, $RuO_2$, Pd—Ag, metal oxide of those material, a printing conductor made of glass or the like, transparent conductor such as $In_2O_3$—$SnO_2$, and semiconductor material such as polysilicon.

An interval L between the element electrodes, a length W of the element electrodes, the configuration of the electrically conductive film 2004, etc., are designed taking the applied form, etc., into consideration. The interval L between the element electrodes is preferably set to a range of from several hundreds of nm to several hundreds of $\mu$m, and more preferably set to a range of from several $\mu$m to several tens of $\mu$m.

The length W of the element electrode can be preferably set to a range of several $\mu$m to several hundreds of $\mu$m taking the resistance of the electrode and the electron emission characteristic into consideration, and the film thickness d of the element electrodes 2002 and 2003 can be preferably set to a range of several tens of nm to several $\mu$m.

The electron emission element according to the present invention is not limited to the structure shown in FIG. 23, but also applicable to a structure in which the electrically conductive film 2004 and the opposite element electrodes 2002 and 2003 are stacked on the substrate 2001 in the stated order.

It is preferable that the fine grain film formed of fine grains is used as the electrically conductive thin film 2004 in order to obtain the excellent electron emission characteristic. The thickness of the electrically conductive film 2004 is appropriately set taking a step coverage on the element electrodes 2002 and 2003, the resistance between the element electrodes 2002 and 2003, the forming conditions which will be described later, etc., into consideration, and normally preferably set to a range of several times of 0.1 nm to several hundreds of nm, and more preferably set to a range of 1 nm to 50 nm. The resistance Rs is a value of $10^2$ to $10^7$ Ω/square. Rs is the amount obtained when the resistor R of the thin film which is t in thickness, w in width and 1 in length satisfies R=Rs(1/w). In the present specification, the forming process will be described with reference to an example of the electrifying process, but the forming process is not limited to this and includes a process of forming a high resistant state by producing a crack in the film.

The material of the electrically conductive film 2004 may be appropriately selected from metal such as Pd, Pt, Ru, Ag, Au, Ti, In, Cu, Fe, Zn, Sn, Ta, W or Pd, oxide such as PdO, $SnO_2$, $In_2O_3$, PbO or $Sb_2O_3$, boride such as $HfB_2$, $ZrB_2$, $LaB_6$, $CeB_6$, YB, or $GdB_4$, carbide such as TiC, ZrC, HfC, TaC, SiC or WC, nitride such as TiN, ZrN or HfN, semiconductor such as Si or Ge, carbon and the like.

The fine grain film described in the present specification is a film in which a plurality of fine grains are assembled together, and the fine structure takes a state in which the fine grains are dispersed, individually, or a state in which the fine grains are adjacent to each other overlapped with each other (including a cases in which several fine grains are assembled and formed into an island structure as a while). The grain diameter of the fine grains is set to a range of several times of 0.1 nm to several hundreds of nm, preferably from 1 nm to 20 nm.

In the present specification, since the term "fine grains" is frequently used, its meaning will be described.

The small grain is called "fine grain" and smaller grain than "fine grain" is called "ultra fine grain". The grains further smaller than "ultra fine grains" and about several hundreds or less in the number of atoms is generally called "cluster".

However, the boundaries of the respective grains are not strict but change depending on how the grains being classified in accordance with the noticeable property. Also, there is a case in which "fine grain" and "ultra fine grain" are called "fine grains" together, along which the description in the present specification is made.

The literally "Experimental Physics Lecture No. 14, Surface and Fine Grain" (edited by Tadao Kinoshita and issued by Kyoritsu Publication in Sep. 1, 1986) discloses the following matter.

"In this disclosure, "fine grain" is about 2–3 $\mu$m to about 10 nm in diameter, and particularly "ultra fine grain" is about 10 nm to 2–3 nm in grain diameter. Both of the fine grain and the ultra fine grain may be written merely as fine grain together, and the boundary of those grains is not strict and a substantial criterion. The grain in which the number of atoms that constitute the grains is about 2 to several tens to several hundreds is called "cluster""(p. 195, lines 22 to 26).

In addition, the definition of "ultra fine grains" in "Hayashi/Ultra Fine Grain Project" by Shin Gijutsu Kaihatsu Jigyo Group" discloses the further smaller lower limit of the grain diameter as follows:

"In "ultra fin particle project" in Sozo Kagaku Gijutsu Suishin Seido (1981 to 1986), the grain which is in a range of about 1 to 100 nm in the size (diameter) of the grain is called "ultra fine particle". As a result, one ultra fine particle is the assembly of atoms about 100 to $10^8$. The ultra fine particles are large or giant particles as compared with the size of atoms." (Ultra Fine Particle, Sozo Kagaku Gijutsu" written by Tatsuetsu Hayashi, Ryoji Ueda, Akira Tasaki; page 2, lines 1 to 4 of Mita Publication 1988), "The particle smaller than the ultra fine particle, that is, one particle made up of several to several hundred atoms is normally called "cluster"" (page 2, lines 12 to 13 in that publication).

Taking the above-described normal definitions into consideration, in the present specification, "fine grain" is directed to the assembly of a large number of atoms and molecules in which the lower limit of the grain diameter is about several times of 0.1 nm to 1 nm, and the upper limit is about several $\mu$m.

The electron emission portion 2005 is made up of a high-resistant crack formed in parts of the electrically conductive film 2004, and depends on the thickness, the quality and the material of the electrically conductive film 2004, and a method such as the electrification forming which will be described later. There is a case in which electrically conductive fine grains which are several times of 0.1 nm to several tens of nm in grain diameter exist in the interior of the electron emission portion 2005. The electrically conductive fine grains contain parts or all of elements of the material that constitutes the electrically conductive film 2004. The electron emission portions 2005 and the electrically conductive film 2004 in the vicinity of the electron emission portions 2005 may include carbon or carbon compound.

Subsequently, a description will be given of a vertical type surface conduction type electron emission element.

Figure 34:
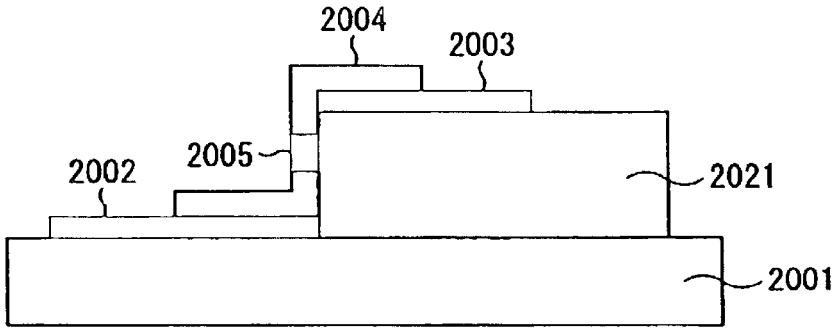
FIG. 34 is a schematic view showing the structure of a vertical type surface conduction type electron emission element to which the present invention is applicable.

FIG. 34 is a schematic view showing an example of a vertical type surface conduction type electron emission element to which the surface conduction type electron emission element of the present invention is applicable.

Figure 33A:
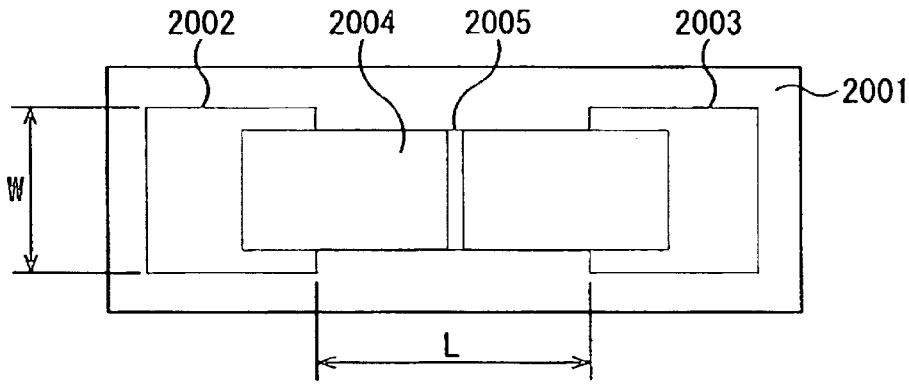
FIGS. 33A and 33B are a schematic plan view and a cross-sectional view showing the structure of a surface conduction type electron emission element to which the present invention is applicable.
Figure 33B:
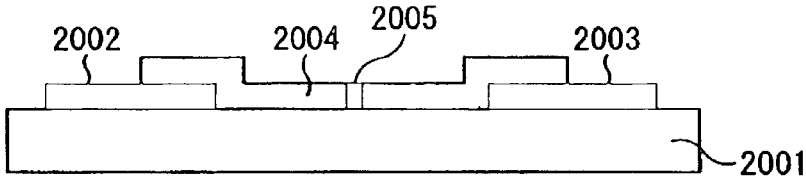

Referring to FIG. 34, the same parts as those shown in FIG. 33 are designated by identical references with those in FIG. 33. Reference numeral 2021 denotes a step forming portion. The substrate 2001, the element electrodes 2002, 2003, the electrically conductive thin film 2004 and the electron emission portion 2005 may be made of the same materials as those in the above-described plane type surface conduction type electron emission element. The step forming portion 2021 may be made of an insulating material such as $SiO_2$ formed through the vacuum evaporation method, the printing method, the sputtering method or the like. The thickness of the step forming portion 2021 may be set to a range of several hundreds nm to several tens of $\mu$m which corresponds to the element electrode interval L of the plane type surface conduction type electron emission element as described above. The thickness is set taking a method of forming the step forming portion and a voltage applied between the element electrodes into consideration, and preferably set to a range of several tens of nm to several $\mu$m.

The electrically conductive thin film 4 is laminated on the element electrodes 2002 and 2003 after the element electrodes 2002 and 2003 and the step forming portion 2021 have been prepared. The electron emission portion 2005 is formed in the step forming portion 2025 in FIG. 34. However, the electrically conductive thin film 4 depends on the manufacturing condition, the forming condition, etc., and the configuration and the position of the electrically conductive thin film 4 are not limited to this.

There are various methods of manufacturing the above-described surface conduction type electron emission element, and one example of the methods will be schematically shown in FIG. 35.

Hereinafter, an example of the manufacturing method will be described with reference to FIGS. 33 and 35. In FIG. 35, the same parts as those shown in FIG. 33 are designated by identical references with those in FIG. 33.

Figure 35A:
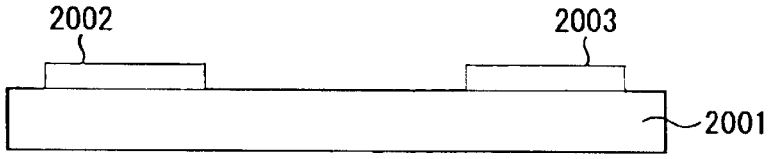
FIGS. 35A to 35C are schematic views showing an example of a method of manufacturing a surface conduction type electron emission element to which the present invention is applicable.

1) After the substrate 2001 has been sufficiently cleaned by using a detergent, pure water, organic solvent, etc., and the material of the element electrodes are deposited on the substrate 2001 through the vacuum evaporation method, the sputtering method or the like, the element electrodes 2002 and 2003 are formed on the substrate 2001, for example, by using the photolithography (FIG. 35A).

Figure 35B:
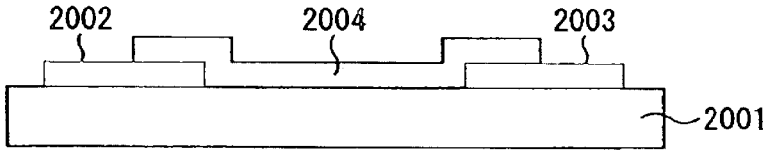

2) An organic metal solution is coated on the substrate 2001 on which the element electrodes 2002 and 2003 are disposed, to thereby form an organic metal thin film. As the organic metal solution, there may be used a solution of the organic metal compound which mainly contains metal of the material of the above-mentioned electrically conductive film 2004. The organic metal thin film is baked by heating and then patterned by lift-off, etching or the like, to thereby form the electrically conductive film 2004 (FIG. 35B). In this example, a description was given of the method of coating the organic metal solution. However, the method of forming the electrically conductive film 2004 is not limited to the above method, but there may be employed a vacuum evaporation method, a sputtering method, a chemical gas phase depositing method, a dispersively coating method, a dipping method, a spinner method, or the like.

Figure 35C:
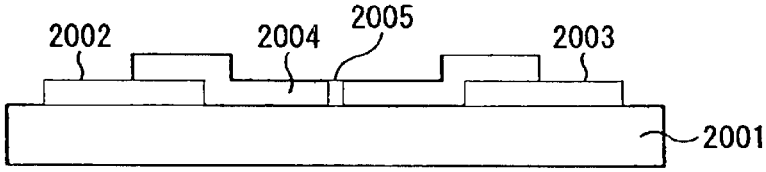

3) Subsequently, a forming process is conducted. An example of a method of conducting the forming process will be described with reference to a method using an electrifying process. When electricity is supplied between the element electrodes 2002 and 2003 by using a power supply not shown, an electron emission portion 2005 with a changed structure is formed on a portion of the electrically conductive film 2004 (FIG. 35C). The portion with the changed structure which is locally destroyed, deformed or affected is formed in the electrically conductive film 2004 through the electrification forming process. That portion constitutes the electron emission portion 2005. An example of the voltage waveform of the electrification forming is shown in FIG. 36.

Figure 26:
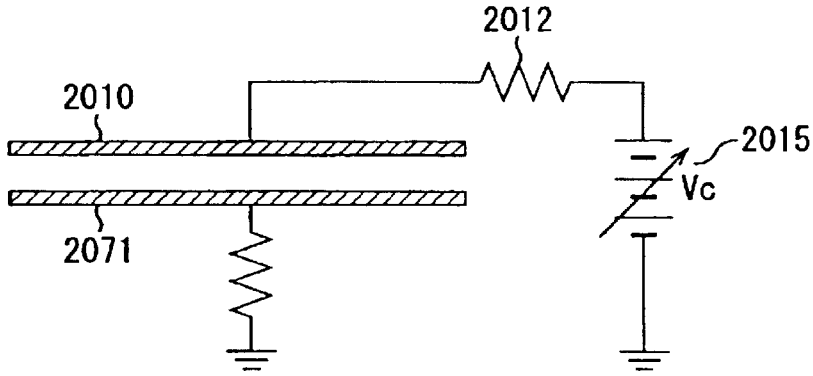
FIG. 26 is a schematic view showing an equivalent circuit in the conditioning process.

It is preferable that the voltage waveform is a pulse waveform. In case of the pulse waveform, there are a manner of continuously applying pulses with the pulse peak value as a constant voltage as shown in FIG. 26A and a manner of applying a voltage pulse while the pulse peak value is being increased as shown in FIG. 36B.

Figure 36A:
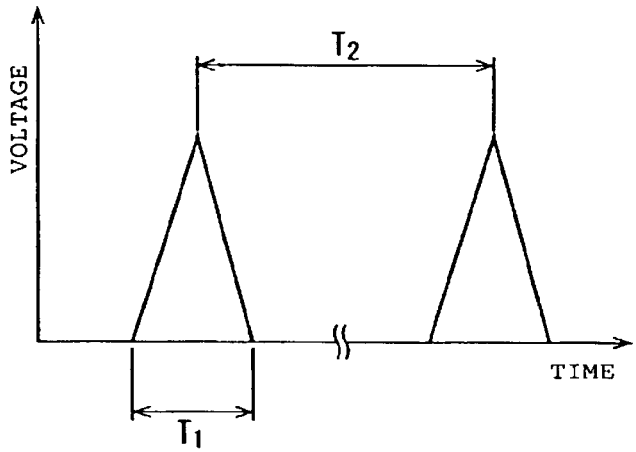
FIGS. 36A and 36B are schematic views showing an example of a voltage waveform in an electrification forming process applicable in the manufacture of a surface conduction type electron emission element to which the present invention is applicable.

In FIG. 36A, T1 and T2 are the pulse width and the pulse interval of the voltage waveform. As usual, T1 is set to a range of 1 $\mu$sec to 10 msec, and T2 is set to a range of 10 $\mu$sec to 10 msec. The peak value (a peak voltage during the electrification forming process) of a chopping wave is appropriately selected in accordance with the form of the surface conduction type electron emission element. Under the above condition, a voltage is applied, for example, for several seconds to several tens of minutes. The pulse waveform is not limited to the chopping wave but a desired waveform such as a rectangular wave can be applied.

Figure 36B:
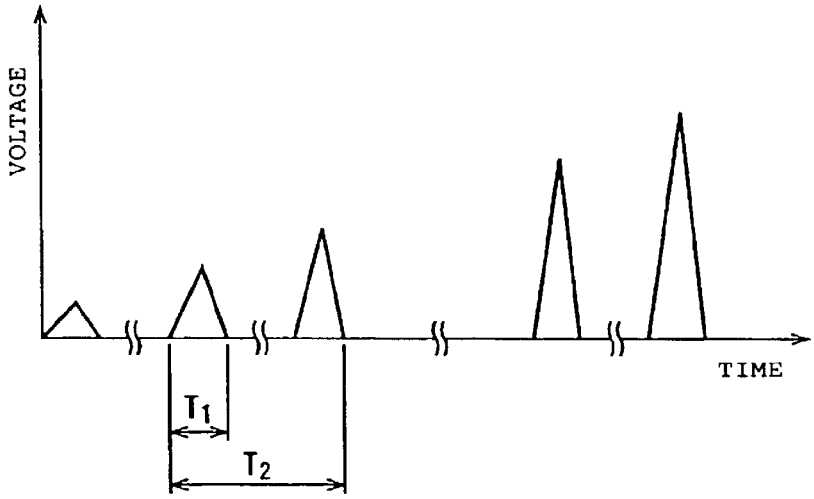

In FIG. 36B, T1 and T2 are identical with T1 and T2 shown in FIG. 36A. The peak value (the peak voltage during the electrification forming process) of the chopping wave is increased, for example, about 0.1 V step by 0.1 V step.

The completion of the electrification forming process can be detected by applying a voltage to the degree that the electrically conductive thin film 2004 is not locally destroyed or deformed during a pulse interval T2 and measuring a current. An element current that flows due to application of a voltage of, for example, about 0.1 V is measured, a resistance is found, and when the detected resistance is 1 MΩ or more, the electrification forming process is completed.

4) It is preferable that the element on which the forming process has been conducted is subjected to a process called "activating process". The activating process is a process for remarkably changing the element current If and the emission current Ie.

The activating process can repeat the application of a pulse under an atmosphere containing an organic material as in the electrification forming process. The atmosphere can be produced by using the organic gas remaining in the atmosphere in the case where gas is exhausted from the vacuum vessel by using, for example, an oil dispersion pump, a rotary pump or the like, or the atmosphere is obtained by introducing an appropriate organic material gas into vacuum where gas is sufficiently exhausted by an ion pump or the like once. In this situation, a preferable gas pressure of the organic material is appropriately set according to circumstances because it depends on the form of the above-mentioned application, the shape of the vacuum vessel, a sort of the organic material, etc. An appropriate organic material may be aliphatic hydrocarbons such as alkane, alkene or alkyne, aroma hydrocarbons, alcohols, aldehydes, ketones, amines, or organic acids such as phenol, carboxylic acid or sulfonic acid. Specifically, there can be applied saturated hydrocarbon represented by $C_nH_{2n+2}$ such as methane, ethane or propane, unsaturated hydrocarbon represented by a composition formula of $C_nH_{2n}$ or the like such as ethylene, propylene, benzene, toluene, methanol, ethanol, formaldehyde, acetaldehyde, acetone, methyl ethyl ketone, methylamine, ethylamine, phenol, formic acid, acetic acid, propionic acid, etc., or the mixture of those materials.

Through the above process, carbon or carbon compound is deposited on the element from the organic material that exists in the atmosphere, to thereby remarkably change the element current If and the emission current Ie.

The judgement of the completion of the activating process can be appropriately conducted while the element current If and the emission current Ie are measured. The pulse width, the pulse interval, the pulse peak value and so on are appropriately set.

Carbon or carbon compound is, for example, graphite (so-called HOPG', PG and GC where HOPG is directed to the substantially complete crystal structure of graphite, PG is directed to the slightly disordered crystal structure about 20 nm in crystal grain and GC is directed to the more largely disordered crystal structure about 2 nm in crystal grain), or amorphous carbon (directed to amorphous carbon, and the mixture of amorphous carbon and microcrystal of the graphite), and its thickness is preferably set to a range of 50 nm or less, more preferably 30 nm or less.

5) It is preferable that the electron emission element obtained through the above processes is subjected to a stabilizing process. This process is a process of exhausting the organic material from the vacuum vessel. It is preferable that a vacuum exhausting device that exhausts the organic material from the vacuum vessel is a device using no oil so that the characteristics of the respective electron emission elements are not adversely affected by the oil generated from the device. Specifically, there can be applied a vacuum exhausting device such as a sorption pump or an ion pump.

In case of using the oil dispersion pump or the rotary pump as the exhausting device, and using the organic gas derived from the oil components generated from those pumps in the above activating process, it is necessary to suppress the divided pressure of that component as large as possible. The divided pressure of the organic compounds within the vacuum vessel is preferably set to a divided pressure under which carbon or carbon compound is not substantially newly deposited, that is, $1.3\times10^{-6}$ Pa or less, and particularly preferably set to $1.3\times10^{-8}$ Pa or less. It is preferable that when the organic material is further exhausted from the vacuum vessel, the entire vacuum vessel is heated so that the molecules of the organic material adsorbed by the inner wall of the vacuum vessel or the respective electron emission elements are liable to be exhausted. In this situation, the heating condition is set to 80 to 250° C., and preferably set to 150° C. or higher and it is desirable that a heat treatment is conducted for a period of time as long as possible. However, the present invention is not particularly limited to the above conditions, but the above process is conducted under the conditions appropriately selected according to various conditions such as the size and the shape of the vacuum vessel or the structure of the electron emission element. It is necessary to reduce the pressure within the vacuum vessel as much as possible, preferably to $1\times10^{-5}$ Pa or less, and more preferably to $1.3\times10^{-6}$ Pa or less.

It is preferable that the atmosphere at the driving time after the stabilizing process has been conducted is kept to the atmosphere after the above stabilizing process has been completed, but the atmosphere is not limited to this, that is, the sufficient stable characteristic can be maintained even if the degree of vacuum per se is lowered somewhat if the organic material is sufficiently removed.

With the application of such vacuum atmosphere, the additional deposition of carbon or carbon compound can be suppressed and also $H_2O$, $O_2$ or the like adsorbed on the vacuum vessel, the substrate, etc., can be removed, as a result of which the element current If and the emission current Ie are stabilized.

The basic characteristic of the electron emission element used in the present invention which has been obtained through the above-described process will be described with reference to FIGS. 37 and 38.

Figure 37:
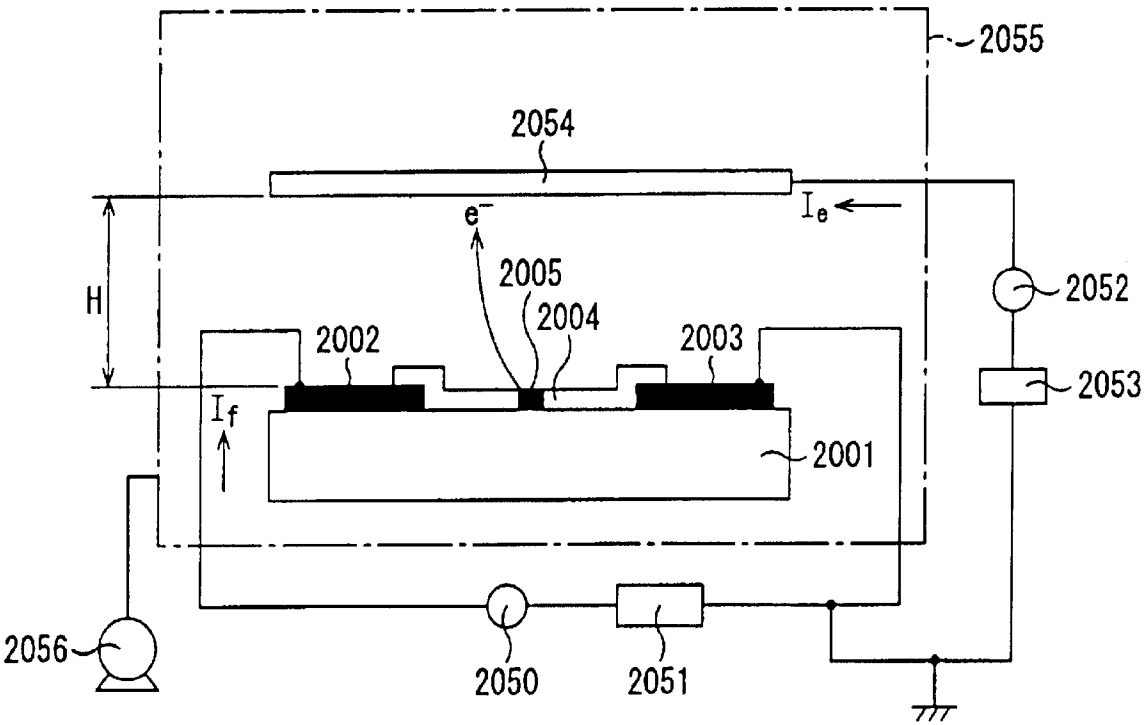
FIG. 37 is a schematic view showing an example of a vacuum processing device having a measurement evaluating function.

FIG. 37 is a schematic diagram showing an example of a vacuum processing device, and the vacuum processing device functions also as a measurement evaluating device. In FIG. 37, the parts as those shown in FIG. 33 are designated by identical references as those in FIG. 33. Referring to FIG. 37, reference numeral 2055 denotes a vacuum vessel, and 2056 is an exhaust pump. The electron emission elements are disposed within the vacuum vessel 2055. That is, reference numeral 2001 denotes a substrate which constitutes the electron emission elements, 2002 and 2003 are element electrodes, 2004 is an electrically conductive thin film and 2005 is an electron emission portion. Reference numeral 2051 denotes a power supply for applying an element voltage Vf to the electron emission elements, 2050 is an ammeter for measuring an element current If that flows in the electrically conductive thin film 2004 between the element electrodes 2002 and 2003, and 2054 is an anode electrode for catching the emission current Ie emitted from the electron emission portions of the element. Reference numeral 2053 is a high voltage source for applying a voltage to the anode electrode 2054, and 2052 is an ammeter for measuring the emission current Ie emitted from the electron emission portions 2005 of the element. As an example, the measurement can be conducted under the conditions where a voltage across the anode electrode is in a range of from 1 kV to 10 kV, and a distance H between the anode electrode and the electron emission element is in a range of from 2 mm to 8 mm.

A device such as a vacuum gage not shown necessary for measurement under the vacuum atmosphere is located within the vacuum vessel 2055, and the measurement evaluation is conducted under a desired vacuum atmosphere. The exhaust pump 2056 is made up of a normal high vacuum device system made up of a turbo pump, a rotary pump or the like, and a super high vacuum device system made up of an ion pump or the like. The entire vacuum processing device where the electron source substrate is disposed in this example can be heated up to 250° C. by a heater not shown. Therefore, the processes subsequent to the above-described electrification forming process can be conducted by using the vacuum processing device.

Figure 38:
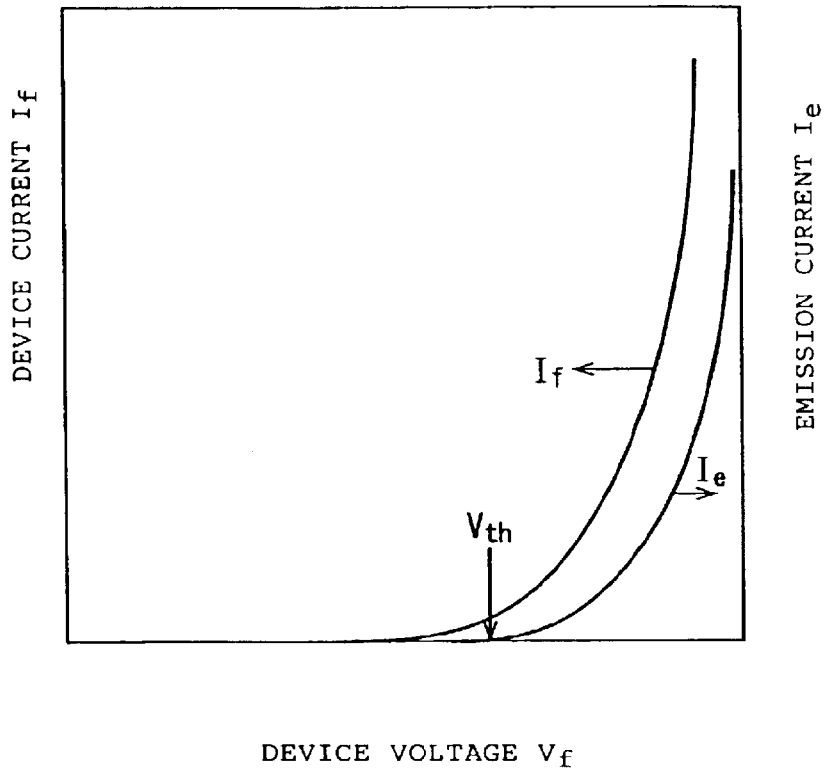
FIG. 38 is a graph showing a relationship of an emission current Ie, an element current If and an element voltage Vf in a surface conduction type electron emission element to which the present invention is applicable.

FIG. 38 is a diagram schematically showing a relationship of the emission current Ie, the element current If and the element voltage Vf which are measured by using the vacuum processing device shown in FIG. 37. In FIG. 38, since the emission current Ie is remarkably small as compared with the element current If, it is represented by an arbitrary unit. The axes of ordinate and abscissa are linear scales.

As is apparent from FIG. 38, the surface conduction type electron emission element used in the present invention has the following three characteristic properties of the emission current Ie.

(i) When an element voltage which is equal to or more than a certain voltage (called "threshold voltage" Vth in FIG. 38) is applied to the electron emission element, the emission current Ie rapidly increases whereas when the element voltage as applied is less than the threshold voltage Vth, the emission current Ie is hardly detected. That is, the electron emission element is a non-linear element with a definite threshold voltage Vth with respect to the emission current Ie.

(ii) Because the emission current Ie depends on the element voltage Vf in a monotonic increase manner, the emission current Ie can be controlled by the element voltage Vf.

(iii) The emission charges caught by the anode electrode 2054 depends on a period of time during which the element voltage Vf is applied to the electron emission element. That is, the emission charges caught by the anode electrode 2054 can be controlled by the period of time during which the element voltage Vf is applied to the electron emission element.

As is understood from the above description, the surface conduction type electron emission element to which the present invention is applicable can readily control the electron emission characteristic in response to an input signal. By utilizing this property, the electron emission elements used in the present invention can be applied to multiple fields such as the electron source structured so as to arrange a plurality of electron emission elements, an image forming apparatus and so on.

In FIG. 38, there is shown by a solid line, an example in which the element current If monotonically increases with respect to the element voltage Vf (hereinafter referred to as "MI characteristic"). There is a case in which the element current If exhibits a voltage control type negative resistant characteristic (hereinafter referred to as "VCNR characteristic") with respect to the element voltage Vf (not shown). Those characteristics can be controlled by controlling the above-described process.

The electron source according to the present invention is designed in such a manner that a plurality of electron emission elements are arranged on the substrate, and the image forming apparatus according to the present invention is structured by the combination of the electron source with the image forming member which can form an image by irradiation of the electron beam from the electron source.

The applied examples of the electron emission element to which the present invention is applicable will be described below.

A plurality of the surface conduction type electron sources to which the present invention is applicable are disposed on the substrate, thereby being capable of structuring, for example, an electron source or an image forming apparatus. Various arrangements of the electron emission elements can be applied.

As one example, there is a ladder-like arrangement in which a large number of electron emission elements arranged in parallel are connected to each other at both ends thereof so that a large number of electron emission element rows are disposed (called "row direction"), and the electrons from the electron emission elements are driven under control by a control electrode (also called "grid") disposed above the electron emission elements along a direction orthogonal to the above wirings (called "column direction"). As another example, there is an arrangement in which a plurality of electron emission elements are arranged in a matrix in an X-direction and a Y-direction, and ones of electrodes of the plural electron emission elements disposed in the same row are commonly connected to the wirings in the X-direction, and others of the electrodes of the plural electron emission elements disposed in the same column are commonly connected to the wirings in the Y-direction, which is a so-called simple matrix arrangement. First, the simple matrix arrangement will be described in detail below.

The surface conduction type electron emission element to which the present invention is applicable has the characteristics of (i) to (iii) as described above. That is, the emission elements from the surface conduction type electron emission elements can be controlled by the peak value and the width of a pulse-like voltage applied between the opposite element electrodes when the element voltage is equal to or more than the threshold voltage. On the other hand, when the element voltage is less than the threshold voltage, the emission elements are hardly emitted. According to that characteristic, even in the case where a large number of electron emission elements are arranged, if pulse voltages are appropriately applied to the respective elements, the surface conduction type electron emission elements are selected in response to an input signal so as to control the amount of emitted electrons.

Figure 39:
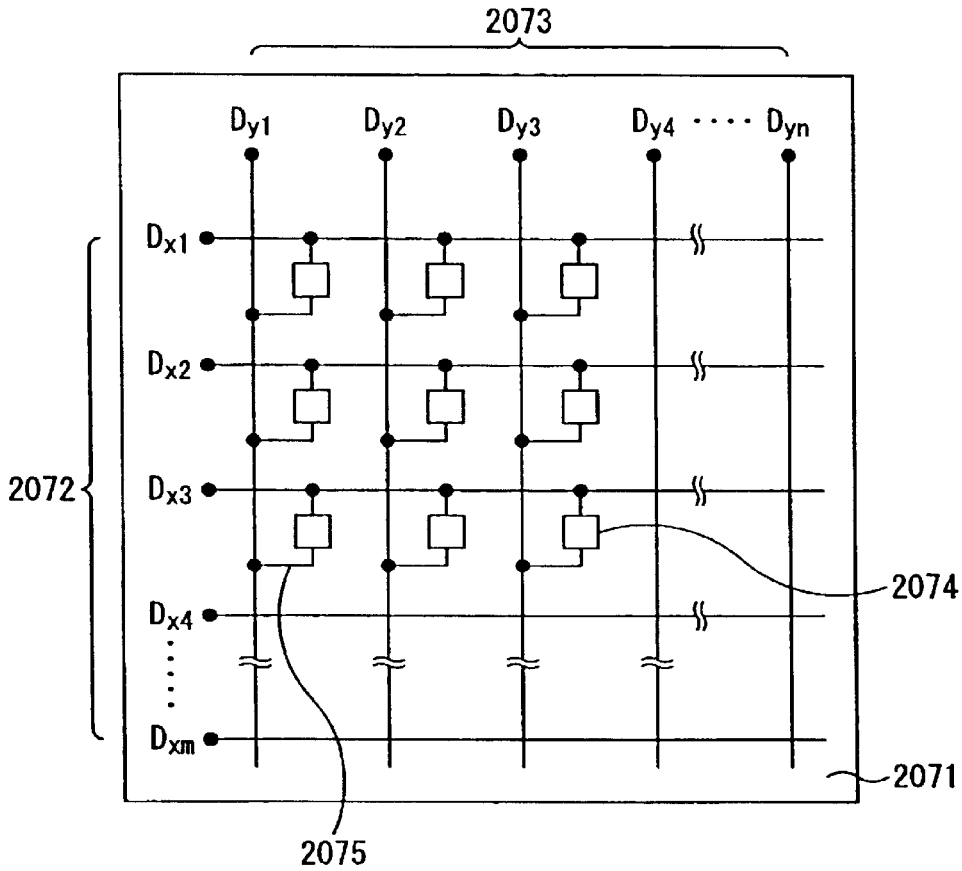
FIG. 39 is a schematic view showing an example of an electron source arranged in a simple matrix to which the present invention is applicable.

Hereinafter, a description will be given of the electron source substrate obtained by disposing a plurality of electron emission elements to which the present invention is applicable on the basis of the above principle with reference to FIG. 39. Referring to FIG. 39, reference numeral 2071 denotes an electron source substrate, 2072 is X-directional wirings, and 2073 is Y-directional wirings. Reference numeral 2074 denotes a surface conduction type electron emission element, and 2075 is connections. The surface conduction type electron emission element 2074 may be any one of the above-described plane type or the vertical type.

The m X-directional wirings 2072 are comprised of Dx1, Dx2, . . . , Dxm, and can be made of an electrically conductive metal, etc., formed through a vacuum evaporation method, a printing method, a sputtering method or the like. The material, the thickness and the width of the wirings are appropriately designed. The Y-directional wirings 2073 are comprised of n wirings of Dy1, Dy2, . . . , Dyn, and are formed in the same manner as the X-directional wirings 2072.

An interlayer insulating layer not shown is disposed between the m X-directional wirings 2072 and the n Y-directional wirings 2073 so that those wirings 2072 and 2073 are electrically isolated from each other (both of m and n are positive integers).

The interlayer insulating layer not shown is made of $SiO_2$ formed through a vacuum evaporation method, a printing method, a sputtering method or the like. For example, the interlayer insulating layer is formed H in a desired configuration on an entire surface or a partial surface of the substrate 2071 on which the X-directional wirings 2072 are formed, and in particular, the thickness, the material and the manufacturing method of the interlayer insulating layer are appropriately set so as to withstand the potential difference of the cross portions of the X-directional wirings 2072 and the Y-directional wirings 2073. The X-directional wirings 2072 and the Y-directional wirings 2073 are drawn as external terminals, respectively.

The respective pairs of electrodes (not shown) which constitute the surface conduction type electron emission elements 2074 are electrically connected by the m X-directional wirings 2072, the n Y-directional wirings 2073 and the connections 2075 made of the electrically conductive metal or the like.

The material of the wirings 2072 and the wirings 2073, the material of the connections 2075 and the material of the pairs of element electrodes may be partially or entirely identical with each other or different from each other. Those materials are appropriately selected from, for example, the above-described materials of the element electrode. In the case where the material of the element electrode is identical with the wiring material, the wirings connected to the element electrodes can be regarded as the element electrodes.

The X-directional wirings 2072 are connected with scanning signal supply means not shown which supplies a scanning signal for selecting the row of the surface conduction type electron emission elements 2074 arranged in the X-direction. On the other hand, the Y-directional wirings 2073 are connected with modulation signal generating means not shown for modulating the respective columns of the surface conduction type electron emission elements 2074 arranged in the Y-direction in response to the input signal. The drive voltage which is applied to the respective electron emission elements is applied as a differential voltage between the scanning signal and the modulation signal which are supplied to the element.

In the above structure, the individual element is selected so as to be driven independently, by using the simple matrix wiring.

A conditioning process according to the present invention is conducted on a high voltage to the electron source substrate having a large number of electron sources thus prepared.

Figure 24:
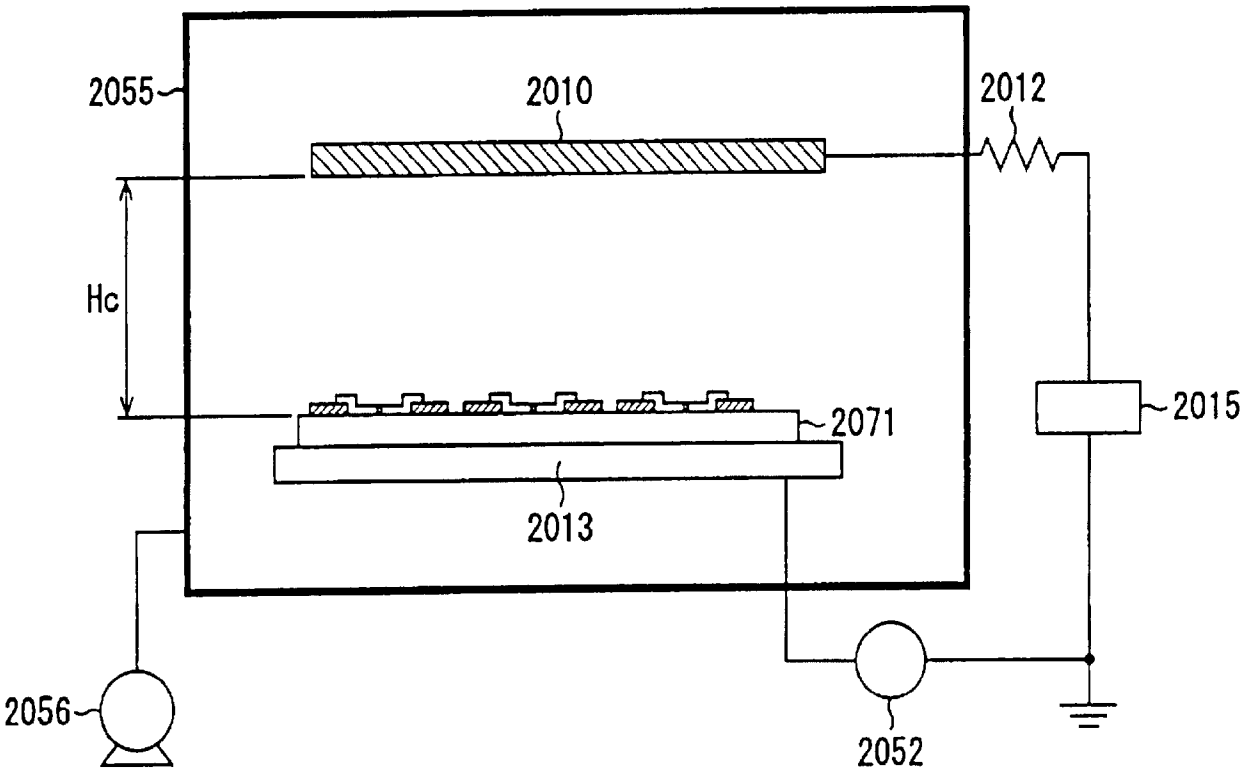
FIG. 24 is a schematic view showing a vacuum exhaust device for conducting the conditioning process of an electron source substrate to which the present invention is applicable.

FIGS. 23 and 24 are structural schematic views showing a device for conducting the conditioning process. In those figures, reference numeral 2071 denotes an electron source substrate, 2010 is a high voltage application electrode, and 2015 is a high voltage power supply. The wirings connected to the respective elements are commonly grounded. Also, a limit resistor 2012 is inserted between the high voltage application electrode 2010 and the high pressure power supply 2015 in order to prevent an over-current due to discharge.

Reference numeral 2055 denotes a vacuum vessel, and 2056 is an exhaust pump. A mechanical stage 2013 movable in the X, Y and Z directions is disposed within the vacuum vessel 2055, and the high voltage application electrode 2010 is located above the mechanical stage 2013. The electron source substrate 2071 is fixed onto the mechanical stage 2013. The X-directional and Y-directional wirings are made common at the end portions of the respective wirings by an electrically conductive takeoff member 2014 and grounded. The high voltage application electrode 2010 is connected to the high voltage power supply 2015 through the limit resistor 2012. Also, reference numeral 2052 denotes an ammeter.

A distance Hc between the electron source substrate and the high voltage application electrode can be determined by controlling the mechanical stage. Also, the voltage Vc applied to the high voltage application electrode is determined as follows:

It is assumed that the electron source substrate is used so that the voltage Va is applied to the opposite electrode which is apart from the electron source substrate by a distance H. In this situation, the voltage Vc of the high voltage power supply and the distance Hc between the electron source substrate and the high voltage application electrode are determined so as to satisfy Vc/Hc>Va/H in this process. In fact, there are many cases in which this process is conducted under the condition where Vc/Hc (electric field intensity Ec) is about 1.1 to 1.5 times of Va/H (electric field intensity Ea).

For example, in the case where the electron source substrate according to the present invention is used as the image forming apparatus, it is necessary to apply an electric field which is equal to or more than the electric field intensity applied between the electron source substrate and the phosphors as the image forming apparatus in this process. In the case of using the above-described electron source, the electric field intensity is about 1 to 8 kV/mm.

The presence/absence of the discharge operation in this process is conducted by measuring a current that flows between the high voltage application electrode and the electron source substrate. For example, the current that flows in the above-described limit resistor can be recognized by monitoring a voltage both ends of the limit resistor.

In the conditioning process, the members of the electron source or the image forming apparatus such the wirings, the electrodes or the electrically conductive film may be destroyed depending on the conditions.

The destroy of the elements due to the discharge in this process is evaluated by a change of the element characteristics before and after this process.

In the case where this process is conducted before the forming process, the destroy of the elements can be recognized by a change in the resistance of the respective elements, and in the case where this process is conducted before the forming process, the destroy of the elements can be recognized by a change in the electron emission characteristic of the respective elements.

For example, if the elements becomes high in resistance before the forming process, the sufficient electron emission characteristic cannot be obtained when the forming process is conducted later. Also, if the electron emission characteristic is deteriorated after the forming process, the sufficient characteristic is not obtained even if the activating process is conducted later. For that reason, there arises a problem on the yield which causes the unevenness of the electron source substrate, etc.

In the electron source substrate before the forming process, it is assumed that the resistors of the respective elements before this process is implemented is R1, and the resistors of the respective elements after this process is implemented is R2. It is assumed that the discharge of N times is observed in this process. Also, when the ratio R2/R1 of the element resistance before and after this process exceeds, for example, 2, because the sufficient emission characteristic is not obtained when the forming process is conducted later, judgement is made that the element is destroyed in this process, and its number is k. The k/N is considered to be the average number of the elements destroyed by one discharge operation, and the k/N is called "the number of discharge destroys".

In the electron source substrate after the forming process, it is assumed that the emission current of the respective elements before this process is implemented is I1, and the emission current of the respective elements after this process is implemented is I2. For example, when the ratio I1/I2 exceeds 2, because the sufficient characteristic is not obtained even when the activating process is conducted later, judgement is made that the element is destroyed in this process, and the number of discharge destroys can be defined by the number k and the number of discharges N in this process, likewise.

As described above, in order to reduce the possibility that the members of the electron source and the image forming apparatus are destroyed, an energy stored in the electron source and the capacitor made up of the high voltage application electrodes may be made small. Specifically, an area of the high voltage application electrode may be set to be smaller than an area of the electron source substrate, and both of the high voltage application electrode and the electron source substrate may be relatively moved while an interval between the high voltage application electrode and the electron source substrate is maintained to a given value.

The destroy of the above-described member has a threshold value with respect to the above energy, that is, the area of the high voltage application electrode, and the destroy of the member may be remarkable when the energy, that is, the area is larger than specific values Eth and Sth. In the case where the above value is known in a specific process, the high voltage application electrode smaller than Sth is used so that the above energy does not exceed the known value to execute the conditioning process.

Figure 27:
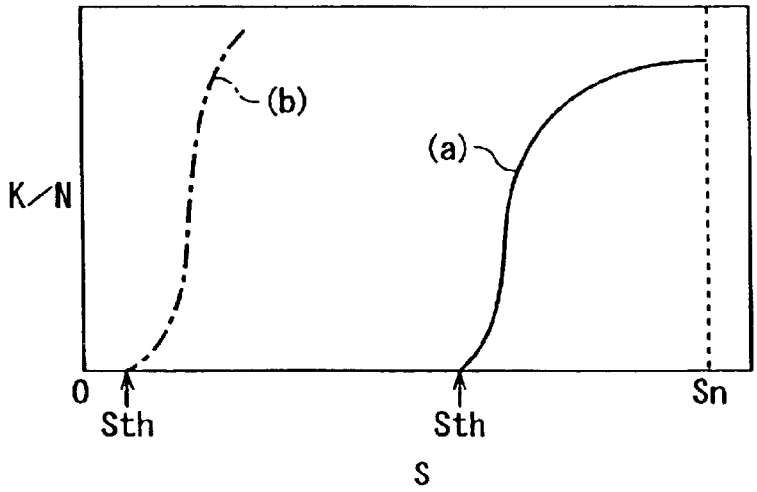
FIG. 27 is a graph showing a relationship between an area of a high voltage applying electrode and the number of discharge destroys in the conditioning process.

The number k/N of discharge destroys when this process is executed by changing the area S of the high voltage application voltage is shown in FIG. 27. The number of discharge destroys can take a value of from 0 to the number of elements m×n on the electro source substrate. All of the elements are hardly destroyed by one discharge, and the number of discharge destroys are the same degree as the number of elements in the X-direction or Y-direction. Also, in the figure, Sn is the area of the electron source substrate.

The above relationship depends on the structure of the electron source substrate, the resistances of the X-directional and Y-directional wirings and the characteristic of the element (the configuration of the electrically conductive film, the manufacturing process, etc.). The curve (a) in FIG. 27 plots the number of discharge destroys in the conditioning process of the electron source substrate before the forming process with respect to the area S of the high voltage application electrode. On the other hand, the curve (b) of FIG. 27 plots the number of discharge destroys with respect to the electron source substrate after the forming process. In any cases, it is found that the number of discharge destroys increases when the area of the high voltage application electrode which is increased is equal to or more than the threshold value Sth. This is because the electrically conductive thin film is destroyed during the discharge operation by the energy Econ stored in the capacitor formed of the high voltage application electrode and electron source substrate when the high voltage application electrode of the area equal to or more than Sth is used. That is, when the high voltage application electrode of an area S is used, an energy of $Econ=\in\times S/Hc\times Vc^2/2$ is stored in the capacitor. When the high voltage application electrode of the area equal to or more than Sth is used, the energy is consumed on the electron source substrate when the energy is discharged, and the electrically conductive thin film is destroyed.

For example, in the electrically conductive thin film using Pd as shown in FIG. 27A, the energy stored in the capacitor formed by the high voltage application electrode of Sth and the electron source substrate is substantially $1\times10^{-2}$ J.

After the forming process, the value of Sth, that is, Eth becomes remarkably small as compared with that before the forming process. In order to conduct the conditioning process without damaging the member in this state, it is necessary to use the high voltage application electrode which is very small in area. Although being not preferable in practical use, in the case where the conditioning process is conducted before the forming process, and a new discharge factor occurs for some reason during the forming process, the conditioning process can be again conducted by using a very small electrode.

When the conditioning process is conducted using the high voltage application electrode of an area equal to or more than Sth, the energy is consumed on the electron source substrate during the discharge operation, and the film is destroyed. Also, if the conditioning process is conducted under the condition where lEth>Econ, it is apparent from FIG. 5A that the destroy does not occur.

In other words, assuming that an area where the electrode and the insulating substrate face each other is S, a distance between the electrode and the substrate is Hc, a voltage applied between the electrode and the common wiring is Vc, a dielectric constant of vacuum is $\epsilon$, and an energy by which the electrically conductive thin film is destroyed is Eth, the conditioning process is conducted under the following condition:

$$\in\times S\times Vc^2/2Hc<Eth \quad (1)$$

As a result, the conditioning process can be conducted without destroying the electron emission element by destroying the electrically conductive thin film.

As described above, when the area S of the high voltage application electrode is appropriately selected, the energy consumed by the electrically conductive thin film during the discharge operation is set to be lower than the energy Eth by which the electrically conductive thin film is destroyed during the discharge operation, or less, thereby being capable of preventing the destroy of the electrically conductive thin film during the conditioning process.

Also, a method of setting the energy stored in the capacitor to the energy Eth by which the electrically conductive thin film is destroyed during the discharge operation, or less can be realized by reducing the supply voltage Vc while the electric field Vc/Hc applied to the electron source substrate is maintained other than a case in which the area of the high voltage application electrode is reduced.

In addition, if the area of the high voltage application electrode is appropriately selected as described above, this process can be applied without destroying the electron source substrate which has been subjected to the forming process.

For example, when the electrically conductive film using the above-described Pd is formed, the energy by which the electrically conductive thin film is destroyed as obtained is $1\times10^{-4}$ J. In this state, a relationship between the area of the high voltage application electrode and the number of the discharge destroys is shown in FIG. 27B.

The moving speed of the stage is arbitrarily selected within a range where a purpose of this process can be achieved.

Also, in the case where a long period of time is taken for this process due to the relative moving speed of the high voltage application electrode and the electron source substrate and the area of the high voltage application electrode, a plurality of high voltage application electrodes can be made common through the limit resistor and connected to the high voltage power supply.

Also, it is possible that the high voltage application electrode having the same area as that of the electron source substrate is divided into a plurality of pieces, and the respective high voltage application electrodes are made common through the limit resistor and connected to the high voltage power supply. In this case, it is not necessary to move the electron source substrate or the high voltage application electrode, and the effects of the present invention can be obtained in a short period of time.

Figure 40:
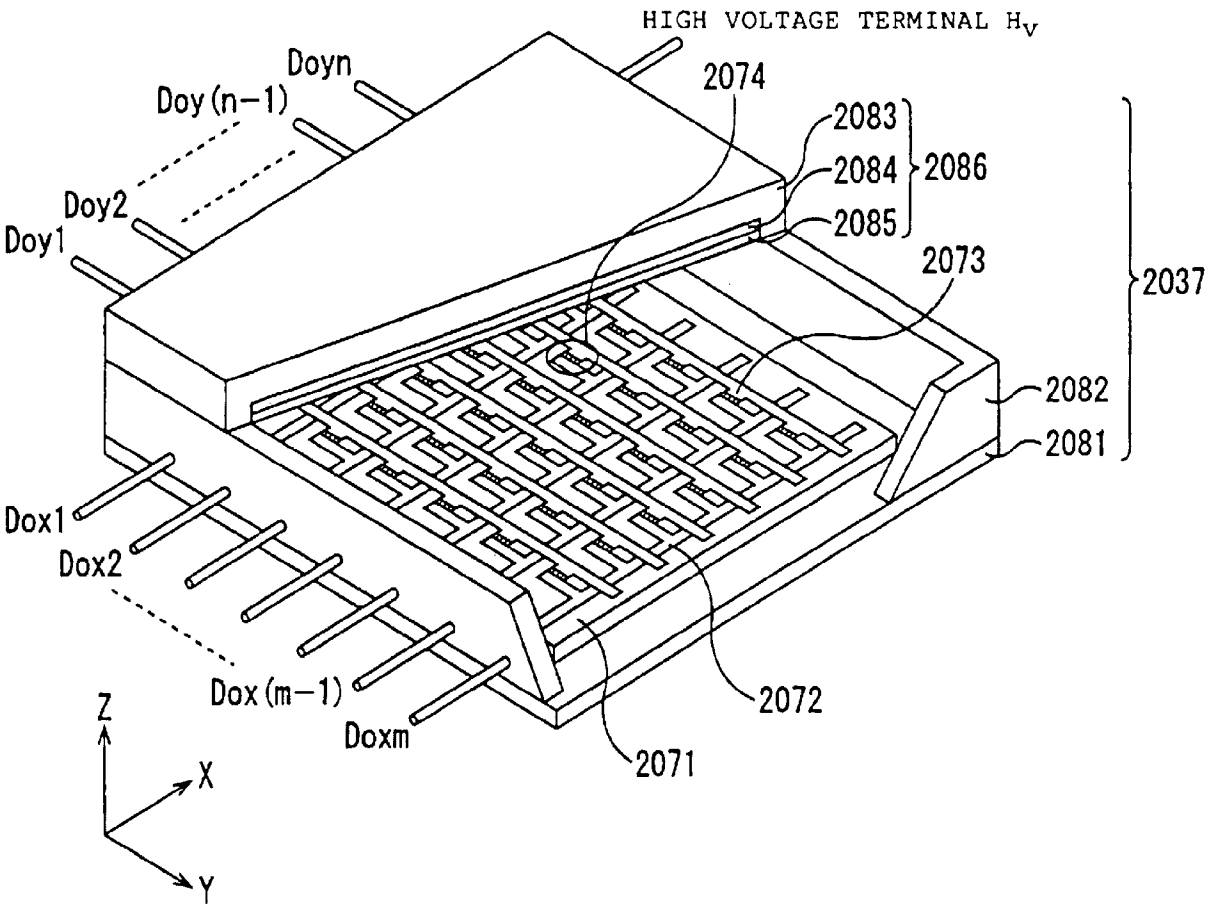
FIG. 40 is a schematic view showing an example of a display panel of an image forming apparatus to which the present invention is applicable.
Figure 41A:
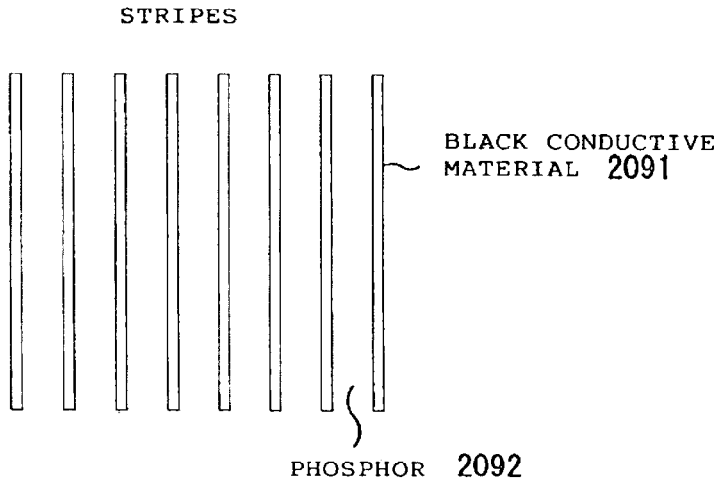
FIGS. 41A and 41B are schematic views showing an example of a fluorescent film.
Figure 41B:
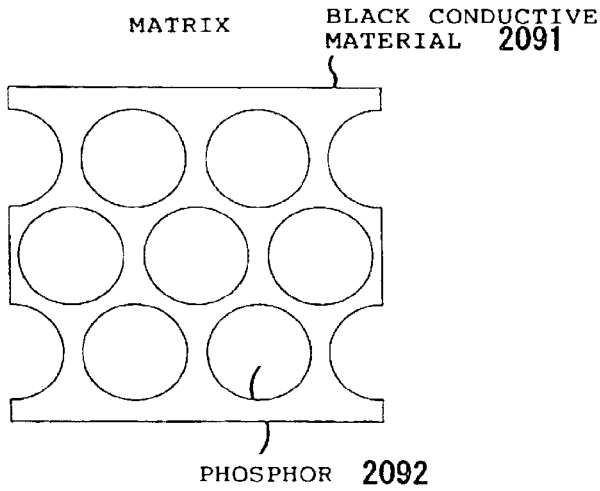
Figure 42:
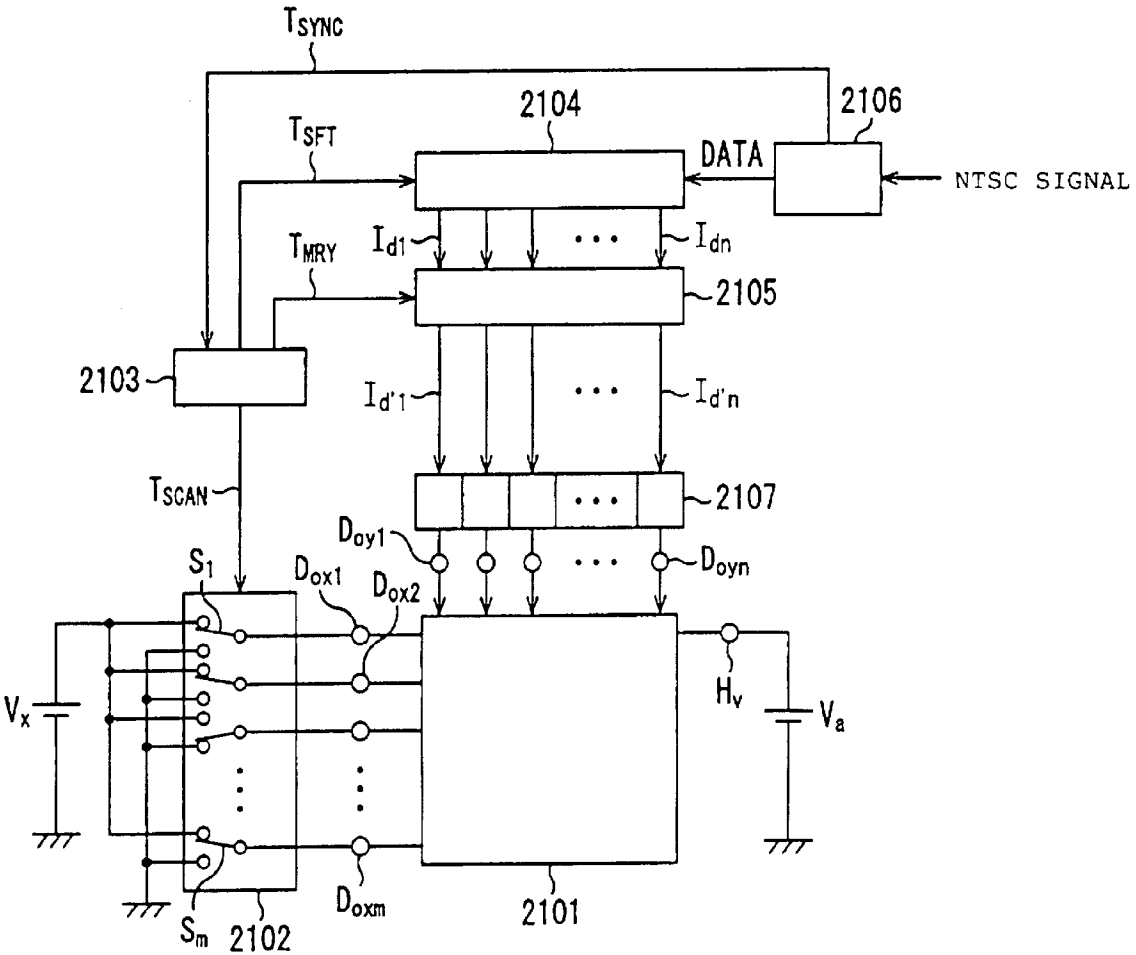
FIG. 42 is a block diagram showing an example of a drive circuit for conducting display in response to a television signal of the NTSC system in an image forming apparatus.

The image forming apparatus structured by using the electron source in the simple matrix arrangement will be described with reference to FIGS. 40, 41 and 42. FIG. 40 is a schematic view showing an example of a display panel of an image forming apparatus, FIG. 41 is a schematic view showing an example of a fluorescent film used in the image forming apparatus shown in FIG. 40, and FIG. 42 is a block diagram showing an example of a drive circuit for conducting display in response to a television signal of the NTSC system.

Referring to FIG. 40, reference numeral 2071 denotes an electron source substrate on which a plurality of electron emission elements are arranged; 2081 is a rear plate fixed with the electron source substrate 2071; and 2086 is a face plate in which a fluorescent film 2084, a metal back 2085 and so on are formed on an inner surface of a glass substrate 2083. Reference numeral 2082 denotes a support frame, and the support frame 2082 is joined with the rear plate 2081 and the face plate 2086 through a flit glass with a low melting point or the like.

Reference numeral 2074 corresponds to the electron emission element shown in FIG. 23. Reference numeral 2072 and 2073 are X-directional wirings and Y-directional wirings which are connected to a pair of element electrodes of the surface conduction type electron emission devices.

The envelope 2088 is made up of the face plate 2086, the support frame 2082 and the rear plate 2081 as described above. Because the rear plate 2081 is provided mainly for the purpose of reinforcing the strength of the substrate 2071, if the substrate 2071 per se has a sufficient strength, the separately provided rear plate 2081 may be unnecessary.

In other words, the support frame 2082 may be directly sealingly attached to the substrate 2071 so that the envelope 2088 is made up of the face plate 2086, the support frame 2082 and the substrate 2071. On the other hand, if a support member not shown which is called "spacer" is located between the face plate 2086 and the rear plate 2081, the envelope 2088 having a sufficient strength against the atmospheric pressure can be structured.

FIG. 41 is a schematic view showing a fluorescent film. The fluorescent film 2084 can be made up of only a phosphor in case of monochrome. In case of a color fluorescent film, the fluorescent film 2084 can be made up of a black conductive member 2091 and a phosphor 2092 which are called "black stripes" or "black matrix" due to the arrangement of the phosphors. The purposes of providing the black stripes and the black matrix are to make a mixed color, etc., neutral by blacking the boundary portions of the respective phosphors 2092 of three primary color phosphors required in case of color display, and to suppress the deterioration of contrast due to reflection of the external light on the fluorescent film 2084. The material of the black stripes can be made of a material that mainly contains black lead which is generally used, or a material which is electrically conductive and small in the transmission and refection of a light.

A method of coating the phosphors on the glass substrate 2083 can be applied with a sedimentation or printing method, etc., regardless of monochrome or color. The metal back 2085 is normally disposed on the inner surface side of the fluorescent film 2084. The purposes of providing the metal back are to improve the luminance by mirror-reflecting a light directed to the inner surface side among the light emission of the phosphors to the face plate 2086 side, to operate the metal back as an electrode for applying an electron beam accelerating voltage, and to protect the phosphors from any damage due to collision of negative ions produced within the envelope, etc. The metal back can be manufactured by smoothing the inner surface of the fluorescent film (normally called "filming") after the fluorescent film has been prepared, and thereafter depositing Al through the vacuum evaporation, etc.

The face plate 2086 may be provided with a transparent electrode (not shown) at the outer surface side of the fluorescent film 2084 in order to enhance the electric conductivity of the fluorescent film 2084.

When the above sealing attachment of the envelope is conducted, in case of color, it is necessary that the respective color phosphors are made to correspond to the electron emission elements, and the sufficient positioning is essential.

An example of a method of manufacturing the image forming apparatus shown in FIG. 40 will be described below.

Figure 45:
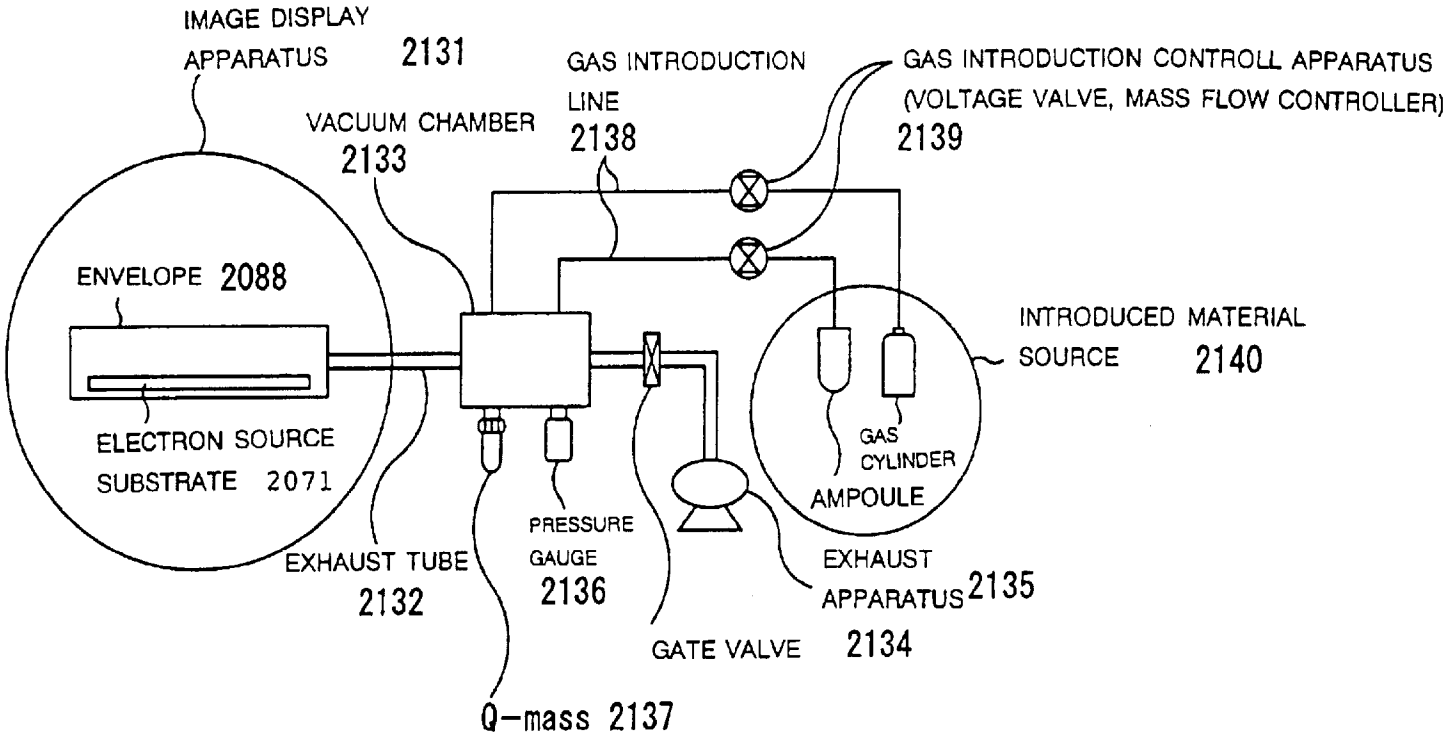
FIG. 45 is a schematic view showing a vacuum exhaust device for conducting forming and miscellaneous processes in an image forming apparatus in accordance with the present invention.

FIG. 45 is a schematic view showing the outline of a device used in the above process. An image forming apparatus 2131 is coupled to a vacuum chamber 2133 through an exhaust pipe 2132 and also connected to an exhausting device 2135 through a gate valve 2134. A pressure gauge 2136, a quadrupole mass spectrograph 2137 and so on are attached to the vacuum chamber 2133 in order to measure an internal pressure and the divided pressures of the respective components in the atmosphere.

Because it is difficult to directly measure the internal pressure in the envelope 2088 of the image forming apparatus 2131, etc., a pressure or the like in the vacuum chamber 2133 is measured, to thereby control the processing conditions.

Also, a gas introduction line 2138 is connected to the vacuum chamber 2133 in order to introduce required gas into the vacuum chamber to control the atmosphere. The other end of the gas introduction line 2138 is connected with an introduction material source 2140, and the introduction material is inserted into an ample or a bomb and then stored therein. Introduction amount control means 2139 for controlling a rate at which the introduction material is introduced is disposed on the gas introduction line. As the specific introduction amount control means, a valve such a slow leak valve which can control a flow rate to be escaped, a mass flow controller, etc., can be used in accordance with a kind of the introduction material.

Figure 25:
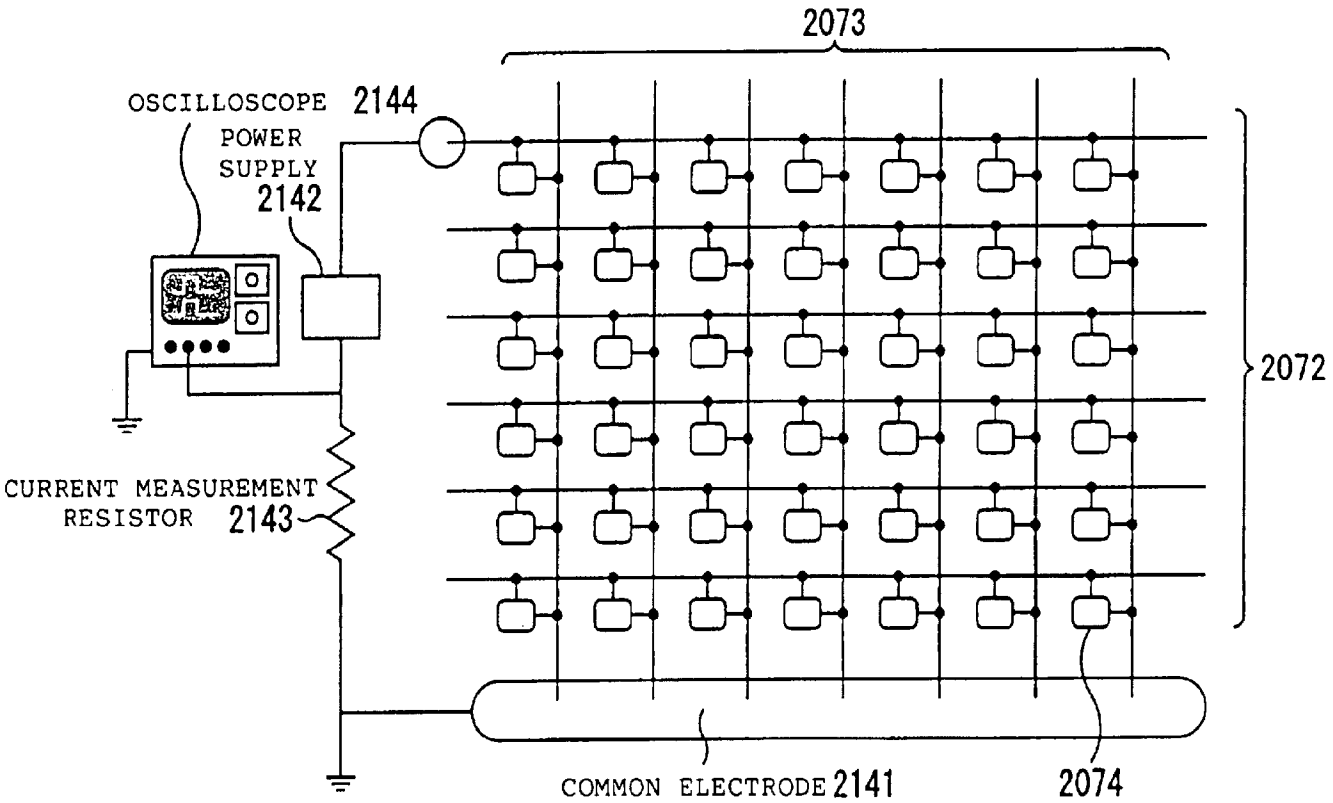
FIG. 25 is a schematic view showing a connecting method for conducting forming and activating processes in an image forming apparatus in accordance with the present invention.

A gas is exhausted from the interior of the envelope 2088 by the device shown in FIG. 45 to conduct a forming process. In this situation, for example, as shown in FIG. 25, the Y-directional wirings 2073 are connected to the common electrode 2141, and a voltage pulse is applied to the elements connected to one of the X-directional wirings 2072 by the power supply 2142 at the same time, thereby being capable of conducting the forming operation. The conditions such as the shape of the pulse, the Judgement of the completion of the processing, etc., may be selected in accordance with the above-described method of forming the respective elements. Also, if pulses phases of which are shifted are sequentially applied to the plurality of X-directional wirings (scroll), it is possible to conduct the forming operation on the elements connected to the plurality of X-directional wirings together. In the figure, reference numeral 2143 denotes a current measurement resistor, and 2144 is a current measurement oscilloscope.

After the forming process has been completed, an activating process is conducted. The organic material is introduced into the envelope 2088 from the gas introduction line 2138 after a gas has been sufficiently exhausted from the envelope 2088. Alternatively, as described above, as the method of activating the individual elements, a gas is first exhausted by the oil dispersion pump or the rotary pump, by which the organic material remaining in the vacuum atmosphere may be used. Also, a material other than the organic material may be introduced as occasion demands. In the atmosphere containing the organic material thus formed, a voltage is applied to the respective electron emission elements with the results that carbon, carbon compound or the mixture of those materials is deposited on the electron emission portions, and the amount of emitted electrons drastically arises as in the case of the respective elements. Also, in this example, in the voltage applying method, the voltage pulse may be applied to the elements connected in one directional wiring by the same connection as that in the above-described forming process at the same time.

After the activating process has been completed, it is preferable to conduct the stabilizing process as in the individual elements.

The gas within the envelope 2088 is exhausted through an exhaust pipe 2132 by the exhausting device 2135 using no oil such as an ion pump or a sorption pump while being appropriately heated so as to be maintained at 80 to 250° C., to thereby provide the atmosphere sufficiently small in the amount of organic material, and thereafter the exhaust pipe is heated and melted by a burner to conduct sealing. In order to maintain the pressure after the envelope 2088 is sealed, a gettering process may be conducted. This is a process in which a getter disposed at a given position (not shown) within the envelope 2088 is heated due to heating using resistor heating or high frequency heating, etc., immediately before the envelope 2088 is sealed or after the envelope 2088 has been sealed, to thereby form a deposition film. The getter normally mainly contains Ba or the like and maintains the atmosphere within the envelop 2088 due to the adsorbing action of the deposition film.

Subsequently, a description will be given of an structural example of a drive circuit for conducting television display on the basis of a television signal of an NTSC system on the display panel structured by using the electron source of the simple matrix arrangement with reference to FIG. 42. Referring to FIG. 42, reference numeral 2101 denotes an image display panel; 2102, a scanning circuit; 2103, a control circuit; 2104, a shift register; 2105, a line memory; 2106, a synchronous signal separating circuit; 2107, a modulated signal generator; and Vx and Va are d.c. voltage sources.

The display panel 2101 is connected to an external electric circuit through terminals Dox1 to Doxm, terminals Doy1 to Doyn, and a high voltage terminal Hv. The terminals Dox1 to Doxm are applied with a scanning signal for sequentially driving the electron source disposed within the display panel, that is, the surface conduction type electron emission element group which are arranged in a matrix of m rows×n columns one line by one line (n element).

The terminals Dy1 to Dyn are applied with a modulation signal for controlling the output electron beams of the respective elements of the surface conduction type electron emission elements on one row selected in accordance with the scanning signal. The high voltage terminal Hv is applied with a d.c. voltage of, for example, 10 kV by the d.c. voltage source Va. This is an accelerating voltage for giving an energy sufficient to excite the phosphors to an electron beam emitted from the surface conduction type electron emission elements.

The scanning circuit 2102 will be described. The scanning circuit 2102 includes M switching elements (in the figure, schematically represented by S1 to Sm) therein. The respective switching elements select any one of the output voltage of the d.c. voltage supply Vx and 0 V (ground level) and are electrically connected to the terminals Dx1 to Dxm of the display panel 2101. The respective switching elements of S1 to Sm operate on the basis of a control signal Tscan outputted from the control circuit 2103 and can be structured by the combination of switching elements such as FETS.

In this example, the d.c. voltage source Vx is so set as to output a constant voltage so that a drive voltage applied to an element which is not scanned becomes an electron emission threshold voltage or less, on the basis of the characteristic of the surface conduction type electron emission elements (electron emission threshold voltage).

The control circuit 2103 has a function of matching the operation of the respective members with each other so that appropriate display is conducted on the basis of an image signal inputted from the external. The control circuit 2103 generates the respective control signals of Tscan, Tsft and Tmry to the respective members on the basis of a synchronous signal Tsync transmitted from the synchronous signal separating circuit 2106.

The synchronous signal separating circuit 2106 is a circuit for separating a synchronous signal component and a luminance signal component from the television signal of the NTSC system which is inputted from the external and can be made up of a general frequency dividing (filtering) circuit and so on. The synchronous signal separated by the synchronous signal separating circuit 2106 consists of a vertical synchronous signal and a horizontal synchronous signal, but is shown as a signal Tsync in this example for convenience of description. The luminance signal component of an image which is separated from the television signal is represented as a DATA signal for convenience. The DATA signal is inputted to the shift register 2104.

The shift register 2104 is so designed as to serial-parallel convert the DATA signal inputted in serial temporarily for one line of the image and operates on the basis of the control signal Tsft transmitted from the control circuit 2103 (that is, the control signal Tsft is also called "shift clock" of the shift register 2104). The data for one line of the image which has been converted from serial to parallel (corresponding to the drive data of n elements of the electron emission elements) is outputted from the shift register 2104 as n parallel signals of Id1 to Idn.

The line memory 2105 is a memory device for storing the data for one line of the image for a required period of time, and appropriately stores the contents of Id1 to Idn in accordance with the control signal Tmry transmitted from the control circuit 2103. The stored contents are outputted as Id1 to Idn and then inputted to the modulated signal generator 2107.

The modulation signal generator 2107 is a signal source for appropriately driving and modulating the respective surface conduction type electron emission elements in accordance with the respective image data Id'1 to Id'n, and its output signal is supplied to the surface conduction type electron emission elements within the display panel 2101 through the terminals Doy1 to Dyn.

As described above, the electron emission element to which the present invention is applicable has the following basic characteristics of the emission current Ie. That is, the electron emission has the definite threshold value Vth, and the electron emission occurs only when the voltage of Vth or higher is applied. The emission current also changes in accordance with a change of the supply voltage to the elements with respect to the voltage which is equal to or higher than the electron emission threshold value. From the above fact, in the case where the pulse voltage is applied to the electron emission elements, for example, even if the voltage lower than the electron emission threshold value is applied to the elements, the electron emission does not occur. However, in the case where the voltage equal to or higher than the electron emission threshold value, the electron beams are outputted. In this situation, the intensity of the output electron beams can be controlled by changing the peak value Vm of the pulses. Also, it is possible to control the total amount of the electric charges of the electron beams outputted by changing the pulse width Pw.

Accordingly, as a system of modulating the electron emission element in accordance with the input signal, there can be applied a voltage modulating system, a pulse width modulating system and so on. In implementing the voltage modulating system, as the modulation signal generator 2107, there can be used a circuit of the voltage modulating system which generates a voltage pulse of a constant length and appropriately modulates a peak value of the pulse in accordance with inputted data.

In implementing the pulse width modulating system, as the modulation signal generator 2107, there can be used a circuit of the pulse width modulating system which generates a voltage pulse of a constant peak value and appropriately modulates the width of the voltage pulse in accordance with inputted data.

The shift register 2104 and the line memory 2105 may be of the digital signal system or the analog signal system. This is because the serial to parallel conversion of the image signal and the storage thereof may be conducted at a given speed.

In the case of using the digital signal system, it is necessary to convert the output signal DATA of the synchronous signal separating circuit 2106 into a digital signal, and in this case, an A/D convertor may be disposed on an output portion of the synchronous signal separating circuit 2106. With being associated with the above structure, a circuit used in the modulation signal generator 2107 is slightly different depending on whether the output signal of the line memory 2105 being a digital signal or an analog signal. That is, in case of the voltage modulating system using the digital signal, the modulation signal generator 2107 is equipped with, for example, a D/A converting circuit, and an amplifying circuit or the like is added to the generator 2107 as occasion demands. In case of the pulse width modulating system, the modulation signal generator 2107 is equipped with, for example, a circuit combining a high-speed oscillator, a counter (counter) that counts the number of waves outputted from the oscillator, and a comparator (comparator) which compares an output value of the counter with an output value of the memory together. As occasion demands, an amplifier which voltage-amplifies the modulated signal which is outputted from the comparator and modulated in pulse width up to the drive voltage of the surface conduction type electron emission elements may be added to the circuit.

In case of the voltage modulating system using the analog signal, the modulation signal generator 2107 may be equipped with, for example, an amplifying circuit using an operational amplifier, etc., and as occasion demands, a level shifting circuit, etc., may be added to the system. In case of the pulse width modulating system, for example, a voltage control type oscillating circuit (VCO) can be applied, and as occasion demands, an amplifier for amplifying the voltage up to a drive voltage of the surface conduction type electron emission elements may be added to the system.

In the image forming apparatus thus structured according to the present invention, a voltage is applied to the respective electron emission elements through the terminals Dox1 to Doxm and the terminals Doy1 to Doyn disposed in the exterior of the vessel, to thereby cause electron emission. A high voltage is applied to the metal back 2085 or a transparent electrode (not shown) through a high voltage terminal Hv, to thereby accelerate an electron beam. The accelerated electrons collide with the fluorescent film 2084 to emit a light, thereby forming an image.

The above-described structure of the image forming apparatus is an example of the image forming apparatus to which the present invention is applicable, and various deformation can be made on the basis of the technical conception of the present invention. The input signal is of the NTSC system in this embodiment, but the input signal is not limited to this system and is applicable to the PAL and SECAM systems, etc., and also a TV signal (for example, a high-grade TV including the MUSE system) system with a larger number of scanning lines than the PAL and SECAM systems.

Subsequently, the electron source arranged in a ladder and the image forming apparatus will be described with reference to FIGS. 43 and 44.

Figure 43:
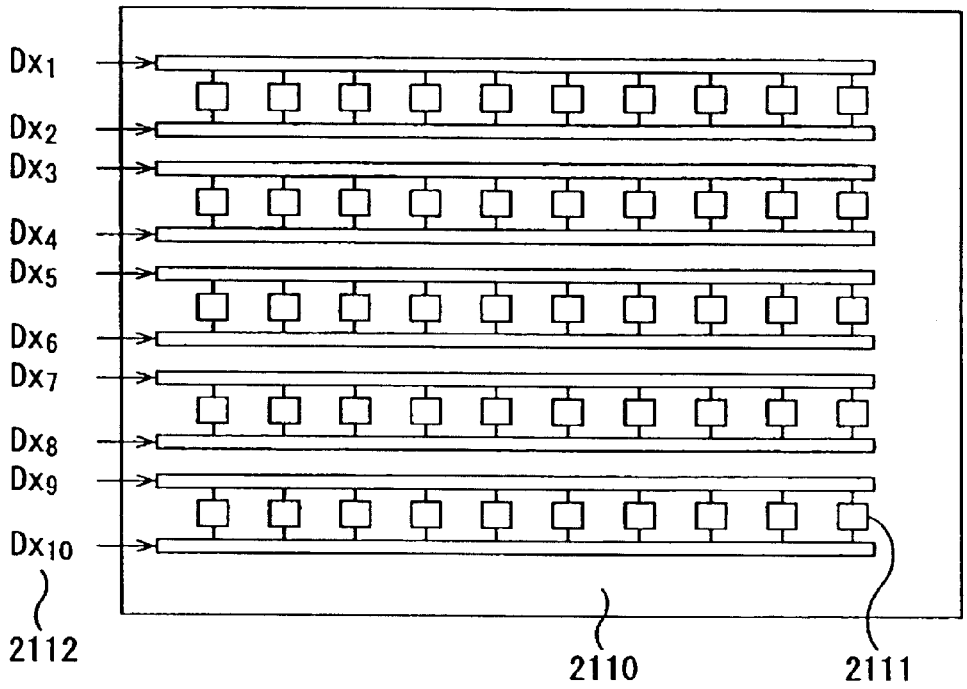
FIG. 43 is a schematic view showing an example of the electron source arranged in a ladder to which the present invention is applicable.

FIG. 43 is a schematic view showing an example of the electron source which is arranged in the form of a ladder. Referring to FIG. 43, reference numeral 2110 denotes an electron source substrate; and 2111 is electron emission elements. Reference numeral 2112 and Dx1 to Dx10 denote common wirings for connecting the electron emission elements 2111. A plurality of electron emission elements 2111 are disposed on the substrate 2110 in parallel in the X-direction (called element row). A plurality of element rows are disposed to constitute the electron source. When the drive voltage is applied between the common wirings of the respective element rows, the respective element rows can be driven independently. That is, the element rows from which the electron beams are intended to be emitted are applied with a voltage of an electron emission threshold value or higher whereas the element rows from which the electron beams are not intended to be emitted are applied with a voltage lower than the electron emission threshold value. The common wirings Dx2 to Dx9 positioned between the respective element rows can be made by integrating, for example, Dx2 and Dx3 into the same wiring.

Figure 44:
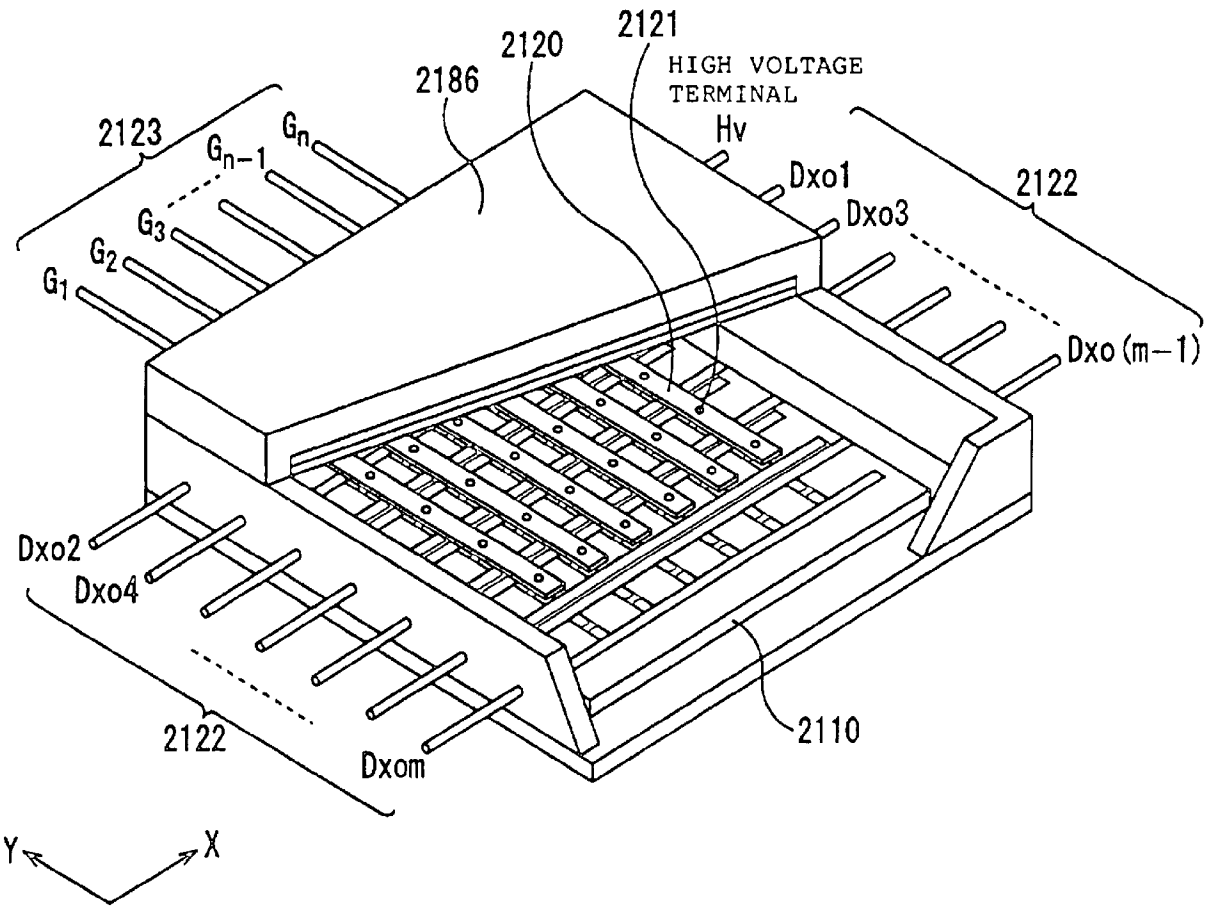
FIG. 44 is a schematic view showing an example of a display panel of an image forming apparatus to which the present invention is applicable.

FIG. 44 is a schematic view showing an example of a panel structure in the image forming apparatus having the electron sources which are arranged in the form of a ladder. Reference numeral 2120 denotes grid electrodes; 2121 is openings through which electrons pass; and 2122 is vessel external terminals of Dox1, Dox2, . . . , Doxm. Reference numeral 2123 is vessel external terminals of G1, G2, . . . , Gn connected with the grid electrodes 2120, and 110 is an electron source substrate on which the common wirings between the respective element rows are made identical with each other. In FIG. 44, the same parts as those shown in FIGS. 40 and 43 are designated by identical references as those in those figures. A great difference between the image forming apparatus shown in FIG. 44 and the image forming apparatus of the simple matrix arrangement shown in FIG. 40 resides in whether or not the grid electrodes 2120 are disposed between the electron source substrate 2110 and the face plate 2086.

In FIG. 44, the grid electrodes 2120 are disposed between the substrate 2110 and the face plate 2086. The grid electrodes 2120 are so designed as to modulate the electron beam emitted from the surface conduction type electron emission elements and has one circular opening 2121 for each of the respective elements in order that the electron beam is allowed to pass through the stripe electrodes disposed orthogonal to the element rows of the ladder-type arrangement. The shape of the grid and the position at which the grid electrodes are arranged are not limited to what are shown in FIG. 44. For example, a large number of passage ports can be disposed in a mesh as openings, or the grid can be disposed around or in the vicinity of the surface conduction type emission elements.

The vessel external terminals 2122 and the grid vessel external terminals 2123 are electrically connected to a control circuit not shown.

In the image forming apparatus according to this embodiment, the modulated signal for one line of the image is supplied to the grid electrode columns at the same time in synchronism with the sequential drive (scanning) operation of the element rows column by column. With this operation, the irradiation of the respective electron beams to the phosphors is controlled, thereby being capable of displaying the image one line by one line.

The image forming apparatus according to the present invention can be employed as a display device for a television broadcast, a display device for a television conference system and a computer or the like, an image forming apparatus structured by using a photosensitive drum and so on as an optical printer, etc.

EXAMPLES

Hereinafter, an embodiment of the present invention will be described in more detail.

Example 1

This embodiment is an example in which electron source substrate is manufactured through the conditioning process in accordance with the present invention.

Figure 30:
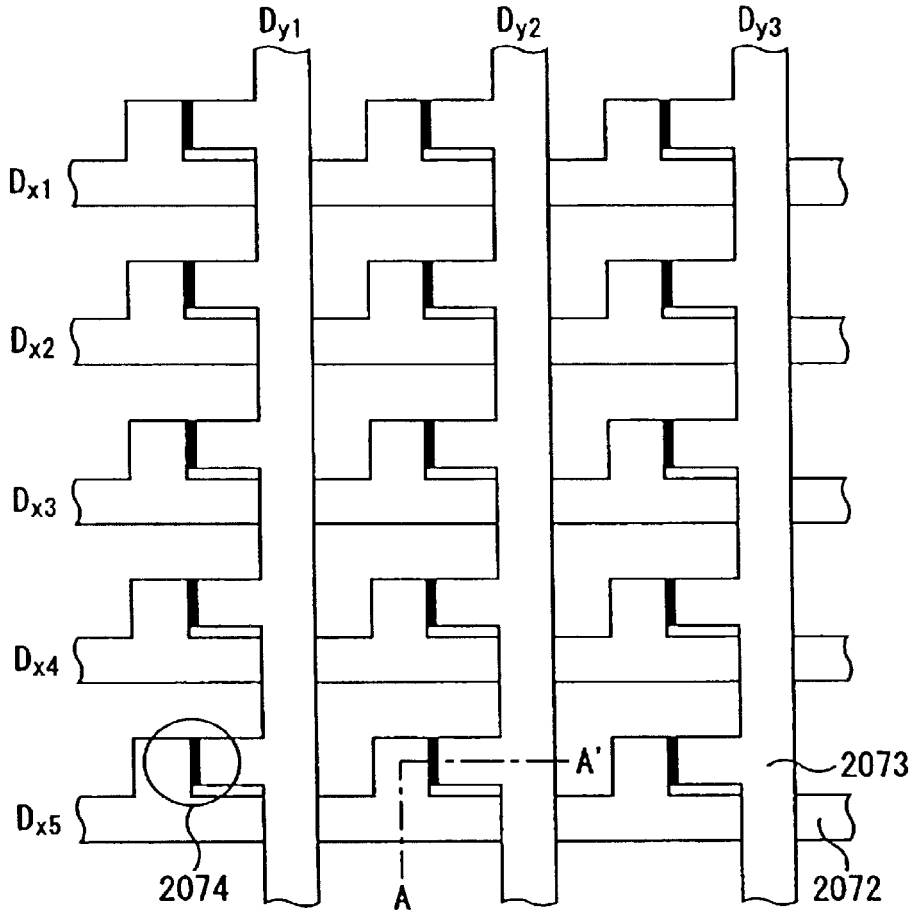
FIG. 30 is a plan view showing an electron source to which the present invention is applicable.
Figure 31:
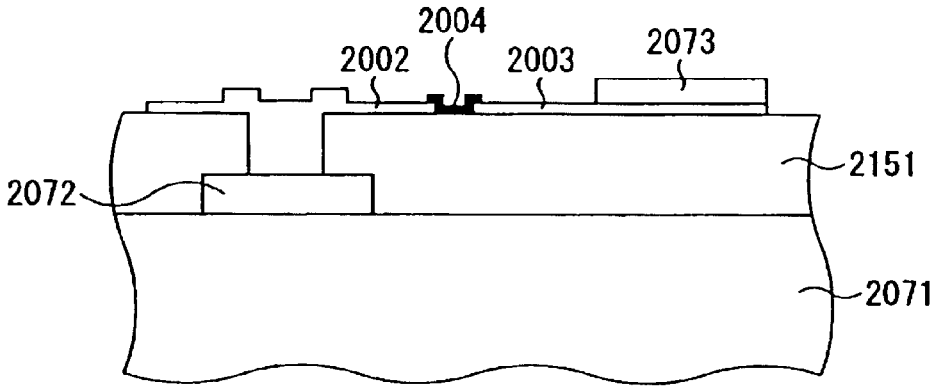
FIG. 31 is a cross-sectional view taken along a line A–A' of FIG. 30.
Figure 32A:
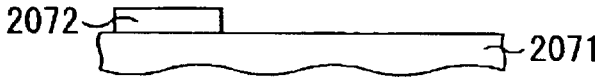
FIGS. 32A to 32G are cross-sectional views showing the manufacturing process shown in FIG. 31.
Figure 32B:
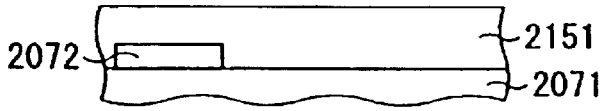
Figure 32C:
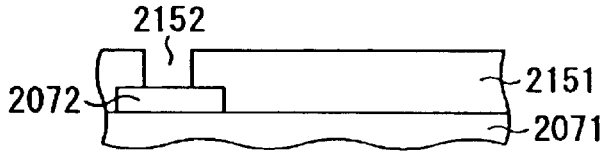
Figure 32D:
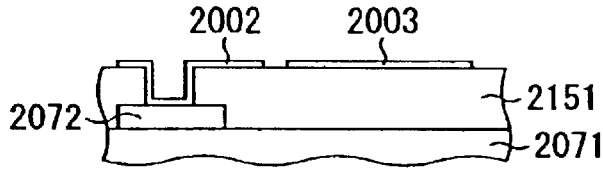
Figure 32E:
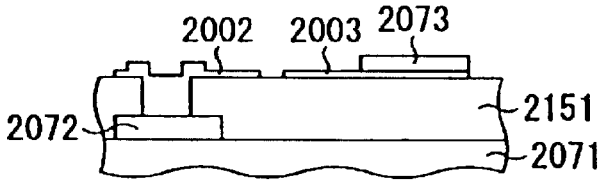
Figure 32F:
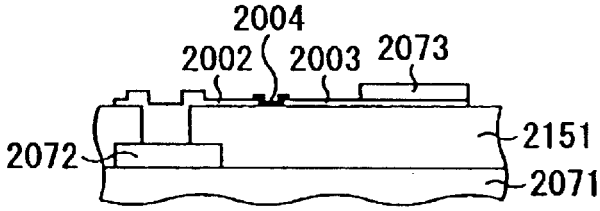
Figure 32G:
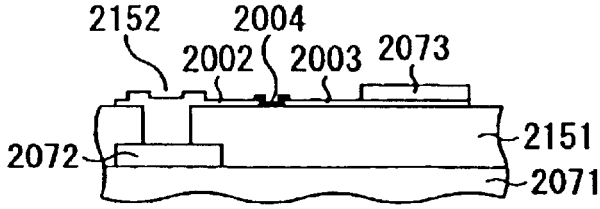

In this embodiment, an image forming apparatus used in display or the like will be described. FIG. 40 is a basic structural view of the image forming apparatus, and FIG. 41 is a fluorescent film. A plan view of the part of the electron source is shown in FIG. 30. Also, a cross-sectional view taken along a. line A–A' in the figure is shown in FIG. 31. The same references in FIGS. 30 and 31 denote identical parts. In the figure, reference numeral 2071 denotes a substrate; 2072 is X-directlonal wirings (also called lower wirings) corresponding to. Doxm shown in FIG. 30; 2073 is Y-directional wirings (also called upper wirings) corresponding to Doyn shown in FIG. 40; 2004 is a thin film including electron emission portions; 2002 and 2003 are element electrodes; 2151 is an interlayer insulating layer; and 2152 is a contact hole for electrically connecting the element electrode 2002 and the lower wirings 2072.

In the electron source substrate according to this embodiment, 2000 electron emission elements are formed on the X-directional wiring, and 1100 electron emission elements are formed on the Y-directional wiring. Also, the size of the electron source substrate is 900 mm in the X-direction and 500 mm in the Y-direction.

Subsequently, the manufacturing method will be described in detail in accordance with the process order with reference to FIG. 32.

Step-a

A Cr film 5 nm in thickness and an Au film 600 nm in thickness are sequentially laminated through a vacuum evaporation method on a substrate 2071 obtained by forming a silicon oxide film 0.5 $\mu$m in thickness on a soda lime glass which has been cleaned through a sputtering method. Then, after photoresist (AZ1370 made by Hext Corp.) is rotationally coated on the upper surface of the layer by a spinner and baked, a photo mask image is exposed and developed to form a resist pattern of the lower wirings 2072, and an Au/Cr deposit film is wet-etched to form the lower wirings 2072 in a desired shape.

Step-b

Subsequently, the interlayer insulating layer 2151 formed of a silicon oxide film 1.0 $\mu$m in thickness is deposited through an RF sputtering method.

Step-c

A photoresist pattern for forming a contact hole 2152 in the silicon oxide film deposited in the step b is prepared, and the interlayer insulating layer 2151 is etched with the photoresist pattern as a mask to form the contact hole 2152. The etching is conducted through an RIE (Reactive Ion Etching) method using $CF_4$ and $H_2$ gas.

Step-d

Thereafter, a pattern for producing a gap G between the element electrode 2002 and the element electrode 2003 is formed in a photoresist (RD-2000N-41 made by Hitachi Kasei Corp.), and a Ti film 5 nm in thickness and an Ni film 100 nm in thickness are sequentially deposited through a vacuum evaporation method. The photoresist pattern is melted by an organic solvent, and the Ni/Ti deposit film is lifted off to form the element electrodes 2002 and 2003 which are 5 $\mu$m in the element electrode interval L1 and 300 $\mu$m in the width W1 of the element electrodes.

Step-e

After a photoresist pattern of the upper wirings 2073 is formed on the element electrode 2003, a Ti film 5 nm in thickness and an Au film 500 nm in thickness are sequentially deposited through the vacuum evaporation method, and an unnecessary portion is removed by lift-off to form the upper wiring 2073 in a desired shape.

Step-f

A Cr film 100 nm in thickness is deposited and patterned through the vacuum evaporation, an organic Pd solvent (ccp 4230 made by Okuno Chemicals Corp.) is rotationally coated on it by a spinner and then heated and baked at 300° C. for 10 minutes. The thickness of the electrically conductive thin film 2004 which is formed of fine grains and made of PdO as the main element thus formed is 10 nm, and the sheet resistance is $5\times10^4$ Ω/square.

Thereafter, the Cr film and the electrically conductive thin film 4 which has been baked are etched by an acid etchant to form a desired pattern.

Step-g

A pattern designed to coat a resist except for the contact hole 2152 portion is formed, and then a Ti film 5 nm in thickness and an Au film 500 nm in thickness are sequentially deposited through the vacuum evaporation method, and an unnecessary portion is removed by lift-off to embed the contact hole 2152 therein.

Through the above processes, the lower wirings 2072, the interlayer insulating film 2151, the upper wirings 2073 and the element electrodes 2002, 2003, the electrically conductive film 2004, and so on are formed on the insulating substrate 2071. The resistances of the lower wirings, the upper wirings and the electrically conductive thin film thus formed are about 5 Ω, 3 Ω and 300 Ω, respectively.

[Conditioning Process]

Subsequently, the electron source substrate manufactured in the above manner is subjected to a conditioning process by the device structured as shown in FIGS. 23 and 24.

First, an indium sheet (the electrically conductive takeoff member) 2014 which is 500 $\mu$m in thickness and 5 mm in width are press-fitted on end portions of the upper and lower wirings with respect to the electron source substrate 2071, all the wirings are made common and grounded, and then fixed onto the mechanical stage 2013.

Because the area of the electron source substrate in this embodiment is larger than the above-described Sth, an electrode smaller than Sth is used as th high voltage application electrode. In other words, the high voltage application electrode 100 mm in the X-direction and 500 mm in the Y-direction is used. In this case, the area opposite to the electron source substrate is 0.05 $m^2$. The high voltage application electrode is connected to the high voltage power supply through the limit resistor of 5 MΩ.

Thereafter, the mechanical stage 2013 is moved in the Z-direction so that a distance to the high voltage application electrode becomes 2 mm. Also, a d.c. voltage of 10 kV is applied to the high voltage application electrode.

In this situation, the energy Econ stored in the capacitor formed by the high voltage application electrode and the electron source substrate is $1.1\times10^{-2}$ J. This is the energy Eth or less which is destroyed when the above-described electrically conductive thin film is destroyed during the discharge operation.

The mechanical stage is moved at 10 mm/min in the X-direction and allowed to pass through the high voltage application electrode. In this situation, a period of time required for allowing the electron source substrate to pass through the high voltage application electrode is 100 minutes.

Also, the current that flows between the high voltage application electrode and the electron source substrate is measured at the voltage at both ends of the control resistor. In this process, the discharge phenomenon in which a current of 10 $\mu$A or more flows between the electron source substrate was observed 4 times.

Thereafter, the high voltage power supply is turned off, the electron source substrate is detached from the device, and the indium sheet 2014 is removed from the electron source substrate.

The resistance of the respective elements is about 300 Ω before this conditioning process, but a large difference in the resistances of the respective elements was not measured after this process.

Subsequently, using the electron source substrate, the image forming apparatus structured as shown in FIG. 40 is manufactured as follows.

After the substrate 2071 on which a large number of plane type surface conduction electron emission elements are fixed onto the rear plate 2081, the face plate 2086 (which is structured in such a manner that the fluorescent film 2084 and the metal back 2085 are formed on an inner surface of the glass substrate 2083) is disposed 3mm above the substrate 2001 through the support frame 2082. Then, a flit glass is coated on the joint portions of the face plate 2086, the support frame 2082 and the rear plate 2081 and baked in the atmosphere at 410° C. for 10 minutes or longer so that those members are sealingly attached to each other, to thus prepare the envelope 2088. Also, the substrate 2071 is also fixed onto the rear plate 2081 by the flit glass. In FIG. 40, reference numeral 2074 denotes an electron emission element, 2072 and 2073 are the X-directional wirings and the Y-directional wirings, respectively.

The fluorescent film 2084 is formed of a color fluorescent film arranged in the black stripes which is made up of the black electrically conductive material 2091 and the phosphor 2092. The black stripes are formed in advance, and the respective phosphors of the respective colors are coated on the respective gap portions, to thereby prepare the fluorescent film 2084. The method of coating the phosphors on the glass substrate is a slurry method. The metal back 2085 is disposed on the inner surface side of the fluorescent film 2084. The metal back 2085 is produced by smoothing the inner surface of the fluorescent film (normally called "filming") after the fluorescent film is produced and then by vacuum-evaporating Al. In conducting the above-described sealing, because the phosphors of the respective colors are made to correspond to the electron emission elements in a case of color, sufficient positioning is conducted.

The envelope 2088 thus completed is connected to the vacuum device from which gas is exhausted by the magnetic floating type turbo regulator pump through an exhaust pipe (not shown).

Thereafter, gas is exhausted from the envelope 2088 to $1.3\times10^{-4}$ Pa.

[Forming Process]

A voltage is applied between the electrodes 2002 and 2003 of the electron emission element 2074 through the vessel external terminals Dox1 to Doxm (m=2000) and Doy1 to Doyn (n=1100), and the electron emission portions 2005 are produced by conducting the electrification processing (forming process) on the electrically conductive film 2004.

The voltage waveform of the forming process is shown In FIG. 36B. In FIG. 36B, T1 and T2 are the pulse width and the pulse interval of the voltage waveform, and in this embodiment, T1 is set to 1 msec, and T2 is set to 10 msec, and the peak value (peak voltage during the forming process) steps up by 0.1 V step, to conduct the forming process. Also, a resistance measuring pulse is inserted between T2 at a voltage of 0.1 V at the same time during the forming process to measure the resistance. The completion of the forming process is made when the measured value by the resistor measuring pulse becomes about 1 MΩ or more, and at the same time, the application of voltage to the element is completed. The forming voltage VF of the respective elements is 10.0 V.

The electron emission portions 5 thus produced becomes in a state where fine grains that mainly contain paradium elements are dispersed, and the fine grains are 3 nm in average grain diameter.

Subsequently, benzonitrile of $6.6\times10^{-4}$ Pa is introduced into the envelope 2088.

The vessel external terminals Dox1 to Doxm (m=2000) are made common, and a power supply (not shown) is sequentially connected to Doy1 to Doyn (n=1100), and a voltage is applied between the electrodes 2002 and 2003 of the corresponding electron emission elements 2074 to conduct the activating process.

The voltage applying conditions during the activating process is that there are used the chopping waves of both poles (FIG. 36B) in which the peak value is ±10 V, the pulse width is 0.1 msec, and the pulse interval is 5 msec. Thereafter, the peak value gradually increases from ±10 V to ±16 V at a rate of 3.3 mV/sec, and the voltage application is completed when it reaches ±16 V.

Thereafter, benzonitrile is exhausted from the envelope 2088.

Finally, after baking is conducted at 150° C. for 10 hour under a pressure of about $1.33\times10^{-4}$ Pa as the stabilizing process, the exhaust pipe not shown is heated by a gas burner and welded to seal the envelope 2088.

In the image forming apparatus thus completed in accordance with the present invention, the scanning signal and the modulation signal are supplied to the respective electron emission elements through the vessel external terminals Dox1 to Doxm (m=2000) and the terminals Doy1 to Doyn (n=1100) by signal generating means not shown, to thereby emit the electron, and a high voltage of 10 kV is applied to the metal back 2085 through the high voltage terminal Hv, and the electron beams are accelerated to collide with the fluorescent film 2084 to conduct excitation and light emission, thus displaying an image.

A variation of the emitted current (Ie) of the respective electron emission elements (dispersion σ/average R) in the image display is 8%.

As described above, even in the manufacture of the large area electron source substrate, the conditioning process can be implemented without giving a damage to the electron emission elements, and the discharge during the image forming operation can be suppressed, and the electron source substrate having the uniform characteristic can be provided.

Example 2

This embodiment shows an example in which the conditioning process according to the present invention is conducted after the forming process to prepare the electron source substrate.

This embodiment is also an example in which the image forming apparatus is manufactured.

On the electron source substrate of the embodiment, there are formed 720 on the X-directional wirings and 240 on the Y-directional wirings of election emission elements. Also, the size of the electron source substrate is 200 mm in the X-direction and 150 mm in the Y-direction.

The structure and the manufacturing method of the electron source substrate are conducted in the same manner as that in the example 1 till the conditioning process.

[First Conditioning Process]

A first conditioning process is conducted on the electron source substrate according to this embodiment. The size of the high voltage application electrode is 200 mm in the X-direction and 150 mm in the Y-direction. In this process, the electron source substrate is maintained at a position facing the high voltage application electrode for 30 minutes. Other methods such as the limit resistor (5 MΩ), the voltage applied to the high voltage application electrode (10 kV), a distance (2 mm) between the high voltage application electrode and the electron source substrate, etc. are applied as in the example 1.

In this situation, the energy Vcon stored in the capacitor formed by the high voltage application electrode and the electron source substrate is $6.6\times10^{-3}$ J. This is the energy Eth or less which is destroyed when the above-described electrically conductive thin film is destroyed during the discharge operation.

In this process, one discharge operation is observed. Although the resistances of the respective elements are about 300 Ω before this process, a large difference in the resistances of the respective elements is not measured after this process.

[Forming Process]

The electron source substrate manufactured as described above is located within the device of FIG. 37, and gas is exhausted from the interior of the vacuum evaporation 2055 to conduct the forming process. In this situation, as shown in FIG. 25, the Y-directional wirings 2073 are connected to the common electrode 2141, a voltage pulse is applied to the element connected to one of the X-directional wirings 2072 by the power supply 2142 at the same time to conduct the forming process. The conditions such as the shape of the pulse and the evaluation of the end of processing is carried out under the same method as the example 1. The same operation is sequentially conducted on the respective X-directional wirings 2072 to conduct the forming on all the elements. The forming voltage VF is 5.0 V.

Subsequently, benzonitrile of $6.6\times10^{-4}$ Pa is introduced into the envelope 2055 to conduct the activation.

As in the forming process, as shown in FIG. 25, the Y-directional wirings 2073 are connected to the common electrode 2141, and a voltage pulse is applied to the element connected to one of the X-directional wirings 2072 by the power supply 2142 at the same time to conduct the activation. The voltage application conditions use a chopping wave of both poles (FIG. 36B) in which the peak value is ±5 V, the pulse width is 0.1 msec, and the pulse interval is 5 msec. Thereafter, the peak value gradually increases from ±5 V to ±14 V at a rate of 3.3 mV/sec, and the voltage application is completed when it reaches ±14 V. The same operation is conducted sequentially on the respective X-directional wiring 2072 to activate all the elements.

Thereafter, benzonitrile is exhausted from the envelope 2055.

Finally, baking is conducted at 150° C. for 10 hours under a pressure of about $1.33\times10^{-4}$ Pa as the stabilizing process.

A voltage of 10 kV is applied to the anode electrode 2054 located 3 mm above the electron source substrate thus manufactured by the high voltage power supply to drive the elements on the electron source substrate. Here, the anode electrode as used is that a monochrome fluorescent film and a metal back is disposed on the entire surface of the glass substrate on which a transparent electrode is formed.

As in the forming process, as shown in FIG. 25, the Y-directional wirings 2073 are connected to the common electrode 2141, and a voltage pulse is applied to the element connected to one of the X-directional wirings 2072 by the power supply 2142 at the same time to drive the elements. The voltage waveform is shown in FIG. 36A. In FIG. 36A, T1 and T2 are the pulse width and the pulse interval of the voltage waveform, and in this embodiment, T1 is set to 16.7 msec, and T2 is set to 1 msec, and the peak value is 15 V.

At this time, a slight light emission was seen in a part of the electron source substrate in a d.c. manner. Because the fine slight light emission leads to discharge that causes the deterioration of the element during the subsequent driving operation, the conditioning process is conducted again.

[Second Conditioning Process]

Figure 28:
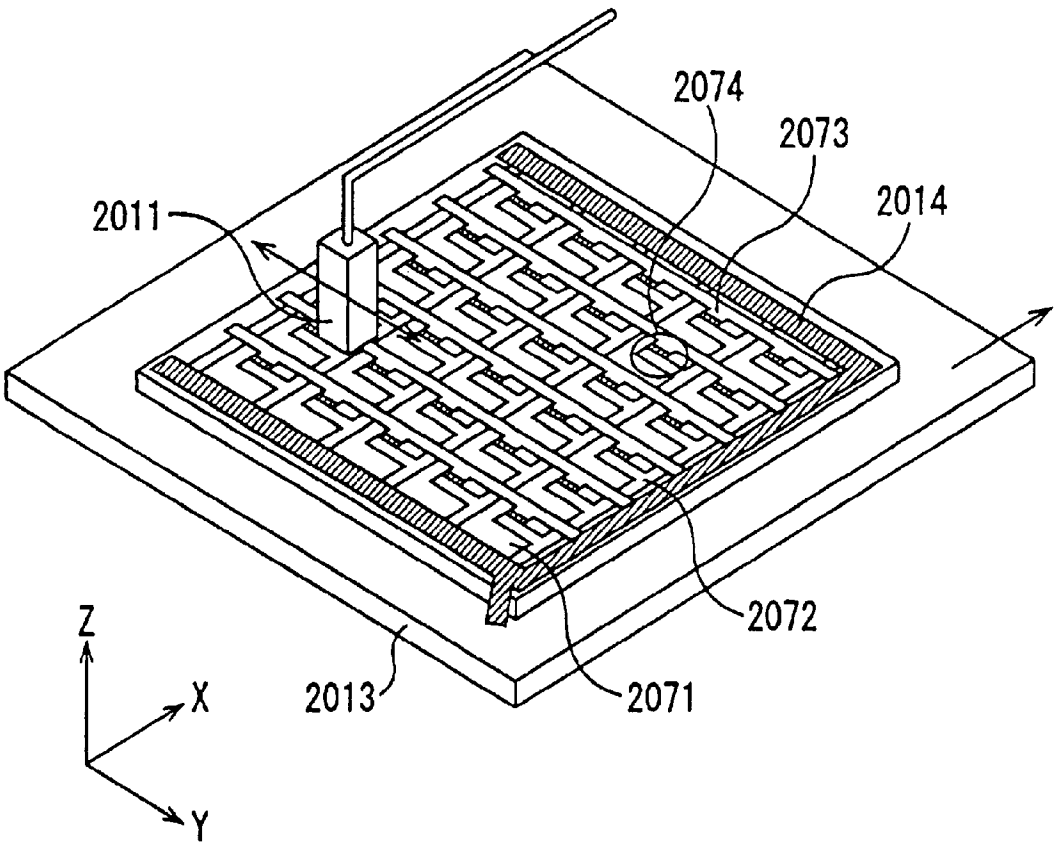
FIG. 28 is a schematic view showing a conditioning process of an electron source substrate to which the present invention is applicable.
Figure 29:
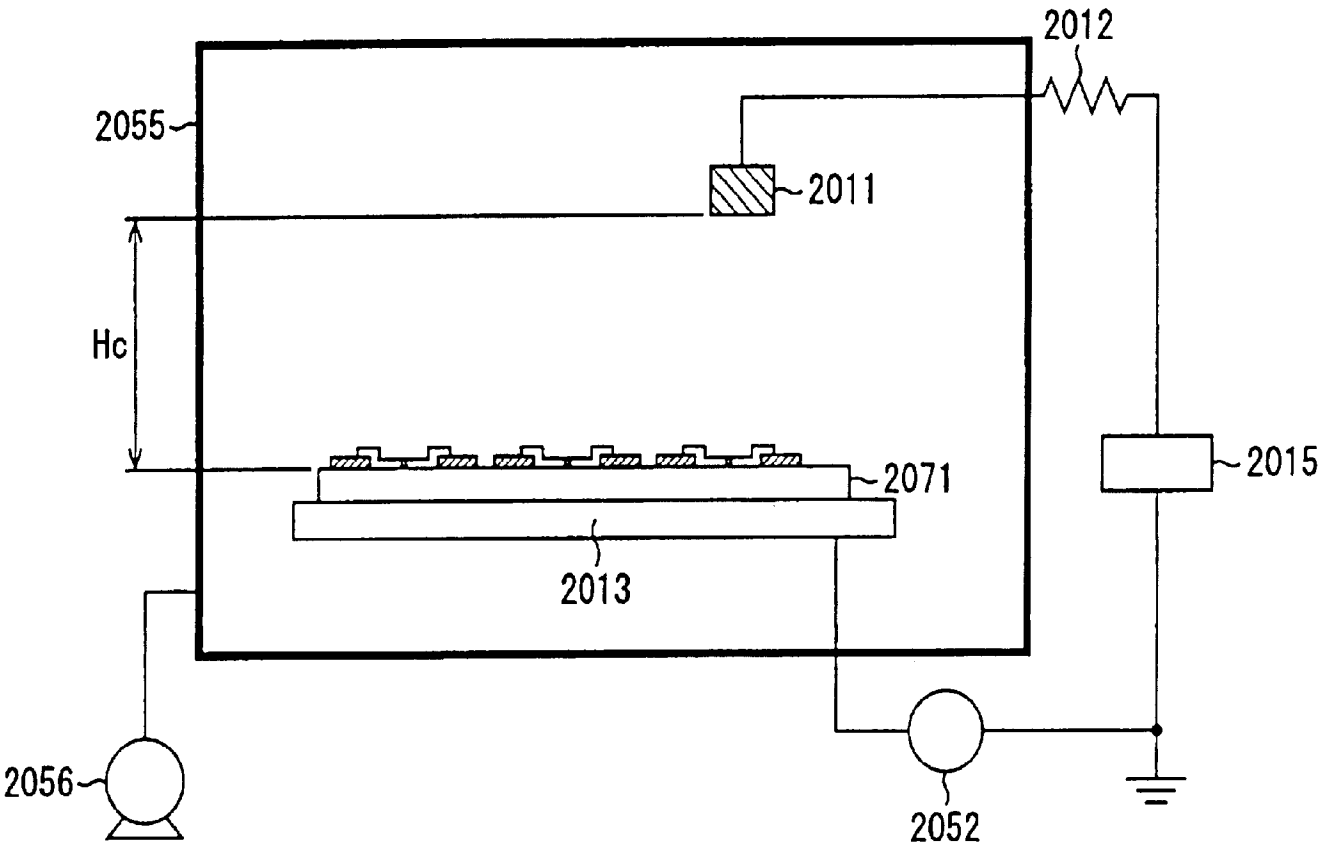
FIG. 29 is a schematic view showing a vacuum exhaust device for conducting the conditioning process of an electron source substrate to which the present invention is applicable.

This conditioning process is implemented by the electric field applying device structured as shown in FIGS. 28 and 29.

First, an indium sheet 2014 which is 500 μm in thickness and 5 mm in width are press-fitted on the end portions of the upper and lower wirings with respect to the electron source substrate 2071, and all the wirings are made common and grounded, and then fixed onto the mechanical stage 2013. The high voltage application electrodes 2011 as used is 1 mm in both of the X-direction and the Y-direction. At this time, the area opposite to the electron source substrate is $1\times10^{-6}$ $m^2$. The high voltage application electrode 2011 is connected to the high voltage power supply through the limit resistor 2012 of 5 MΩ. Thereafter, the mechanical stage 2013 is moved in the Z-direction so that a distance to the high voltage application electrode 2011 becomes 2 mm. Also, a d.c. voltage of 12 kV is applied to the high voltage application electrode 2011 by the high voltage power supply 2015.

At this time, the energy Econ stored in the capacitor formed by the high voltage application electrode 2011 and the electron source substrate 2071 is $3.2\times10^{-7}$ J. This is the energy Eth or less which is destroyed in the above-described electrically conductive thin film discharge operation.

The mechanical stage 2013 is moved at 10 mm/min in the X-direction and the high voltage application electrode 2011 is allowed to repeatedly reciprocate the width of 10 mm in the Y-direction at 100 mm/min. At this time, the mechanical stage 2013 is moved so that a region where the above-described slight light emission is observed passes below the high voltage application electrode 2011.

Also, the current that flows between the high voltage application electrode 2011 and the electron source substrate 2071 is measured at the voltage at both ends of the limit resistor 2012. In this process, the discharge phenomenon in which a current of 10 $\mu$A or more flows between the electron source substrate was observed 1 time.

Thereafter, the high voltage power supply is turned off, the electron source substrate 2071 is detached from the device; and the indium sheet 2014 is removed from the electron source substrate 71.

The electron source substrate 2071 is located within the device shown in FIG. 27 again, and the elements on the electron source substrate are driven in the same manner as this conditioning process. The slight light emission which has been measured is not found. Also, the emission current of the electron emission elements is not changed.

As described above, even in the process after the forming process, the conditioning process can be implemented without giving a damage to the electron emission elements on the electron source substrate. As a result, the electron source substrate thus manufactured can be efficiently provided.

Example 3

This embodiment shows an example in which a conditioning process is conducted by using a plurality of high voltage application electrodes. The structure and the manufacturing method of the electron source substrate are conducted in the same manner as that in the example 1 until the conditioning process. The high voltage application electrodes used in the conditioning process as used is 10 electrodes which are the same configuration as that used in the example 1. The respective electrodes are disposed at the intervals of 10 mm in the X-direction. The same manner such as the voltage applied to the respective high voltage application electrodes (10 kV), a distance between the respective high voltage application electrodes and the electron source substrate (2 mm), etc., are conducted except that the respective electrodes are connected to the high voltage power supply through the limit resistor (5 MΩ), respectively. Also, the movement of the mechanical stage is conducted in the same manner as that in the example 1. However, a period of time required to allow an arbitrary point of the electron source substrate to pass through at least any one of the high voltage application electrodes is about 10 minutes. In this process, the discharge operation of 3 times is observed, and the same effects as those in the example 1 is obtained.

As described above, the conditioning process can be conducted in a short period of time by using a plurality of high voltage application electrodes.

Example 4

In this embodiment, a voltage is controlled so that a leader current flows between the electron source substrate and the electrode opposite to the electron source substrate during the conditioning process.

Through this manner, the voltage application can be conducted without generating the discharge which occurs instantly.

Third Embodiment

Hereinafter, a preferred embodiment mode of the present invention will be described together with reference to specific data. In the following description, all the rear plate during the manufacturing process, that is, "substrate on which the electrodes are formed" and so on are called rear plate for convenience.

Embodiment 1)

Figure 46:
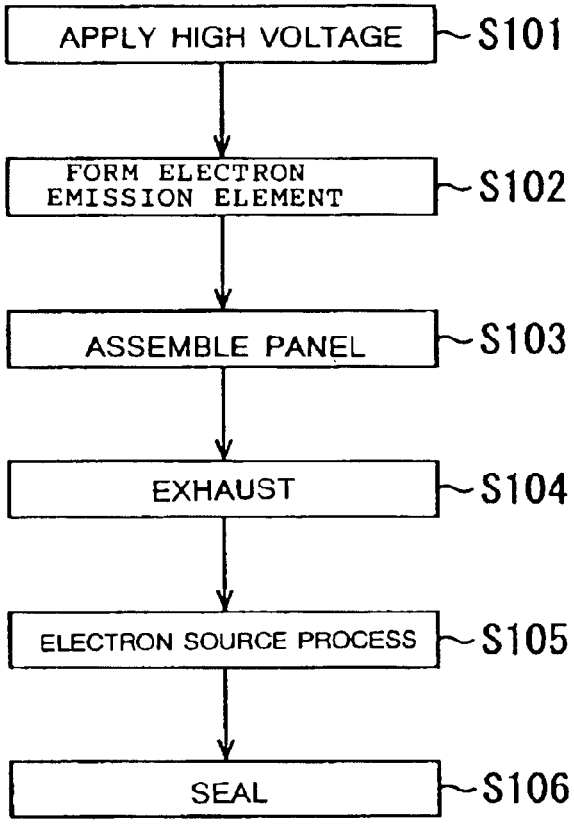
FIG. 46 is a diagram showing a flow of processes in a method of manufacturing an image forming apparatus in accordance with the present invention.

First, a flow of a process of a method of manufacturing an image display device in accordance with the present invention will be described in brief with reference to FIG. 46.

First, the rear plate (substrate on which the electrodes are formed) is set in the vacuum chamber, and a process of applying a high voltage to the rear plate which is the feature of the present invention is conducted after the vacuum exhaust (Step S101). The element electrodes and the wirings are formed on the rear plate, but the electron emission elements are not yet formed. In this example, this process is a process of applying a high voltage to the cathode plate as a pre-processing in a process before sealing (paneling) and conducted on the rear plate substrate on which the electrode is formed before the electron beam source is completed. The detail will be described later. This process can be conducted in vacuum or gas.

In particular, in this process, it is preferable that a high voltage is applied between the substrate on which the electrodes are formed and a dummy face plate with an electrode which is opposite to the substrate. Also, it is preferable that the substrate has a feeder wiring to the electron emission element, and a high voltage is applied with the wiring as one electrode and the dummy face plate as the other electrode. For example, in the case where the substrate on which the electrodes are formed has a plurality of row-directional wirings and a plurality of column-directional wirings for feeder for wiring a plurality of electron emission elements in a matrix, and all of the row-directional wirings and the column-directional wirings are made common, a high voltage is applied with the wirings as one electrode and the dummy face plate as the other electrode. The high voltage as used is a d.c. voltage that gradually steps up from a low voltage, an a.c. voltage that gradually steps up from a low voltage, a pulse voltage that gradually steps up from a low voltage, etc.

The process will be described in detail later.

Subsequently, the electron emission elements are formed on the rear plate (Step S102). The surface conduction type emission element are used as the electron emission element in this example. The detail will be described later.

Then, the airtight vessel made up of the rear plate, the side walls, the face plate with the phosphors, the spacer with an atmospheric pressure resistant structure, etc., is assembled (Step S103). The assembling method will be described in detail later.

Subsequently, gas is exhausted to a vacuum of about $1.3\times10^{-4}$ Pa from the interior of the airtight vessel through the exhaust pipe (Step S104). The exhausting method will be described in detail later.

Then, the electron source process necessary for operating the surface conduction type emission element is conducted (Step S105). Specifically, the process consists of an electrification forming process for forming the electron emission portions and an electrification activating process for improving the electron emission characteristic. Those processes will be described in detail later.

Finally, the exhaust pipe is sealed (Step S106).

The two purposes of applying the high voltage to the rear plate which is the feature of the present invention are stated below.

First, a significant defective product is found out as soon as possible to improve the manufacture yield.

In the conventional manufacturing method, the high voltage equivalent to the image display is applied in a final stage after the electron source process. On the contrary, since the process of applying the high voltage is conducted further before, the defective product to which the high voltage cannot be applied is found, and the subsequent process can be interrupted. It is presumed that the impossibility of application of the high voltage is in a state where discharge is continuously generated for the reasons of dust attachment, the configuration defect, etc., and the withstand voltage is not improved.

Second, the discharge source that is caused by the rear plate is removed by the so-called conditioning effect to improve the insulating withstand voltage and the discharge withstand voltage.

The conditioning effect will be described with reference to the schematic view of FIG. 47.

Figure 47:
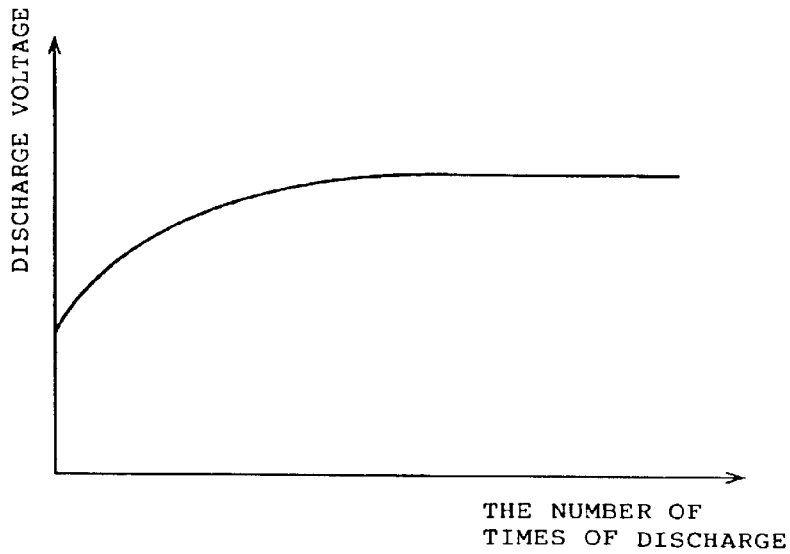
FIG. 47 is a diagram for explanation of a conditioning effect in accordance with the present invention.

In FIG. 47, the axis of abscissa is the number of times of discharges, and the axis of ordinate is the discharge voltage at this time. It is apparent from the figure that the discharge voltage steps up with an increase in the number of times of discharges, and the withstand voltage is improved.

That the discharges are repeated to improve the withstand voltage is generally called conditioning effect. It is presumed that the factors that produce the conditioning effect are a removal of the adsorbed gas or attachment, a reduction of the electric field emission electron current due to smoothing the fine protrusion, an improvement in the surface configuration due to heat melting, etc. The details are not proved now.

Also, because the causes of the vacuum discharge are almost on the cathode side, the process of applying the high voltage to the rear plate which is the cathode in the image forming apparatus of this example for the purpose of improving the yield and conditioning as described above is very effective.

In the image forming apparatus using the surface conduction type emission element, the conditioning effect is found. However, as described above, since there arise the problems that a damage of the discharge on the surface conduction type emission elements is large, and the elements around the discharge portion are remarkably deteriorated, the conditioning process could not be implemented up to now.

On the other hand, according to the present invention, the discharge withstand voltage is improved by the conditioning effect, and an element damageless method, that is, a method in which the display image is not adversely affected at all can be provided.

It is presumed that the reasons for which the conditioning of the element damageless can be realized are as follows.

That is, in the process of applying the high voltage, the surface conduction type emission element is not yet formed, a damage due to the discharge accompanied by the conditioning is limited to the wiring and the element electrode. Because the damage is to the degree which does not influence the electric characteristic, an influence on the surface conduction type emission element which will be formed later is not exhibited, and therefore an influence on the display image is not exhibited at all. In fact, as a result that the present inventors have observed the rear plate after the conditioning process, although the deformation or chip occurs on the wirings and the element electrode in the vicinity of the discharge portion, the electric characteristic defect (disconnection, short-circuiting, etc.) is not recognized.

As described above, the most significant feature of the present invention resides in the order of the processes. That is, the feature of the present invention resides in that a high voltage is applied to the rear plate before the vacuum vessel is formed, that is, before the electron source element is formed, to thereby improve the discharge withstand voltage of the image forming apparatus without adversely affecting the electron source characteristic.

Subsequently, the process of applying a high voltage to the rear plate which is the feature of the present invention will be described in detail.

Figure 48:
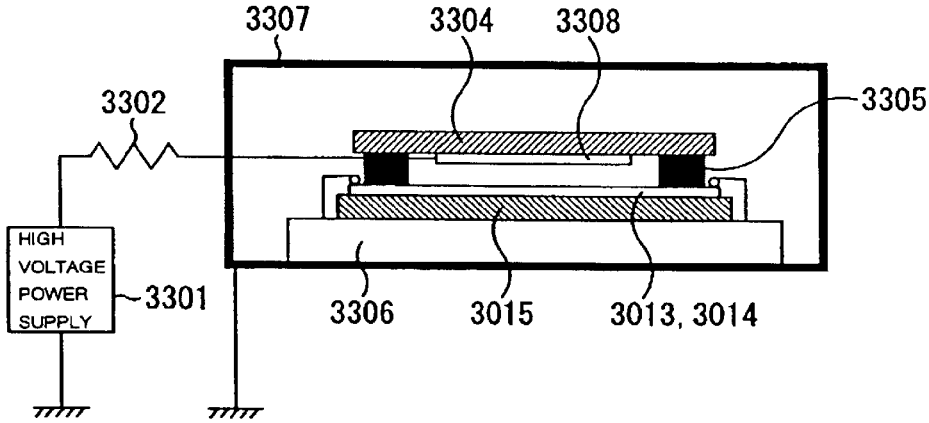
FIG. 48 is a schematic view showing a device for implementing a method of manufacturing an image forming apparatus in accordance with the present invention.

FIG. 48 shows the rough structure of this example, First, the rear plate 3015, the dummy face plate 3104 which is the opposite electrode, and the gap retaining dummy frame 3305 are set in a jig 3306 as shown in FIG. 48. The dummy face plate 3304 used in this example is obtained by coating the ITO transparent electrode 3108 identical in size with the display screen on a glass plate (6 mm in thickness) identical in area with the actual face plate, on which a high voltage application takeoff wiring not shown is disposed.

The dummy frame 3305 is disposed at a position of the frame when the actual image forming apparatus is assembled, and the thickness determines a gap between the rear plate 3015 and the dummy face plate 3304 (2 mm in this example).

A plurality of row-directional wirings 3013 and a plurality of column-directional wirings 3014 on the rear plate 3015 all become GND potential through the vacuum chamber 3307 by the leaf spring structure of a metal jig 3306.

The jig is set in the vacuum chamber 3307, and the process of applying the high voltage to the rear plate is conducted after vacuum exhaust. The rear plate is formed with the element electrodes and the wirings, but the electron emission elements are not yet formed. The method of forming the element electrodes, the wirings and the electron emission elements will be described later.

In this example, the vacuum vessel is kept to a vacuum of about $1.3\times10^{-5}$ Pa.

A high voltage d.c. power generating device 3301 is connected to the ITO transparent electrode 3308 through a current introduction terminal not shown which is fitted onto the chamber and a high voltage takeoff wiring not shown on the dummy face plate 3304.

Figure 49:
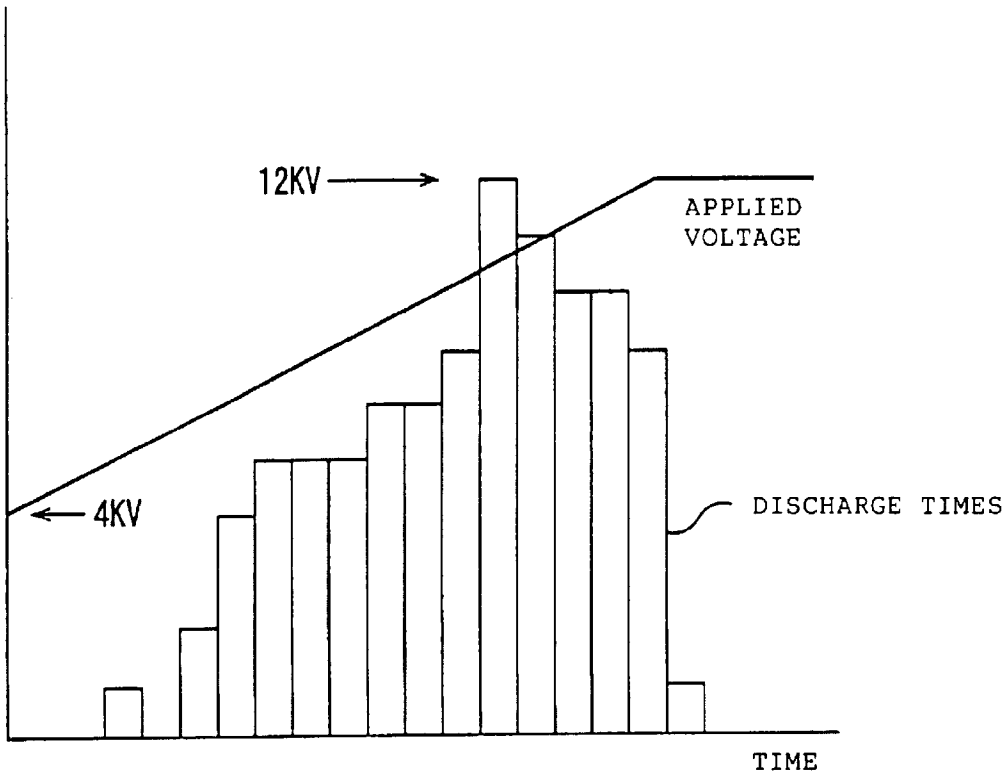
FIG. 49 is a diagram showing a supply voltage and the number of times of discharge in a method of manufacturing an image forming apparatus in accordance with the present invention.

FIG. 49 is a schematic view showing a supply voltage and the number of times of discharges with a time.

The supply voltage is a d.c. voltage and steps up at a rate of 500 V/5 minutes until 4 kV to 12 kV as shown in the figure, and maintained at 12 kV for 15 minutes. In this example, the supply voltage steps up at a given rate, and may step up at a step state.

Observation starts when the discharge slightly exceeds 4 kV, and the discharge increases up to about 10 kV. Thereafter, the discharge is turned to decrease and after the discharge is maintained at 12 kV, it becomes 0 soon. This is caused by the above-described conditioning effect.

The above voltage, the step-up rate, the retaining period of time, etc., are preferred values for the image forming apparatus of the present invention, and it is desirable that the conditions are appropriately changed if the design is changed. In this case, it is necessary that at a voltage of the required accelerating voltage or higher for the image display, the voltage is maintained for a sufficient period of time after the discharge is not observed.

With the image display device manufactured through the above processes, an excellent display image without discharge can be obtained.

(1) The Summary of an Image Display Device

Subsequently, a description will be given of the structure and a manufacturing method of a display panel in an image display device to which the present invention is applied.

Figure 51:
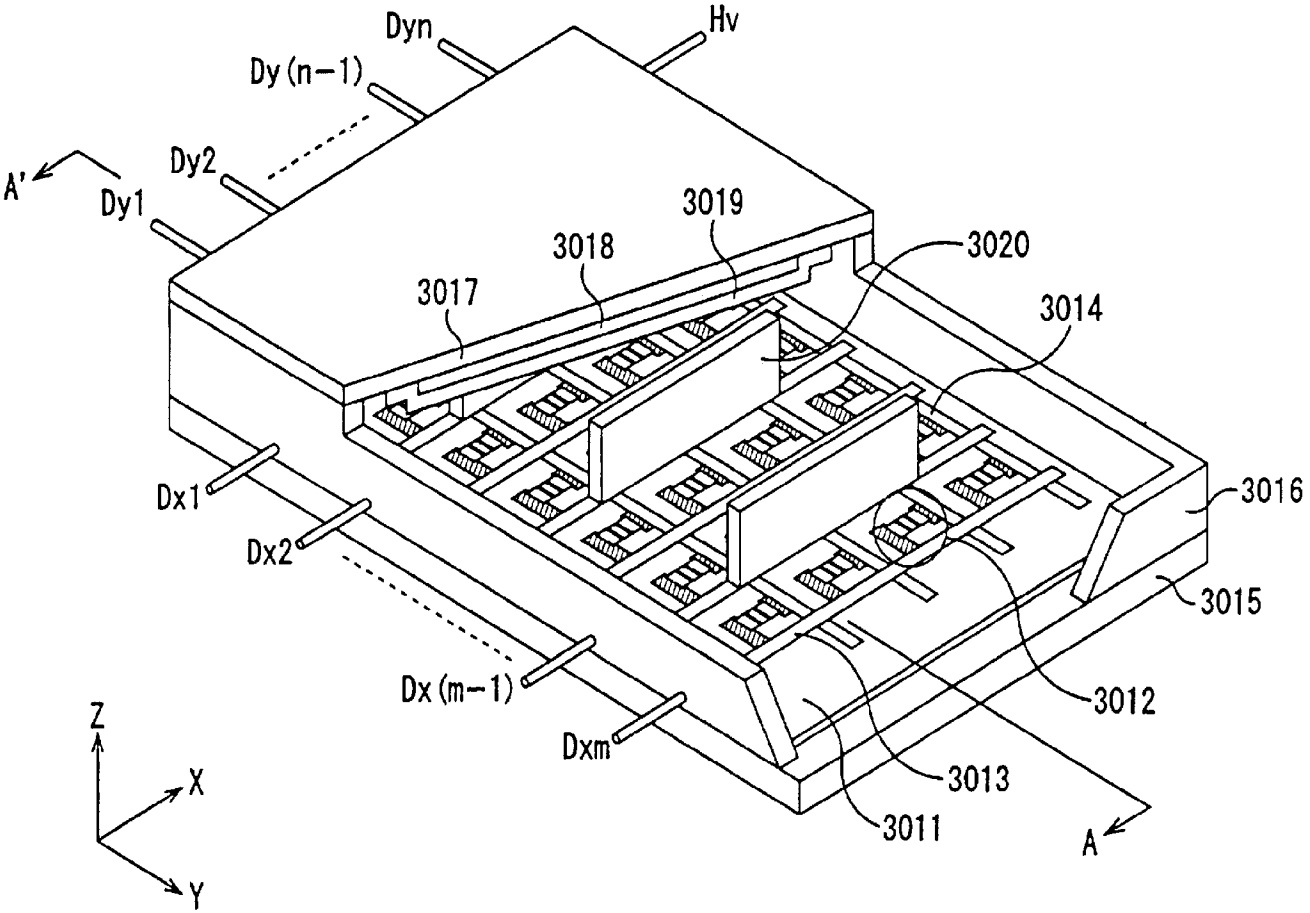
FIG. 51 is a perspective view showing an image display device in accordance with an embodiment of the present invention in which a part of a display panel is cut out.

FIG. 51 is a perspective view showing a display panel used in this embodiment in which a part of the panel is cut off in order to show the internal structure.

In the figure, reference numeral 3015 denotes a rear plate, 3016 is a side wall, and 3017 is a face plate, in which the members 3015 to 3017 constitute an airtight vessel for maintaining the interior of a display panel in a vacuum state. In assembling the airtight vessel, it is necessary to seal the joint portions of the respective members in order to maintain the sufficient strength and airtightness. For example, the joint portions are coated with flit glass and then baked at 400 to 500° C. in the atmosphere or nitrogen atmosphere for 10 minutes or longer, to thereby achieve the sealing. A method of exhausting the gas in the interior of the airtight vessel into vacuum will be described later. Also, since the interior of the above airtight vessel is maintained in the vacuum state of about $1.3\times10^{-4}$ Pa, the spacers 3020 are disposed as an atmospheric pressure resistant structural body for the purpose of preventing the airtight vessel from being destroyed due to the atmospheric pressure, an unintentional impact, etc.

The spacer 3020 needs to provide insulation sufficient to resist the high voltage applied between the row-directional wirings 3013 and the column-directional wirings 3014 on the substrate 3011 and the metal back 3019 on the inner surface of the face plate 3017. As occasion demands, for the purpose of preventing the electric charge onto the surface of the spacer 3020, a semiconductor film may be disposed on the vacuum exposed portion.

In the mode described here, the configuration of the spacer 3020 is of a thin plate, and disposed in parallel with the row-directional wirings 3013 and fixed by coating, for example, flit glass on the joint portion and baking the flit glass in the atmosphere or the nitrogen atmosphere at 400 to 500° C. for 10 minutes or longer.

The rear plate 3015 is fixed with the substrate 3011 on which N×M cold cathode elements 3012 are formed. (N and M are positive integers of 2 or more and appropriately set in accordance with the target number of display pixels. For example, in a display device for the purpose of display of a high-quality television, it is desirable to set the numbers of N=3000 and M=1000, or more.) The N×M cold cathode element are wired in a single matrix by M row-directional wirings 3013 and N column-directional wirings 3014. A portion made up of the above-mentioned members 3011 to 3014 is called "multiple electron beam source".

Subsequently, a description will be given of the structure of a multiple electron beam source in which the surface conduction type emission elements (which will be described later) are arranged on the substrate as the cold cathode elements and wired in a single matrix.

Figure 52:
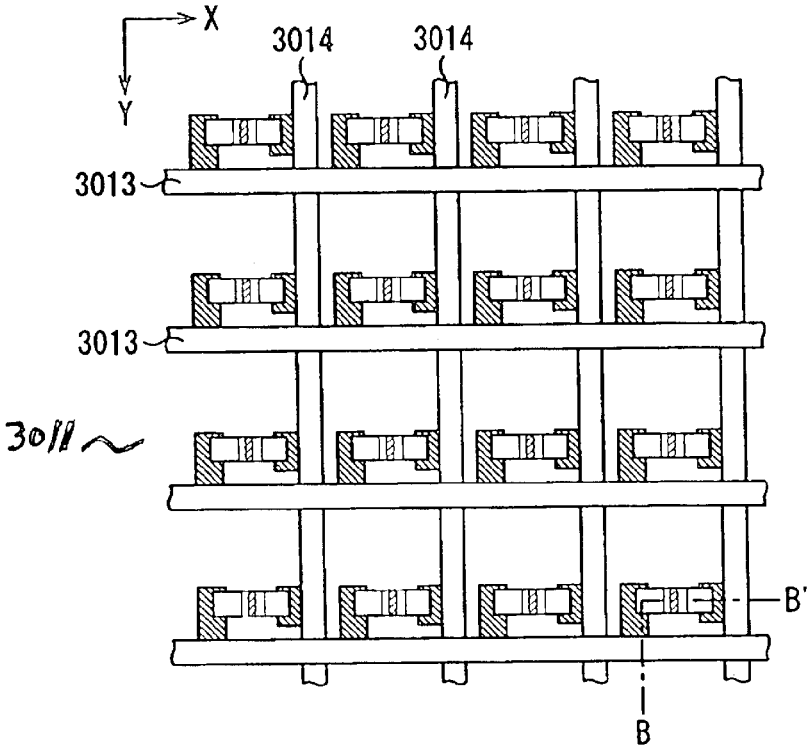
FIG. 52 is a plan view showing a substrate of a multiple electron beam source.

FIG. 52 shows a plan view of the multiple electron beam source used in the display panel shown in FIG. 51. The same surface conduction type emission elements as those shown in FIG. 55 which will be described later are disposed on the substrate 3011, and those elements are wired in a single matrix by the row-directional wirings 3013 and the column-directional wirings 3014. On a portion where the row-directional wirings 3013 and the column-directional wirings 3014 cross each other, insulating layers (not shown) are formed between the electrodes, to thereby maintain electric insulation.

Figure 53:
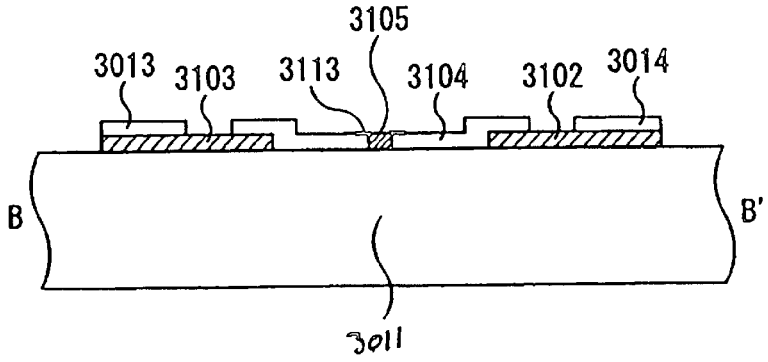
FIG. 53 is a partially cross-sectional view showing a substrate of a multiple electron beam source.

FIG. 53 shows a cross-sectional view taken along a line B–B' of FIG. 52.

The multiple electron source thus structured is manufactured in such a manner where after the row-directional wirings 3013, the column-directional wirings 3014, the interelectrode insulating layer (not shown) and the element electrodes and the electrically conductive thin film of the surface conduction type emission elements have been formed on the substrate in advance, electricity is supplied to the respective elements through the row-directional wirings 3013 and the column-directional wirings 3014 to conduct an electrification forming process and an electrification activating process.

In this embodiment, the substrate 3011 of the multiple electron beam source is fixed on the rear plate 3015 of the airtight vessel. However, in the case where the substrate 3011 of the multiple electron beam source has a sufficient strength, the substrate 3011 per se of the multiple electron beam source may be used as the rear plate of the airtight vessel.

Also, a fluorescent film 3018 is formed on a lower surface of the face plate 3017.

Figure 61A:
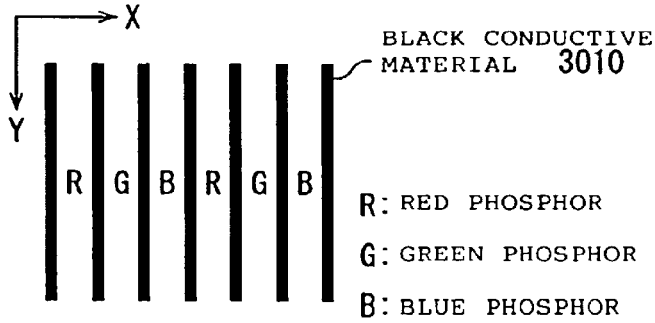
FIGS. 61A to 61C are plan views exemplifying an arrangement of phosphors on a face plate of a display panel.

Because this embodiment is directed to a color display device, phosphors of three primary colors consisting of red, green and blue which are used in the field of CRT are painted on a portion of the fluorescent film 3018, separately. The phosphors of the respective colors are distinguishably painted, for example, in stripes as shown in FIG. 61A, and black electric conductors 3010 are disposed between the stripes of the phosphors. The purposes of providing the black electric conductors 3010 are to prevent the shift of the display colors even if a position to which an electron beam is irradiated is slightly displaced, to prevent the deterioration of display contrast by preventing the reflection of an external light, to prevent the charge-up of the fluorescent film due to the electron beams, etc. The black electric conductor 3010 mainly contains black lead, however a material other than black lead may be used if the material is proper for the above purposes.

Figure 61B:
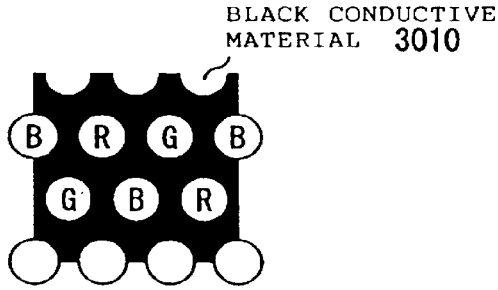
Figure 61C:
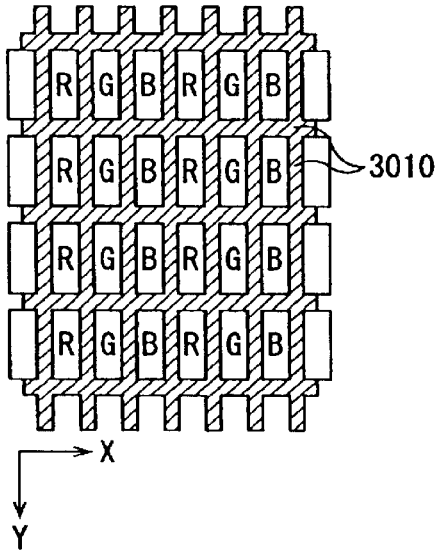

Also, the manner of distinguishably painting the phosphors of three primary colors is not limited to the arrangement of the stripes shown in FIG. 61A, but, for example, an arrangement in the form of delta shown in FIG. 61B or other arrangements (for example, FIG. 61C) may be applied.

In the case of producing a monochrome display panel, a mono-color phosphor material may be used for the fluorescent film 3018, and the black electric conductor may not necessarily be used.

Also, a metal back 3019 known in the field of CRTs is disposed on a surface of the fluorescent film 3018 on the rear plate side. The purposes of providing the metal back 3019 are to improve the light use ratio by partially mirror-reflecting a light emitted from the fluorescent film 3018, to protect the fluorescent film 3018 from collision of negative ions, to operate the metal back as an electrode for applying the electron beam accelerating voltage, to operate the metal back as an electric conductive path of electrons that excite the fluorescent film 3018, etc. The metal back 3019 is formed in such a manner that after the fluorescent film 3018 has been formed on the face plate substrate 3017, the surface of the fluorescent film is smoothed and A1 is vacuum-deposited on the smoothed surface. In the case where the fluorescent film 3018 is made of a phosphor material for a low voltage, the metal back 3019 may not be used.

Also, although being not used in this embodiment, for the purposes of applying the accelerating voltage and improving the electric conductivity of the fluorescent film, for example, a transparent electrode made of ITO may be disposed between the face plate substrate 3017 and the fluorescent film 3018.

Also, Dx1 to Dxm and Dy1 to Dyn and Hv are electric connection terminals with an airtight structure provided for electrically connecting the display panel to an electric circuit not shown. Dx1 to Dxm are electrically connected to the row-directional wirings 3013 of the multiple electron beam source, Dy1 to Dyn are electrically connected to the column-directional wirings 3014 of the multiple electron beam source, and Hv is electrically connected to the metal back 3019 of the face plate, respectively.

Also, in order to exhaust the gas from the interior of the airtight vessel, after the airtight vessel has been assembled, it is connected to an exhaust tube and a vacuum pump not shown, the gas is exhausted from the interior of the airtight vessel to the degree of vacuum of about $1.3\times10^{-5}$ Pa. Thereafter, the exhaust tube is sealed, and in order to maintain the degree of vacuum within the airtight vessel, a getter film (not shown) is formed at a given position within the airtight vessel immediately before sealing or after sealing. The getter film is formed by heating and depositing a getter material that mainly contains, for example, Ba by a heater or a high-frequency heating, and the interior of the airtight vessel is maintained to the degree of vacuum of $1.3\times10^{-3}$ Pa to $1.3\times10^{-5}$ Pa due to the adsorption action of the getter film.

In the image display device using the above-described display panel, when a voltage is applied to the respective cold cathode elements 3012 through the vessel external terminals Dx1 to Dxm and Dy1 to Dyn, electrons are emitted from the respective cold cathode elements 3012. At the same time, when a high voltage of several hundreds of (V) to several (kV) is applied to the metal back 3019 through the vessel external terminal Hv, the emitted electrons are accelerated and collide with the inner surface of the face plate 3017. As a result, the phosphors of the respective colors which form the fluorescent film 3018 are excited to emit a light, thereby displaying an image.

Usually, a supply voltage to the surface conduction type electron emission elements 3012 which are the cold cathode elements is about 12 to 16 V, a distance d between the metal back 3019 and the cold cathode elements 3012 is about 0.1 to 8 mm, a voltage between the metal back 3019 and the cold cathode elements 3012 is about 0.1 kV to 10 kV.

The above description is given of the manufacturing method and the basic structure of the display panel and the outline of the image display device in accordance with the embodiment of the present invention.

(2) Method Manufacturing of Multiple Electron Beam Source

Subsequently, a description will be given of a method of manufacturing a multiple electron beam source used in the image display device of the above example. The multiple electron beam source in the above image display device according to the present invention is used is not limited to the material, the configuration or the manufacturing method of the cold cathode elements if the cold cathode elements are the electron source arranged in a simple matrix. Accordingly, for example, the surface conduction type electron emission element, or the cold cathode element of the FE type, the MIM type or the like can be employed.

However, under the circumstances where the display device large in a display screen and inexpensive is demanded, the surface conduction type electron emission element is particularly preferable among those cold cathode elements. That is, in the FE type, because the relative position and the configuration of the emitter cone and the gate electrode largely influence the electron emission characteristic, the manufacturing technique with an extremely high precision is required. However, this becomes a disadvantageous factor in order to achieve the large area and the reduction of the manufacture costs. Also, in the MIM type, it is necessary to thin the thicknesses of the insulating layer and the upper electrode and also unify the thicknesses. However, this also leads to a disadvantageous factor in order to achieve the large area and the reduction of the manufacture costs. From this viewpoint, in the surface conduction type electron emission element, because the manufacturing method is relatively simple, it is easy to achieve the large area and the reduction of the manufacture costs. Also, the present inventors have found out that among the surface conduction type electron emission elements, the electron emission element in which the electron emission portion or its peripheral portion is formed of a fine grain film is particularly excellent in the electron emission characteristic and is readily manufactured. Accordingly, such an element is most preferable when being used in the multiple electron beam source in the image display device high in luminance and large in screen. Therefore, in the display panel of the above-mentioned embodiment, there is used the surface conduction type electron emission element in which the electron emission portion or its peripheral portion is formed of a fine grain film. First, a description will be given of a basic structure, the manufacturing method and the characteristic in the preferable surface conduction type electron emission element, and thereafter a description will be given of the structure of the multiple electron beam source in which a large number of elements are wired in a simple matrix.

[Preferable Element Structure and Manufacturing Method of Surface Conduction Type Emission Element]

The representative structure of the surface conduction type emission element in which the electron emission portion or its peripheral portion is formed of a fine grain film are classified into two kinds consisting of the plane type and the vertical type.

[Plane Type Surface Conduction Type Emission Element]

First of all, a description will be given of the element structure and the manufacturing method of the plane type surface conduction type emission element.

Figure 55A:
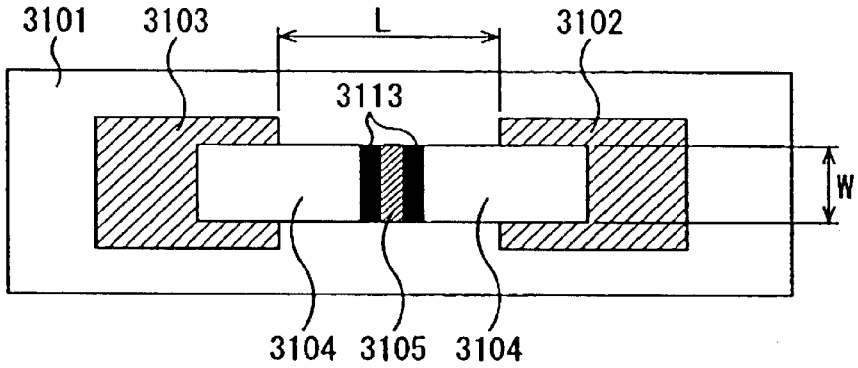
FIGS. 55A and 55B are schematic views showing a plane type surface conduction type emission element.
Figure 55B:
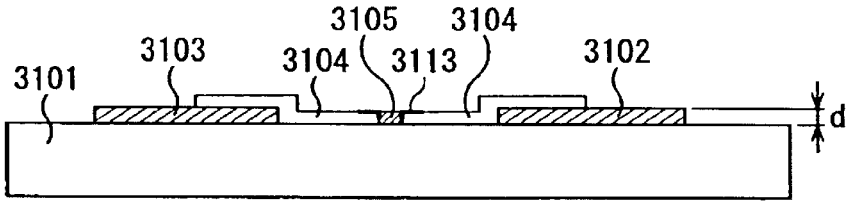

FIGS. 55A and 55B are a plan view and a cross-sectional view for explanation of the structure of the plane type surface conduction type emission element. In the figures, reference numeral 3101 denotes a substrate, 3102 and 3103 are element electrodes, 3104 is an electrically conductive thin film, 3105 is an electron emission portion formed through an electrification forming process, and 3113 is a film formed through an electrification activating process.

The substrate 3101 may be formed of, for example, various glass substrates such as quartz glass or soda lime glass, various ceramics substrate such as alumina, the above-mentioned substrates on which an insulating layer with material of, for example, $SiO_2$ is stacked, etc.

Also, the element electrodes 3102 and 3103 which are disposed on the substrate 3101 and face each other in parallel with the substrate surface are made of electrically conductive material. For example, the material of the element electrodes 3102 and 3103 is appropriately selected from the material consisting of, for example, metal such as Ni, Cr, Au, Mo, W, Pt, Cu, Pd or Ag, or alloy of those metal, metal oxide such as $In_2O_3$—$SnO_2$, or semiconductor material such as polysilicon. The formation of the electrodes can be readily achieved by using the combination of, for example, the film forming technique such as vapor evaporation with the patterning technique such as photolithography or etching. However, those element electrodes 3102 and 3103 may be formed by using other methods (for example, printing technique).

The configuration of the element electrodes 3102 and 3103 can be appropriately designed in accordance with the applied purpose of the electron emission element. In general, the electrode interval L is designed by selecting an appropriate numeral value usually from a range of from several tens of nm to several hundreds of $\mu$m. Among them, the range preferred for applying the electron emission element to the image display device is several $\mu$m to several tens of $\mu$m.

Also, the thickness d of the element electrode is usually selected from an appropriate numeral value of a range of from several tens of nm to several $\mu$m.

Also, the fine grain film is used on a portion of the electrically conductive thin film 3104. The fine grain film described here means a film containing a large number of fine grains as the structural element (also containing the assembly of islands). When investigating the fine grain film microscopically, there are usually observed a structure in which the respective fine grains are isolated from each other, a structure in which the respective fine grains are adjacent to each other, or a structure in which the respective fine grains are overlapped with each other.

The diameter of the fine grains used in the fine grain film is in a range of from several nm to several hundreds of nm, and more preferably in a range of from 1 nm to 20 nm. Also, the thickness of the fine grain film is appropriately set taking the various conditions stated below into consideration. That is, the various conditions are a condition required for electrically satisfactorily connecting the fine grain film to the element electrodes 3102 or 3103, a condition required for satisfactorily conducting the electrification forming which will be described later, a condition required for setting the electric resistance of the fine grain film per se to an appropriate value which will be described later, etc. Specifically, the electric resistance is selected in a range of from several nm to several hundreds of nm, and most preferably in a range of from 1 nm to 50 nm.

Also, the material used for forming the fine grain film may be, for example, metal such as Pd, Pt, Ru, Ag, Au, Ti, In, Cu, Cr, Fe, Zn, Sn, Ta, W, or Pd, oxide such as PdO, $SnO_2$, $In_2O_3$, PbO, or $Sb_2O$, boride such as $HfB_2$, $ZrB_2$, $LaB_6$, $CeB_6$, $YB_4$ or $GdB_4$, carbide such as TiC, ZrC, HfC, TaC, SiC or WC, nitride such as TiN, ZrN or HfN, semiconductor such as Si or Ge, and carbon, from which an appropriate material is selected.

As described above, the electrically conductive thin film 1104 is formed of the fine grain film, and its sheet resistance is set in a range of $10^3$ to $10^7$ Ω/square.

Because it is desirable that the electrically conductive thin film 3104 and the element electrodes 3102, 3103 are electrically satisfactorily connected to each other, portions of the respective members are superimposed on each other.

The superimposing manner is that in the example of FIG. 55, where the substrate, the element electrodes, and the electrically conductive thin film are stacked on each other in the stated order from the bottom, but depending on the occasion, the substrate, the electrically conductive thin film and the element electrodes may be stacked on each other in the stated order from the bottom.

Also, the electron emission portion 3105 is a crack portion formed on a portion of the electrically conductive thin film 3104 and electrically has a higher resistant property than the electrically conductive thin film. The crack is formed by conducting the electrification forming process which will be described later with respect to the electrically conductive thin film 3104. There is a case in which the fine grains several nm to several tens of nm in grain diameter are disposed within the crack. Because it is difficult to show the position and the configuration of the actual electron emission portion with precision and accuracy in the figure, it is schematically shown in FIG. 55.

Also, the thin film 3113 a thin film made of carbon or carbon compound and coats the electron emission portion 3105 and its vicinity. The thin film 3113 is formed by conducting the electrification activating process which will be described later after the electrification forming process.

The thin film 3113 is made of any one of mono-crystal graphite, poly-crystal graphite and amorphous carbon, or the mixture thereof, and the thickness is set to 50 nm or less, and more preferably set to 30 nm or less.

Because it is difficult to show the position and the configuration of the actual thin film 3113 with precision in the figure, it is schematically shown in FIG. 55. Also, FIG. 55A shows an element from which a part of the thin film 3113 is removed.

The above description is given of the basic structure of the preferred element, and a specific structure will be described below.

That is, the substrate 3101 is made of soda lime glass, and the element electrodes 3102 and 3103 are formed of Ni thin films. The thickness d of the element electrodes is 100 nm, and the electrode interval L is 2 $\mu$m. As the main material of the fine grain film, Pd or PdO is used and the thickness of the fine grain frame is about 10 nm and the width is 100 $\mu$m.

Subsequently, a description will be given of a method of manufacturing the preferred plane type surface conduction type emission element. FIGS. 54A to 54D are cross-sectional views for explanation of a process of manufacturing the surface conduction type emission element, and the references of the respective members are identical with those in FIG. 55.

Figure 54A:
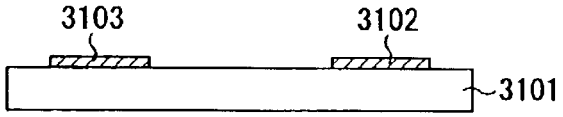
FIGS. 54A to 54E are cross-sectional views showing a process of manufacturing a plane type surface conduction type emission element.

1) First, as shown in FIG. 54A, the element electrode 3102 and 3103 are formed on the substrate 3101.

In formation of the element electrode 3102 and 3103, the substrate 3101 has been sufficiently cleaned by using a detergent, pure water and organic solvent in advance, and the material of the element electrodes are deposited. (As a depositing method, for example, a vacuum film forming technique such as the vapor evaporation method or the sputtering method may be used.) Thereafter, the deposited electrode material is patterned by using the photolithography and etching technique to form a pair of element electrodes 3102 and 3103 shown in FIG. 54A.

Figure 54B:
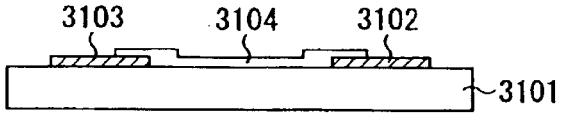

2) Then, as shown in FIG. 54B, the electrically conductive thin film 3104 is formed.

In formation of the electrically conductive thin film 3104, after an organic metal solvent is coated on the substrate shown in the above FIG. 54A, it is dried. After a heat baking process is conducted to form the fine grain film, the film is patterned in a given configuration by the photolithography etching. In this example, the organic metal solvent is directed to a solution of the organic metal compound which contains as the main element the material of the fine grains used for the electrically conductive thin film. (Specifically, the main elements in this embodiment is Pd. Also, in this embodiment, as a coating method, the dipping method is used, however, other methods such as a spinner method or a spray method may also be used.)

Also, as a method of forming the electrically conductive thin film formed of the fine grain film, there is a case of using, for example, a vapor evaporation method, a sputtering method, or a chemical gas phase depositing method, other than the organic metal solution coating method used in this embodiment.

Figure 54C:
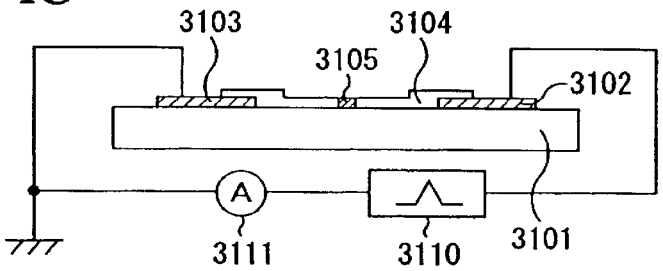

3) Then, as shown in FIG. 54C, an appropriate voltage is applied between the element electrodes 3102 and 3103 from the forming power supply 3110 to conduct the electrification forming, thus forming the electron emission portion 3105.

The electrification forming process means a process in which electrification is conducted on the electrically conductive thin film 3104 formed of the fine grain film to appropriately destroy, deform or affect a part of the electrically conductive film 3104 into a structure suitable for conducting electron emission. In a portion which is changed into the preferred structure for conducting the electron emission among the electrically conductive thin film formed of the fine grain film (that is, the electron emission portion 3105), an appropriate crack is formed in the thin film. As compared with the electron emission portion 3105 before formation, the electric resistance measured between the element electrodes 3102 and 3103 greatly increases after the electron emission portion 3105 has been formed.

Figure 56:
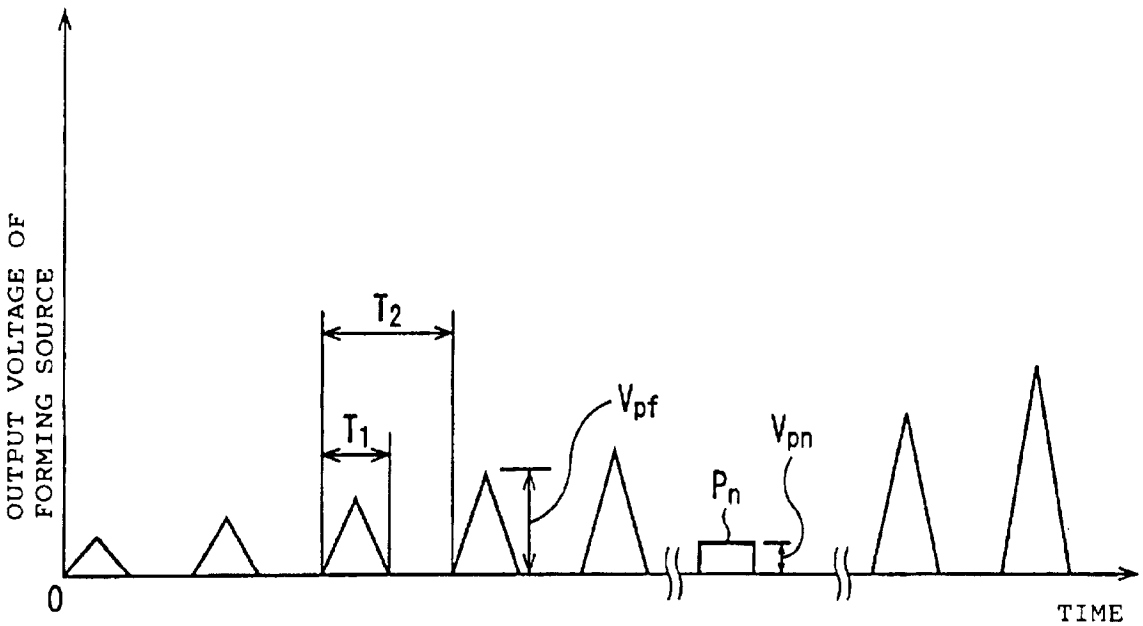
FIG. 56 is a diagram showing a supply voltage waveform in an electrification forming process.

In order to describe the electrifying method in more detail, FIG. 56 shows an example of an appropriate voltage waveform which is applied from the forming power supply 3110. In the case where the electrically conductive thin film formed of the fine grain film is formed, a pulse voltage is preferable, and in case of this embodiment, as shown in the figure, chopping pulses each having a pulse width T1 is continuously applied at a pulse interval T2. In this situation, a peak value Vpf of the chopping pulse sequentially steps up. Also, a monitor pulse Pm for monitoring the forming state of the electron emission portion 3105 is inserted between the chopping pulses at an appropriate interval, and a current that flows in this state is measured by an ammeter 3111.

In this embodiment, under the vacuum atmosphere of, for example, about $1.3\times10^{-3}$ Pa, for example, the pulse width T1 is 1 msec, the pulse interval T2 is 10 msec, and the peak value Vpf steps up 0.1 V every 1 pulse. Then, one monitor pulse Pm is inserted between the chopping pulses every time 5 chopping pulses are applied. The voltage Vpm of the monitor pulse is set to 0.1 V so that the forming process is not adversely affected. Then, at a state where the electric resistance between the element electrodes 3102 and 3103 becomes $1\times10^{6}$ Ω, that is, at a stage where the current measured by the ammeter 3111 when the monitor pulse is applied becomes $1\times10^{-7}$ A electrification for the forming process is completed.

In the above method, there is a preferable method pertaining to the surface conduction type emission element according to this embodiment, for example, in the case where the design of the surface conduction type emission element such as the material and the thickness of the fine grain film, the element electrode interval L, etc., are changed, it is desirable to change the conditions of the electrification in accordance with the change of design.

Figure 54D:
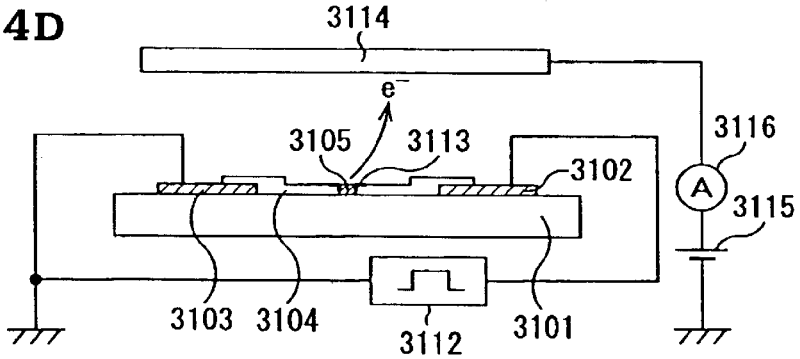

4) Then, as shown in FIG. 54D, an appropriate voltage is applied between the element electrodes 3102 and 3103 by using the activation power supply 3112 to conduct the electrification activating process, thus improving the electron emission characteristic.

The electrification activating process is directed to a process in which the electron emission portion 3105 formed through the above electrification forming process is electrified under an appropriate condition to deposit carbon or carbon compound in the vicinity of the electron emission portion 3105 (in the figure, an accumulation made of carbon or carbon compound is schematically shown as the member 3113). The emission current at the same supply voltage can increase typically 100 times or more through the electrification activating process as compared with a case in which the electrification activating process is not yet conducted.

Specifically, the voltage pulses are periodically applied under the vacuum atmosphere within a range of $1.3\times10^{-2}$ to $1.3\times10^{-3}$ Pa to deposit carbon or carbon compound derived from the organic compound existing in the vacuum atmosphere. The accumulation 3113 is made of any one of mono-crystal graphite, poly-crystal graphite, and amorphous carbon, or the mixture thereof, and the thickness is set to 50 nm or less, and more preferably set to 30 nm or less.

Figure 57A:
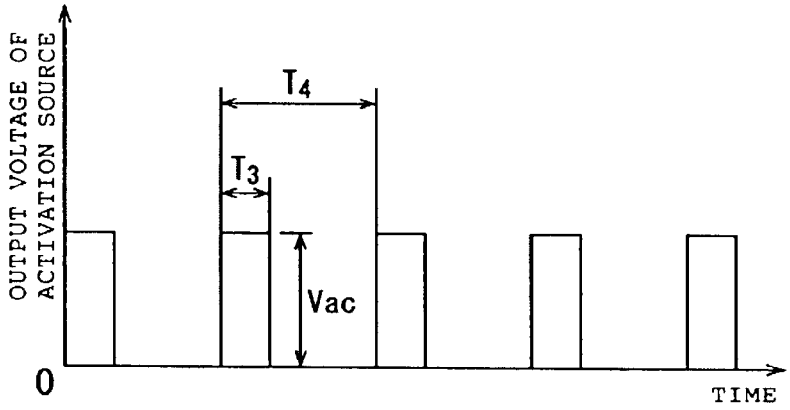
FIGS. 57A and 57B are diagrams showing a change in the supply voltage waveform and the emission current in an electrification activating process.

In order to describe the electrifying method in more detail, FIG. 57A shows an example of the appropriate voltage waveform which is applied from the activation power supply 3112. In this embodiment, a rectangular wave of a constant voltage is periodically applied to conduct the electrification activating process. Specifically, the voltage Vac of the rectangular wave is set to 14 V, the pulse width T3 is set to 1 msec, and the pulse interval T4 is set to 10 msec. The above-described electrifying conditions are preferable conditions pertaining to the surface conduction type emission element according to this embodiment, and in the case where the design of the surface conduction type emission element is changed, it is desirable to appropriately change the conditions in accordance with the change of the design.

Figure 57B:
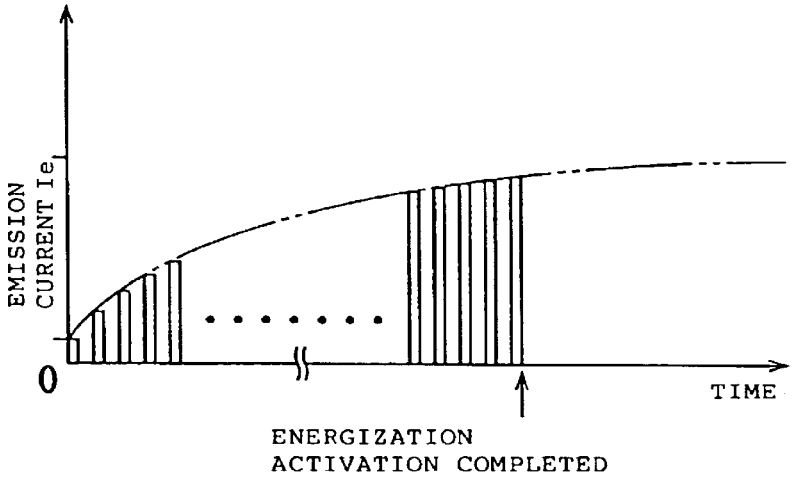

Reference numeral 3114 shown in FIG. 54D is an anode electrode for catching the emission current Ie emitted from the surface conduction type emission element, and a d.c. high voltage power supply 3115 and the current ammeter 3116 are connected (in the case where the substrate 3101 is assembled into the display panel to conduct the activating process, the fluorescent surface of the display panel is used as the anode electrode 3114). The emission current Ie is measured by the ammeter 3116 while a voltage is applied from the activation power supply 3112, and the progress state of the electrification activating process is monitored, to control the operation of the activation power supply 3112. An example of the emission current Ie measured by the ammeter 3116 is shown in FIG. 57B. When a pulse voltage starts to be applied from the activation power supply 3112, the emission current Ie increases with time but thereafter is saturated so as not to substantially increase. In this way, at a time point where the emission current Ie is substantially saturated, the voltage supply from the activation power supply 3112 stops to complete the electrification activating process.

The above-described electrifying conditions are preferable conditions pertaining to the surface conduction type emission element according to this example, and in the case where the design of the surface conduction type emission element is changed, it is desirable to appropriately change the conditions in accordance with the change of the design.

Figure 54E:
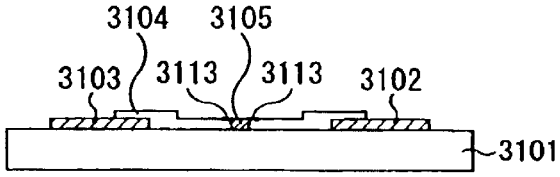

In the above-mentioned manner, the plane type surface conduction type emission element according to this embodiment as shown in FIG. 54E is manufactured.

[Vertical Type Surface Conduction Type Emission Element]

Subsequently, another representative structure of the surface conduction type emission element in which the electron emission portion or its peripheral portion is formed of the fine grain film, that is, the structure of the vertical type surface conduction type emission element, will be described.

Figure 58:
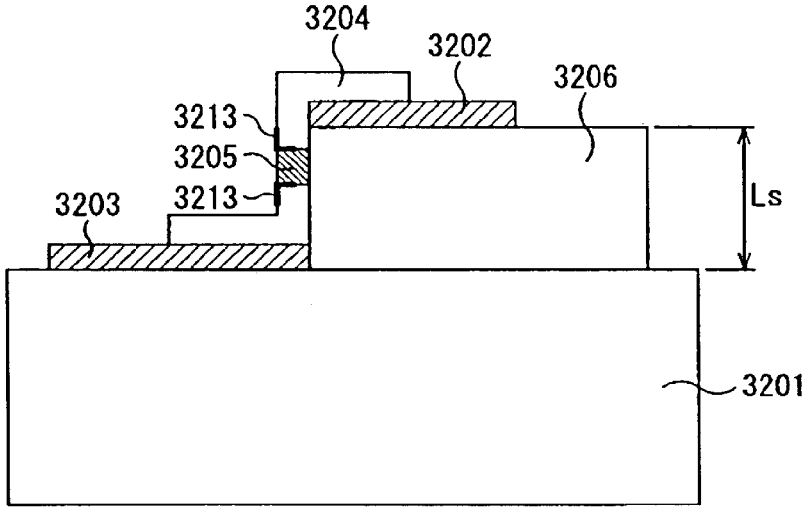
FIG. 58 is a cross-sectional view showing a vertical type surface conduction type electron emission element.

FIG. 58 is a schematic cross-sectional view for explaining the basic structure of the vertical type, and in the figure, reference numeral 3201 denotes a substrate, 3202 and 3203 are element electrodes, 3206 is a step forming member, 3204 is an electrically conductive thin film formed of the fine grain film, 3205 is an electron emission portion formed through the electrification forming process, and 3213 is a thin film formed through the electrification activating process.

Differences of the vertical type from the plane type described in the above reside in that one of the element electrodes (3202) is disposed on the step forming member 3206, and the electrically conductive thin film 3204 is coated on the side surface of the step forming member 3206. Accordingly, the element electrode interval L in the plane type shown in the above FIG. 55 is set as a step height Ls of the step forming member 1206 in the vertical type. In the substrate 3201, the element electrodes 3202, 3203, and the electrically conductive thin film 3204 formed of the fine grain film, the same materials as those described in the above plane type can be similarly used. Also, the step forming member 3206 is made of an electrically insulating material, for example, such as $SiO_2$.

Subsequently, a method of manufacturing the vertical type surface conduction type electron emission element will be described. FIGS. 59A to 59F are cross-sectional views for explaining of the manufacturing process, and the references of the respective members are identical with those in FIG. 58.

Figure 59A:
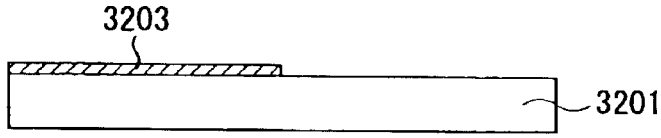
FIGS. 59A to 59F are cross-sectional views showing a process of manufacturing a vertical type surface conduction type emission element.

1) First, as shown in FIG. 59A, the element electrode 3203 is formed on the substrate 3201.

Figure 59B:
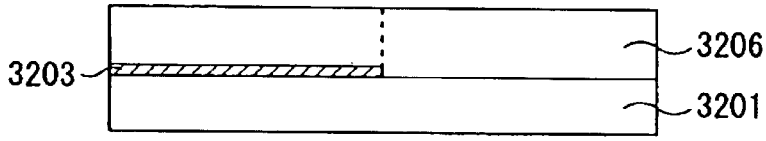

2) Subsequently, as shown in FIG. 59B, an insulating layer for forming the step forming member is stacked. The insulating layer may be formed by stacking, for example, $SiO_2$ through the sputtering method, however, other film forming method such a vapor evaporation method or a printing method may be used.

Figure 59C:
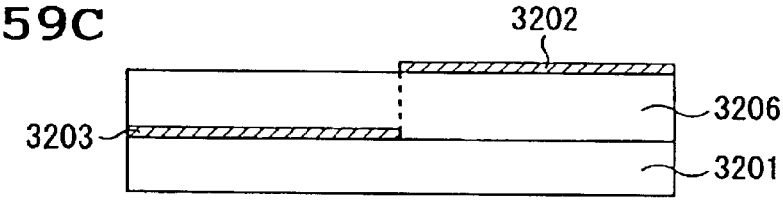

3) Then, as shown in FIG. 59C, the element electrode 3202 is formed on the insulating layer.

Figure 59D:
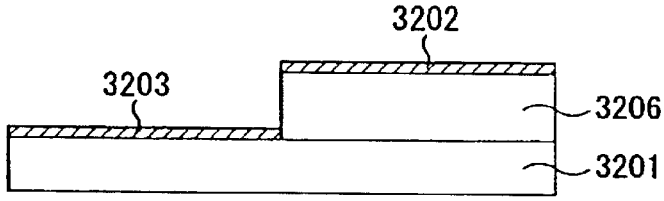

4) Then, as shown in FIG. 59D, a part of the insulating layer is removed by using, for example, the etching method to expose the element electrode 3203.

Figure 59E:
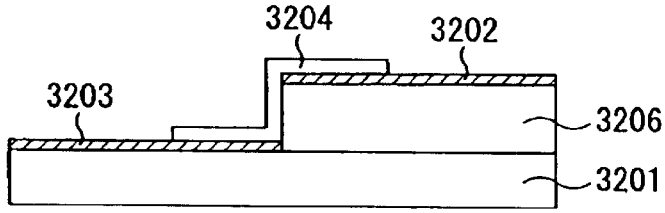

5) Then, as shown in FIG. 59E, the electrically conductive thin film 3204 formed using the fine grain film is formed. In the formation, a film forming technique, for example, such as a coating method may be used similarly as in the above plane type.

6) Then, the electrification forming process is conducted to form the electron emission portion as in the above plane type (the same process as that of the plane type electrification forming process described with reference to FIG. 54C may be conducted.)

7) Then, the electrification activating process is conducted to deposit carbon or carbon compound in the vicinity of the electron emission portion as in the above plane type (the same process as that of the plane type electrification activating process described with reference to FIG. 54D may be conducted.)

Figure 59F:
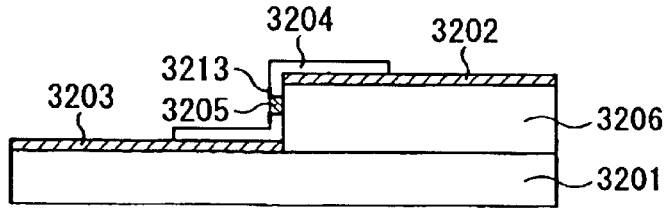

In the above-mentioned manner, the vertical type surface conduction type emission element shown in FIG. 59F is manufactured.

[Characteristic of Surface Conduction Type Emission Element used in Display Device]

The above description is given of the element structures and the manufacturing methods of the plane type and vertical type surface conduction type emission element. Subsequently, the characteristic of the element used in the display device will be described.

Figure 60:
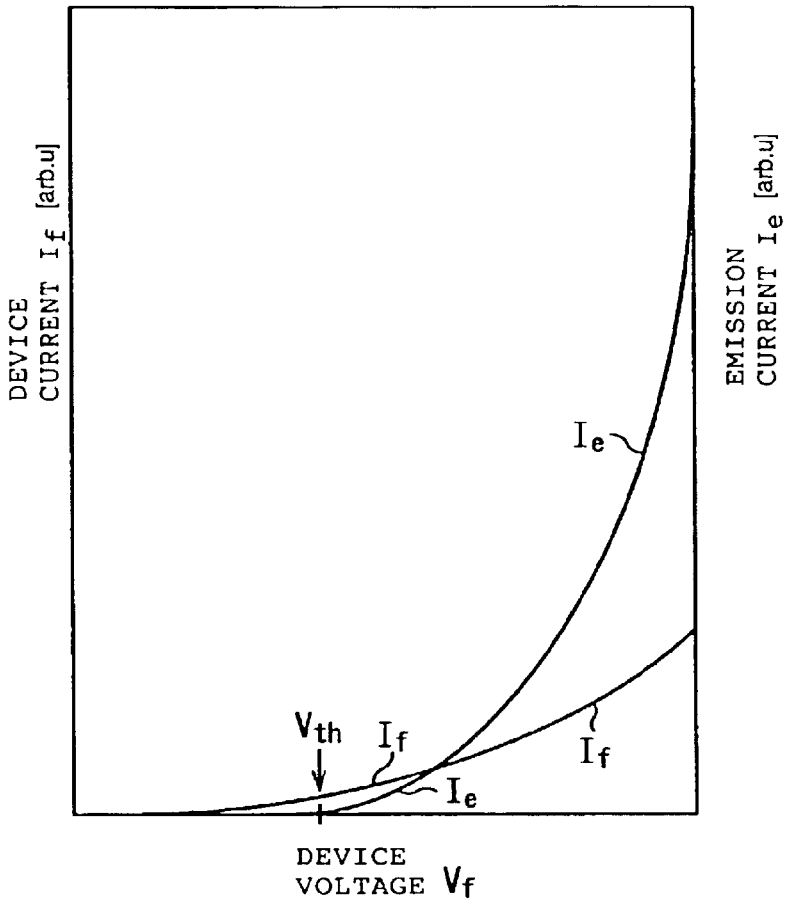
FIG. 60 is a graph showing the typical characteristic of the surface conduction type emission element.

FIG. 60 shows a typical example of the emission current Ie to element supply voltage Vf characteristic, and the element current If to the element supply voltage Vf characteristic in the element used in the display device. Since the emission current Ie is remarkably small as compared with the element current If, it is difficult to show the emission current Ie by the same unit, and those characteristics are changed by changing the design parameters such as the size or configuration of the element. Therefore, those two characteristics are exhibited by arbitrary units, respectively.

The element used in the image display device has the following three characteristics related to the emission current Ie.

First, when a voltage of a given voltage or more (called "threshold voltage Vth") is applied to the element, the emission current Ie rapidly increases. On the other hand, when the voltage is lower than the threshold voltage Vth, the emission current Ie is hardly detected. In other words, it is a non-linear element having a definite threshold voltage Vth with respect to the emission current Ie.

Second, because the emission current Ie changes depending on the voltage Vf applied to the element, the amplitude of the emission current Ie can be controlled by the voltage Vf.

Thirdly, because a response speed of the current Ie emitted from the element with respect to the voltage Vf applied to the element is high, the amount of charges of electrons emitted from the element can be controlled by the length of a period of time during which the voltage Vf is applied.

Because the above-mentioned characteristics are provided, the surface conduction type emission element can be preferably used in the display device. For example, in the display device in which a large number of elements are disposed in correspondence with the pixels of the display screen, the display screen can be sequentially scanned and displayed by using the first characteristic.

In other words, a voltage of the threshold voltage Vth or higher is appropriately applied to the driving element in response to the desired light emitting luminance, and a voltage lower than the threshold voltage Vth is applied to a non-selected state element. When the driving element is sequentially changed over, the display screen can be sequentially scanned and displayed.

Also, because the light emitting luminance can be controlled by using the second characteristic or the third characteristic, the graduation display can be displayed.

(Embodiment 2)

A difference of the embodiment 2 from the embodiment 1 resides in that an a.c. voltage is used in the supply waveform.

In this example, a sine wave peak voltage of 60 Hz is applied while gradually stepping up so that a one-side peak value becomes the same as that in FIG. 49.

By the a.c. voltage, the potentials of both positive and negative poles can be given to the rear plate, and the step-up process is conducted for each cycle, thereby being capable of more effectively obtaining the conditioning effect.

In this example, the a.c. voltage is used in the supply waveform, however, a d.c. voltage of both positive and negative poles may be applied alternately or divided to two times.

Also, a pulse voltage, and more preferably an impulse voltage may be used in the supply waveform. In this case, there is the effect that the damage when electricity is discharged to the surface conduction type emission element can be more reduced.

With the image display device thus manufactured, the excellent display image with no discharge can be obtained.

(Embodiment 3)

A difference of the embodiment 3 from the embodiment 1 resides in the atmosphere when applying the high voltage. In the embodiment 1, the high voltage application is conducted in the vacuum atmosphere whereas in this embodiment, it is conducted in the nitrogen atmosphere.

Figure 50:
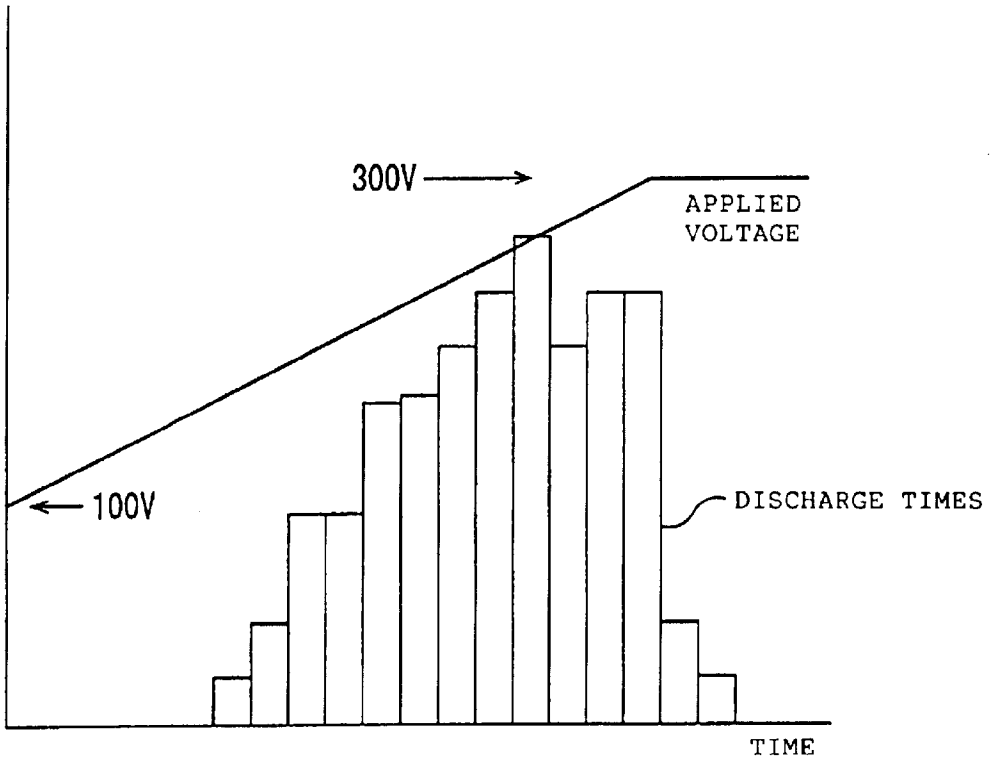
FIG. 50 is a diagram showing a supply voltage and the number of times of discharge in a method of manufacturing an image forming apparatus in accordance with the present invention.

Specifically, after gas is exhausted from the interior of the vacuum vessel, dry nitrogen gas is introduced so as to provide a pressure of about 400 Pa. Thereafter, the process is shifted to the process of applying the high voltage. FIG. 50 is a schematic view showing a supply voltage and the number of times of discharge with a time.

The supply voltage steps up at a rate of 50 V/20 minutes until 100 V to 300 kV as shown in the figure, and maintained at 300 V for 15 minutes. In this example, the supply voltage steps up at a given rate, and may step up at a step state. Observation starts when the discharge slightly exceeds 150 kV, and the discharge increases up to about 250 kV. Thereafter, the discharge is gradually turned to decrease and after the discharge is maintained at 300 V, it becomes 0 soon.

As compared with a case in which a high voltage is applied in the vacuum atmosphere, it is found that the discharge starts from a very low voltage in the nitrogen introduction atmosphere. Also, it is experimentally recognized that substantially the same conditioning effect as that in a case of 10 kV in the vacuum atmosphere is obtained by application of the high voltage up to 300 V in the nitrogen atmosphere of this example.

As described above, according to this example, the device can be downsized with hardly any damage to the element.

The introduction gas is appropriately selected from nitrogen as well as helium, neon, argon, hydrogen, oxygen, carbon dioxide, air and so on. Also, the above pressure is a preferred value for the image display device of the present invention, and it is desirable that the pressure is appropriately changed as the design is changed. More preferably, the pressure is set to several tens of Pa to several thousands of Pa.

The supply voltage as used is the d.c. voltage as in the embodiment 1. However, an a.c. voltage, a pulse voltage or the like may be applied as in the embodiment 2.

The image display device thus manufactured can obtain an excellent display image with no discharge.

Fourth Embodiment (Embodiment 1)

Hereinafter, an image display device according to the present invention will be described in detail.

Figure 62:
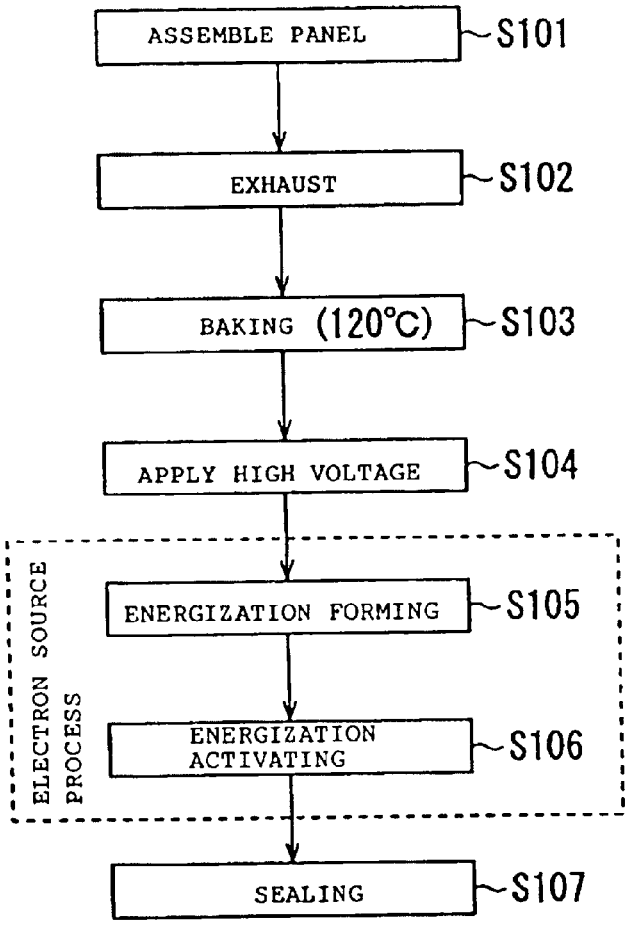
FIG. 62 is a diagram showing a flow of processes in a method of manufacturing an image forming apparatus in accordance with an embodiment of the present invention.

First, a flow of a process of a method of manufacturing an image display device in accordance with the present invention will be described in brief with reference to FIG. 62.

First, the airtight vessel made up of the rear plate, the side walls, the face plate with the phosphors, the spacer is assembled (Step S101). The assembling method will be described in detail later.

Also, the electron source of the present invention, the surface conduction type emission element is used. The detail will be described later.

Subsequently, gas is exhausted to vacuum of about $1.3\times 10^{-4}$ Pa from the interior of the airtight vessel through the exhaust pipe (Step S102). The exhausting method will be described in detail later.

Then, a baking process is conducted at 120° C. (Step S103), and thereafter the process of applying a high voltage between the face plate and the rear plate which is the feature of the present invention (Step S104).

Then, the electron source process necessary for operating the surface conduction type emission elements is conducted. Specifically, the process consists of an electrification forming process for forming the electron emission portions (Step S105) and an electrification activating process for improving the electron emission characteristic (Step S106). Those processes will be described in detail later.

Finally, the exhaust pipe is sealed (Step S107).

The two purposes of applying the high voltage between the face plate and the rear plate which is the feature of the present invention are stated below.

First, a significant defective product is found out as soon as possible to improve the manufacture yield. In the conventional manufacturing method, the high voltage equivalent to the image display is applied in a final state after the electron source process. On the contrary, since the process of applying the high voltage is conducted further before, the defective product to which the high voltage cannot be applied is found out, and the subsequent process can be interrupted. It is presumed that the impossibility of application of the high voltage is in a state where the resistance between the face plate and the rear plate is lowered for the reason of dust attachment, or discharge is continuously generated for the reason of the configuration defect, etc.

Second, the insulating withstand voltage and the discharge withstand voltage between the face plate and the rear plate are improved by the so-called conditioning effect.

The conditioning effect will be described with reference to the schematic view of FIG. 63.

Figure 63:
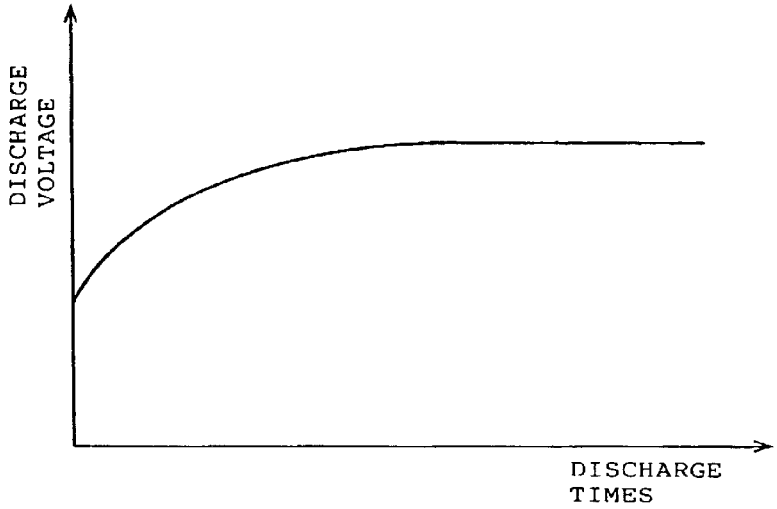
FIG. 63 is a diagram for explanation of a conditioning effect in accordance with an embodiment of the present invention.

In FIG. 63, the axis of abscissa is the number of times of discharges, and the axis of ordinate is the discharge voltage at this time. It is apparent from the figure that the discharge voltage steps up with an increase in the number of times of discharges, and the withstand voltage is improved.

That the discharges are repeated to improve the withstand voltage is generally called conditioning effect. It is presumed that the factors that produce the conditioning effect are a removal of the adsorbed gas or attachment, a reduction of the electric field emission electron current due to smoothing the fine protrusion, an improvement in the surface configuration due to heat melting, etc. The details are not proved now.

In the image forming apparatus using the surface conduction type emission element, the conditioning effect is found. However, as described above, since there arise the problems that a damage of the surface conduction type emission elements due to the dicharge is large, and the elements around the discharge portion are remarkably deteriorated, the conditioning process could not be implemented up to now.

According to the present embodiment, the high voltage is applied between the face plate and the rear plate to generate the discharge, and the discharge withstand voltage is improved by the conditioning effect, and a method in which the surface conduction type emission elements is not damaged (the display image is not adversely affected at all) can be provided.

It is presumed that the two reasons for which the conditioning of the element damageless can be realized in this embodiment are as follows:

First, because the process of applying the high voltage is conducted before the electrification forming process which will be described later, the conditioning is conducted in a state where the resistance between the electrodes of the surface conduction type emission elements is low, and therefore the discharged charges is liable to be escaped to GND, that is, it is difficult that abnormal voltage is applied to the surface conduction type emission element due to discharge.

Another reason is that because the process of applying the high voltage is conducted before the electrification forming process and the electrification activating process which will be described, the conditioning process is conducted in a state where the surface conduction type electron emission elements are not yet formed, and therefore, even if the surface conduction type emission element portion is somewhat damaged by the discharge, the damage is repaired in the activating process.

As described above, the most significant feature of the present invention resides in the order of the processes. That is, the feature of the present invention resides in that a high voltage is applied to the rear plate before the electron source process (before the electron source element is completely formed), to thereby improve the discharge withstand voltage without adversely affecting the electron source characteristic.

Subsequently, the process of applying a high voltage between the face plate and the rear plate which is the feature of the present invention will be described in detail.

In this embodiment, a baking process is conducted at about 120° C. for about 2 hours after the exhaust, prior to the application of the high voltage. This is conducted for the purpose of removing the surface adsorbed gas and improving the degree of vacuum with the effects that the conditioning process can be more effectively conducted in a short period of time. The vacuum vessel is maintained to a vacuum of about $1.3\times10^{-5}$ Pa.

Figure 64:
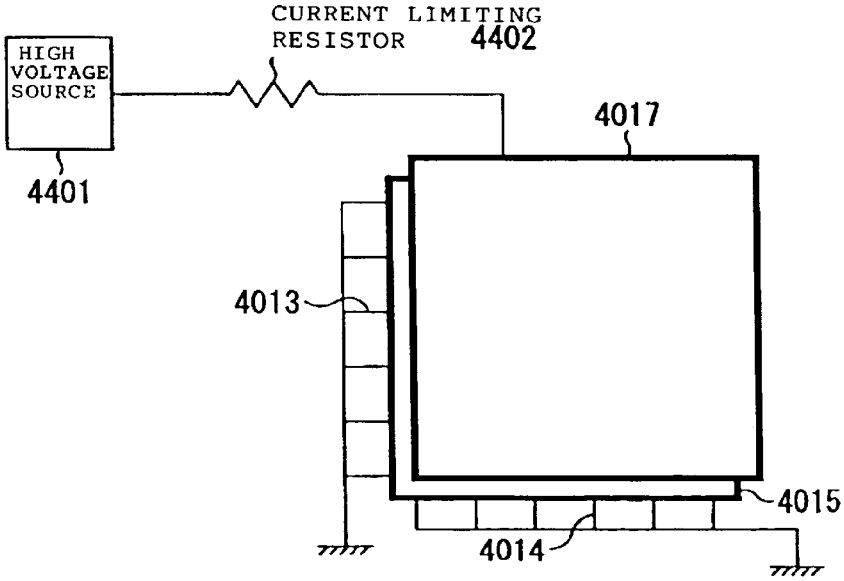
FIG. 64 is a schematic view showing a device for implementing a method of manufacturing an image forming apparatus in accordance with an embodiment of the present invention.

FIG. 64 is a block diagram showing the rough structure of this embodiment.

A high voltage d.c. power generating device 4401 is connected to the face plate 4017 through a current limit resistor 4402, and the face plate 4017 is applied with the d.c. voltage. In fact, the d.c. voltage is applied to a metal back not shown on the face plate 4017.

Figure 68:
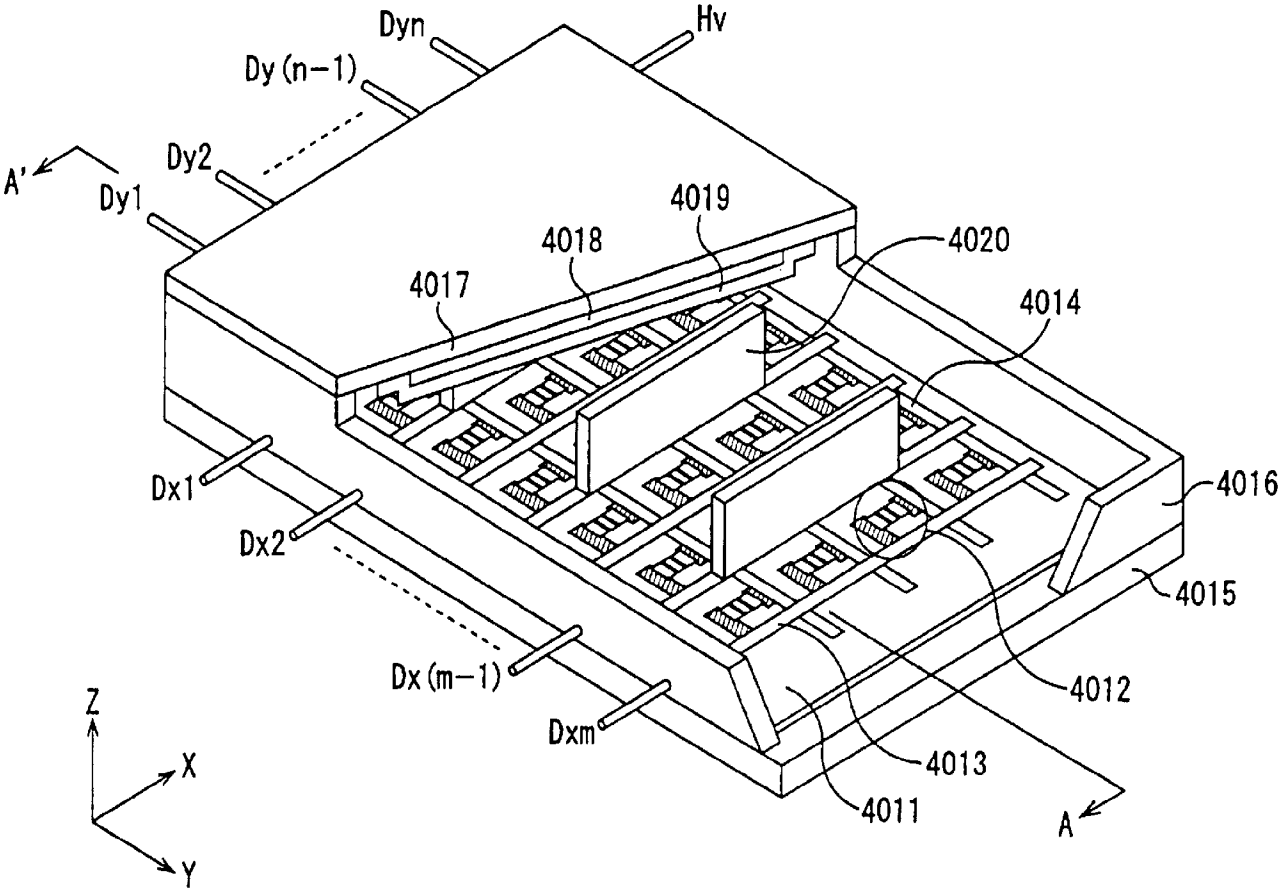
FIG. 68 is a perspective view showing an image display device in accordance with an embodiment of the present invention in which a part of a display panel is cut out.

As shown in FIG. 68, the respective surface conduction type emission elements 4012 are wired in a matrix by the row-directional wirings 4013 and the column-directional wirings 4014 on the rear plate 4015, and as shown in FIG. 64, the row-directional wirings 4013 and the column-directional wirings 4014 are connected to GND potential.

Figure 65:
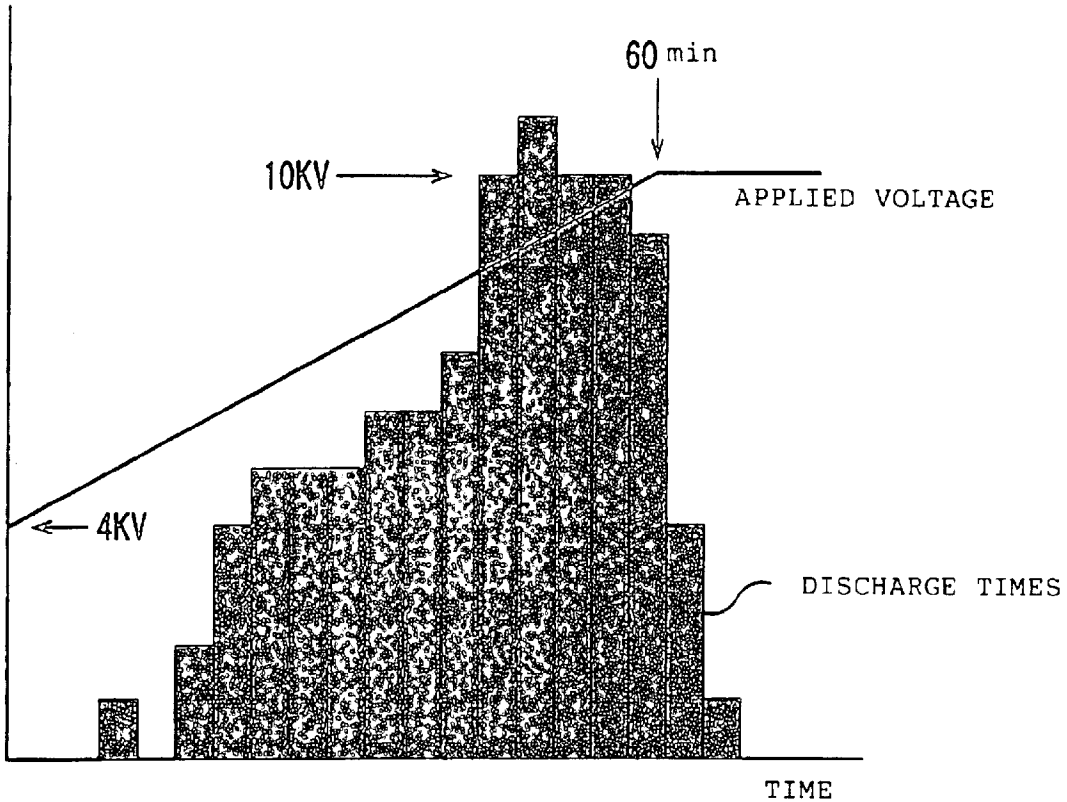
FIG. 65 is a diagram showing a supply voltage and the number of times of discharge in a method of manufacturing an image forming apparatus in accordance with an embodiment of the present invention.

FIG. 65 is a schematic view showing a supply voltage and the number of times of discharges with a time.

The supply voltage steps up at a rate of 500 V/5 minutes until 4 kV to 10 kV as shown in the figure, and maintained at 10 kV for 15 minutes. In this embodiment, the supply voltage steps up at a given rate, and may step up at a step state.

Observation starts when the discharge slightly exceeds 4 kV, and the discharge increases up to about 10 kV. After the discharge is kept to 10 kV, the discharge is turned to decrease and it becomes 0 soon. This is caused by the above-described conditioning effect. Also, the observed discharge includes both of the creeping discharge on the spacer surface or the side wall surface and the vacuum discharge between the rear plate and the face plate including the electron source, the row-directional wirings, the column-directional wirings, etc. The spacer will be described in detail later.

The above voltage, the step-up rate, the retaining period of time, etc., are preferred values for the image forming apparatus of the present invention, and it is desirable that the conditions are appropriately changed if the design is changed. However, in this case, it is necessary that at a voltage of the required accelerating voltage or higher for the image display, the voltage is maintained for a sufficient period of time after the discharge is not observed.

With the image display device manufactured through the above processes, an excellent display image without discharge can be obtained.

(1) The Summary of an Image Display Device

Subsequently, a description will be given of the structure and a manufacturing method of a display panel in an image display device to which the present invention is applied.

FIG. 68 is a perspective view showing a display panel used in this embodiment in which a part of the panel is cut off in order to show the internal structure.

In the figure, reference numeral 4015 denotes a rear plate, 4016 is a side wall, and 4017 is a face plate, in which the members 4015 to 4017 constitute an airtight vessel for maintaining the interior of a display panel in a vacuum state. In assembling the airtight vessel, it is necessary to seal the joint portions of the respective members in order to maintain the sufficient strength and airtightness. For example, the joint portions are coated with flit glass and then baked at 400 to 500 C in the atmosphere or nitrogen atmosphere for 10 minutes or longer, to thereby achieve the sealing. A method of exhausting the gas in the interior of the airtight vessel into vacuum will be described later. Also, since the interior of the above airtight vessel is maintained in the vacuum state of about $1.3\times10^{-4}$ Pa, the spacers 4020 are disposed as an atmospheric pressure resistant structural body for the purpose of preventing the airtight vessel from being destroyed due to the atmospheric pressure, an unintentional impact, etc.

The rear plate 4015 is fixed with the substrate 4011 on which N×M cold cathode elements 4012 are formed. (N and M are positive integers of 2 or more and appropriately set in accordance with the target number of display pixels. For example, in a display device for the purpose of display of a high-quality television, it is desirable to set the numbers of N=3000 and M=1000, or more.) The N×M cold cathode elements are wired in a single matrix by M row-directional wirings 4013 and N column-directional wirings 4014. A portion made up of the above-mentioned members 4011 to 4014 is called "multiple electron beam source".

Subsequently, a description will be given of the structure of a multiple electron beam source in which the surface conduction type emission elements (which will be described later) are arranged on the substrate as the cold cathode elements and wired in a single matrix.

Figure 69:
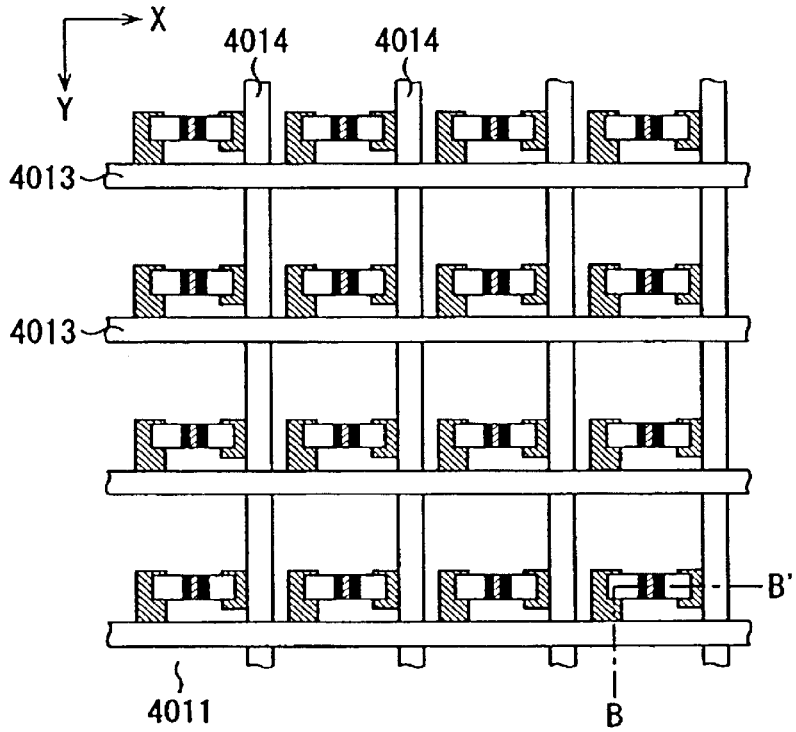
FIG. 69 is a plan view showing a substrate of a multiple electron beam source in accordance with an embodiment of the present invention.

FIG. 69 shows a plan view of the multiple electron beam source used in the display panel shown in FIG. 68. The same surface conduction type emission elements as those shown in FIG. 72 which will be described later are disposed on the substrate 4011, and those elements are wired in a single matrix by the row-directional wirings 4013 and the column-directional wirings 4014. On a portion where the row-directional wirings 4013 and the column-directional wirings 4014 cross each other, insulating layers (not shown) are formed between the electrodes, to thereby maintain electric insulation.

Figure 70:
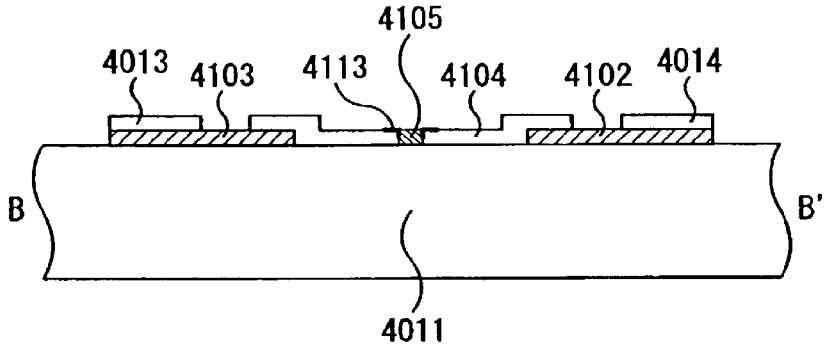
FIG. 70 is a cross-sectional view taken along a line B–B' of the multiple electron beam source shown in FIG. 69.

FIG. 70 shows a cross-sectional view taken along the line B–B' of FIG. 69.

The multiple electron source thus structured is manufactured in such a manner where after the row-directional wirings 4013, the column-directional wirings 4014, the interelectrode insulating layer (not shown) and the element electrodes and the electrically conductive thin film of the surface conduction type emission elements have been formed on the substrate in advance, through the above-mentioned high voltage applying process which is a characteristic of the present invention, electricity is supplied to the respective elements through the row-directional wirings 4013 and the column-directional wirings 4014 to conduct an electrification forming process (which will be described later) and an electrification activating process (which will be described later).

In this embodiment, the substrate 4011 of the multiple electron beam source is fixed on the rear plate 4015 of the airtight vessel. However, in the case where the substrate 4011 of the multiple electron beam source has a sufficient strength, the substrate 4011 per se of the multiple electron beam source may be used as the rear plate of the airtight vessel.

Also, a fluorescent film 4018 is formed on a lower surface of the face plate 4017.

Figure 81A:
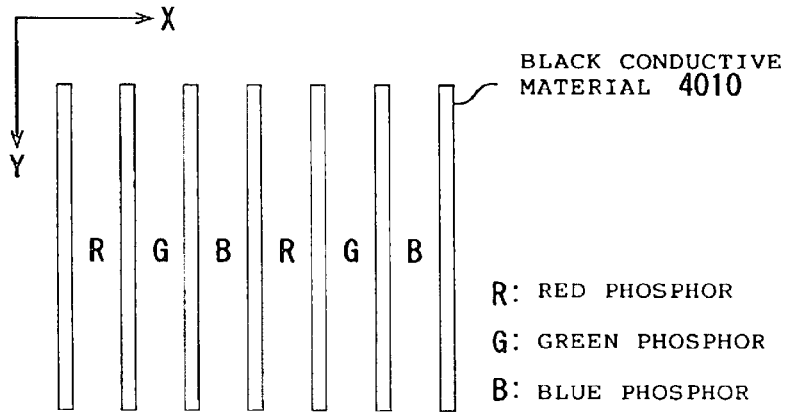
FIGS. 81A and 81B are plan views exemplifying an arrangement of phosphors on a face plate of a display panel in an image forming apparatus in accordance with an embodiment of the present invention.

Because this embodiment is directed to a color display device, phosphors of three primary colors consisting of red, green and blue which are used in the field of CRT are painted on a portion of the fluorescent film 4018, separately. The phosphors of the respective colors are distinguishably painted, for example, in stripes as shown in FIG. 81A, and black electric conductors 4010 are disposed between the stripes of the phosphors. The purposes of providing the black electric conductors 4010 are to prevent the shift of the display colors even if a position to which an electron beam is irradiated is slightly displaced, to prevent the deterioration of display contrast by preventing the reflection of an external light, to prevent the charge-up of the fluorescent film due to the electron beams, etc. The black electric conductor 4010 mainly contains black lead, however a material other than black lead may be used if the material is proper for the above purposes.

Figure 81B:
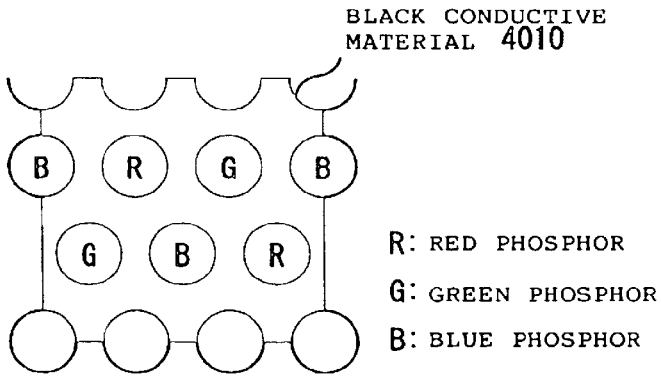
Figure 82:
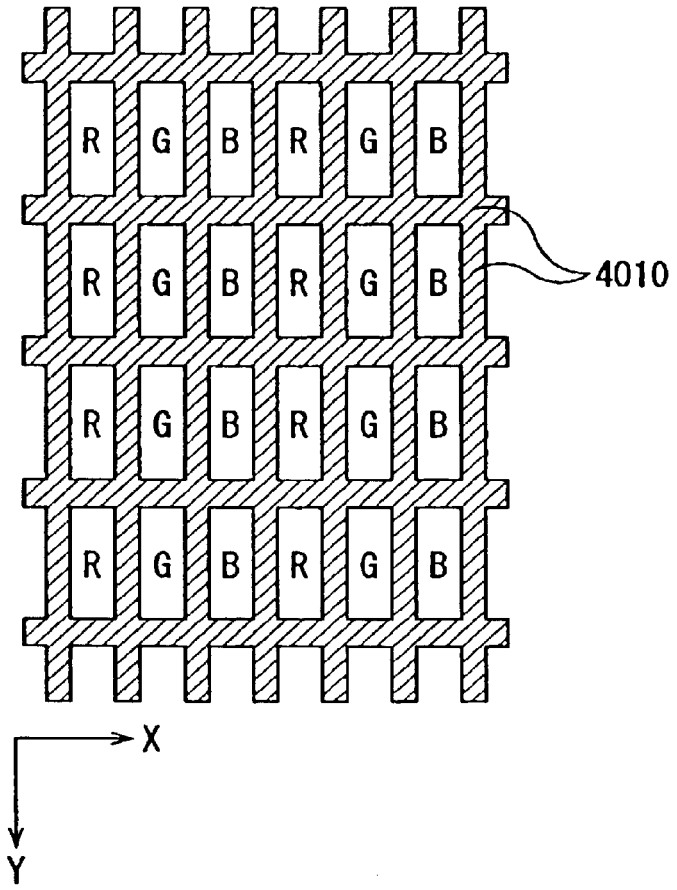
FIG. 82 is another plan view exemplifying an arrangement of phosphors on a face plate of a display panel in an image forming apparatus in accordance with an embodiment of the present invention.

Also, the manner of distinguishably painting the phosphors of three primary colors is not limited to the arrangement of the stripes shown in FIG. 81A, but, for example, an arrangement in the form of delta shown in FIG. 81B or other arrangements (for example, FIG. 82) may be applied.

In the case of producing a monochrome display panel, a mono-color phosphor material may be used for the fluorescent film 4018, and the black electric conductor may not necessarily be used.

Also, a metal back 4019 known in the field of CRTs is disposed on a surface of the fluorescent film 4018 on the rear plate side. The purposes of providing the metal back 4019 are to improve the light use ratio by partially mirror-reflecting a light emitted from the fluorescent film 4018, to protect the fluorescent film 4018 from collision of negative ions, to operate the metal back as an electrode for applying the electron beam accelerating voltage, to operate the metal back as an electric conductive path of electrons that excite the fluorescent film 4018, etc. The metal back 4019 is formed in such a manner that after the fluorescent film 4018 has been formed on the face plate substrate 4017, the surface of the fluorescent film is smoothed and Al is vacuum-deposited on the smoothed surface. In the case where the fluorescent film 4018 is made of a phosphor material for a low voltage, the metal back 4019 may not be used.

Also, although being not used in this embodiment, for the purposes of applying the accelerating voltage and improving the electric conductivity of the fluorescent film, for example, a transparent electrode made of ITO may be disposed between the face plate substrate 4017 and the fluorescent film 4018.

Figure 71:
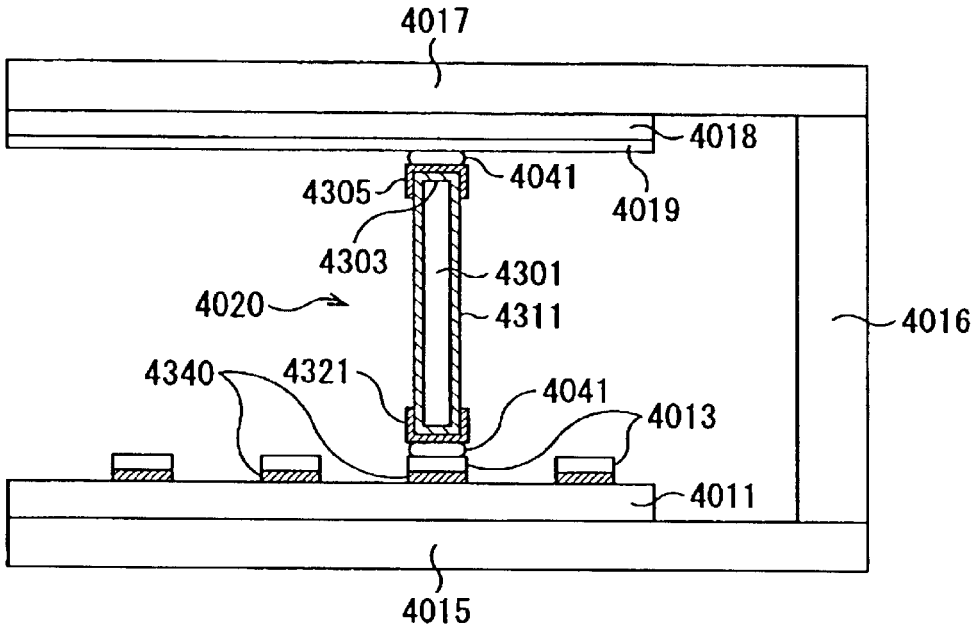
FIG. 71 is a cross-sectional view taken along a line A–A' of the display panel shown in FIG. 68.

FIG. 71 is a schematic cross-sectional view taken along a line A–A' of FIG. 68, in which numeral reference of the respective members correspond to those in FIG. 68. The spacer 4020 is coated with high-resistant film 4311 for the purpose of preventing the charge on the surface of the insulating member 4301. Also, a low resistant film 4321 is formed on abutment surfaces 4303 of the spacer which face the inner side of the face plate 4017 (metal back 4019, etc.) and the surface of the substrate 4011 (row-directional wirings 4013 or the column-directional wirings 4014) and side portions 4305 contacting the abutment surfaces. The spacers 4020 of the number required for achieving the above objects are arranged at required intervals and fixed onto the inner side of the face plate and the surface of the substrate 4011 by a bond 4041. Also, the high resistant film 4311 is formed on at least the surfaces exposed to vacuum within the airtight vessel among the surface of the insulating member 4301, and electrically connected to the inside of the face plate 4017 (metal back 4019, etc.) and the surface of the substrate 4011 (the row-directional wirings 4013 or the column-directional wirings 4014) through the low resistant film 4321 and the bond 4041 on the spacer 4020. In the embodiment described now, the spacers 4020 are shaped in a thin plate, disposed in parallel with the row-directional wirings 4013, and electrically connected to the row-directional wirings 4013.

It is necessary that the spacer 4020 has the insulation sufficient to withstand a high voltage applied between the row-directional wirings 4013 and the column-directional wirings 4014 on the substrate 4011 and the metal back 4019 on the inner surface of the face plate 4017, and also has the electric conductivity so that the charge on the surface of the spacer 4020 is prevented.

The insulating material 1 of the spacers 4020 may be made of, for example, quartz glass, glass reducing impurity content such as Na, soda lime glass, or a ceramic member such as alumina. It is preferable that the coefficient of thermal expansion of the insulating member 4301 is close to that of the members of the airtight vessel and the substrate 4011.

A current obtained by dividing an accelerating voltage Va applied to the face plate 4017 (metal back 4019, etc.) on the high potential side by the resistance Rs of the high resistant film 4311 which is an high resistant film flows in the high resistant film 4311 which structures the spacer 4020. Therefore, the resistance Rs of the spacer is set to a desired range on the basis of the electric charge and the power consumption. From the antistatic viewpoint, the sheet resistivity is preferably set to $10^{12}$ Ω/square or less. In order to obtain a sufficient antistatic effect, it is most preferable that the sheet resistance is set to $10^{11}$ Ω/square or less. It is preferable that the lower limit of the sheet resistivity is set to $10^5$ Ω/square or more although it depends on the configuration of the spacer and a voltage applied between the spacers.

It is desirable to set the thickness t of the high resistant film formed on the insulating material to a range of from 10 nm to 1 μm. Although the high resistant film depends on the surface energy of the material, the adhesion with the substrate and the substrate temperature, the thin film of 10 nm or less in thickness is generally formed in islands, which is unstable in resistance and short in reproducibility. On the other hand, if the thickness t is 1 μm or more, the film stress becomes large with the results that the risk of the film peeling-off becomes high and the film forming period of time becomes long, thus deteriorating the productivity. Accordingly, it is desirable that the thickness is set to a range of from 50 nm to 500 nm. The sheet resistance is ρ/t, and the specific resistance p of the antistatic film is preferably set to 0.1 Ωm to $10_8$ Ωcm from the above-described preferred ranges of the sheet resistance and the thickness t. Further, in order to realize the more preferable ranges of the sheet resistance and the film thickness, it is preferable to set ρ to $10^2$ to $10^6$ $^{\Omega cm}$.

The temperature of the spacer rises because a current flows in the high resistant film, which is an high resistant film, 11 formed on the surface of the spacer as described above, or the entire display generates heat during its operation. When the resistant temperature coefficient of the high resistant film is a large negative value, when the temperature rises, the resistance is reduced, the current flowing in the spacer increases, and the temperature further rises. Then, the current continues to increase until passing the limit of a power supply. The resistant coefficient value when the above-mentioned run-away of the current occurs is experimentally a negative value and 1% or more in absolute value. That is, it is desirable that the resistant temperature coefficient of the high resistant film is a value larger than −1%.

The material of the high resistant film 4311 having the high resistant characteristic may be made of, for example, metal oxide. Among the metal oxide, oxide of chromium, nickel and copper are preferable material. It is presumed that the reason is because those oxides are relatively low in the secondary electron emission coefficient and difficult to be charged even in the case where the electrons emitted from the cold cathode element 4012 hit the spacers 4020. In addition to the metal oxide, carbon is a preferable material because the secondary electron emission coefficient is small. In particular, because amorphous carbon is high in resistance, the spacer resistance is liable to be controlled to a desired value.

As other materials of the high resistant film 4311 having the antistatic characteristic, the nitride of aluminum and a transition metal alloy are preferable materials since the resistance can be controlled in a wide range of from excellent electric conductor to insulator. In addition, they are stable materials since a change in resistance is small in a display device manufacturing process which will be described later. Those materials are more than −1% in the resistant temperature coefficient and liable to be used in practical use. As the transition metal element, there are Ti, Cr, Ta and so on.

The alloy nitride film is formed on the insulating member by a thin-film forming means such as sputtering method, reaction sputtering in a nitrogen gas atmosphere, electron beam vapor evaporation, ion plating, ion assist vapor evaporation, etc. The metal oxide film can be also manufactured through the same thin-film forming method. However, in this case, nitrogen gas is replaced by oxygen gas and used. Al, the metal oxide film can be formed even through the CVD method or the alkoxide coating method The carbon film is manufactured through the vapor evaporation method, the sputtering method, the CVD method or the plasma CVD method, and in particular in the case where amorphous carbon is produced, hydrogen is contained in the atmosphere in the film or hydrocarbon gas is used for the film forming gas.

The low resistant film 4321 that forms the spacers 4020 is so disposed as to electrically connect the high resistant film 4311 to the face plate 4017 at the high potential side (metal back 4019, etc.) and the substrate 4011 (wirings 4013, 4014, etc.) at the low potential side. Hereinafter, the low resistant film 4321 is also called "intermediate electrode layer (intermediate layer)". The intermediate electrode layer (intermediate layer) can provide a plurality of functions stated below.

(1) The high resistant film 11 is electrically connected to the face plate 4017 and the substrate 4011.

As is already described above, the high resistant film 4311 is provided for the purpose of preventing the charge on the surface of the spacer 4020. In the case where the high resistant film 4311 is connected to the face plate 4017 (metal back 4019, etc.) and the substrate 4011 (wirings 4013 and 4014, etc.) directly or through the abutment member 4041, a large contact resistor occurs on the interface of the connecting portion with the result that there is the possibility that the charges occurring on the surface of the spacer cannot be rapidly removed. In order to remove this drawback, the low resistant intermediate layer is disposed on the abutment surfaces 3 and the side portions 5 of the spacers 4020 which are in contact with the face plate 4017, the substrate 4011 and the abutment member 4041.

(2) The potential distribution of the high resistant film 4311 is unified.

The electrons emitted from the cold cathode elements 4012 forms electron loci in accordance with the potential distribution formed between the face plate 4017 and the substrate 4011. In order to prevent the electron loci from being disordered in the vicinity of the spacers 4020, it is desirable to control the potential distribution of the high resistant film 4311 over the entire regions. In the case where the high resistant film 4311 is connected to the face plate 4017 (metal back 4019, etc.) and the substrate 4011 (wirings 4013 and 4014, etc.) directly or through the abutment member 4041, there is the possibility that the unevenness of the connecting state occurs, and the potential distribution of the high resistant film 4311 is shifted from a desired value because of the contact resistance on the interface of the connecting portion. In order to prevent this drawback, the low resistant intermediate layers are disposed over the overall region of the space end portions (the abutment surface 3 or the side portion 4305) where the spacers 4020 abut against the face plate 4017 and the substrate 4011, and a desired potential is applied to the intermediate layer portion, thereby being capable of controlling the potential of the entire high resistant film 4311.

(3) The loci of the emission electrons are controlled.

The electrons emitted from the cold cathode elements 4012 form the electron loci in accordance with the potential distribution formed between the face plate 4017 and the substrate 4011. There is the possibility that the electrons emitted from the cold cathode elements in the vicinity of the spacers are limited (the change in wirings and the element positions, etc.) with the location of the spacers. In this case, in order to form an image without any strain and unevenness, it is necessary that the loci of the emitted electrons are controlled to irradiate the electrons at a desired position on the face plate 4017. If the low resistant intermediate layer is disposed on the side portion 4305 of the surfaces which abut against the face plate 4017 and the substrate 4011, the potential distribution in the vicinity of the spacers 4020 can provide a desired characteristic so as to control the loci of the emitted electrons.

The low resistant film 4321 may be selected from materials having a resistance lower than the high resistant film 4311 by at least one digit, and is appropriately selected from metal such as Ni, Cr, Au, Mo, W, Pt, Ti, Al, Cu or Pd, or alloy of those metal, metal such as Pd, Ag, Au, $RuO_2$, Pd-Ag, metal oxide, a printing conductor made of glass, transparent conductor such as $In_2O_3$—$SnO_2$, and semiconductor material such as polysilicon.

It is necessary that the bond 4041 provides electric conductivity so that the spacers 4020 are electrically connected to the row-directional wirings 4013 and the metal back 4019. That is, flit glass to which an electrically conductive adhesive, metal grains, or electrically conductive filler is added, is preferable.

Also, Dx1 to Dxm and Dy1 to Dyn and Hv are electric connection terminals with an airtight structure provided for electrically connecting the display panel to an electric circuit not shown. Dx1 to Dxm are electrically connected to the row-directional wirings 4013 of the multiple electron beam source, Dy1 to Dyn are electrically connected to the column-directional wirings 4014 of the multiple electron beam source, and Hv is electrically connected to the metal back 4019 of the face plate, respectively.

Also, in order to exhaust the gas from the interior of the airtight vessel, after the airtight vessel has been assembled, it is connected to an exhaust tube and a vacuum pump not shown, and the gas is exhausted from the interior of the airtight vessel to the degree of vacuum of about $1.3\times10^{-5}$ Pa. Thereafter, the exhaust tube is sealed, and in order to maintain the degree of vacuum within the airtight vessel, a getter film (not shown) is formed at a given position within the airtight vessel immediately before sealing or after sealing. The getter film is formed by heating and depositing a getter material that mainly contains, for example, Ba by a heater or a high-frequency heating, and the interior of the airtight vessel is maintained to the degree of vacuum of $1.3\times10^{-3}$ to $1.3\times10^{-5}$ Pa due to the adsorption action of the getter film.

In the image display device using the above-described display panel, when a voltage is applied to the respective cold cathode element 4012 through the vessel external terminals Dx1 to Dxm and Dy1 to Dyn, electrons are emitted from the respective cold cathode elements 4012. At the same time, when a high voltage of several hundreds of V to several kV is applied to the metal back 4019 through the vessel external terminal Hv, the emitted electrons are accelerated and collide with the inner surface of the face plate 4017. As a result, the phosphors of the respective colors which form the fluorescent film 4018 are excited to emit a light, thereby displaying an image.

Usually, a supply voltage to the surface conduction type emission elements 4012 which are the cold cathode elements according to the present invention is about 12 to 16 V, a distance d between the metal back 4019 and the cold cathode elements 4012 is about 1 to 8 mm, a voltage between the metal back 4019 and the cold cathode elements 4012 is about 0.1 kV to 10 kV.

The above description is given of the basic structure and the manufacturing method of the display panel and the outline of the image display device of this embodiment in accordance with the present invention.

(2) Method of Manufacturing a Multiple Electron Beam Source

Subsequently, a description will be given of a method of manufacturing the multiple electron beam source used in the display panel of this embodiment. The multiple electron beam source used in the image display device of this invention is not limited to the material, the configuration or the manufacturing method of the cold cathode element if the multiple electron beam source is an electron source in which the cold electrode elements are wired in a single matrix. Accordingly, for example, a surface conduction type emission element, or a cold cathode element of the FE type or the MIM type can be employed.

Under the circumstances where the image display device large in a display screen and inexpensive is demanded, the surface conduction type emission element is particularly preferable among those cold cathode elements. That is, in the FE type, because the relative position and the configuration of the emitter cone and the gate electrode largely depend on the emission characteristic, the manufacturing technique with an extremely high precision is required. However, this becomes a disadvantageous factor in order to achieve the large area and the reduction of the manufacture costs. Also, in the MIM type, it is necessary to thin the thicknesses of the insulating layer and the upper electrode and also unify the thicknesses. However, this also leads to a disadvantageous factor in order to achieve the large area and the reduction of the manufacture costs. From this viewpoint, in the surface conduction type electron emission element, because the manufacturing method is relatively simple, it is easy to achieve the large area and the reduction of the manufacture costs. Also, the present inventors have found that among the surface conduction type emission elements, the electron emission element in which the electron emission portion or its peripheral portion is formed of a fine grain film is particularly excellent in the emission characteristic and is readily manufactured. Accordingly, such an element is most preferable when being used in the multiple electron beam source in the image display device high in luminance and large in screen. Therefore, in the display panel of the above-mentioned embodiment, there is used the surface conduction type emission element in which the emission portion or its peripheral portion is formed of a fine grain film. First, a description will be given of a basic structure, the manufacturing method and the characteristic in the preferable surface conduction type emission element, and thereafter a description will be given of the structure of the multiple electron beam source in which a large number of elements are wired in a simple matrix.

[Preferable Element Structure and Manufacturing Method of Surface Conduction Type Electron Emission Element]

The representative structure of the surface conduction type electron emission element in which the electron emission portion or its peripheral portion is formed of a fine grain film are classified into two kinds consisting of the plane type and the vertical type.

[Plane Type Surface Conduction Type Emission Element]

First of all, a description will be given of the element structure and the manufacturing method of the plane type surface conduction type emission element.

Figure 72A:
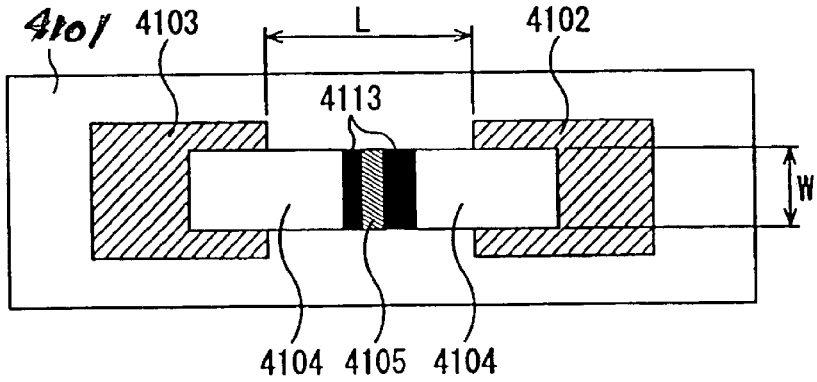
FIGS. 72A and 72B are a schematic plan view and a cross-sectional view showing a plane type surface conduction type electron emission element used in an embodiment of the present invention.
Figure 72B:
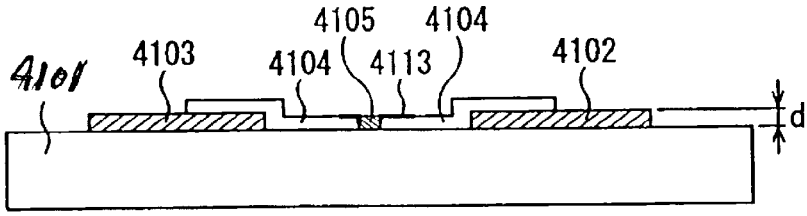

FIGS. 72A and 72B are a plan view and a cross-sectional view for explanation of the structure of the plane type surface conduction type electron emission element. In the figures, reference numeral 4101 denotes a substrate, 4102 and 4103 are element electrodes, 4104 is an electrically conductive thin film, 4105 is an electron emission portion formed through an electrification forming process, and 4113 is a film formed through an electrification activating process.

The substrate 4101 may be formed of, for example, various glass substrates such as quartz glass or soda lime glass, various ceramics substrate such as alumina, the above-mentioned substrates on which an insulating layer with material of, for example, $SiO_2$ is stacked, etc.

Also, the element electrodes 4102 and 4103 which are disposed on the substrate 4101 and face each other in parallel with the substrate surface are made of electrically conductive material. For example, the material of the element electrodes 4102 and 4103 is appropriately selected from the material consisting of, for example, metal such as Ni, Cr, Au, Mo, W, Pt, Cu, Pd or Ag, or alloy of those metal, metal oxide such as $In_2O_3$—$SnO_2$, or semiconductor material such as polysilicon. The formation of the electrodes can be readily achieved by using the combination of, for example, the film forming technique such as vapor evaporation with the patterning technique such as photolithography or etching. However, those element electrodes 4102 and 4103 may be formed by using other methods (for example, printing technique).

The configuration of the element electrodes 4102 and 4103 can be appropriately designed in accordance with the applied purpose of the electron emission element. In general, the electrode interval L is designed by selecting an appropriate numeral value usually from a range of from several tens of nm to several hundreds of μm. Among them, the range preferred for applying the electron emission element to the image display device is several μm to several tens of μm. Also, the thickness d of the element electrode is usually selected from an appropriate numeral value of a range of from several tens of nm to several μm.

Also, the fine grain film is used on a portion of the electrically conductive thin film 4104. The fine grain film described here means a film containing a large number of fine grains as the structural element (also containing the assembly of islands). When investigating the fine grain film microscopically, there are usually observed a structure in which the respective fine grains are isolated from each other, a structure in which the respective fine grains are adjacent to each other, or a structure in which the respective fine grains are overlapped with each other.

The diameter of the fine grains used in the fine grain film is in a range of from several nm to several hundreds of nm, and more preferably in a range of from 1 nm to 20 nm. Also, the thickness of the fine grain film is appropriately set taking the various conditions stated below into consideration. That is, the various conditions are a condition required for electrically satisfactorily connecting the fine grain film to the element electrodes 4102 or 4103, a condition required for satisfactorily conducting the electrification forming which will be described later, a condition required for setting the electric resistance of the fine grain film per se to an appropriate value which will be described later, etc. Specifically, the electric resistance is selected in a range of from several nm to several hundreds of nm, and most preferably in a range of from 1 nm to 50 nm.

Also, the material used for forming the fine grain film may be, for example, metal such as Pd, Pt, Ru, Ag, Au, Ti, In, Cu, Cr, Fe, Zn, Sn, Ta, W, or Pd, oxide such as PdO, $SnO_2$, $In_2O_3$, PbO, or $Sb_2O$, boride such as $HfB_2$, $ZrB_2$, $LaB_6$, $CeB_6$, YB, or $GdB_4$, carbide such as TiC, ZrC, HfC, TaC, SiC or WC, nitride such as TiN, ZrN or HfN, semiconductor such as Si or Ge, and carbon, from which an appropriate material is selected.

As described above, the electrically conductive thin film 4104 is formed of the fine grain film, and its sheet resistance is set in a range of $10^3$ to $10^7$ Ω/square.

Because it is desirable that the electrically conductive thin film 4104 and the element electrodes 4102, 4103 are electrically satisfactorily connected to each other, portions of the respective members are superimposed on each other. The superimposing manner is that in the example of FIG. 72, where the substrate, the element electrodes, and the electrically conductive thin film are stacked on each other in the stated order from the bottom, but depending on the occasion, the substrate, the electrically conductive thin film and the element electrodes may be stacked on each other in the stated order from the bottom.

Also, the electron emission portion 4105 is a crack portion formed on a portion of the electrically conductive thin film 4104 and electrically has a higher resistant property than the electrically conductive thin film. The crack is formed by conducting the electrification forming process which will be described later with respect to the electrically conductive thin film 4104. There is a case in which the fine grains several nm to several tens of nm in grain diameter are disposed within the crack. Because it is difficult to show the position and the configuration of the actual electron emission portion with precision and accuracy in the figure, it is schematically shown in FIG. 72.

Also, the thin film 4113 a thin film made of carbon or carbon compound and coats the electron emission portion 4105 and its vicinity. The thin film 4113 is formed by conducting the electrification activating process which will be described later after the electrification forming process.

The thin film 4113 is made of any one of mono-crystal graphite, poly-crystal graphite and amorphous carbon, or the mixture thereof, and the thickness is set to 50 nm or less, and more preferably set to 30 nm or less. Because it is difficult to show the position and the configuration of the actual thin film 4113 with precision in the figure, it is schematically shown in FIG. 72. Also, the plan view of FIGS. 72A shows an element from which a part of the electron emission portion 4105 of the thin film 4113 is removed.

The above description is given of the basic structure of the preferred element, and a specific structure will be described below.

That is, the substrate 1101 is made of soda lime glass, and the element electrodes 4102 and 4103 are formed of Ni thin films. The thickness d of the element electrodes 4102 and 4103 is 10 nm, and the electrode interval L is 2 μm.

As the main material of the fine grain film, Pd or PdO is used and the thickness of the fine grain frame is about 100 nm and the width is 100 μm.

Subsequently, a description will be given of a method of manufacturing the preferred plane type surface conduction type emission element. FIGS. 73A to 73E are cross-sectional views for explanation of a process of manufacturing the surface conduction type electron emission element, and the references of the respective members are identical with those in FIG. 72.

Figure 73A:
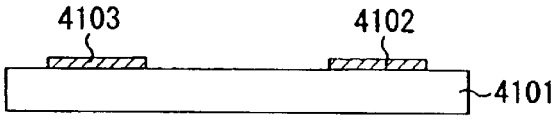
FIGS. 73A to 73E are cross-sectional views showing a process of manufacturing the plane type surface conduction type electron emission element shown in FIGS. 72A and 72B.

1) First, as shown in FIG. 73A the element electrode 4102 and 4103 are formed on the substrate 4101.

In formation of the element electrode 4102 and 4103, the substrate 4101 has been sufficiently cleaned by using a detergent, pure water and organic solvent in advance, and the material of the element electrodes are deposited. As a depositing method, for example, a vacuum film forming technique such as the vapor evaporation method or the sputtering method may be used. Thereafter, the deposited electrode material is patterned by using the photolithography and etching technique to form a pair of element electrodes 4102 and 4103 shown in FIG. 73A.

Figure 73B:
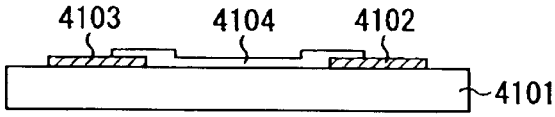

2) Then, as shown in FIG. 73B, the electrically conductive thin film 4104 is formed.

In formation of the electrically conductive thin film 4104, after an organic metal solvent is coated on the substrate shown in the above FIG. 73A, it is dried. After a heat baking process is conducted to form the fine grain film, the film is patterned in a given configuration by the photolithography etching. In this example, the organic metal solvent is directed to a solution of the organic metal compound which contains as the main element the material of the fine grains used for the electrically conductive thin film. (Specifically, the main elements in this embodiment is Pd. Also, in this embodiment, as a coating method, the dipping method is used, however, other methods such as a spinner method or a spray method may also be used.)

Also, as a method of forming the electrically conductive thin film formed of the fine grain film, there is a case of using, for example, a vapor evaporation method, a sputtering method, or a chemical gas phase depositing method, other than the organic metal solution coating method used in this embodiment.

Figure 73C:
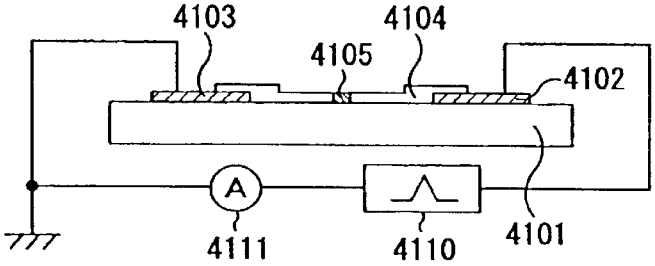

3) Then, as shown in FIG. 73C, an appropriate voltage is applied between the element electrodes 4102 and 4103 from the forming power supply 4110 to conduct the electrification forming, thus forming the electron emission portion 4105.

The electrification forming process means a process in which electrification is conducted on the electrically conductive thin film 4104 formed of the fine grain film to appropriately destroy, deform or affect a part of the electrically conductive film 4104 into a structure suitable for conducting electron emission. In a portion which is changed into the preferred structure for conducting the electron emission among the electrically conductive thin film formed of the fine grain film (that is, the electron emission portion 4105), an appropriate crack is formed in the thin film. As compared with the electron emission portion 4105 before formation, the electric resistance measured between the element electrodes 4102 and 4103 greatly increases after the electron emission portion 4105 has been formed.

Figure 74:
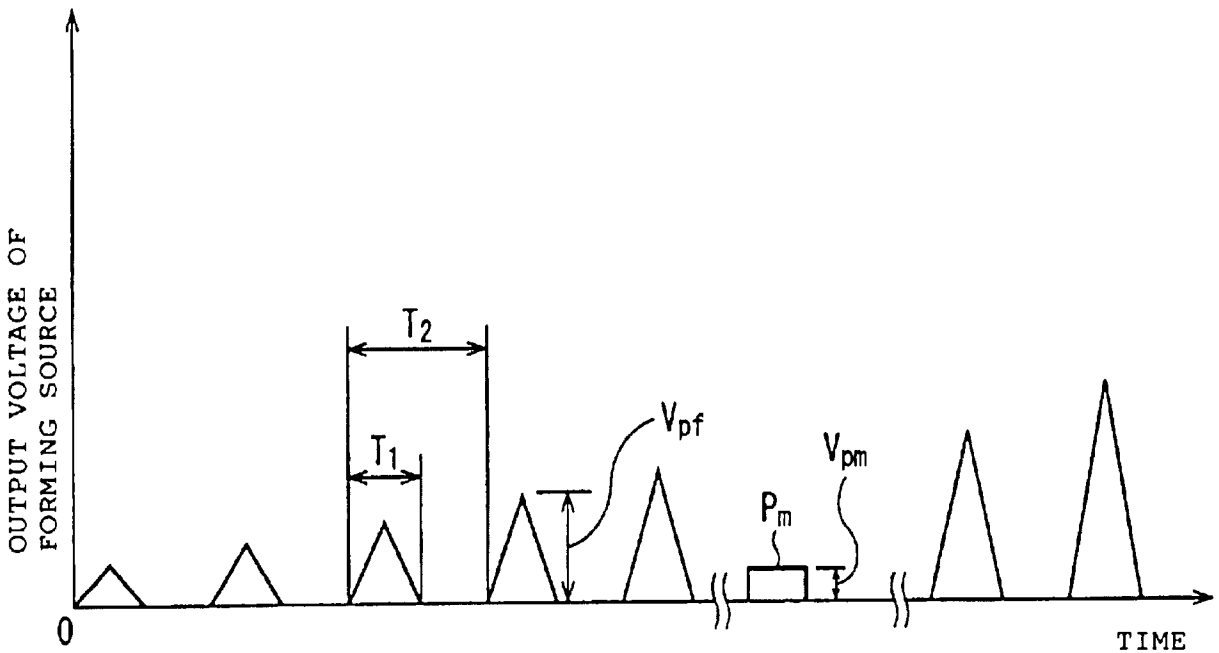
FIG. 74 is a diagram showing a supply voltage waveform in an electrification forming process in a method of manufacturing an image forming apparatus in accordance with an embodiment of the present invention.

In order to describe the electrifying method in more detail, FIG. 74 shows an example of an appropriate voltage waveform which is applied from the forming power supply 4110. In the case where the electrically conductive thin film formed of the fine grain film is formed, a pulse voltage is preferable, and in case of this embodiment, as shown in the figure, chopping pulses each having a pulse width T1 is continuously applied at a pulse interval T2. In this situation, a peak value Vpf of the chopping pulse sequentially steps up. Also, a monitor pulse Pm for monitoring the forming state of the electron emission portion 4105 is inserted between the chopping pulses at an appropriate interval, and a current that flows in this state is measured by an ammeter 4111.

In this embodiment, under the vacuum atmosphere of, for example, about $1.3\times10^{-3}$ Pa, for example, the pulse width T1 is 1 msec, the pulse interval T2 is 10 msec, and the peak value Vpf steps up 0.1 V every 1 pulse. Then, one monitor pulse Pm is inserted between the chopping pulses every time 5 chopping pulses are applied. The voltage Vpm of the monitor pulse is set to 0.1 V so that the forming process is not adversely affected. Then, at a state where the electric resistance between the element electrodes 4102 and 4103 becomes $1\times10^{6}$ Ω, that is, at a stage where the current measured by the ammeter 4111 when the monitor pulse is applied becomes $1\times10^{-7}$ A or less, the electrification for the forming process is completed.

In the above method, there is a preferable method pertaining to the surface conduction type emission element according to this embodiment, for example, in the case where the design of the surface conduction type emission element such as the material and the thickness of the fine grain film, the element electrode interval L, etc., are changed, it is desirable to change the conditions of the electrification in accordance with the change of design.

Figure 73D:
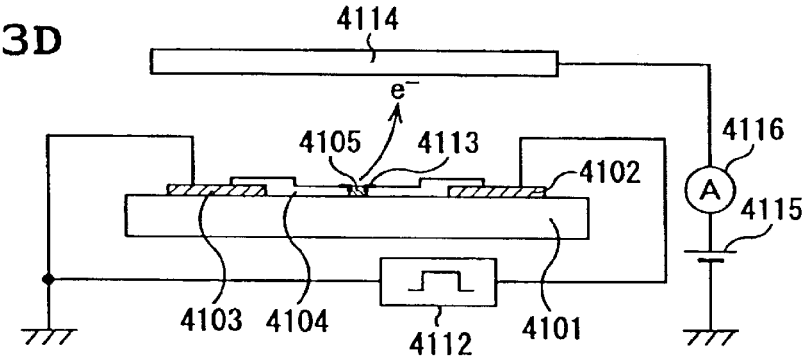

4) Then, as shown in FIG. 73D, an appropriate voltage is applied between the element electrodes 4102 and 4103 by using the activation power supply 4112 to conduct the electrification activating process, thus improving the electron emission characteristic.

The electrification activating process is directed to a process in which the electron emission portion 4105 formed through the above electrification forming process is electrified under an appropriate condition to deposit carbon or carbon compound in the vicinity of the electron emission portion 4105 (in the figure, an accumulation made of carbon or carbon compound is schematically shown as the member 4113). The emission current at the same supply voltage can increase typically 100 times or more through the electrification activating process as compared with a case in which the electrification activating process is not yet conducted.

Specifically, the voltage pulses are periodically applied under the vacuum atmosphere within a range of $1.3\times10^{-2}$ Pa to $1.3\times10^{-3}$ Pa to deposit carbon or carbon compound derived from the organic compound existing in the vacuum atmosphere. The accumulation 4113 is made of any one of mono-crystal graphite, poly-crystal graphite, and amorphous carbon, or the mixture thereof, and the thickness is set to 50 nm or less, and more preferably set to 30 nm or less.

Figure 75A:
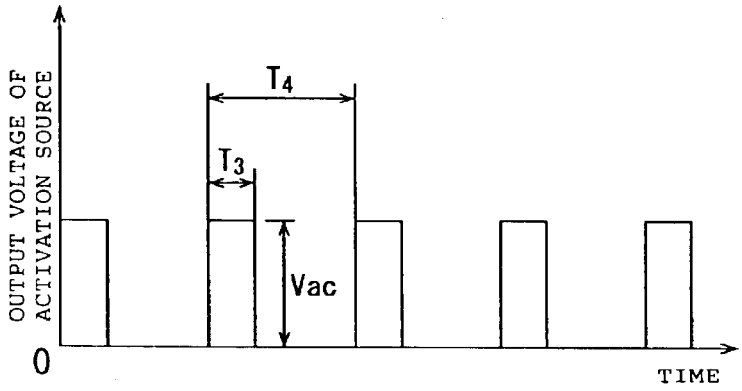
FIGS. 75A and 75B are diagrams showing a change in the supply voltage waveform and the emission current in an electrification activating process in a method of manufacturing an image forming apparatus in accordance with an embodiment of the present invention.

In order to describe the electrifying method in more detail, FIG. 75A shows an example of the appropriate voltage waveform which is applied from the activation power supply 4112. In this embodiment, a rectangular wave of a constant voltage is periodically applied to conduct the electrification activating process. Specifically, the voltage Vac of the rectangular wave is set to 14 V, the pulse width T3 is set to 1 msec, and the pulse interval T4 is set to 10 msec. The above-described electrifying conditions are preferable conditions pertaining to the surface conduction type emission element according to this embodiment, and in the case where the design of the surface conduction type emission element is changed, it is desirable to appropriately change the conditions in accordance with the change of the design.

Figure 75B:
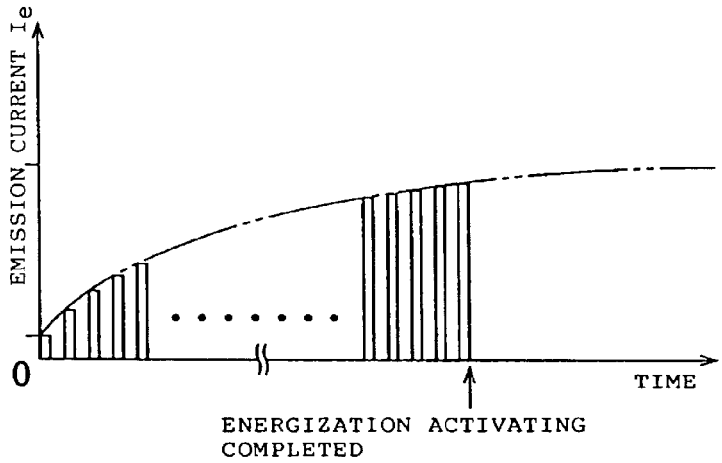

Reference numeral 4114 shown in FIG. 73D is an anode electrode for catching the emission current Ie emitted from the surface conduction type emission element, and a d.c. high voltage power supply 4115 and the current ammeter 4116 are connected (in the case where the substrate 4011 is assembled into the display panel to conduct the activating process, the fluorescent surface of the display panel is used as the anode electrode 4114). The emission current Ie is measured by the ammeter 4116 while a voltage is applied from the activation power supply 4112, and the progress state of the electrification activating process is monitored, to control the operation of the activation power supply 4112. An example of the emission current Ie measured by the ammeter 4116 is shown in FIG. 75B. When a pulse voltage starts to be applied from the activation power supply 4112, the emission current Ie increases with time but thereafter is saturated so as not to substantially increase. In this way, at a time point where the emission current Ie is substantially saturated, the voltage supply from the activation power supply 4112 stops to complete the electrification activating process.

The above-described electrifying conditions are preferable conditions pertaining to the surface conduction type emission element according to this embodiment, and in the case where the design of the surface conduction type emission element is changed, it is desirable to appropriately change the conditions in accordance with the change of the design.

Figure 73E:
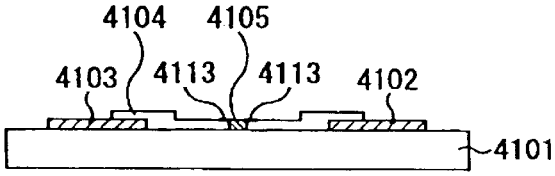

In the above-mentioned manner, the plane type surface conduction type emission element according to this embodiment as shown in FIG. 73E is manufactured.

[Vertical Type Surface Conduction Type Emission Element]

Subsequently, another representative structure of the surface conduction type emission element in which the emission portion or its peripheral portion is formed of the fine grain film, that is, the structure of the vertical type surface conduction type electron emission element, will be described.

Figure 76:
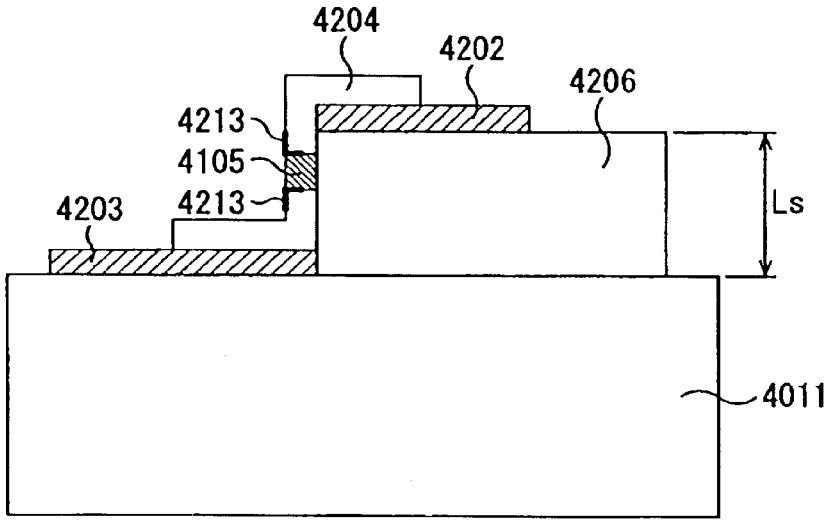
FIG. 76 is a cross-sectional view showing a vertical type surface conduction type emission element in an image forming apparatus in an embodiment of the present invention.

FIG. 76 is a schematic cross-sectional view for explaining the basic structure of the vertical type, and in the figure, reference numeral 4011 denotes a substrate, 4202 and 4203 are element electrodes, 4206 is a step forming member, 4204 is an electrically conductive thin film formed of the fine grain film, 4105 is an electron emission portion formed through the electrification forming process, and 4213 is a thin film formed through the electrification activating process.

Differences of the vertical type from the plane type described in the above reside in that one of the element electrodes (4202) is disposed on the step forming member 4206, and the electrically conductive thin film 4204 is coated on the side surface of the step forming member 4206. Accordingly, the element electrode interval L in the plane type shown in the above FIG. 72 is set as a step height Ls of the step forming member 4206 in the vertical type. In the substrate 4011, the element electrodes 4202, 4203, and the electrically conductive thin film 4204 formed of the fine grain film, the same materials as those described in the above plane type can be similarly used. Also, the step forming member 4206 is made of an electrically insulating material, for example, such as $SiO_2$.

Subsequently, a method of manufacturing the vertical type surface conduction type emission element will be described. FIGS. 77A to 77F are cross-sectional views for explaining of the manufacturing process, and the references of the respective members are identical with those in FIG. 76.

Figure 77A:
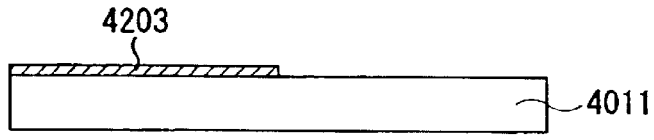
FIGS. 77A to 77F are cross-sectional views showing a process of manufacturing the vertical type surface conduction type electron emission element shown in FIG. 76.

1) First, as shown in FIG. 77A, the element electrode 4203 is formed on the substrate 4011.

Figure 77B:
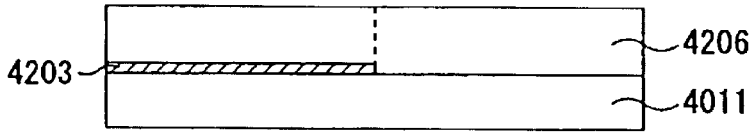

2) Subsequently, as shown in FIG. 77B, an insulating layer for forming the step forming member is stacked. The insulating layer may be formed by stacking, for example, $SiO_2$ through the sputtering method, however, other film forming method such a vacuum evaporation method or a printing method may be used.

Figure 77C:
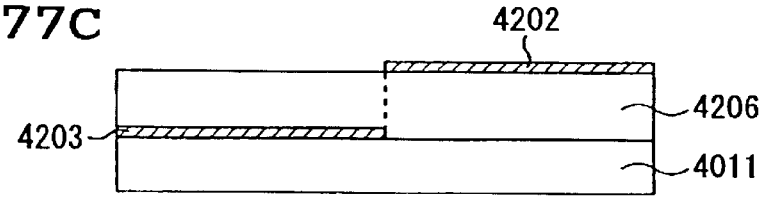

3) Then, as shown in FIG. 77C, the element electrode 4202 is formed on the insulating layer.

Figure 77D:
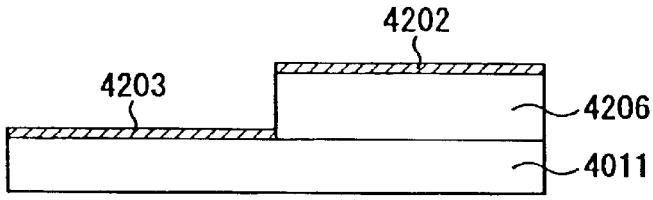

4) Then, as shown in FIG. 77D, a part of the insulating layer is removed by using, for example, the etching method to expose the element electrode 4203.

Figure 77E:
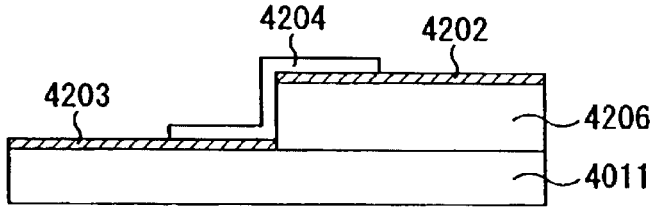

5) Then, as shown in FIG. 77E, the electrically conductive thin film 4204 formed using the fine grain film is formed. In the formation, a film forming technique, for example, such as a coating method may be used similarly as in the above plane type.

6) Then, the electrification forming process is conducted to form the electron emission portion as in the above plane type (the same process as that of the plane type electrification forming process described with reference to FIG. 73C may be conducted.)

7) Then, the electrification activating process is conducted to deposit carbon or carbon compound in the vicinity of the electron emission portion as in the above plane type (the same process as that of the plane type electrification activating process described with reference to FIG. 73D may be conducted.)

Figure 77F:
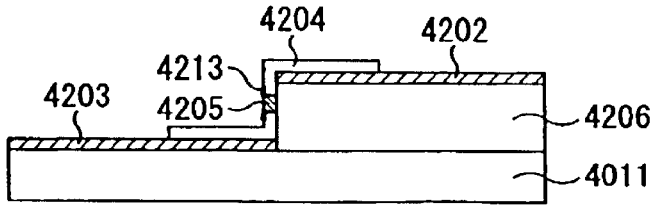

In the above-mentioned manner, the vertical type surface conduction type emission element shown in FIG. 77F is manufactured.

[Characteristic of Surface Conduction Type Emission Element used in Display Device]

The above description is given of the element structures and the manufacturing methods of the plane type and vertical type surface conduction type emission element. Subsequently, the characteristic of the element used in the display device will be described.

Figure 78:
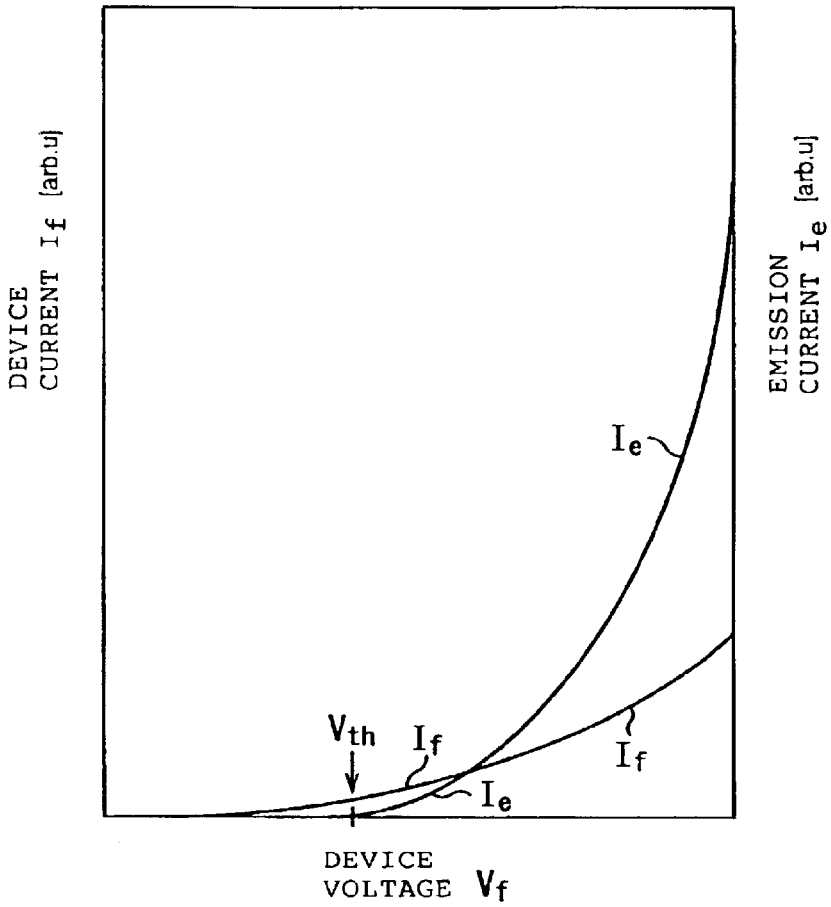
FIG. 78 is a graph showing the typical characteristic of the surface conduction type emission element in an image forming apparatus in an embodiment of the present invention.

FIG. 78 shows a typical example of the emission current Ie to element supply voltage Vf characteristic, and the element current If to the element supply voltage Vf characteristic in the element used in the display device. Since the emission current Ie is remarkably small as compared with the element current If, it is difficult to show the emission current Ie by the same unit, and those characteristics are changed by changing the design parameters such as the size or configuration of the element. Therefore, those two characteristics are exhibited by arbitrary units, respectively.

The element used in the display device has the following three characteristics related to the emission current Ie.

First, when a voltage of a given voltage or more (called "threshold voltage Vth") is applied to the element, the emission current Ie rapidly increases. On the other hand, when the voltage is lower than the threshold voltage Vth, the emission current Ie is hardly detected.

Second, because the emission current Ie changes depending on the voltage Vf applied to the element, the amplitude of the emission current Ie can be controlled by the voltage Vf.

Thirdly, because a response speed of the current Ie emitted from the element with respect to the voltage Vf applied to the element is high, the amount of charges of electrons emitted from the element can be controlled by the length of a period of time during which the voltage Vf is applied.

Because the above-mentioned characteristics are provided, the surface conduction type electron emission element can be preferably used in the image display device. For example, in the image display device in which a large number of elements are disposed in correspondence with the pixels of the display screen, the display screen can be sequentially scanned and displayed by using the first characteristic. In other words, a voltage of the threshold voltage Vth or higher is appropriately applied to the driving element in response to the desired light emitting luminance, and a voltage lower than the threshold voltage Vth is applied to a non-selected state element. When the driving element is sequentially changed over, the display screen can be sequentially scanned and displayed.

Also, because the light emitting luminance can be controlled by using the second characteristic or the third characteristic, the graduation display can be displayed.

[Structure of the Multiple Electron Beam Source in Which Plural Elements are Wired in a Simple Matrix]

Subsequently, a description will be given of a structure of the multiple electron beam source in which the surface conduction type emission elements are disposed on the substrate as the cold cathode elements and wired in a simple matrix.

FIG. 69 shows a plan view of the multiple electron beam source used in the display panel shown in FIG. 68. The same surface conduction type emission elements as those shown in FIG. 72 are arranged on the substrate, and those elements are wired in a simple matrix by the row-directional wirings 4013 and the column-directional wirings 4014. Portions where the row-directional wirings 4013 and the column-directional wirings 4014 cross each other are formed with insulating layers (not shown) between electrodes, to keep electric insulation.

FIG. 70 shows a cross-sectional view taken along a line B–B' of FIG. 69.

The multiple electron source thus structured is manufactured in such a manner that the row-directional wirings 4013, the column-directional wirings 4014, inter-electrode insulating layers (not shown), the element electrodes of the surface conduction type emission elements and the electrically conductive thin film have been formed on a substrate in advance, electricity is supplied to the respective elements through the row-directional wirings 4013 and the column-directional wirings 4014 to conduct an electrification forming process and an electrification activating process.

(3) Drive Circuit Structure (and Driving Method)

Figure 79:
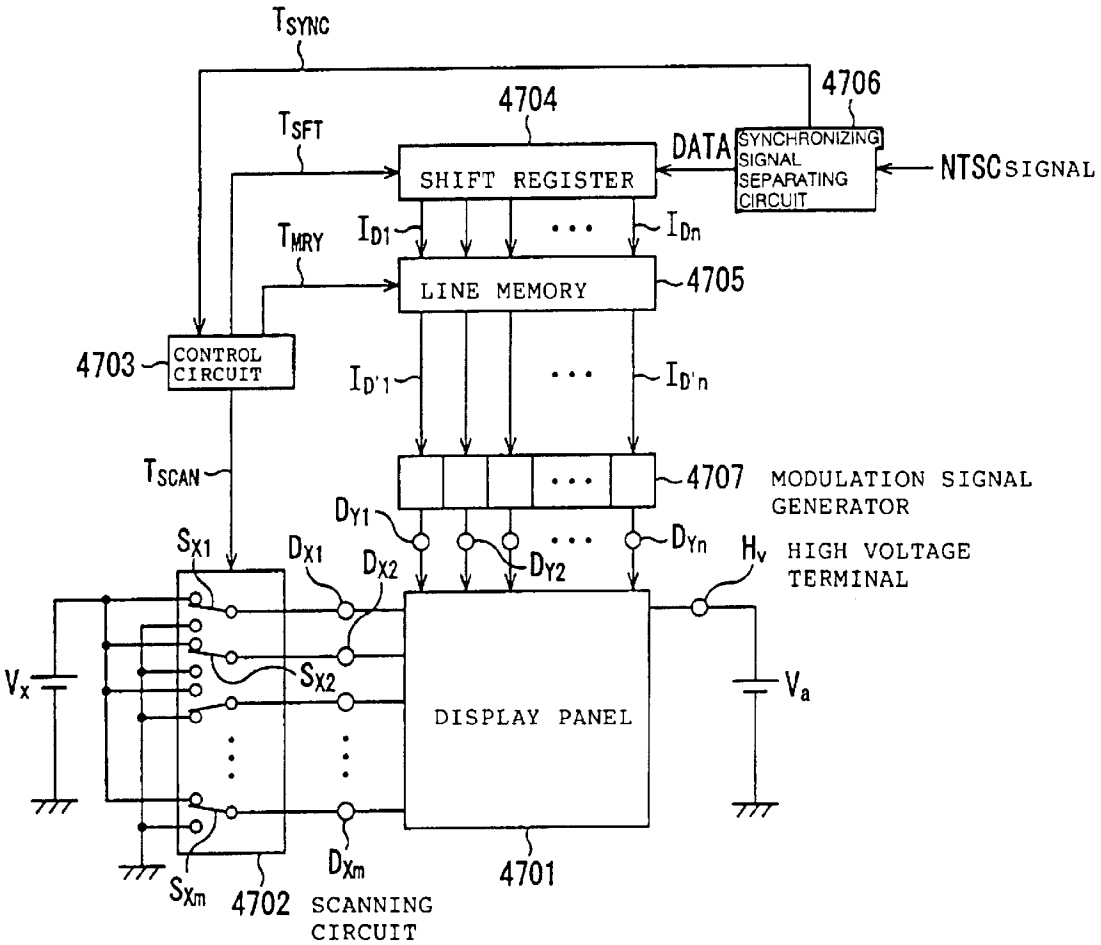
FIG. 79 is a block diagram showing the schematic structure of a drive circuit in an image forming apparatus in an embodiment of the present invention.

FIG. 79 is a block diagram showing the rough structure of a drive circuit for an television display on the basis of a television signal of the NTSC system. In the figure, a display panel 4701 corresponds to the above-described display panel, which is manufactured and operates as described above. Also, a scanning circuit 4702 scans the display line, and a control circuit 4703 produces a signal, etc. inputted to the scanning circuit 4702. A shift register 4704 shifts data for one line, and a line memory 4705 outputs data for one line from the shift register 4704 to a modulated signal generator 4707. A synchronous signal separating circuit 4706 separates a synchronous signal from the NTSC signal.

Hereinafter, the functions of the respective portions in the device shown in FIG. 79 will be described in more detail.

First, the display panel 4701 is connected to an external electric circuit through terminals Dx1 to Dxm, Dy1 to Dyn and a high voltage terminal Hv. To the terminals Dx1 to Dxm is applied a scanning signal for sequentially driving the multiple beam source disposed within the display panel 4701, that is, the cold cathode elements which are wired in a matrix of m rows×n columns for each row (n pixels). On the other hand, to the terminals Dy1 to Dyn is applied a modulated signal for controlling the output electron beams of the respective n elements for one row which is selected by the above scanning signal. Also, to the high voltage terminal Hv is applied a d.c. voltage of, for example, 5 kV from the d.c. voltage source Va. This is an accelerating voltage for giving sufficient energy for exciting the phosphors to the electron beam outputted from the multiple electron beam source.

Then, the scanning circuit 4702 will be described. The circuit includes m switching elements. (in the figure, schematically represented by S1 to Sm) therein, and the respective switching elements select any one of the output voltage of the d.c. voltage source Vx and 0 V (ground level) and are electrically connected to the terminals Dx1 to Dxm of the display panel 4701. The respective switching elements of S1 to Sm operate on the basis of a control signal Tscan outputted from the control circuit 4703, and in fact, can be readily structured by the combination of the switching elements such as FETs. The above d.c. voltage source Vx is so set as to output a constant voltage so that the drive voltage applied to the element not scanned becomes the electron emission threshold voltage Vth or lower on the basis of the characteristic of the electron emission element exemplified in FIG. 78.

The control circuit 4703 matches the operation of the respective portions so that appropriate display is conducted on the basis of an image signal inputted from the external. The respective control signals of Tscan, Tsft, and Tmry are produced to the respective portions, on the basis of the synchronous signal Tsync transmitted from the synchronous signal separating circuit 4706 which will be described next. The synchronous signal separating circuit 4706 is a circuit for separating a synchronous signal component and a luminance signal component from a television signal of the NTSC system which is inputted from the external. The synchronous signal separated from the synchronous signal separating circuit 4706 consists of a vertical synchronous signal and a horizontal synchronous signal as is well known, but shown as a Tsync signal for convenience of description. On the other hand, the luminance signal component of the image separated from the above television signal is represented by a DATA signal for convenience, and the signal is inputted to the shift register 4704.

The shift register 4704 serial to parallel converts the above DATA signal inputted in a serial manner in a time series for one line of the image, and operates on the basis of the control signal Tsft transmitted from the above control circuit 4703. In other words, the control signal Tsft can be also called the shift clock of the shift register 4704. The data for one line of the image which is serial/parallel converted (corresponding to the drive data for n elements of the electron emission element) is outputted from the shift register 4704 as n signals of Id1 to Idn.

The line memory 4705 is a memory device for storing data for one line of the image for a required period of time, and appropriately stores the contents of Id1 to Idn in accordance with the control signal Tmry transmitted from the control circuit 4703. The stored contents are outputted as I'd1 to I'dn and then inputted to the modulated signal generator 4707.

The modulated signal generator 4707 is a signal source for appropriately driving and modulating the respective electron emission elements 4015 in correspondence with the above respective image data. I'd1 to I'dn, and its output signal is supplied to the electron emission element 4015 within the display panel 4701 through the terminals Dy1 to Dyn.

As was described with reference to FIG. 78, the surface conduction type emission element according to the present invention has the following basic characteristics with respect to the emission current Ie. That is, the electron emission provides the definite threshold voltage Vth (8 V in the surface conduction type electron emission element according to an embodiment mode which will be described later), and the electrons are emitted only when a voltage of the threshold voltage Vth or higher is applied. Also, the emission current Ie also changes with respect to the voltage of the electron emission threshold value Vth or higher in correspondence with a change in voltage as shown in the graph of FIG. 78. From this fact, in the case where a pulse voltage is applied to the element, for example, even if a voltage of the electron emission threshold value Vth or lower is applied to the element, the electrons are not emitted. On the other hand, in the case where a voltage of the emission threshold value Vth or higher is applied to the element, the electron beam is outputted from the surface conduction type electron emission element. In this situation, it is possible to control the intensity of the output electron beam by changing the peak value Vm of the pulse. Also, it is possible to control the total amount of the charges of the outputted electron beam by changing the width Pw of the pulse.

Accordingly, as a system of modulating the electron emission element in response to an input signal, a voltage modulating system, a pulse width modulating system, etc., are applicable. In realizing the voltage modulating system, as the modulated signal generator 4707, there can be used a voltage modulating system which generates a voltage pulse of a constant length, and appropriately modulates the peak value of the pulse in accordance with the inputted data. Also, in implementing the pulse width modulating system, as the modulated signal generator 4707, there can be used a circuit of the pulse width modulating system which generates a voltage pulse of a constant peak value and appropriately modulates the width of the voltage pulse in accordance with the inputted data.

The shift register 4704 and the line memory 4705 may be of the digital signal type or the analog signal type. Namely, this is because the serial to parallel conversion of the image signal and the storage may be conducted at a given speed.

In the case of using the digital signal system, it is necessary to convert the output signal DATA of the synchronous signal separating circuit 4706 into a digital signal. To satisfy this, an A/D convertor may be disposed on an output portion of the synchronous signal separating circuit 4706. In association with this, the circuit used in the modulated signal generator is slightly different depending on whether an output signal of the line memory 4705 is a digital signal or an analog signal. In other words, in a case of the voltage modulating system using the digital signal, for example, a D/A converting circuit is used for the modulated signal generator 4707, and as necessary, an amplifying circuit is added. In a case of the pulse width modulating system, in the modulated signal generator 4707, there is a circuit that combines a high-speed oscillator, a counter that counts the number of waves outputted from the oscillator, and a comparator that compares an output value of the counter with an output value of the memory. As necessary, there can be added an amplifier for voltage-amplifying the modulated signal which is modulated in pulse width and outputted from the comparator up to the drive voltage of the electron emission element.

In a case of the voltage modulating system using the analog signal, for example, an amplifying circuit using an operational amplifier can be applied to the modulated signal generator 4707, and as necessary, a shift level circuit, etc., can be added. In a case of the pulse width modulating system, for example, a voltage control type oscillating circuit (VCO) can be applied, and as necessary, an amplifier for amplifying the voltage up to the drive voltage of the electron emission element can be added.

In the image display device thus structured to which the present invention can be applied, a voltage is applied to the respective electron emission elements through the vessel external terminals Dx1 to Dxm, and Dy1 to Dyn to emit the electrons. A high voltage is applied to the metal back 4019 or the transparent electrode (not shown) through a high voltage terminal Hv to accelerate the electron beam. The accelerated electrons collide with the fluorescent film 4018 and emit a light, to thereby form an image.

The structure of the image display device described here is an example of the image forming apparatus to which the present invention is applicable, and various modifications is enabled on the basis of the concept of the present invention. The input signal is of NTSC system in this example. However, the input signal is not limited to this, but various systems of the PAL system, the SECAM system, a TV signal system having a larger number of scanning lines than those systems (for example, a so-called high-grade TV) may also be applied.

(4) Derived Form

Figure 80:
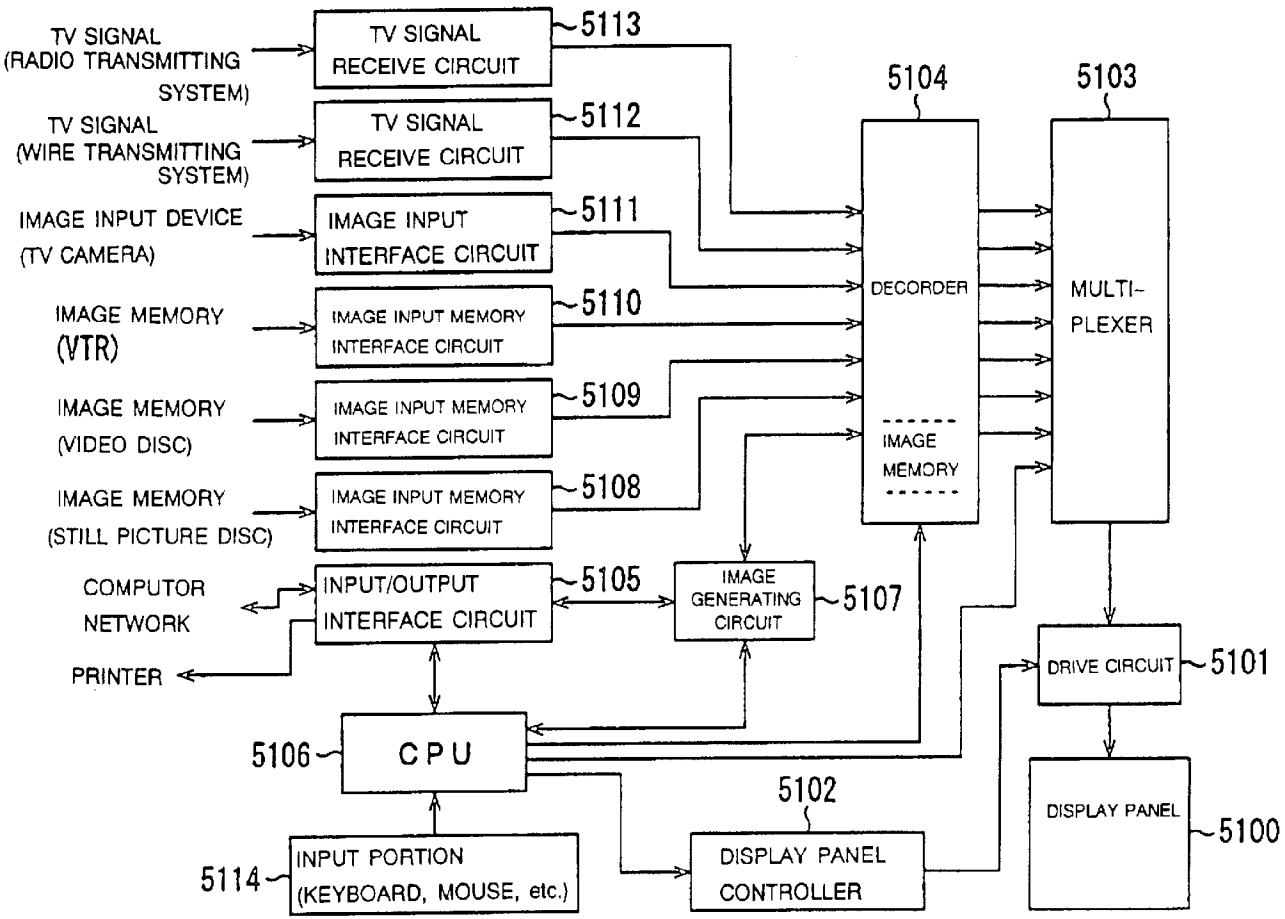
FIG. 80 is a block diagram showing a multi-function image display device using an image forming apparatus in an embodiment of the present invention.

FIG. 80 is a diagram showing one example of a multiple function display device structured in such a manner that image information supplied from various image information sources, for example, including television broadcast can be displayed on a display panel using the above-described surface conduction type emission elements as an electronic beam source.

In the figure, reference numeral 5100 denotes a display panel, 5101 is a drive circuit of the display panel, 5102 is a display controller, 5103 is a multiplexer, 5104 is a decoder, 5105 is an input/output interface circuit, 5106 is a CPU, 5107 is an image generating circuit, 5108, 5109 and 5110 are image memory interface circuits, 5111 is an image input interface circuit, 5112 and 5113 are TV signal receiving circuits, and 5114 is an input portion.

The display device according to this embodiment displays video,information and at the same time reproduces audio information when the device receives a signal including both of the video information and the audio information, for example, as with a television signal. However, circuits pertaining to the reception, separation, reproduction, processing, storage of the audio information, a speaker and so on which are not directly concerned with the features of the present invention will be omitted from description.

Hereinafter, the functions of the respective parts will be described along a flow of the image signal.

First, the TV signal receiving circuit 5113 is a circuit for receiving a TV image signal transmitted on a radio transmission system such as electric waves or spatial optic communication. The system of the received TV signal is not particularly limited, and various systems of the NTSC system, the PAL system, the SECAM system and so on may be applied. Also, a TV signal having a larger number of scanning lines than those systems (for example, high-grade TV) is a proper signal source for exhibiting the advantage of the above-described display panel suitable for a large area or a large number of pixels. The TV signal received by the TV signal receiving circuit 5113 is outputted to the decoder 5104.

The TV signal receiving circuit 5112 is a circuit for receiving the TV image signal transmitted on the wire transmitting system such as a coaxial cable or an optical fiber. As in the above TV signal receiving circuit 5113, the system of the received TV signal is not particularly limited. Also, the TV signal received by this circuit is outputted to the decoder 5104.

The image input interface circuit 5111 is a circuit for taking in an image signal supplied from an image input device, for example, a TV camera or an image reading scanner, and the taken-in image signal is outputted to the decoder 5104.

Also, the image memory interface circuit 5110 is a circuit for taking in an image signal stored in the videotape recorder (hereinafter referred to as VTR), and the take-in image signal is outputted to the decoder 5104.

Further, the image memory interface circuit 5109 is a circuit for taking in an image signal stored in a video disc, and the taken-in image signal is outputted to the decoder 5104.

Further, the image memory interface circuit 5108 is a circuit for taking in an image signal from a device that stores still image data, a so-called still image disc, and the taken-in still image data is outputted to the decoder 5104.

The input/output interface circuit 5105 is a circuit for connecting the present display device to an output device such as an external computer, a computer network or a printer. The input/output interface circuit 5105 conducts the input/output of image data, character/graphic information, and also can conduct the input/output of a control signal or numerical data between the CPU 5106 provided in the present display device and the external as occasion demands.

The image generating circuit 5107 is a circuit for generating image data for display on the basis of image data or character/graphic information inputted from the external through the input/output interface circuit 5105 or image data or character/graphic information outputted from the CPU 5106. The interior of the image generating circuit 5107 is equipped with circuits necessary for generating the image, such as a rewriteable memory for storing, for example, the image data and the character/graphic information, a read only memory in which an image pattern corresponding to character codes are stored, and a processor for conducting image processing, etc.

The image data for display generated by the image generating circuit 5107 is outputted to the decoder 5104, but can be outputted to the external computer network or the printer through the input/output interface circuit 5105 as occasion demands.

Further, the CPU 5106 mainly conducts the operation control of the present display device, and work pertaining to the generation, selection or edit of the display image.

For example, the control signal is outputted to the multiplexer 5103, and the image signal displayed on the display panel is appropriately selected or combined. In this case, the control signal is generated with respect to the display panel controller 5102 in response to the image signal to be displayed, and the operation of the display device such as a screen display frequency, a scanning method (for example, interlace or non-interlace) or the number of scanning lines for one screen is appropriately controlled.

Also, the image data or the character/graphic information is directly outputted to the image generating circuit 5107, or the external computer or the memory is accessed through the input/output interface circuit 5105 to input the image data or the character/graphic information.

Further, the CPU 5106 may of course pertain to the works for other purposes. For example, the CPU 5106 may be directly concerned with a function of generating or processing the information as in a personal computer, a word processor, etc.

Also, as described above, the CPU 5106 may be connected to the external computer network through the input/output interface circuit 5105, and cooperates works such as numerical calculation with the external device.

Further, the input portion 5114 is so designed as to input a command, program or data to the CPU 5106 by a user. For example, various input devices such as a joy stick, a bar code reader, or a voice recognizing device in addition to a keyboard or a mouse can be used.

Also, the decoder 5104 is a circuit for reversely converting various image signals inputted from the above devices 5107 to 5113 into a three primary color signal, or a luminance signal and an I signal, a Q signal. As indicated by a dotted line in the figure, it is desirable that the decoder 5104 includes an image memory therein. This is to deal with the television signal that requires the image memory in reserve conversion as in, for example, the MUSE system. Further, with the provision of the image memory, the display of the still picture is facilitated. Also, there are advantages in that the image processing and editing such as an image thinning, interpolation, enlargement, reduction or composition are facilitated in cooperation with the image generating circuit 5107 and the CPU 5106.

Also, the multiplexer 5103 is so designed as to appropriately select the display image on the basis of the control signal inputted from the CPU 5106. That is, the multiplexer 5103 selects a desired image signal from the reversely converted image signals inputted from the decoder 5104 to output the selected image signal to the drive circuit 5101. In this case, if the image signal is changed over and selected within a display period of one screen, one screen is divided into a plurality of areas so that different images can be displayed on each area as in a so-called multi-screen television.

Also, the display panel controller 5102 is a circuit for controlling the operation of the drive circuit 5101 on the basis of the control signal inputted from the above CPU 5106.

Further, as the basic operation of the display panel, for example, a signal for controlling the operating sequence of a power supply (not shown) for driving the display panel is outputted to the drive circuit 5101.

Further, as the method of driving the display panel, for example, a signal for controlling the screen display frequency or the scanning method (for example, interlace or non-interlace) is outputted to the drive circuit 5101.

Also, as occasion demands, a control signal pertaining to the adjustment of an image quality such as the luminance, the contrast, the tone or the sharpness of a display image is outputted to the drive circuit 5101.

Further, the drive circuit 5101 is a circuit for generating a drive signal applied to the display panel 5100 and operates on the basis of an image signal inputted from the multiplexer 5103 and a control signal inputted from the display panel controller 5102.

The above description was given of the functions of the respective parts. With the structure illustrated in FIG. 80, the present display device can display the image information inputted from the various image information sources on the display panel 5100.

That is, after various image signals such as the television broadcast has been reversely converted by the decoder 5104, those image signals are appropriately selected in the multiplexer 5103 and then inputted to the drive circuit 5101. On the other hand, the display controller 5102 generates a control signal for controlling the operation of the drive circuit 5101 in response to the image signal to be displayed. The drive circuit 5101 applies a drive signal to the display panel 5100 on the basis of the image signal and the control signal.

With this operation, the image is displayed on the display panel 5100. Those sequential operation is controlled by the CPU 5106 in a generalizing manner.

Also, the present display device is cooperated with an image memory equipped in the decoder 5104, the image generating circuit 5107 and the CPU 5106, to not only display the image selected from a plurality of image information, but also can conduct image processing for example, enlargement, reduction, rotation, movement, edge emphasis, thinning, interpolation, color conversion, or the conversion of the longitudinal to lateral ratio of an image, or image editing such as composition, erasion, connection, replacement or insertion with respect to the image information to be displayed. Also, although being not particularly described in this embodiment, an exclusive circuit for processing or editing the audio information may be provided as in the above image processing or the image edition.

Accordingly, the present display device can provide the functions of display device of the television broadcast, the terminal device for television conference, the image editing device for dealing with the still picture and the moving picture, the terminal device of the computer, a business terminal device such as a word processor, a playing machine, together. Therefore, the present display device is extremely broad in applied field for industrial or public use.

Further, FIG. 80 merely shows one example of the structure of a display device using a display panel with the surface conduction type emission element as the electron beam source, and it is needless to say that the present invention is not limited to only the above structure. For example, the circuit pertaining to the function unnecessary for the purpose of use may be omitted from the structural elements shown in FIG. 80. Also, conversely, the structural element may be further added depending on the purpose of use. For example, in the case where the present display device is applied as a television phone, it is preferable to add a television camera, an audio microphone, a lighting equipment, a transmit/receive circuit including a modem to the structural elements.

In this display device, since it is easy to thin the display panel with the surface conduction type emission element as the electron beam source, the depth of the entire display device can be reduced. In addition, because the large-area is easy, the luminance is high and the field angle characteristic is also excellent in the display panel using the surface conduction type emission element as the electron beam source, the image high in attendance feeling and powerful can be displayed with a high visibility.

(Embodiment 2)

Hereinafter, only a difference of the image display device according to the present invention from the embodiment 1 will be described.

A difference from the embodiment 1 resides in that an a.c. voltage is used in the supply waveform.

In this embodiment, a sine wave peak voltage of 60 Hz is applied while gradually stepping up so that a one-side peak value becomes the same as that in FIG. 65.

By the a.c. voltage, the potentials of both positive and negative poles can be given to the face plate and the rear plate, and the step-up process is conducted for each cycle, thereby being capable of more effectively obtaining the conditioning effect.

In this embodiment, the a.c. voltage is used in the supply waveform, however, a d.c. voltage of both positive and negative poles may be applied alternately or divided to two times.

Also, a pulse voltage, and more preferably an impulse voltage may be used in the supply waveform. In this case, there is the effect that the damage when electricity is discharged to the surface conduction type emission element can be more reduced.

The order of the process of applying the high voltage between the face plate and the rear plate is before the electrification forming process as in the embodiment 1.

With the image display device thus manufactured, the excellent display image with no discharge can be obtained.

(Embodiment 3)

Hereinafter, only a difference of the image display device according to the present invention from the embodiment 1 will be described.

The difference from the embodiment 1 resides in the atmosphere when the high voltage is applied. In the embodiment 1, the high voltage application is conducted in the vacuum atmosphere whereas in this embodiment, it is conducted in the nitrogen atmosphere.

Figure 66:
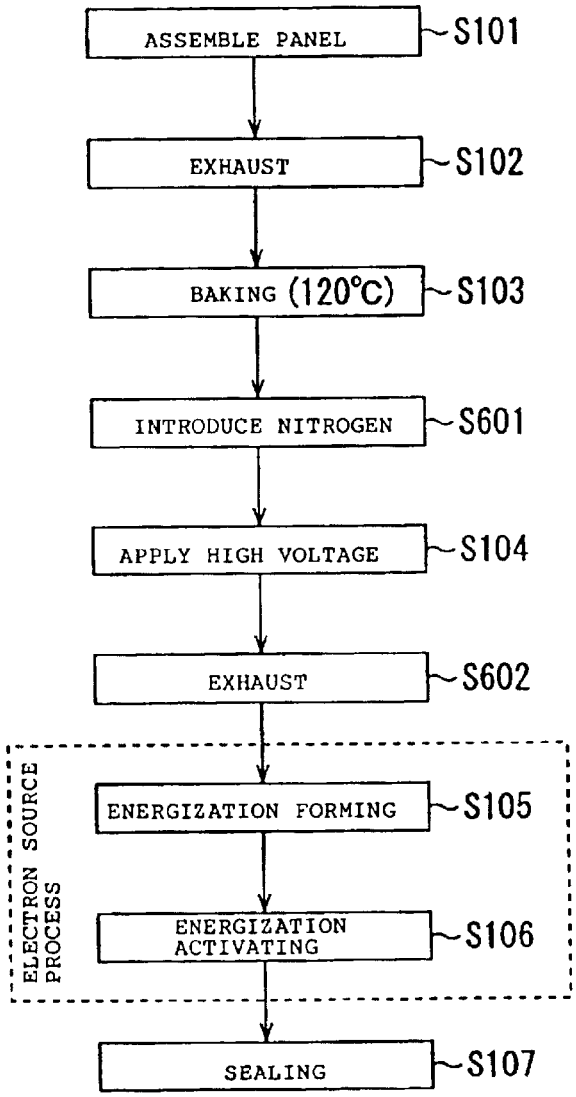
FIG. 66 is a diagram showing a flow of processes in a method of manufacturing an image forming apparatus in accordance with an embodiment of the present invention.

FIG. 66 shows a flow of the process of the present embodiment.

Figure 67:
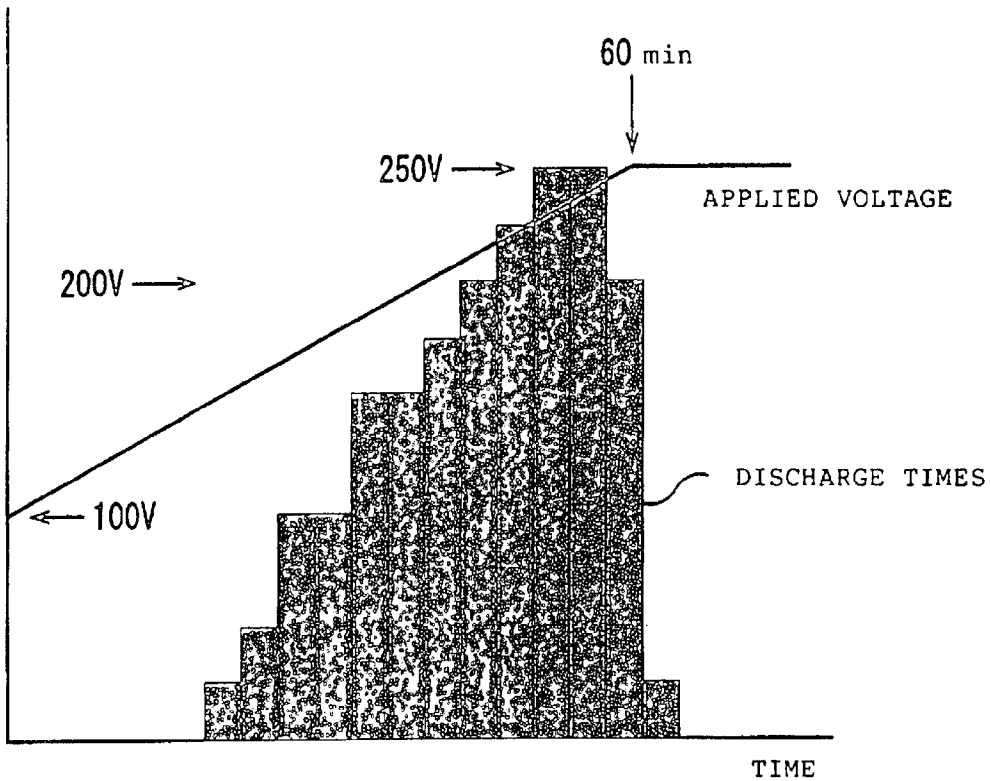
FIG. 67 is a diagram showing a supply voltage and the number of times of discharge in a method of manufacturing an image forming apparatus in accordance with an embodiment of the present invention.

Specifically, after gas is exhausted from the interior of the panel and baking is conducted (120° C. for about 2 hours), dry nitrogen gas is introduced so as to provide a pressure of about 400 Pa (Step S601). Thereafter, the process is shifted to the process of applying the high voltage (Step S104). Thereafter, gas is exhausted (Step S602) and the process is shifted to the electron source process. FIG. 67 is a schematic view showing a supply voltage and the number of times of discharge with a time.

The supply voltage steps up at a rate of 50 V/20 minutes until 100 V to 250 V as shown in FIG. 67, and maintained at 250 V for 15 minutes. In this embodiment, the supply voltage steps up at a given rate, and may step up at a step state.

Observation starts when the discharge slightly exceeds 150 kV, and the discharge increases up to about 250 kV. After the discharge is maintained at 250 V, the discharge is turned to decrease and it becomes 0 soon.

As compared with a case in which a high voltage is applied in the vacuum atmosphere, it is found that the discharge starts from a very low voltage in the nitrogen introduction atmosphere. Also, it is experimentally recognized that the substantially same conditioning effect as that in a case of 10 kV in the vacuum atmosphere is obtained by application of the high voltage up to 250 V in the nitrogen atmosphere of this embodiment.

As described above, according to this example, the device can be downsized with hardly any damage to the element.

The introduction gas can be appropriately selected from nitrogen as well as helium, neon, argon, hydrogen, oxygen, carbon dioxide, air and so on.

Also, the above pressure is a preferred value for the image display device of the present invention, and it is desirable that the pressure is appropriately changed as the design is changed. More preferably, the pressure is set to several tens of Pa to several thousands of Pa.

The supply voltage as used is the d.c. voltage as in the embodiment 1. However, an a.c. voltage, a pulse voltage or the like may be applied as in the embodiment 2.

The order of the process of applying the high voltage is before the electrification forming process as in the embodiment 1, but may be before the electrification activating process.

The image display device thus manufactured can obtain an excellent display image with no discharge.

Fifth Embodiment

Hereinafter, a description will be given in detail of the preferred embodiments of the present invention with reference to the accompanying drawings. The dimensions, the material, the configuration, the relative arrangement and so on of the structural parts described in this embodiment does not limit the scope of the present invention so far as specific description is not given.

A description will be given of a method of manufacturing an image forming apparatus in accordance with the embodiment of the present invention with reference to FIGS. 83 and 84.

Figure 83A:
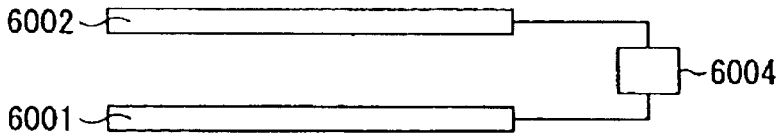
FIGS. 83A and 83B are schematic views showing a method of manufacturing an image forming apparatus in accordance with an embodiment of the present invention.
Figure 83B:
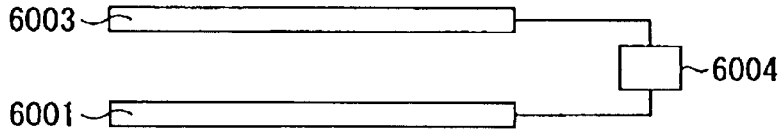

FIG. 83 is a schematic view showing a method of manufacturing an image forming apparatus in accordance with an embodiment of the present invention, in which FIG. 83A shows a first conditioning process, and FIG. 83B shows a second conditioning process.

In the figures, reference numeral 6001 denotes a substrate (anode substrate or a cathode substrate) which is subjected to the conditioning process; 6002 is an electrode disposed opposite to the substrate 6001 during the first conditioning process; 6003 is an electrode disposed opposite to the substrate 6001 during the second conditioning process; and 6004 is a high voltage power supply.

The sheet resistance of the electrode 6002 used in the first conditioning process is different from the sheet resistance of the electrode 6003 used in the second conditioning process.

The sheet resistance is Rs which appears when the resistor R of the thin film which is w in width and 1 in length satisfies R=Rs(1/w).

The amount of electric charges when the electric charges stored in the electrodes opposite to the electron source substrate or the anode substrate 6001 flows in the discharge path when the abnormal discharge occurs can be controlled by the sheet resistance of the electrodes used in the above conditioning process.

That is, because the movement of the electric charges can be more suppressed at the electrode portion as the resistance is higher, by this the movement of the electric charges can be suppressed even in the discharge path.

Figure 84:
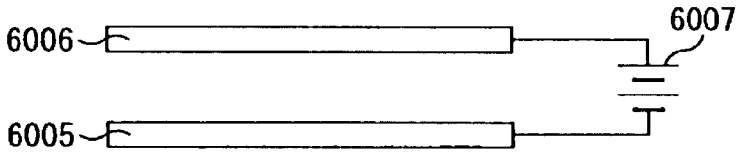
FIG. 84 is a schematic view for explanation of an image forming apparatus manufactured through a manufacturing method in accordance with an embodiment of the present invention.

FIG. 84 is a schematic view for explanation of an image forming apparatus manufactured through a manufacturing method in accordance with an embodiment of the present invention.

In FIG. 84, reference numeral 6005 denotes cathode electrode; 6006 is an anode substrate; and 6007 is a high voltage power supply.

First, the operating operation of the image forming apparatus will be described with reference to FIG. 84.

A plurality of electron emission elements are formed on the cathode substrate 6005, and light emitting means such as phosphors are disposed on the anode substrate 6006.

In order to give a sufficiently accelerating voltage to the electron beams emitted from the cathode substrate 6005, a positive potential of severalkV to several tens of kV is applied to the anode substrate 6006 from the high voltage power supply 6007 with respect to the cathode substrate 6005.

Under the above circumstances, the electrons controlled by the electron emission elements formed on the cathode substrate 6005 are emitted so that the phosphors formed on the anode substrate 6006 fluoresce.

In this case, the flow of the electrons is distinct from the abnormal discharge which is meant in the present specification.

The anode substrate 6006 and the cathode substrate 6005 are normally held in a vacuum, and a distance between the cathode substrate 6005 and the anode substrate 6006 is smaller than the mean free path of the emitted electrons.

In order to stably realize the above circumstances, the manufacturing method according to this embodiment is applied.

The manufacturing method will be described with reference to FIG. 83.

In the manufacturing process according to this embodiment, a process of applying an electric field onto the surface of the anode substrate or the cathode substrate 6001 is provided at a desired stage of the process of manufacturing the anode substrate or the cathode substrate.

The purposes of applying the electric field to the anode substrate or the cathode substrate 6001 in advance are to recognize the withstand voltage of the substrate, to step up the withstand voltage of the substrate, etc.

For that reason, it is preferable that the electric field applied to the surface of the substrate in this process is substantially identical with or higher than the electric field applied when the device is used as the image forming apparatus later.

The electric field applied to the surface of the substrate can be determined by a voltage (voltage of the high voltage power supply 6004) applied between the electrodes 6002, 6003 disposed opposite to the substrate, a distance between the substrate 6001 and the electrodes 6002, 6003, etc.

The voltage supply may be conducted by any manners such as a d.c. manner or a pulse shape, and the implementation may be conducted while the supply voltage is gradually increased.

In the conditioning process, if an electrode having a high sheet resistance is used, the electric charges stored between the electrodes opposite to the substrate 6001 can be suppressed from flowing in the discharge path when the abnormal discharge occurs as described above.

As a result, the above structure can prevent a large-scaled arc discharge from occurring or remarkably reduce its scale, thereby being capable of preventing the abnormal discharge which may secondarily occur.

In other word, in the conditioning process, it is possible to remarkably relax a damage on the substrate 6001 and to step up the withstand voltage of the substrate 6001.

It is not particularly limited that during which process of the manufacturing process the conditioning process is conducted. However, for example, the conditioning process may be conducted after a process in which foreign material, etc., which may cause the discharge are introduced.

As described above, the discharge current can be more suppressed in this process as the sheet resistance of the electrode is higher.

However, the discharge current of a given value or more may be required in order to effectively step up the withstand voltage in the conditioning process.

For that reason, the sheet resistance of the electrodes used in this process is appropriately selected depending on the substrate structure, a kind of imaginary foreign material, or the like, and as described above, the different kinds of conditioning processes which are conducted by the electrodes different in the sheet resistance, that is, the first conditioning process and the second conditioning process are appropriately selected.

This process is implemented as described above, thereby being capable of manufacturing the image forming apparatus that suppresses the occurrence of the abnormal discharge.

In addition, when the conditioning process according to this embodiment is conducted, damage which may occur in this process can be relaxed, and the substrate can be manufactured with an excellent yield.

EXAMPLES

Hereinafter, a more specific embodiment will be described.

First, a description will be given of a case of manufacturing a cathode electrode (electron source substrate) through a process including the manufacturing process based on the above-described embodiment of the present invention.

As the electron emission elements, the cathode substrate made up of the electron source in which the surface conduction type electron emission elements are disposed in a matrix is manufactured.

Figure 85:
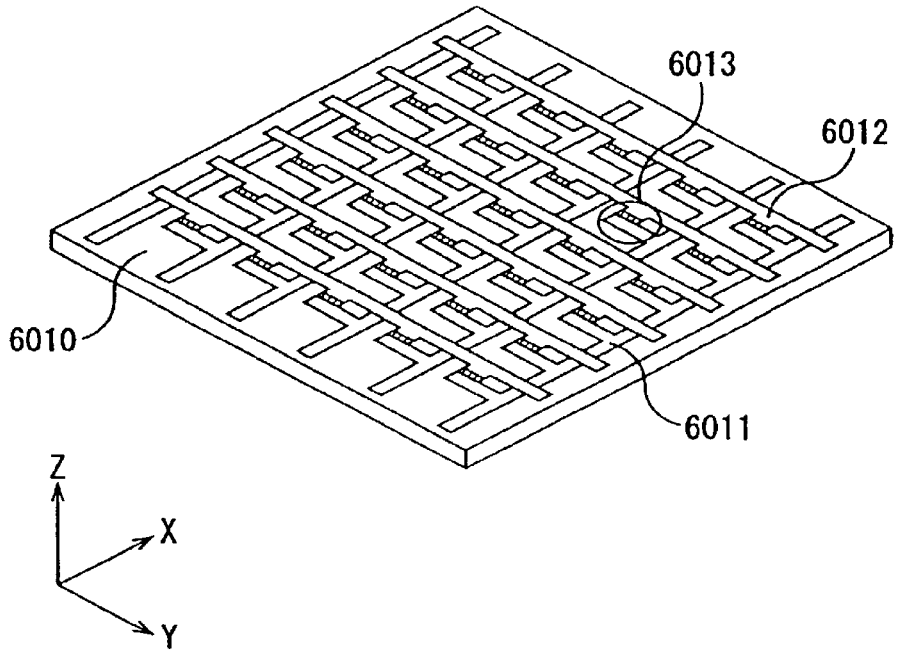
FIG. 85 is a schematic view showing a cathode substrate that constitutes an image forming apparatus manufactured through a manufacturing method in accordance with an embodiment of the present invention.

The schematic view of the cathode substrate on which the electron source is formed is shown in FIG. 85.

In FIG. 85, reference numeral 6011 denotes X-directional wirings, 6012 is Y-directional wirings, and 6013 are surface conduction type electron emission elements.

In this embodiment, 720 elements in the Y-direction (n=720) and 240 elements in the X-direction (m=240) are manufactured.

The surface conduction type electron emission element 6013 is provided with opposite element electrode, and an electrically conductive thin film is formed between the element electrodes.

In addition, the electron emission portions not shown are formed on the electrically conductive thin film.

In the conditioning process, a surface of the cathode substrate which forms the electron emission portions is disposed opposite to the conditioning electrode.

The wirings on the cathode substrate is grounded, and the conditioning electrode is connected to the high voltage power supply.

The cathode substrate and the conditioning electrode are supported by an insulator so that a distance therebetween becomes 2 mm.

Hereinafter, the manufacturing process will be described in the order of processes.

(Electrode Forming Process)

First, the element electrodes are formed on the cathode substrate through the photolithography, and the X-directional wirings, the Y-directional wirings and the interlayer insulating layers (not shown) disposed at locations where the X-directional wirings and the Y-directional wirings cross each other are formed on the cathode substrate through the printing method.

(First Conditioning Process)

In the first conditioning process, an electrode $10^3$ Ω/square in sheet resistance is used.

A positive high voltage is applied from the high voltage power supply to start the first conditioning process.

In this embodiment, a rectangular wave 200 ms in pulse width and 1 Hz in frequency is applied to the electrode, and the peak value steps up at a rate of 10 V/sec up to 30 kV.

As a result of conducting the light emission measurement by using a photo multiplier for the purpose of detecting the abnormal discharge in this process, three times of the abnormal discharges of are detected in this process.

(Thin Film Forming Process)

Subsequently, the electrically conductive thin film is formed between the element electrodes through the BJ method (a method conducted by the bubble jet system (one sort of ink jet system).

(Second Conditioning Process)

In the second conditioning process, the electrode $10^5$ Ω/square in sheet resistance is used.

In this process, the electric field is applied in the same manner as that in the first conditioning process. In this process, fife times of the abnormal discharges of are conducted.

(Electron Emission Portion Forming Process)

In addition, a process of forming the electron emission portion on the above-described electrically conductive thin film is implemented.

(Third Conditioning Process)

In the third conditioning process, the electrode $10^7$ Ω/square in sheet resistance is used.

In this process, a positive high voltage is applied to the electrode from the high voltage power supply.

In this process, the d.c. voltage steps up at a rate of 10 V/sec up to 25 kV, to thereby implement the process.

In this process, the abnormal discharge is detected once.

(Fourth Conditioning Process)

Finally, the fourth conditioning process is conducted.

The sheet resistance of the electrode as used is several Ω/square, and a d.c. voltage is applied from the high voltage power supply and then held for 30 minutes.

In this process, the abnormal discharge is not detected.

Subsequently, a description will be given of a case of manufacturing an anode substrate through a process including the manufacturing process based on the above-described embodiment of the present invention.

Figure 86A:
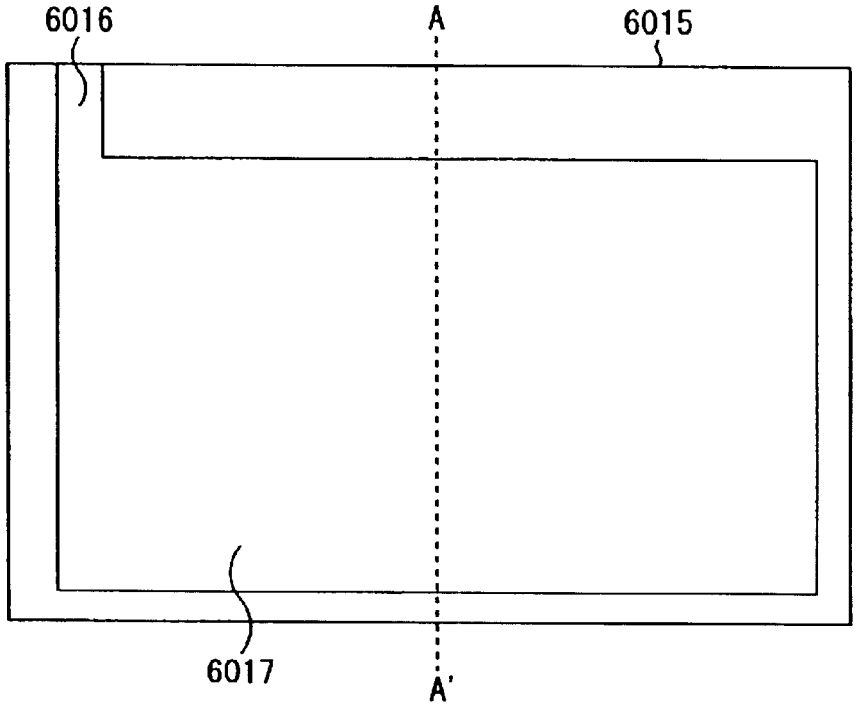
FIGS. 86A and 86B are schematic views showing an anode substrate that constitutes an image forming apparatus manufactured through a manufacturing method in accordance with an embodiment of the present invention.
Figure 86B:
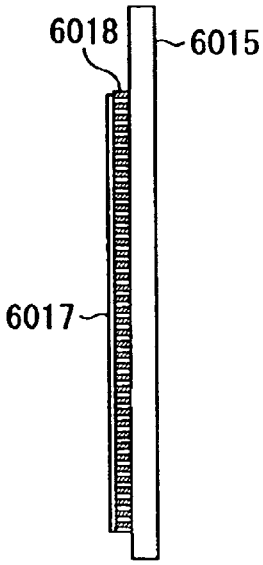

FIG. 86 is a schematic view showing the structure of the anode substrate manufactured in the manufacturing process in accordance with this embodiment, in which FIG. 86A is a plan view thereof, and FIG. 86B is a side view thereof.

In the figures, reference numeral 6016 denotes a high voltage takeout portion for applying a high voltage necessary for accelerating the electron beam; 6017 is a metal back; and 6018 is a phosphor.

In the conditioning process, the anode substrate is disposed so that the surface of the anode substrate on which the metal back and the fluorescent film are formed is opposite to the electrode.

Also, the anode substrate grounds the high voltage takeout portion, and the conditioning electrode is connected to the high voltage power supply.

Further, the cathode substrate and the conditioning electrode are supported by an insulator so that a distance therebetween becomes 2 mm.

(First Conditioning Process)

The first conditioning process is conducted on the anode substrate on which the fluorescent film is formed (fluorescent film forming process).

In this example, in the conditioning process, an electrode $10^{10}$ Ω/square in sheet resistance is used, and a negative high voltage is applied from the high voltage power supply to start the first conditioning process.

In this embodiment, a d.c. voltage steps up at a rate of −10 V/sec from 0 kV to −30 kV, and thereafter is held at −30 kV for an hour, to thereby implement this process.

As a result of conducting the light emission measurement by using a photomal for the purpose of detecting the abnormal discharge in this process, the abnormal discharge is detected once in this process.

(Second Conditioning Process)

Subsequently, the second conditioning process is conducted.

In this process, the electrode several Ω/square in sheet resistance is used, and a high voltage is applied from the high voltage power supply to conduct the second conditioning process.

In this process, a d.c. voltage of −20 kV is held for 30 minutes to implement this process. In this process, the abnormal discharge is not conducted.

The cathode substrate and the anode substrate thus produced is used to manufacture the image display portion.

Figure 87:
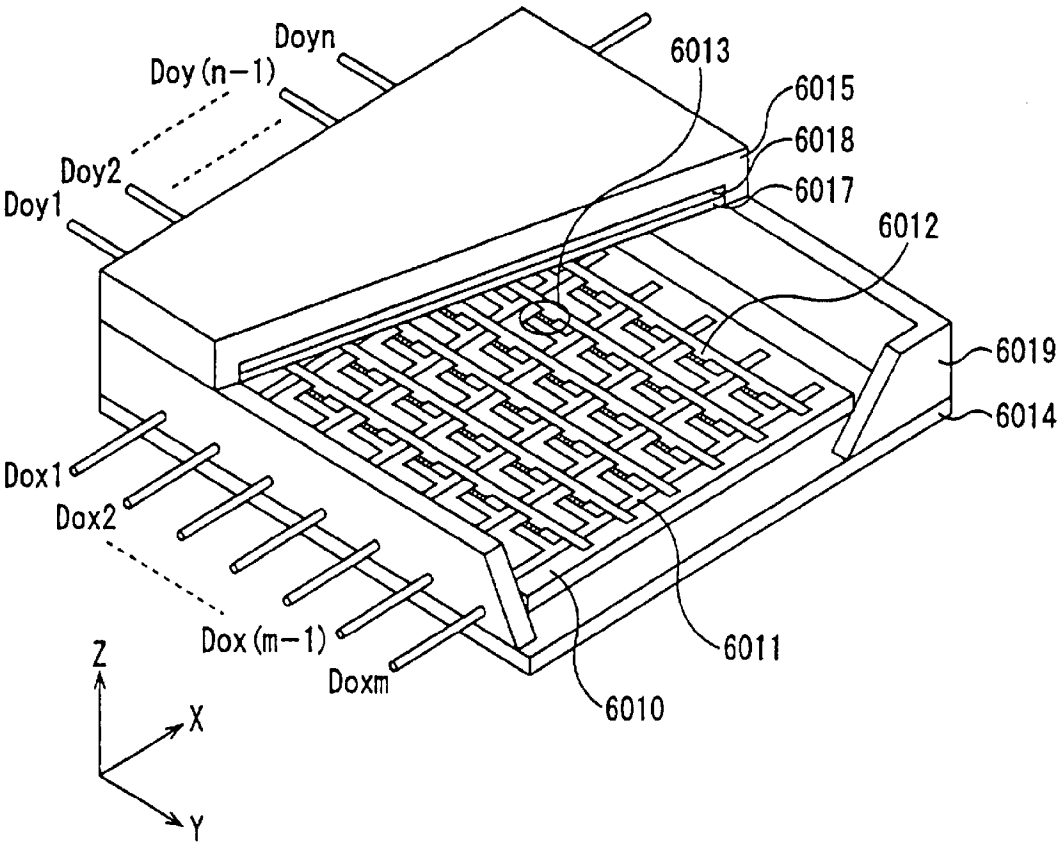
FIG. 87 is a schematic structural diagram showing an image forming apparatus manufactured through a manufacturing method in accordance with an embodiment of the present invention.

FIG. 87 is a schematic structural diagram showing an image forming apparatus manufactured through a manufacturing method in accordance with an embodiment of the present invention.

In FIG. 87, the same parts as those in FIGS. 85 and 86 are denoted by identical reference.

Also, in the figure, reference numeral 6014 denotes a rear plate that supports the cathode substrate 10; 6018 is a phosphor; 6017 is a metal back; 6019 is a support frame that supports the anode substrate 6015 and the cathode substrate 6010.

A distance between the cathode substrate and the anode substrate is 2 mm.

Also, the opposite element electrode is disposed on the surface conduction type electron emission element 6013, and a voltage of about 15 V is applied between the element electrodes, to thereby allow an element current If to flow between the electrodes and emit the electrons at the same time.

In order to evaluate the characteristic of the image forming apparatus manufactured through the manufacturing method in accordance with the embodiment of the present invention as described above, the following evaluate experiment was conducted.

First, a high voltage of 10 kV is applied to the anode to drive a driver unit not shown which is connected to the X-directional wirings 6011 of the cathode substrate 6010, specifically Dox1, Dox2, . . . , Dox(m−1), Doxm, and the Y-directional wirings 6012, specifically Doy1, Doy2, . . . , Doy(n−1), Doyn, to display the image and examined the presence/absence of the pixel defect.

As a result, the pixel defect which may pertain to the abnormal discharge is not found, that is, it is found that the pixels are not damaged in the conditioning process.

Subsequently, in this state, the endurance test was conducted for 300 hours while various image is displayed.

As a result, an excellent image is held with never producing the abnormal discharge.

Sixth Embodiment

A specific embodiment in which the present invention is applied to the manufacture of the image forming apparatus will be described below.

Figure 88:
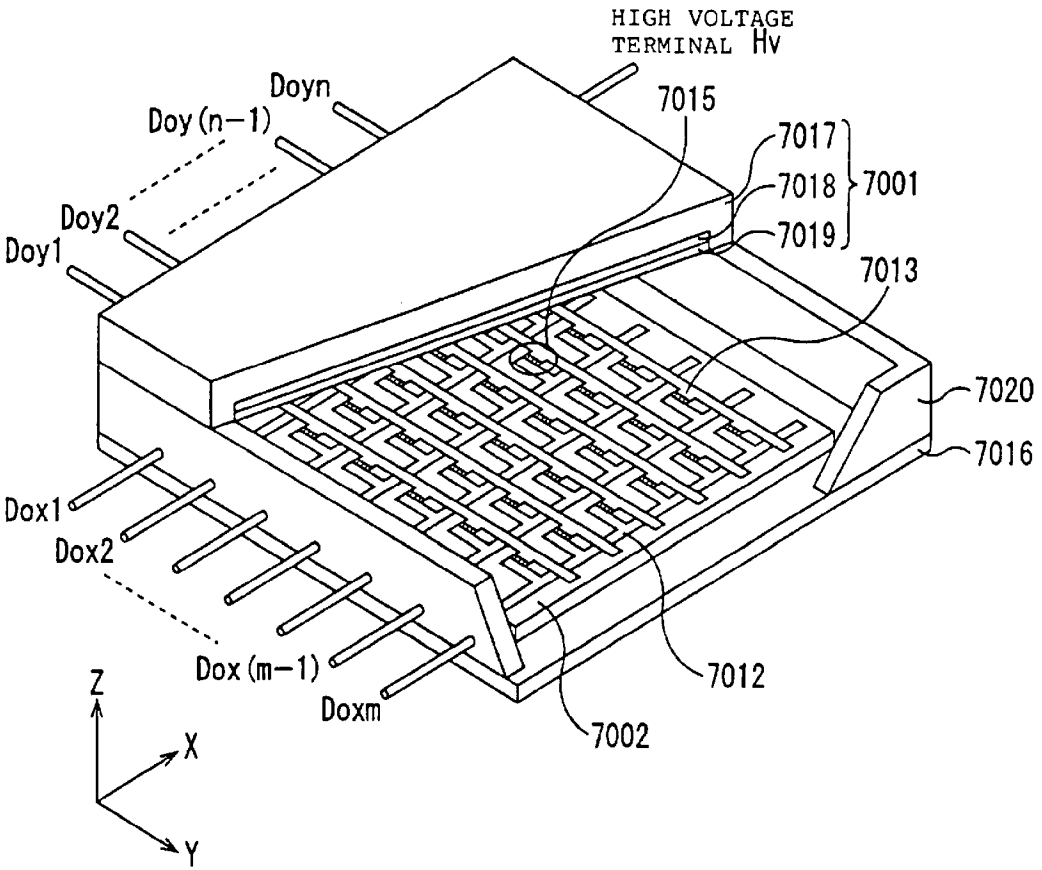
FIG. 88 is a schematic perspective view showing a main structure of an image forming apparatus manufactured in accordance with an embodiment of the present invention.

FIG. 88 is a schematic perspective view showing a main structure of an image forming apparatus manufactured in a manufacturing method in accordance with an embodiment of the present invention.

Figure 89:
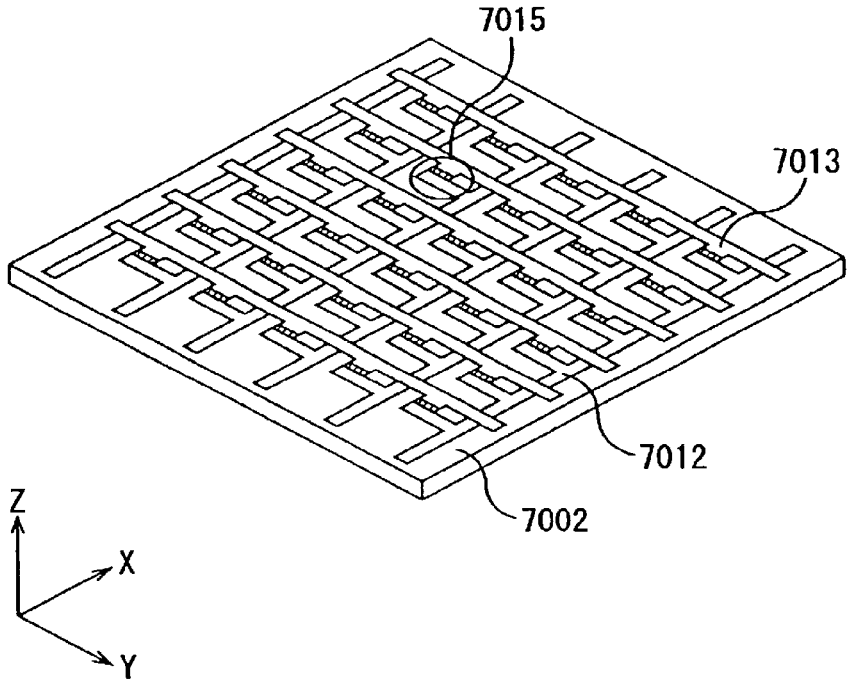
FIG. 89 is a schematic perspective view showing a cathode substrate which is a structural element of an image forming apparatus.

Referring to FIG. 88, the image forming apparatus includes an anode substrate 7001 and a cathode substrate 7002, and the cathode substrate 7002 is structured in such a manner that a large number of surface conduction type electron emission elements 7015 (circled in the figure) which are used as the electron source are arranged in a matrix on the cathode electrode 7002, as shown in FIG. 89. The anode substrate 7001 is structured in such a manner that phosphor surfaces 7018 for R, G and B for conducting color display, and a metal back surface 7019 which covers the phosphor surfaces 7018 and is made of aluminum and about 100 (nm) in thickness is embedded and fixed onto the glass substrate 7017.

In addition, reference numeral 7012 denotes X-directional wirings; 7013 is Y-directional wirings; 7016 is a rear plate that supports the cathode substrate 7002; and 7020 is a support frame that fixes the anode substrate 7001 and the cathode substrate 7002.

Figure 90A:
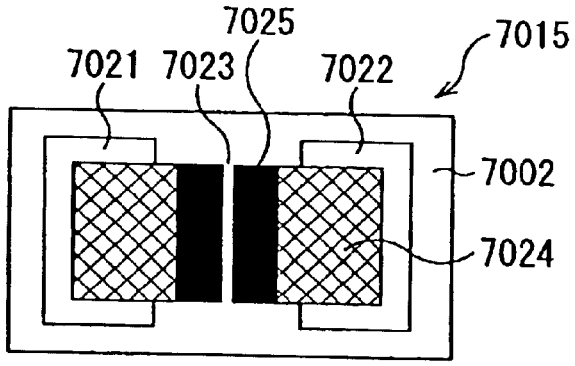
FIGS. 90A and 90B are schematic views showing a surface conduction type electron emission element which is a structural element of a cathode substrate.
Figure 90B:
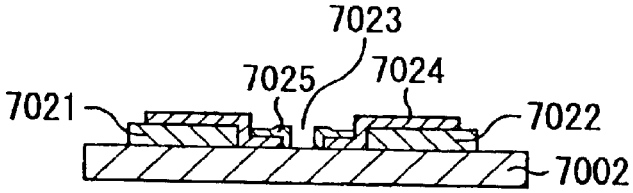

FIG. 90 is a schematic view showing a surface conduction type electron emission element 7015, in which FIG. 90A is a plan view thereof and FIG. 90B is a cross-sectional view thereof.

The electron emission element 7015 includes a pair of element electrodes 7021 and 7022 which are adjacent on the cathode substrate 7002, and an electrically conductive thin film 7024 which is connected to those element electrodes 7021 and 7022 and has an electron emission portion 7023 in a part thereof. The electron emission portion 7023 is a portion where a part of the electrically conductive thin film 7024 is destroyed, deformed or affected into a high resistant state. Also, there is a case in which a deposition film 7025 that mainly contains carbon or carbon compound is formed on the electron emission portion 7023 and around the electron emission portion 7023 in order to control the electron emission.

The electron emission element 7015 can emit the electrons from the electron emission portion 7023 by applying a voltage of about 7015 (V) between the element electrodes 7021 and 7022 to supply the element current If between the element electrodes 7021 and 7022.

This embodiment is directed to a process when manufacturing the cathode substrate 7002 in a process of manufacturing the above-described image forming apparatus.

Figure 91:
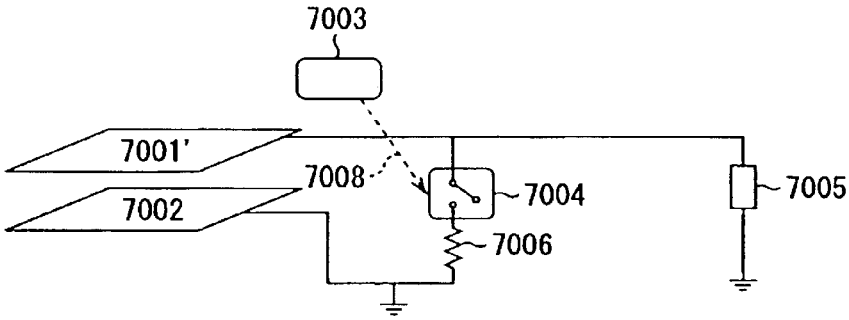
FIG. 91 is a schematic view showing a main structure of a manufacturing apparatus used in this embodiment.
Figure 92:
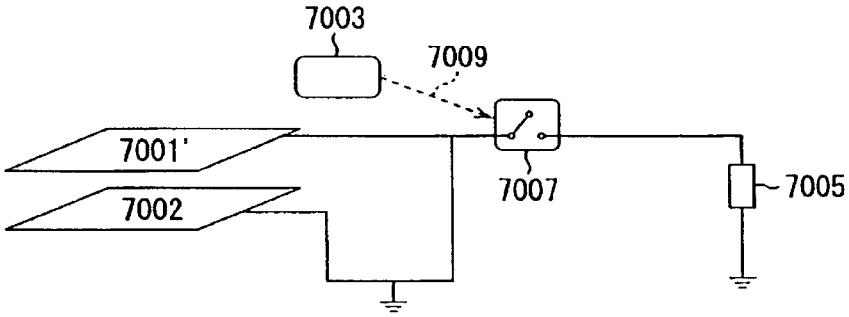
FIG. 92 is a schematic view showing another example of a main structure of a manufacturing apparatus used in this embodiment.
Figure 93:
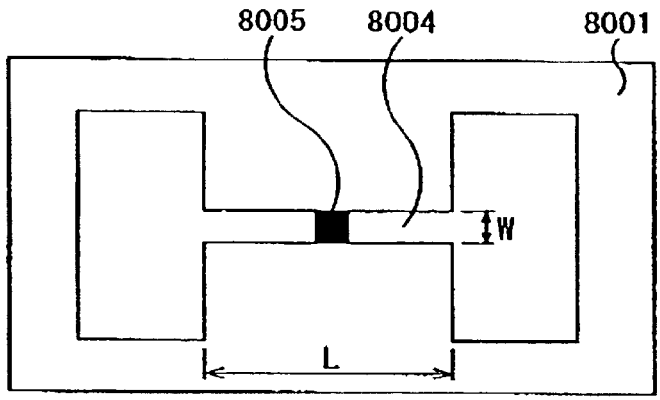
FIG. 93 is a diagram showing an example of a conventional surface conduction type emission element.
Figure 94:
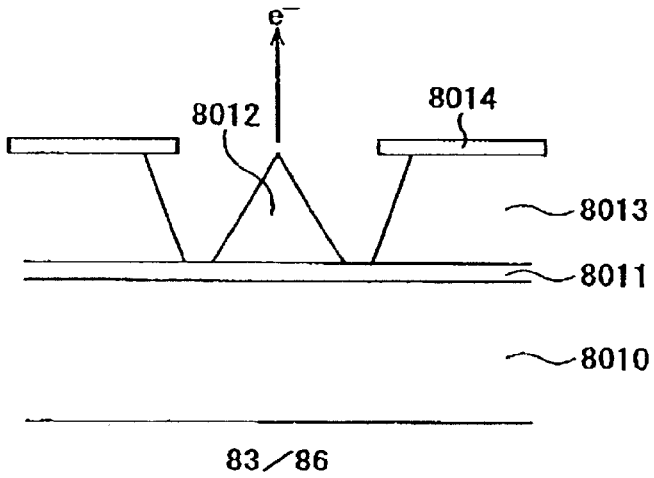
PRIOR ART FIG. 94
FIG. 94 is a diagram showing an example of a conventional FE type element.
Figure 95:
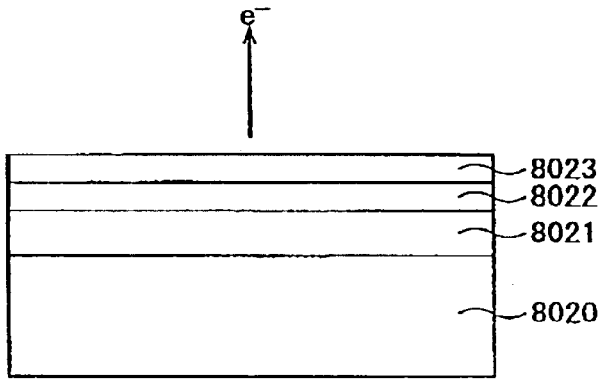
FIG. 95 is a diagram showing an example of a conventional MIM type element.
Figure 96:
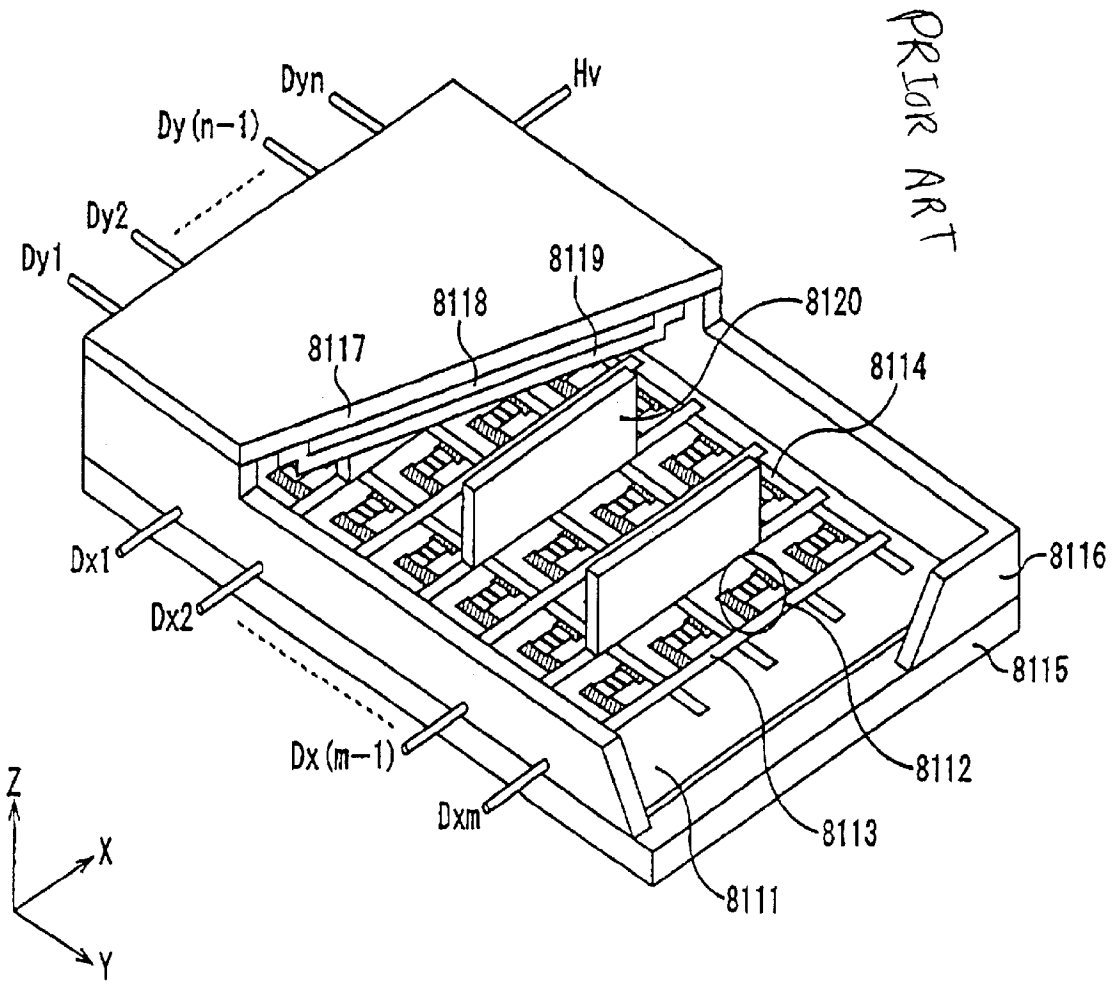
FIG. 96 is a perspective view showing a display panel of an image forming apparatus in which a part of a display panel is cut out.
Figure 97:
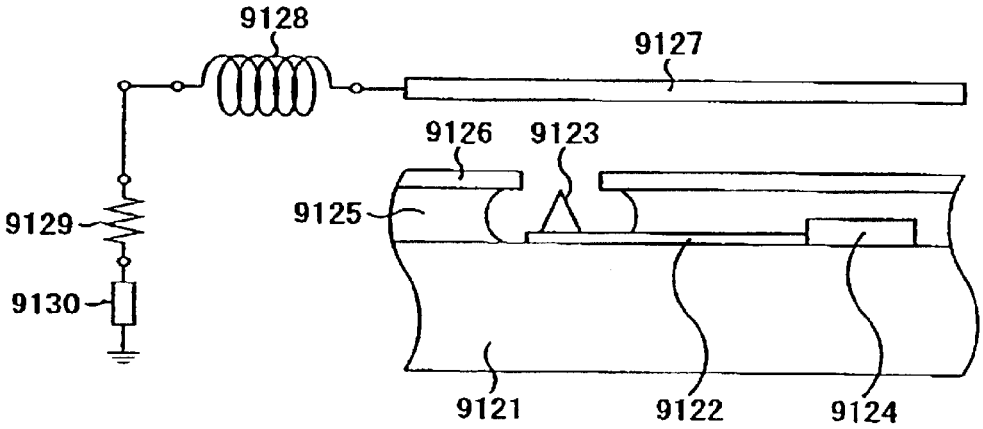
FIG. 97 is a schematic view showing a technique of limiting an arc current in an image forming apparatus in accordance with a prior art.

FIGS. 91 and 92 are schematic views showing the main structure of the manufacturing apparatus in accordance with this embodiment. In FIG. 92, the same parts as those in FIG. 91 are denoted by the identical reference.

Referring to FIG. 91, reference numeral 7001 denotes an anode substrate; 7002 is a cathode substrate; 7003 is detecting means for detecting the abnormal discharge; 7004 is a change-over switch that short-circuits the anode and the cathode; 7005 is a high voltage power supply; 7006 is a resistor when the change-over switch 7004 is short-circuited; and 7008 is a signal transmitted from the detecting means 7003 for controlling the change-over switch 7004. On the other hand, in FIG. 89, reference numeral 7007 denotes a change-over switch between the anode and the high voltage power supply, 7009 is a signal transmitted from the detecting means 7003 for controlling the change-over switch 7007.

Hereinafter, the function of the manufacturing apparatus shown in FIG. 91 will be described. The manufacturing apparatus is preferable particularly in the case where a capacitance produced by the anode and the cathode is large.

First, a conditioning in which a positive high voltage is applied to the anode substrate 7001' in vacuum as compared with the cathode substrate 7002 at a desired stage of the process of manufacturing the electron emission element 7015 which is the electron source on the cathode substrate 7002. The anode substrate 7001' is used to implement the conditioning which may be different from the anode substrate 7001 for forming an image.

It is not necessary that the anode substrate 7001' is the above-described image formation substrate. In this situation, this process is implemented while, for example, the potential applied to the anode is gradually increased. In this situation, in the case where the abnormal discharge occurs before the potential reaches a desired potential, the abnormal discharge is detected by the detecting means 7003, and then the signal 7008 is generated to open/close the change-over switch 7004.

The detecting means 7003 and the signal 7008 may output a signal that conducts the open/close operation of the change-over switch 7004, for example, in the case where the potential of the anode is monitored, and a change in potential larger than a certain threshold value is found. It is preferable that the signal 7008 is a signal that opens the change-over switch 7004 again after the change-over switch 7004 is closed for a given period of time as soon as the abnormal discharge is detected. It is preferable that a period of time where the change-over switch 7004 is closed for a given period of time is selected taking the characteristic of the high voltage power supply 7005 as used into consideration. It is preferable that the high voltage power supply 7005 is used by the combination of an inductance with a capacitance, etc., for the normal purpose of improving stability of the output.

In addition, it is better that the supply of the electric charges from the high voltage power supply can be actually ignored during the abnormal discharge operation, and a stabilization d.c. power supply where the output voltage of the high voltage power supply is hardly lowered immediately when the abnormal discharge operation occurs may be provided. In other words, the above-described period of time where the change-over switch 7004 is closed for a given period of time is selected by a period of time where the output voltage of the high voltage power supply is hardly lowered in a process of the potential of the anode substrate 7001' to a normal potential. This process is implemented until the potential of the anode becomes a desired value while the above-described control is conducted, to thereby complete the conditioning process.

Subsequently, the function of the manufacturing apparatus shown in FIG. 92 will be described. In FIG. 92, a change-over switch 7007 is disposed between the anode substrate 7001' and the high voltage power supply, and the change-over switch 7007 is controlled in accordance with a signal 7009 from the detecting means 7003. The manufacturing apparatus shown in FIG. 92 is preferable in the case where the abnormal discharge that secondarily occurs dominantly gives damage to the element.

As described above, the conditioning of applying the high potential to the anode substrate in vacuum is implemented. The change-over switch 7007 is opened at the same time when the abnormal discharge is detected. As a result, the anode and the high voltage power supply can be electrically disconnected for an arbitrary period of time without giving the load to the high voltage power supply. In the case where the anode and the high voltage power supply are electrically connected to each other from that state, the change-over switch 7007 may be closed after the change-over switch 7007 is opened. This process is implemented until the potential of the anode becomes a desired value while the above-described control is conducted, to thereby complete the conditioning process.

Subsequently, the operating principle of the manufacturing apparatus will be described. In order to function as the image forming apparatus, there is normally used a substrate where light emitting means such as a pair of phosphors are disposed on the anode substrate 7001, and in order to give a sufficiently accelerating voltage to the electron beam, a high positive potential of several (kV) to several tens of (kv) is applied. Under the above circumstance, the electrons controlled by the electron emission elements formed on the cathode substrate 7002 are emitted so that the phosphor surface 7018 formed on the anode substrate 7001 fluoresces. In this case, the flow of the electrons is distinct from the abnormal discharge which is meant in the present embodiment. The anode substrate 7001 and the cathode substrate 7002 are normally held in vacuum, and a distance between the anode substrate 7001 and the cathode substrate 7002 is smaller than the mean free path of the emitted electrons.

In order to stably realize the above circumstances, the present invention is applied. That is, the present invention implements the conditioning process of applying a high positive potential of several (kV) to several tens of (kV) to the anode with respect to the cathode substrate 7002 as follows:

In the structure shown in FIG. 91, a high positive potential, specifically, about several (kV) to several tens of (kV) is applied to the anode substrate 7001 with respect to the cathode substrate 7002. The potential is selected from a potential which is substantially identical with or higher than a value applied during the image forming operation. In this situation, a space between the cathode substrate 7002 and the anode substrate 7001 is maintained in the vacuum atmosphere. The voltage supply may be conducted by any manners such as a d.c. manner or a pulse shape, and the implementation may be conducted while the supply voltage is gradually increased.

To specify the start of the abnormal discharge can be conducted by measuring a change in the anode potential by a voltmeter disposed close to the anode substrate 7001'. In this case, in the case where a change in potential larger than a certain threshold value is found, a signal that conducts the open/close operation of the change-over switch 7004 may be outputted. Also, there is a method of observing the fluorescent phenomenon pertaining to the abnormal discharge.

Subsequently, a control when the abnormal discharge occurs will be described. The abnormal discharge occurs, and the change-over switch 7004 is closed as soon as a current starts to flow in a space through the vacuum between the anode substrate 7001' and the cathode substrate 7002. Then, the electric charges stored in the anode is partially opened through the change-over switch 7004. In this case, if a period of time necessary when the abnormal discharge is measured and the change-over switch 7004 is closed is sufficiently short, the current which flows in a space through the vacuum between the anode substrate 70011 and the cathode substrate 7002 can be partially interrupted or suppressed to a smaller value. As a result, damage which naturally occurs on the cathode substrate 7002 can be remarkably relaxed. The resistor 7006 when the change-over switch 7004 is short-circuited is used for the purpose of protecting the change-over switch 7004, and it is preferable that the resistance of the resistor 7006 is as small as possible.

Subsequently, the change-over switch 7004 is opened again. In this situation, if the current does not flow in a space through the vacuum between the anode substrate 7001' and the cathode substrate 7002, the current that flows from the high voltage power supply 7005 flows as a charge current that restores the potential of the anode to a regular value again.

The above description is applied to a case of the structure shown in FIG. 91. In the structure shown in FIG. 92, how to control is different. The abnormal discharge occurs, and the change-over switch 7007 is opened as soon as a current starts to flow in a space through the vacuum between the anode substrate 7001' and the cathode substrate 7002, and the anode substrate 7001' and the high voltage power supply 7005 are electrically disconnected. As a result, the electric charges stored in the anode substrate 7001' is released as a current during the discharge operation. However, when the operation of opening the change-over switch 7007 is effected, the potential of the anode substrate 7001' can be held in a state where the potential is close to the cathode substrate 7002 for an arbitrary period of time. If a period of time for holding the potential is sufficiently taken, the discharge which secondarily occurs can be more surely prevented. Also, since the anodesubstrate 7001' and the high voltage power supply 7005 are electrically disconnected, there is no fear that a large load is given to the high voltage power supply 7005.

The above two methods are effective even if those methods are combined to implement this process. In this case, the abnormal discharge operation which first occurs is affected, and the current that flows in the space through the vacuum can be suppressed, thereby being capable of preventing the abnormal discharge which secondarily occurs.

According to this embodiment, damage which naturally occurs on the cathode substrate 7002 can be remarkably relaxed, thereby being capable of implementing the conditioning process. Also, the conditioning process is implemented, thereby being capable of manufacturing the image forming apparatus that suppresses the occurrence of the abnormal discharge.

EXAMPLES

Hereinafter, this embodiment will be described in detail.

Example 1

The anode substrate 7001', the cathode substrate 7002, the abnormal discharge detecting means 7003, the switch 7004 that short-circuits the anode and the cathode, the high voltage power supply 7005 and the resistor 7006 are disposed as schematically shown in FIG. 91, to implement the conditioning process. Reference numeral 7008 denotes a control signal. The abnormal discharge detecting means 7003 and the control signal 7008 are made up of an ammeter disposes in the vicinity of the anode substrate 7001' and a system that sends to the change-over switch 7004 a trigger signal 10 ($\mu$sec) in pulse width in the case where the drop of the potential of 20 (V) or more is observed. A counter is also equipped to count the number of times of control. Also, a high voltage semiconductor switch is used for the change-over switch 7004, a d.c. high voltage power supply is used for the high voltage power supply 7005, and the resistor 7006 is set to 100 Ω. Also, in this embodiment, the surface conduction type electron emission elements 7015 are arranged in such a manner that 720 elements are in the Y-direction (n=720), and 240 elements are in the X-direction (m=240).

In the image forming apparatus manufactured in this embodiment, a distance between the cathode substrate 7002 and the image formation anode substrate 7001' is 2 (mm), and the maximum voltage applied to the anode during the image forming operation is 10 (kV). Therefore, the conditioning conditions are that a distance between the cathode substrate 7002 and the image formation anode substrate 7001' is 2 (mm), and the maximum voltage applied to the conditioning anode electrode 7001' is 15 (kV). Hereinafter, the manufacturing process according to this embodiment will be described in order.

1) An arrangement is made with the cathode substrate 2 schematically shown in FIG. 89 as a cathode and using the conditioning anode electrode 7001' as shown in FIG. 91. The conditioning anode electrode 7001' is shaped in an electrode having a portion which is overlapped with at least the electrically conductive portion on the cathode substrate 7002 when the anode substrate 7001' is disposed opposite to the cathode substrate 7002. The anode substrate 7001' is provided for conducting the conditioning process which is different from the image formation anode substrate 7001. Also, in order to use the cathode substrate 7002 as the cathode, the X-directional wirings 7012 and the Y-directional wirings 7013 formed on the cathode substrate 7002 are grounded. An insulating block not shown is inserted between the anode substrate 7001' and the cathode substrate 7002, and an interval between the anode substrate 7001' and the cathode substrate 7002 is held to 2 (mm). Also, the anode substrate 7001', the cathode substrate 7002, the insulating block, etc., are disposed within the vacuum vessel (not shown).

2) Gas is exhausted from the interior of the above-described vacuum vessel. As a result, a vacuum state is created between the anode substrate 7001' and the cathode substrate 7002.

3) When the pressure within the vacuum vessel is lower than $1\times10^{-3}$ (Pa), a high voltage is applied to the anode substrate 7001' by the high voltage power supply 7005, to thereby start the conditioning process. In this embodiment, a d.c. voltage steps up at a rate of 10 V/sec from 5 kV to 15 kV, and thereafter is held at 15 kV for about 10 minutes, to thereby implement this process. The presence/absence of the abnormal discharge is always measured by the abnormal discharge detecting means 7003 while the voltage steps up, and in the case where the abnormal discharge is detected, the change-over switch 7004 is controlled through the control signal 7004. In this embodiment, the abnormal discharges of 7 times are detected, and control of 7 times are conducted correspondingly.

4) After the completion of the above-described conditioning process, the pressure within the vacuum vessel is returned to the atmosphere, and a process for completing the electron source is implemented on the cathode substrate 7002, to finally manufacture the image display portion shown in FIG. 88.

As described above, in order to evaluate the characteristic of the image forming apparatus manufactured through the manufacturing method in accordance with the present invention, the following evaluate experiment was conducted.

First, a high voltage of 10 kV is applied to the anode to drive the driver unit not shown which is connected to the X-directional wirings 7012 of the cathode substrate 7002, specifically Dox1, Dox2, . . . , Dox(m−1), Doxm, and the Y-directional wirings 7013, specifically Doy1, Doy2, . . . , Doy(n−1), Doyn, to display the image and examined the presence/absence of the pixel defect. As a result, the pixel defect which may pertain to the abnormal discharge is not found, that is, it is found that the pixels are not damaged in the conditioning process.

Subsequently, in this state, the endurance test was conducted for 300 hours while various images are displayed. As a result, an excellent image is held with never producing the abnormal discharge. From the above fact, it is proved that the image forming apparatus manufactured by the manufacturing method of the image forming apparatus in accordance with the present invention is effective in suppression of the abnormal discharge.

Example 2

The conditioning process of the example 1 is implemented after the image display device schematically shown in FIG. 88 has been assembled. A vacuum state is created between the cathode substrate 7002 and the anode substrate 7001' during the conditioning process.

This example 2 conducts the conditioning process under the same conditions as those in the example 1 except that photo detecting means is provided as the detecting means 7003, and the presence/absence of the abnormal discharge is detected to open/close the change-over switch 7004.

The photo detection is to detect a light generated by irradiating the electrons emitted from the cathode substrate 7002 regardless of the drive on the phosphors. When a signal pertaining to the abnormal discharge is detected, the change-over switch 7004 is closed, and the change-over switch 7004 is opened again after 10 (μm). As in the example 1, the voltage steps up at a rate of 10 V/sec from 5 kV to 15 kV, and thereafter is held at 15 kV for about 10 minutes, to thereby implement this process. As a result, the abnormal discharges of 11 times are detected, and control of 11 times are conducted correspondingly. Thereafter, through necessary processes, and also the driver unit not shown, etc., are connected to complete a device that enables image formation.

Then, as in the example 1, a high voltage of 10 (kV) is applied to the anode substrate 7001' to conduct the evaluation. As a result, the pixel defect which may pertain to the abnormal discharge is not found, that is, it is found that the pixels are not damaged in the conditioning process. Subsequently, in this state, the endurance test was conducted for 300 hours while various images are displayed. As a result, an excellent image is held with never producing the abnormal discharge. From the above fact, it is proved that the image forming apparatus manufactured by the manufacturing method of the image forming apparatus in accordance with the present invention is effective in suppression of the abnormal discharge.

Example 3

The anode substrate 7001', the cathode substrate 7002, the abnormal discharge detecting means 7003, the high voltage power supply 7005 and the change-over switch 7007 between the anode and the high voltage power supply are disposed as schematically shown in FIG. 92, to implement the conditioning process. Reference numeral 7009 denotes a control signal. The detecting means 7003 is formed of photo detecting means as in the example 2, and made up of a system that detects the presence/absence of the abnormal discharge and sends to the switch 7007 a trigger signal of 5 sec in pulse width in the case where the abnormal discharge is detected. A counter is also equipped to count the number of times of control. Also, a vacuum switch is used for the change-over switch 7007, and a d.c. high voltage power supply is used for the high voltage power supply 7005.

In this embodiment, because the trigger signal of 5 sec in pulse width is sent to the change-over switch 7007 as a control signal, the anode substrate 7001' and the high voltage power supply 7005 are electrically interrupted for about 5 sec during the abnormal discharge operation. The cathode substrate 7002 is structured by the electron source in which the surface conduction type electron emission elements 7015 are arranged in matrix as the electron emission element as in the example 1. In this embodiment, however, the surface conduction type electron emission elements 7015 are arranged in such a manner that 240 elements are in the Y-direction (n=240), and 80 elements are in the X-direction (m=80). Note that, similarly, in this embodiment, this process is implemented after the electrically conductive film has been formed as in the example 1.

In the image forming apparatus manufactured in this embodiment, a distance between the cathode substrate 7002 and the image formation anode substrate 7001' is 2.5 (mm), and the maximum voltage applied to the anode electrode during the image forming operation is 12 (kV). Therefore, the conditioning conditions are that a distance between the cathode substrate 7002 and the anode substrate 7001' is 2.5 (nm), and the maximum voltage applied to the conditioning anode electrode is 18 (kV). Hereinafter, the manufacturing process will be described in order.

1) An arrangement is made with the cathode substrate 7002 schematically shown in FIG. 89 as a cathode and using the conditioning anode substrate 7001' as shown in FIG. 92. The conditioning anode substrate 7001' is shaped in an electrode having a portion which is overlapped with at least the electrically conductive portion on the cathode substrate 7002 when the anode substrate 7001' is disposed opposite to the cathode substrate 7002. Also, in order to use the cathode substrate 7002 as the cathode, the X-directional wirings 7012 and the Y-directional wirings 7013 formed on the cathode substrate 7002 are grounded. An insulating block not shown is inserted between the anode substrate 7001' and the cathode substrate 7002, and an interval between the anode substrate 7001' and the cathode substrate 7002 is held to 2 (mm). Also, the anode substrate 7001, the cathode substrate 7002, the insulating block, etc., are disposed within the vacuum vessel (not shown).

2) Gas is exhausted from the interior of the above-described vacuum vessel. As a result, a vacuum state is created between the anode substrate 7001' and the cathode substrate 7002.

3) When the pressure within the vacuum vessel is lower than $1\times10^{-3}$ (Pa), a high voltage is applied to the anode substrate 7001' by the high voltage power supply 7005, to thereby start the conditioning process. In this embodiment, a d.c. voltage steps up at a rate of 10 V/sec from 6 kV to 18 kV, and thereafter is held at 18 kV for about 10 minutes, to thereby implement this process. The presence/absence of the abnormal discharge is always measured by the detecting means 7003 while the voltage steps up, and in the case where the abnormal discharge is detected, the switch 7007 is controlled through the control signal 7009. In this situation, since the anode substrate 7001' and the high voltage power supply 7005 are electrically disconnected for about 5 seconds as described above, in the case where the abnormal discharge is detected in this embodiment, there is conducted control of stopping the step-up of the high voltage power supply 7005 and maintaining the voltage before the detection of the abnormal discharge for about 5 seconds, in addition to the above control.

The reason that a period of time where the anode substrate 7001' and the high voltage power supply 7005 are electrically disconnected is set to about 5 seconds is to effectively prevent the abnormal discharge which occurs secondarily. As a result of implementing the conditioning process in this condition, in this embodiment, the abnormal discharges of 19 times are detected, and control of 19 times are conducted correspondingly. Also, the abnormal discharge occurs over at the shortest interval of 29 seconds, and it is presumed that the abnormal discharge which occurs secondarily is effectively prevented in this embodiment. As that reason, it is presumed that because the anode substrate 7001' and the high voltage power supply 7005 are electrically disconnected for about 5 seconds after the abnormal discharge is detected, even if the degree of vacuum of the anode substrate 7001' and the cathode substrate 7002 is locally deteriorated, the degree of vacuum is restored to some degree.

4) After the completion of the above-described conditioning process, the pressure within the vacuum vessel is returned to the atmosphere, and a process for completing the electron source is implemented on the cathode substrate 7002, to finally manufacture the image display device schematically shown in FIG. 88.

As described above, in order to evaluate the characteristic of the image forming apparatus manufactured through the manufacturing method in accordance with the present invention, the following evaluation experiment was conducted.

First, a high voltage of 12 kV is applied to the anode to drive the driver unit not shown which is connected to the X-directional wirings 7012 of the cathode substrate 7002, specifically Dox1, Dox2, . . . , Dox(m−1), Doxm, and the Y-directional wirings 7013, specifically Doy1, Doy2, . . . , Doy(n−1), Doyn, to display the image and examined the presence/absence of the pixel defect. As a result, the pixel defect which may pertain to the abnormal discharge is not found, that is, it is found that the pixels are not damaged in the conditioning process. Subsequently, in this state, the endurance test was conducted for 300 hours while various images are displayed. As a result, an excellent image is held with never producing the abnormal discharge. From the above fact, it is proved that the image forming apparatus manufactured by the manufacturing method of the image forming apparatus in accordance with the present invention is effective in suppression of the abnormal discharge.

In the above-described examples 1 to 3, as means for suppressing the abnormal discharge during the conditioning process, there are described a case in which the potential of the anode is made to approach the potential of the cathode, or the anode and the high voltage power supply are electrically disconnected. There arises no problem even if those cases are combined together. Also, the abnormal discharge observing means is not limited to those cases.

The above description is made with reference to the examples of the surface conduction type emission elements. However, the electron beam device and the image display device to which the present invention is applicable are not limit to the device using the surface conduction type emission elements. For example, there is an electric field emission element known as the spint type. As a pair of electrodes, the emitter electrode called "emitter cone" and the gate electrode having an opening portion, and an emitter is positioned within the opening portion, and a voltage is applied between the emitter and the gate to emit the electrons. In particular, there has been known electrodes having a sharp end portion as an emitter in which the electrons are emitted from the end portion. The present invention is preferably applicable to the electron beam device using the above electric field emission element.

Specifically, after the wirings are formed, the conditioning process may be conducted before the emitter and/or the opening portion of the gate electrode is formed as in the above-described respective embodiment modes and respective embodiments.

INDUSTRIAL APPLICABILITY

According to the present invention, an electric field applying process is conducted on the electron source substrate, to thereby remove a factor such as a protrusion which induces a discharge phenomenon in driving an electron beam device represented by an image forming apparatus, thus realizing an image forming apparatus excellent in display characteristic with no defective pixel even in image display for a long period of time.

Also, according to the present invention, in the conditioning process, since an energy stored in the capacitor formed by the electrode and the electron source substrate is limited to an energy that destroys the electrically conductive thin film or less, the energy consumed by the electron source substrate during the discharge operation in this process can be limited, thereby being capable of suppressing the destroy of the electrically conductive thin film.

In particular, in manufacture of the large-area electron source substrate, this process can be implemented without damaging the elements on the electron source substrate.

Further, because the conditioning process is conducted in any process during the electron source substrate manufacturing, the substrate of the electron source can be manufactured with high efficiency.

In addition, according to the present invention, since plural kinds of conditioning processes using electrodes whose sheet resistances are different from each other are provided, the occurrence of the abnormal discharge can be suppressed during the manufacturing process or in use after the final product is manufactured, thereby being capable of the reliability.

What is claimed is:

1. A method of manufacturing an electron beam device in which electron emission portions that emit electrons and wirings that electrically connect the electron emission portions are disposed on a substrate, the method comprising:

a wiring forming step of forming at least one wiring on the substrate; and an electron emission portion forming process of forming the electron emission portions on the substrate, wherein an electric field applying process of applying a given electric field to the substrate on which the at least one wiring is formed is conducted using an electrode opposing a surface on the substrate on which the at least one wiring is formed, after the wiring forming step is completed and before said electron emission portion forming process is completed, and wherein the electric field is 1 kV/mm or more in its electric field intensity.

2. The method of manufacturing the electron beam device according to claim 1, wherein said electron emission portion forming step includes an electrode forming step of forming a pair of electrodes to which different potentials are given from the wirings in correspondence with respective ones of the electron emission portions, and said electric field applying process is conducted before said electrode forming step is conducted.

3. The method of manufacturing the electron beam device according to claim 2, wherein the pair of electrodes comprise an emitter and a gate of the electric field emission type electron emission element.

4. The method of manufacturing the electron beam device according to claim 2, wherein the pair of electrodes comprise a pair of electrodes that constitute surface conduction type electron emission elements.

5. The method of manufacturing the electron beam device according to claim 4, wherein said electrode forming step comprises a step which includes a thin film forming step of forming an electrically conductive thin film on the substrate, and produces a gap in the electrically conductive thin film and constitutes the pair of electrodes by the electrically conductive thin film which exists on both sides of the gap.

6. A method of manufacturing an electron beam device in which electron emission portions that emit electrons and wirings that electrically connect the electron emission portions are disposed on a substrate, the method comprising:

a wiring forming step of forming at least one wiring on the substrate; and an electron emission portion forming process of forming the electron emission portions on the substrate;

wherein an electric field applying process of applying a given electric field to the substrate on which the at least one wiring is formed is conducted after said wiring forming step is completed and before said electron emission portion forming process is completed, and wherein said electric field applying process comprises a step of discharging, by application of the electric field, electricity from a portion of the substrate from which electricity is liable to be discharged in various processes after said electric field applying process including said electron emission portion forming process, or when said electron beam device is used, to thereby change the portion of the substrate into a shape which is difficult to discharge electricity.

7. A method of manufacturing an electron beam device in which electron emission portions that emit electrons and wirings that electrically connect the electron emission portions are disposed on a substrate, the method comprising:

a wiring forming step of forming at least one wiring on the substrate; and an electron emission portion forming process of forming the electron emission portions on the substrate, wherein an electric field applying process of applying a given electric field to the substrate on which the at least one wiring is formed is conducted after said wiring forming step is completed and before said electron emission portion forming process is completed, wherein said electron emission portion forming step includes an electrode forming step of forming a pair of electrodes to which different potentials are given from the wirings in correspondence with respective ones of the electron emission portions, and said electric field applying process is conducted before said electrode forming step is conducted, wherein the pair of electrodes comprise a pair of electrodes that constitute surface conduction type electron emission elements, wherein said electrode forming step comprises a step which includes a thin film forming step of forming an electrically conductive thin film on the substrate, and produces a gap in the electrically conductive thin film and constitutes the pair of electrodes by the electrically conductive thin film which exists on both sides of the gap, and wherein said electric field applying process is conducted before said thin film forming step is conducted.

8. A method of manufacturing an electron beam device in which electron emission portions that emit electrons and wirings that electrically connect the electron emission portions are disposed on a substrate, the method comprising:

a wiring forming step of forming at least one wiring on the substrate; and an electron emission portion forming process of forming the electron emission portions on the substrate;

wherein an electric field applying process of applying a given electric field to the substrate on which the wiring is formed is conducted after said wiring forming step is completed and before said electron emission portion forming process is completed, wherein said electron emission portion forming step includes an electrode forming step of forming a pair of electrodes to which different potentials are given from the wirings in correspondence with respective ones of the electron emission portions, and said electric field applying process is conducted before said electrode forming step is conducted, wherein the pair of electrodes comprise a pair of electrodes that constitute surface conduction type electron emission elements, wherein said electrode forming step comprises a step which includes a thin film forming step of forming an electrically conductive thin film on the substrate, and produces a gap in the electrically conductive thin film and constitutes the pair of electrodes by the electrically conductive thin film which exists on both sides of the gap, and wherein said electric field applying process is conducted after said thin film forming step is completed and before the gap is produced in the electrically conductive thin film.

9. A method of manufacturing an electron beam device in which electron emission portions that emit electrons and wirings that electrically connect the electron emission portions are disposed on a substrate, the method comprising:

a wiring forming step of forming at least one wiring on the substrate; and an electron emission portion forming process of forming the electron emission portions on the substrate;

wherein an electric field applying process of applying a given electric field to the substrate on which the at least one wiring is formed is conducted using an electrode opposing a surface of the substrate on which the at least one wiring is formed after said wiring forming step is completed and before said electron emission portion forming process is completed, said electron emission portion forming step includes an electrode forming step of forming a pair of electrodes to which different potentials are given from said wirings in correspondence with respective ones of the electron emission portions, and said electric field applying process is conducted before said electrode forming step is conducted, and the pair of electrodes comprise an emitter and a gate of an electric field emission type electron emission element, said electric field applying process is conducted before the emitter is formed.

10. The method of manufacturing the electron beam device according to claim 9, wherein the electric field emission type electron emission element comprises the emitter that emits electrons from an end portion and the gate that produces an electric field between the end portion and the gate.

11. The method of manufacturing the electron beam device according to claim 9, wherein said electric field applying process is conducted before the gate is formed.

12. The method of manufacturing the electron beam device according to claim 11, wherein the plurality of electron emission portions are connected onto one main surface of the substrate in the form of a ladder or a matrix by the wirings.

13. The method of manufacturing the electron beam device according to claim 12, wherein, in said electric field applying process, the electrode is disposed opposite to a surface of the substrate on which the wirings are disposed, and a voltage is applied between the electrode and the wirings on the substrate to apply the electric field.

14. The method of manufacturing the electron beam device according to claim 12, wherein a voltage given between the electrode and the wirings is changed during said electric field applying process.

15. A method of manufacturing an electron beam device in which electron emission portions that emit electrons and wirings that electrically connect the electron emission portions are disposed on a substrate, the method comprising:

a wiring forming step of forming at least one wiring on the substrate; and an electron emission portion forming process of forming the electron emission portions on the substrate;

wherein an electric field applying process of applying a given electric field to the substrate on which the at least one wiring is formed is conducted using an electrode opposing a surface of the substrate on which the at least one wiring is formed after said wiring forming step is completed and before said electron emission portion forming process is completed, wherein said electron emission portion forming step includes an electrode forming step of forming a pair of electrodes to which different potentials are given from the wirings in correspondence with respective ones of the electron emission portions, and said electric field applying process is conducted before said electrode forming step is conducted, wherein the pair of electrodes comprise an emitter and a gate of the electric field emission type electron emission element, wherein said electric field applying process is conducted before the emitter is formed, wherein said electric field applying process is conducted before the gate is formed, wherein the plurality of electron emission portions are connected onto one main surface of the substrate in the form of a ladder or a matrix by the wirings, and wherein a distance between the electrode and the wirings is changed during the electric field applying process.

16. A method of manufacturing an electron beam device in which electron emission portions that emit electrons and wirings that electrically connect the electron emission portions are disposed on a substrate, the method comprising:

a wiring forming step of forming at least one wiring on the substrate; and an electron emission portion forming process of forming the electron emission portions on the substrate;

wherein an electric field applying process of applying a given electric field to the substrate on which the at least one wiring is formed is conducted using an electrode opposing a surface of the substrate on which the at least one wiring is formed after said wiring forming step is completed and before said electron emission portion forming process is completed, wherein said electron emission portion forming step includes an electrode forming step of forming a pair of electrodes to which different potentials are given from the wirings in correspondence with respective ones of the electron emission portions, and said electric field applying process is conducted before said electrode forming step is conducted, wherein the pair of electrodes comprise an emitter and a gate of the electric field emission type electron emission element, wherein said electric field applying process is conducted before the emitter is formed, wherein said electric field applying process is conducted before the gate is formed, wherein the plurality of electron emission portions are connected onto one main surface of the substrate in the form of a ladder or a matrix by the wirings, and wherein a current limit resistor is connected between the electrode and a power supply that applies a voltage to the electrode.

17. A method of manufacturing an electron beam device in which electron emission portions that emit electrons and wirings that electrically connect the electron emission portions are disposed on a substrate, the method comprising:

a wiring forming step of forming at least one wiring on the substrate; and an electron emission portion forming process of forming the electron emission portions on the substrate;

wherein an electric field applying process of applying a given electric field to the substrate on which the at least one wiring is formed is conducted after said wiring forming step is completed and before said electron emission portion forming process is completed, wherein said electron emission portion forming step includes an electrode forming step of forming a pair of electrodes to which different potentials are given from the wirings in correspondence with respective ones of the electron emission portions, and said electric field applying process is conducted before said electrode forming step is conducted, wherein the pair of electrodes comprise an emitter and a gate of the electric field emission type electron emission element, wherein said electric field applying process is conducted before the emitter is formed, wherein said electric field applying process is conducted before the gate is formed, wherein the plurality of electron emission portions are connected onto one main surface of the substrate in the form of a ladder or a matrix by the wirings, and wherein said electric field applying process is conducted in a vacuum atmosphere.

18. A method of manufacturing an electron beam device in which electron emission portions that emit electrons and wirings that electrically connect the electron emission portions are disposed on a substrate, the method comprising:

a wiring forming step of forming at least one wiring on the substrate; and an electron emission portion forming process of forming the electron emission portions on the substrate;

wherein an electric field applying process of applying a given electric field to the substrate on which the at least one wiring is formed is conducted using an electrode opposing a surface of the substrate on which the at least one wiring is formed after said wiring forming step is completed and before said electron emission portion forming process is completed, wherein said electron emission portion forming step includes an electrode forming step of forming a pair of electrodes to which different potentials are given from the wirings in correspondence with respective ones of the electron emission portions, and said electric field applying process is conducted before said electrode forming step is conducted, wherein the pair of electrodes comprise an emitter and a gate of the electric field emission type electron emission element, wherein the electric field emission type electron emission element comprises the emitter that emits electrons from an end portion and the gate that produces an electric field between the end portion and the gate, wherein said electric field applying process is conducted before the emitter is formed, wherein said electric field applying process is conducted before the gate is formed, wherein the plurality of electron emission portions are connected onto one main surface of the substrate in the form of a ladder or a matrix by the wirings, and wherein a distance between the electrode and the wirings is changed during the electric field applying process.

19. A method of manufacturing an electron beam device in which electron emission portions that emit electrons and wirings that electrically connect the electron emission portions are disposed on a substrate, the method comprising:

a wiring forming step of forming at least one wiring on the substrate; and an electron emission portion forming process of forming the electron emission portions on the substrate;

wherein an electric field applying process of applying a given electric field to the substrate on which the at least one wiring is formed is conducted using an electrode opposing a surface of the substrate on which the at least one wiring is formed after said wiring forming step is completed and before said electron emission portion forming process is completed, wherein said electron emission portion forming step includes an electrode forming step of forming a pair of electrodes to which different potentials are given from the wirings in correspondence with respective ones of the electron emission portions, and said electric field applying process is conducted before said electrode forming step is conducted, wherein the pair of electrodes comprise an emitter and a gate of the electric field emission type electron emission element, wherein the electric field emission type electron emission element comprises the emitter that emits electrons from an end portion and the gate that produces an electric field between the end portion and the gate, wherein said electric field applying process is conducted before the emitter is formed, wherein said electric field applying process is conducted before the gate is formed, wherein the plurality of electron emission portions are connected onto one main surface of the substrate in the form of a ladder or a matrix by the wirings, and wherein a current limit resistor is connected between the electrode and a power supply that applies a voltage to the electrode.

20. A method of manufacturing an electron beam device in which electron emission portions that emit electrons and wirings that electrically connect the electron emission portions are disposed on a substrate, the method comprising:

a wiring forming step of forming at least one wiring on the substrate; and an electron emission portion forming process of forming the electron emission portions on the substrate;

wherein an electric field applying process of applying a given electric field to the substrate on which the at least one wiring is formed is conducted after said wiring forming step is completed and before said electron emission portion forming process is completed, wherein said electron emission portion forming step includes an electrode forming step of forming a pair of electrodes to which different potentials are given from the wirings in correspondence with respective ones of the electron emission portions, and said electric field applying process is conducted before said electrode forming step is conducted, wherein the pair of electrodes comprise an emitter and a gate of the electric field emission type electron emission element, wherein the electric field emission type electron emission element comprises the emitter that emits electrons from an end portion and the gate that produces an electric field between the end portion and the gate, wherein said electric field applying process is conducted before the emitter is formed, wherein said electric field applying process is conducted before the gate is formed, wherein the plurality of electron emission portions are connected onto one main surface of the substrate in the form of a ladder or a matrix by the wirings, and wherein said electric field applying process is conducted in a vacuum atmosphere.

21. A method of manufacturing an image forming apparatus provided with a rear plate on which are disposed a pair of device electrodes, an electroconductive film disposed between the pair of device electrodes and having an electron emitting portion emitting at least one electron and a wiring connected electrically to the pair of device electrodes, and a face plate on which an image forming member is disposed, the method comprising:

a wiring forming step of forming the wiring on the rear plate;

a device electrode forming step of forming the pair of device electrodes connected electrically to the wiring on the rear plate;

an electroconductive film forming step of forming the electroconductive film between the pair of device electrodes on the rear plate;

an electron emitting portion forming step of forming the electron emitting portion on the electroconductive film after the electroconductive film forming step;

a sealing step of providing sealing between the rear plate and the face plate on which the image forming member is disposed; and a voltage applying step wherein, after completing the wiring forming step and the device electrode forming step, before the electron emitting portion forming step and the sealing step, an electrode is disposed in opposition to the rear plate on which the wiring and the device electrodes are disposed, and a voltage is applied between the electrode and the rear plate, wherein the voltage applying step is conducted to cause an electrical discharging between the electrode and the rear plate.

22. A method of manufacturing an image forming apparatus provided with a rear plate on which are disposed a pair of device electrodes, an electroconductive film disposed between the pair of device electrodes and having an electron emitting portion emitting at least one electron and a wiring connected electrically to the pair of device electrodes, and a face plate on which an image forming member is disposed, the method comprising:

a wiring forming step of forming the wiring on the rear plate;

a device electrode forming step of forming the pair of device electrodes connected electrically to the wiring on the rear plate;

an electroconductive film forming step of forming the electroconductive film between the pair of device electrodes on the rear plate;

an electron emitting portion forming step of forming the electron emitting portion on the electroconductive film after the electroconductive film forming step;

a sealing step of providing sealing between the rear plate and the face plate on which the image forming member is disposed; and a voltage applying step wherein, after completing the wiring forming step, the device electrode forming step and the electroconductive film forming step, before the electron emitting portion forming step and the sealing step, an electrode is disposed in opposition to the rear plate on which the wiring, the device electrodes and the electroconductive film are disposed, and a voltage is applied between the electrode and the rear plate, wherein the voltage applying step is conducted to cause an electrical discharging between the electrode and the rear plate.

23. A method of manufacturing an image forming apparatus provided with a rear plate on which an electron emitting portion emitting at least one electron and a wiring connected electrically to the electron emitting portion are disposed, and a face plate on which an image forming member is disposed, the method comprising:

a wiring forming step of forming the wiring on the rear plate;

an electron emitting portion forming step of forming the electron emitting portion on the rear plate;

a sealing step of sealing between the rear plate and the face plate on which the image forming member is disposed; and a voltage applying step wherein, after completing the wiring forming step, before the electron emitting portion forming step and the sealing step, an electrode is disposed in opposition to the rear plate on which the wiring is disposed, and a voltage is applied between the electrode and the rear plate, wherein the voltage applying step is conducted to cause an electrical discharging between the electrode and the rear plate.

24. The method according to claim 23, wherein the voltage applying step is a step of applying an electric field of 1 kV/m or greater between the electrode and the rear plate.

25. The method according to claim 23, wherein the voltage applying step is conducted within a depressurized atmosphere.

26. The method according to claim 23, wherein the voltage applying step is conducted within a gas containing atmosphere.

27. The method according to claim 23, wherein the voltage applied between the electrode and the rear plate changes during the voltage applying step.

28. The method according to claim 27, wherein the voltage is a D.C. voltage gradually increasing from a lower voltage.

29. The method according to claim 27, wherein the voltage is an A.C. voltage gradually increasing from a lower voltage.

30. The method according to claim 27, wherein the voltage is a pulse voltage gradually increasing from a lower voltage.

31. The method according to claim 27, wherein a distance between the electrode and the rear plate is changed during the voltage applying step.

32. A method of manufacturing an image forming apparatus provided with a rear plate on which an electroconductive film having an electron emitting portion emitting at least one electron and a wiring connected electrically to the electroconductive film are disposed, and a face plate on which an image forming member is disposed, the method comprising:

a wiring forming step of forming the wiring on the rear plate;

an electroconductive film forming step of forming the electroconductive film electrically connected to the wiring on the rear plate;

an electron emitting portion forming step of forming the electron emitting portion on the electroconductive film after the electroconductive film forming step;

a sealing step of providing sealing between the rear plate and the face plate on which the image forming member is disposed; and a voltage applying step wherein, after completing the wiring forming step and the electroconductive film forming step, before the electron emitting portion forming step and the sealing step, an electrode is disposed in opposition to the rear plate on which the wiring and the electroconductive film are disposed, and a voltage is applied between the electrode and the rear plate, wherein the voltage applying step is conducted to cause an electrical discharging between the electrode and the rear plate.

33. The method according to claim 32, wherein the electron emitting portion forming step for forming the electron emitting portion on the electroconductive film is a step of forming a gap in the electroconductive film.

34. The method according to claim 33, wherein the step of forming the gap in the electroconductive film includes a step of energizing the electroconductive film.

35. The method according to claim 33, wherein after the step of forming the gap in the electroconductive film, a further step of depositing a deposit on or in a vicinity of the electron emitting portion is conducted.

36. The method according to claim 32, wherein the voltage applying step is conducted such that, at applying a voltage between the electrode and the rear plate, an energy stored in a capacitor formed by the electrode and the rear plate is smaller than an energy which destroys the electroconductive film.

37. The method according to claim 36, wherein an area S where the electrode and the rear plate face each other, a distance Hc between the electrode and the rear plate, a voltage Vc applied between the electrode and the wiring, a dielectric constant ∈ of a vacuum, and an energy Eth by which the electrically conductive thin film is destroyed, meet following condition:

$$\in \times S \times Vc^2/2Hc < Eth \quad (1).$$

* * * * *